US011614217B2

(12) United States Patent
Rodgers et al.

(10) Patent No.: US 11,614,217 B2
(45) **Date of Patent: *Mar. 28, 2023**

(54) LIGHTING SYSTEMS GENERATING PARTIALLY-COLLIMATED LIGHT EMISSIONS

(71) Applicant: Korrus, Inc., Los Angeles, CA (US)

(72) Inventors: Elizabeth Rodgers, Long Beach, CA (US); Paul Pickard, Acton, CA (US); Sana Ashraf, Glendale, CA (US); Xin Zhang, Los Angeles, CA (US); Richard Wu, Morgan Hill, CA (US); Raghuram L. V. Petluri, Cerritos, CA (US)

(73) Assignee: KORRUS, INC., Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/652,396

(22) Filed: Feb. 24, 2022

(65) Prior Publication Data

US 2022/0252239 A1 Aug. 11, 2022

Related U.S. Application Data

(63) Continuation of application No. 17/067,744, filed on Oct. 11, 2020, now Pat. No. 11,306,897, which is a (Continued)

(51) Int. Cl.
*F21V 7/04* (2006.01)
*F21V 5/10* (2018.01)

(Continued)

(52) U.S. Cl.
CPC ..... *F21V 7/04* (2013.01); *F21V 5/10* (2018.02); *F21V 9/38* (2018.02); *F21V 13/14* (2013.01);

(Continued)

(58) Field of Classification Search
CPC ..... F21V 7/04; F21V 5/10; F21V 9/38; F21V 9/08; F21V 13/14; F21Y 2115/10
See application file for complete search history.

(56) References Cited

U.S. PATENT DOCUMENTS 2,430,472 A 11/1947 Levy
D149,124 S 3/1948 Hewitt (Continued)

FOREIGN PATENT DOCUMENTS

CA 2623604 8/2009
CN 1536686 10/2004

(Continued)

OTHER PUBLICATIONS

"Targetti Company Profile", 2016, downloaded from http://www.targetti.com/media/files/catalogue-brochure/T.sub.--Company.sub.-2016.sub.--EN.pdf; 37 pages.

(Continued)

*Primary Examiner* — Mary Ellen Bowman
(74) *Attorney, Agent, or Firm* — Jay M. Brown

(57) ABSTRACT

Lighting system including bowl reflector, visible-light source, central reflector, and optically-transparent body. Bowl reflector has central axis, and rim defining emission aperture, and first visible-light-reflective surface defining portion of cavity in bowl reflector. First visible-light-reflective surface includes parabolic surface. Visible-light source is located in cavity and configured for generating visible-light emissions from semiconductor light-emitting device. Central reflector includes second visible-light-reflective surface, having convex flared funnel shape and having first peak facing toward visible-light source. Optically-transparent body has first base being spaced apart from second base and having side wall extending between first and second bases. Concave flared funnel-shaped surface of second base faces toward convex flared funnel-shaped second visible- (Continued)

light reflective surface of central reflector. First base includes central region having convex paraboloidal-shaped surface and second peak facing toward visible-light source.

20 Claims, 62 Drawing Sheets

Related U.S. Application Data continuation-in-part of application No. 16/401,170, filed on May 2, 2019, now Pat. No. 10,801,696, which is a continuation-in-part of application No. 15/921,206, filed on Mar. 14, 2018, now Pat. No. 10,378,726, which is a continuation of application No. PCT/US2018/016662, filed on Feb. 2, 2018, and a continuation-in-part of application No. 15/835,610, filed on Dec. 8, 2017, now abandoned, which is a continuation of application No. 14/617,849, filed on Feb. 9, 2015, now Pat. No. 9,869,450, and a continuation of application No. PCT/US2016/016972, filed on Feb. 8, 2016.

(60) Provisional application No. 62/666,079, filed on May 2, 2018.

(51) Int. Cl.

| | |
|---|---|
| ***F21V 9/38*** | (2018.01) |
| ***F21V 13/14*** | (2006.01) |
| ***F21Y 115/10*** | (2016.01) |
| ***F21V 7/00*** | (2006.01) |
| ***F21V 9/08*** | (2018.01) |

(52) U.S. Cl.

CPC ..... *F21V 7/0091* (2013.01); *F21V 9/08* (2013.01); *F21Y 2115/10* (2016.08)

(56) References Cited

U.S. PATENT DOCUMENTS

| | | | |
|---|---|---|---|
| D152,113 | S | 12/1948 | J. A. |
| 2,458,967 | A | 1/1949 | Wiedenhoeft |
| 2,678,380 | A | 5/1954 | Westby |
| 2,702,378 | A | 2/1955 | Talty |
| D191,734 | S | 11/1961 | Daher |
| 3,040,170 | A | 6/1962 | Chwan |
| 3,078,366 | A | 2/1963 | Winkler |
| 3,120,929 | A | 2/1964 | Henning |
| 3,220,471 | A | 11/1965 | Coe |
| 3,247,368 | A | 4/1966 | McHugh |
| 3,435,891 | A | 4/1969 | Parrish |
| D214,582 | S | 7/1969 | Routh |
| D217,096 | S | 4/1970 | Birns |
| 3,538,321 | A | 11/1970 | Cameron |
| 3,639,751 | A | 2/1972 | Pichel |
| 3,643,038 | A | 2/1972 | Sato |
| D231,559 | S | 4/1974 | Darling |
| D234,712 | S | 4/1975 | Kennedy |
| 3,989,976 | A | 11/1976 | Tabor |
| 4,090,210 | A | 5/1978 | Wehling |
| 4,091,444 | A | 5/1978 | Mori |
| 4,138,716 | A | 2/1979 | Muhlethaler |
| D251,500 | S | 4/1979 | Aigner |
| 4,258,413 | A | 3/1981 | Mausser |
| 4,345,306 | A | 8/1982 | Summey |
| 4,414,489 | A | 11/1983 | Young |
| 4,420,207 | A | 12/1983 | Nishikawa |
| 4,423,471 | A | 12/1983 | Gordin |
| 4,445,164 | A | 4/1984 | Giles, III |
| 4,453,203 | A | 6/1984 | Pate |
| 4,467,403 | A | 8/1984 | May |
| 4,473,873 | A | 9/1984 | Quiogue |
| 4,564,888 | A | 1/1986 | Lewin |
| 4,578,742 | A | 3/1986 | Klein |
| 4,580,859 | A | 4/1986 | Frano |
| 4,609,979 | A | 9/1986 | Kristofek |
| 4,674,015 | A | 6/1987 | Smith |
| 4,727,648 | A | 3/1988 | Savage, Jr. |
| 4,733,335 | A | 3/1988 | Serizawa |
| D296,717 | S | 7/1988 | Kane |
| 4,755,918 | A | 7/1988 | Pristash |
| 4,757,431 | A | 7/1988 | Cross |
| 4,761,721 | A | 8/1988 | Willing |
| D300,876 | S | 4/1989 | Sakai |
| 4,833,579 | A | 5/1989 | Skegin |
| 4,837,927 | A | 6/1989 | Savage, Jr. |
| 4,870,327 | A | 9/1989 | Jorgensen |
| 4,872,097 | A | 10/1989 | Miller |
| 4,882,667 | A | 11/1989 | Skegin |
| 4,918,497 | A | 4/1990 | Edmond |
| D308,114 | S | 5/1990 | Shemitz |
| D308,260 | S | 5/1990 | Shemitz |
| 4,966,862 | A | 10/1990 | Edmond |
| D315,030 | S | 2/1991 | Jacobs |
| D316,303 | S | 4/1991 | Layne |
| D316,306 | S | 4/1991 | Shemitz |
| 5,027,168 | A | 6/1991 | Edmond |
| D319,512 | S | 8/1991 | Lettenmayer |
| D322,862 | S | 12/1991 | Miller |
| 5,087,212 | A | 2/1992 | Hanami |
| D325,645 | S | 4/1992 | Grange |
| 5,140,507 | A | 8/1992 | Harwood |
| D330,944 | S | 11/1992 | Wereley |
| 5,174,649 | A | 12/1992 | Alston |
| 5,177,404 | A | 1/1993 | Cohen |
| 5,210,051 | A | 5/1993 | Carter, Jr. |
| D336,536 | S | 6/1993 | Shaanan |
| 5,235,470 | A | 8/1993 | Cheng |
| D340,514 | S | 10/1993 | Liao |
| 5,253,152 | A | 10/1993 | Yang |
| 5,282,364 | A | 2/1994 | Cech |
| 5,303,124 | A | 4/1994 | Wrobel |
| 5,324,213 | A | 6/1994 | Frantz |
| 5,325,281 | A | 6/1994 | Harwood |
| D348,744 | S | 7/1994 | Johnson |
| 5,335,159 | A | 8/1994 | Chen |
| 5,337,225 | A | 8/1994 | Brookman |
| 5,338,944 | A | 8/1994 | Edmond |
| 5,359,345 | A | 10/1994 | Hunter |
| 5,367,229 | A | 11/1994 | Yang |
| 5,381,323 | A | 1/1995 | Osteen |
| 5,387,901 | A | 2/1995 | Hardt |
| 5,393,993 | A | 2/1995 | Edmond |
| 5,410,462 | A | 4/1995 | Wolfe |
| 5,416,342 | A | 5/1995 | Edmond |
| 5,436,809 | A | 7/1995 | Brassier |
| 5,440,466 | A | 8/1995 | Belisle |
| 5,450,303 | A | 9/1995 | Markiewicz |
| 5,490,048 | A | 2/1996 | Brassier |
| 5,504,665 | A | 4/1996 | Osteen |
| 5,515,253 | A | 5/1996 | Sjobom |
| 5,516,390 | A | 5/1996 | Tomita |
| 5,523,589 | A | 6/1996 | Edmond |
| D373,437 | S | 9/1996 | Kira |
| 5,577,492 | A | 11/1996 | Parkyn, Jr. |
| 5,584,574 | A | 12/1996 | Haddad |
| 5,599,091 | A | 2/1997 | Kira |
| 5,604,135 | A | 2/1997 | Edmond |
| 5,628,557 | A | 5/1997 | Huang |
| 5,631,190 | A | 5/1997 | Negley |
| 5,632,551 | A | 5/1997 | Roney |
| 5,634,822 | A | 6/1997 | Gunell |
| 5,655,832 | A | 8/1997 | Pelka |
| 5,658,066 | A | 8/1997 | Hirsch |
| D383,236 | S | 9/1997 | Krogman |
| D384,336 | S | 9/1997 | Gerber |
| 5,676,453 | A | 10/1997 | Parkyn, Jr. |
| D390,992 | S | 2/1998 | Shemitz |
| 5,713,662 | A | 2/1998 | Kira |
| 5,739,554 | A | 4/1998 | Edmond |
| 5,757,144 | A | 5/1998 | Nilssen |
| 5,788,533 | A | 8/1998 | Alvarado-Rodriguez |

(56) References Cited

U.S. PATENT DOCUMENTS

| | | | |
|---|---|---|---|
| 5,794,685 | A | 8/1998 | Dean |
| 5,800,050 | A | 9/1998 | Leadford |
| 5,806,955 | A | 9/1998 | Parkyn, Jr. |
| D408,823 | S | 4/1999 | Kirby |
| 5,890,793 | A | 4/1999 | Stephens |
| 5,894,196 | A | 4/1999 | McDermott |
| 5,898,267 | A | 4/1999 | McDermott |
| 5,909,955 | A | 6/1999 | Roorda |
| 5,912,477 | A | 6/1999 | Negley |
| 5,938,316 | A | 8/1999 | Yan |
| 5,971,571 | A | 10/1999 | Rose |
| 6,022,130 | A | 2/2000 | Donato |
| 6,051,940 | A | 4/2000 | Arun |
| 6,072,160 | A | 6/2000 | Bahl |
| 6,079,851 | A | 6/2000 | Altman |
| 6,083,021 | A | 7/2000 | Lau |
| 6,104,536 | A | 8/2000 | Eckhardt |
| 6,120,600 | A | 9/2000 | Edmond |
| 6,124,673 | A | 9/2000 | Bishop |
| 6,149,112 | A | 11/2000 | Thieltges |
| 6,149,288 | A | 11/2000 | Huang |
| 6,176,594 | B1 | 1/2001 | Yarconi |
| D437,449 | S | 2/2001 | Soller |
| D437,652 | S | 2/2001 | Uhler |
| 6,187,606 | B1 | 2/2001 | Edmond |
| 6,198,233 | B1 | 3/2001 | McConaughy |
| 6,201,262 | B1 | 3/2001 | Edmond |
| D443,710 | S | 6/2001 | Chiu |
| 6,244,877 | B1 | 6/2001 | Asao |
| 6,249,375 | B1 | 6/2001 | Silhengst |
| D445,936 | S | 7/2001 | Mier-Langner |
| 6,260,981 | B1 | 7/2001 | Fiene |
| D446,592 | S | 8/2001 | Leen |
| 6,273,588 | B1 | 8/2001 | Arakelian |
| D448,508 | S | 9/2001 | Benghozi |
| 6,312,787 | B1 | 11/2001 | Hayashi |
| 6,318,883 | B1 | 11/2001 | Sugiyama |
| D452,843 | S | 1/2002 | Henrici |
| 6,341,523 | B2 | 1/2002 | Lynam |
| D457,673 | S | 5/2002 | Martinson |
| 6,386,723 | B1 | 5/2002 | Eberlein |
| 6,390,646 | B1 | 5/2002 | Yan |
| 6,392,360 | B2 | 5/2002 | McConaughy |
| 6,426,704 | B1 | 7/2002 | Hutchison |
| 6,435,693 | B1 | 8/2002 | Fiene |
| 6,439,736 | B1 | 8/2002 | Fiene |
| 6,439,743 | B1 | 8/2002 | Hutchison |
| 6,439,749 | B1 | 8/2002 | Miller |
| 6,441,943 | B1 | 8/2002 | Roberts |
| D462,801 | S | 9/2002 | Huang |
| 6,450,662 | B1 | 9/2002 | Hutchison |
| 6,450,664 | B1 | 9/2002 | Kelly |
| D464,455 | S | 10/2002 | Fong |
| D464,939 | S | 10/2002 | Chuang |
| D465,046 | S | 10/2002 | Layne |
| 6,473,002 | B1 | 10/2002 | Hutchison |
| 6,474,839 | B1 | 11/2002 | Hutchison |
| 6,478,453 | B2 | 11/2002 | Lammers |
| 6,488,386 | B1 | 12/2002 | Yan |
| 6,508,567 | B1 | 1/2003 | Fiene |
| D470,962 | S | 2/2003 | Chen |
| 6,525,939 | B2 | 2/2003 | Liang |
| D472,339 | S | 3/2003 | Russello |
| 6,527,422 | B1 | 3/2003 | Hutchison |
| 6,530,674 | B2 | 3/2003 | Grierson |
| D473,529 | S | 4/2003 | Feinbloom |
| 6,540,382 | B1 | 4/2003 | Simon |
| 6,561,690 | B2 | 5/2003 | Balestriero |
| D476,439 | S | 6/2003 | O'Rourke |
| 6,598,998 | B2 | 7/2003 | West |
| 6,600,175 | B1 | 7/2003 | Baretz |
| 6,601,970 | B2 | 8/2003 | Ueda |
| 6,618,231 | B2 | 9/2003 | McConaughy |
| 6,632,006 | B1 | 10/2003 | Rippel |
| 6,636,003 | B2 | 10/2003 | Rahm |
| D482,476 | S | 11/2003 | Kwong |
| 6,641,284 | B2 | 11/2003 | Stopa |
| 6,662,211 | B1 | 12/2003 | Weller |
| 6,679,621 | B2 | 1/2004 | West |
| 6,682,211 | B2 | 1/2004 | English |
| 6,683,419 | B2 | 1/2004 | Kriparos |
| 6,691,768 | B2 | 2/2004 | Hsieh |
| 6,703,640 | B1 | 3/2004 | Hembree |
| 6,733,164 | B1 | 5/2004 | Smith, Jr. |
| D491,306 | S | 6/2004 | Zucker |
| 6,744,693 | B2 | 6/2004 | Brockmann |
| 6,752,645 | B2 | 6/2004 | Nakamura |
| 6,773,138 | B2 | 8/2004 | Coushaine |
| 6,787,999 | B2 | 9/2004 | Stimac |
| 6,788,510 | B2 | 9/2004 | McConaughy |
| 6,791,119 | B2 | 9/2004 | Slater, Jr. |
| 6,814,462 | B1 | 11/2004 | Fiene |
| 6,824,296 | B2 | 11/2004 | Souza |
| 6,824,390 | B2 | 11/2004 | Brown |
| 6,827,469 | B2 | 12/2004 | Coushaine |
| 6,853,010 | B2 | 2/2005 | Slater, Jr. |
| 6,860,617 | B2 | 3/2005 | Fiene |
| 6,863,424 | B2 | 3/2005 | Smith |
| 6,864,513 | B2 | 3/2005 | Lin |
| 6,869,206 | B2 | 3/2005 | Zimmerman |
| 6,871,993 | B2 | 3/2005 | Hecht |
| D504,967 | S | 5/2005 | Kung |
| 6,893,144 | B2 | 5/2005 | Fan |
| D506,065 | S | 6/2005 | Sugino |
| 6,902,200 | B1 | 6/2005 | Beadle |
| 6,902,291 | B2 | 6/2005 | Rizkin |
| 6,903,380 | B2 | 6/2005 | Barnett |
| 6,905,232 | B2 | 6/2005 | Lin |
| 6,946,806 | B1 | 9/2005 | Choi |
| 6,958,497 | B2 | 10/2005 | Emerson |
| 6,960,872 | B2 | 11/2005 | Beeson |
| 6,966,677 | B2 | 11/2005 | Galli |
| 6,979,097 | B2 | 12/2005 | Elam |
| D516,020 | S | 2/2006 | Wong |
| D516,229 | S | 2/2006 | Tang |
| 6,998,650 | B1 | 2/2006 | Wu |
| 7,025,464 | B2 | 4/2006 | Beeson |
| 7,040,774 | B2 | 5/2006 | Beeson |
| 7,048,385 | B2 | 5/2006 | Beeson |
| 7,063,130 | B2 | 6/2006 | Huang |
| 7,063,440 | B2 | 6/2006 | Mohacsi |
| 7,066,617 | B2 | 6/2006 | Mandy |
| D524,975 | S | 7/2006 | Oas |
| 7,070,301 | B2 | 7/2006 | Magarill |
| 7,077,546 | B2 | 7/2006 | Yamauchi |
| D527,119 | S | 8/2006 | Maxik |
| D527,131 | S | 8/2006 | McCarthy |
| 7,093,958 | B2 | 8/2006 | Coushaine |
| 7,095,056 | B2 | 8/2006 | Skus |
| 7,097,332 | B2 | 8/2006 | Vamberi |
| 7,098,397 | B2 | 8/2006 | Lange |
| 7,111,963 | B2 | 9/2006 | Zhang |
| 7,111,971 | B2 | 9/2006 | Coushaine |
| 7,112,916 | B2 | 9/2006 | Goh |
| D530,683 | S | 10/2006 | Rivas |
| 7,131,749 | B2 | 11/2006 | Wimberly |
| 7,132,804 | B2 | 11/2006 | Lys |
| 7,138,667 | B2 | 11/2006 | Barnett |
| 7,149,089 | B2 | 12/2006 | Blasko |
| 7,150,553 | B2 | 12/2006 | English |
| D535,774 | S | 1/2007 | Weston |
| 7,159,997 | B2 | 1/2007 | Reo |
| 7,160,004 | B2 | 1/2007 | Peck |
| 7,172,319 | B2 | 2/2007 | Holder |
| 7,182,480 | B2 | 2/2007 | Kan |
| D538,951 | S | 3/2007 | Maxik |
| D539,459 | S | 3/2007 | Benghozi |
| 7,198,386 | B2 | 4/2007 | Zampini |
| 7,207,696 | B1 | 4/2007 | Lin |
| D541,957 | S | 5/2007 | Wang |
| 7,210,957 | B2 | 5/2007 | Mrakovich |
| 7,213,940 | B1 | 5/2007 | Van De Ven |
| 7,221,374 | B2 | 5/2007 | Dixon |
| D544,110 | S | 6/2007 | Hooker |

(56) References Cited

U.S. PATENT DOCUMENTS

| | | | |
|---|---|---|---|
| D545,457 | S | 6/2007 | Chen |
| 7,234,950 | B1 | 6/2007 | Wickett |
| 7,237,930 | B2 | 7/2007 | Onishi |
| D548,691 | S | 8/2007 | Krieger |
| 7,267,461 | B2 | 9/2007 | Kan |
| 7,273,299 | B2 | 9/2007 | Parkyn |
| D552,779 | S | 10/2007 | Starck |
| 7,282,840 | B2 | 10/2007 | Chih |
| 7,285,791 | B2 | 10/2007 | Beeson |
| 7,286,296 | B2 | 10/2007 | Chaves |
| 7,288,902 | B1 | 10/2007 | Melanson |
| 7,293,908 | B2 | 11/2007 | Beeson |
| 7,303,301 | B2 | 12/2007 | Koren |
| D561,924 | S | 2/2008 | Yiu |
| D563,013 | S | 2/2008 | Levine |
| 7,329,907 | B2 | 2/2008 | Pang |
| D564,119 | S | 3/2008 | Metlen |
| 7,344,279 | B2 | 3/2008 | Mueller |
| 7,344,296 | B2 | 3/2008 | Matsui |
| 7,352,006 | B2 | 4/2008 | Beeson |
| 7,352,124 | B2 | 4/2008 | Beeson |
| 7,357,534 | B2 | 4/2008 | Snyder |
| 7,358,657 | B2 | 4/2008 | Koegler |
| 7,358,679 | B2 | 4/2008 | Lys |
| 7,360,925 | B2 | 4/2008 | Coushaine |
| D568,829 | S | 5/2008 | Yamashita |
| 7,369,386 | B2 | 5/2008 | Rasmussen |
| 7,370,993 | B2 | 5/2008 | Beeson |
| 7,378,686 | B2 | 5/2008 | Beeson |
| D570,505 | S | 6/2008 | Maxik |
| 7,381,942 | B2 | 6/2008 | Chin |
| D574,095 | S | 7/2008 | Hill |
| 7,396,139 | B2 | 7/2008 | Savage |
| 7,396,146 | B1 | 7/2008 | Wang |
| 7,413,326 | B2 | 8/2008 | Tain |
| D576,545 | S | 9/2008 | Mandel |
| D576,964 | S | 9/2008 | Shaner |
| D577,453 | S | 9/2008 | Metlen |
| D577,836 | S | 9/2008 | Engebrigtsen |
| 7,422,347 | B2 | 9/2008 | Miyairi |
| D579,421 | S | 10/2008 | Chu |
| 7,431,463 | B2 | 10/2008 | Beeson |
| D581,080 | S | 11/2008 | Mier-Langner |
| D581,554 | S | 11/2008 | To |
| D581,583 | S | 11/2008 | Peng |
| 7,452,115 | B2 | 11/2008 | Alcelik |
| 7,456,499 | B2 | 11/2008 | Loh |
| D583,975 | S | 12/2008 | Kushinskaya |
| 7,458,820 | B2 | 12/2008 | Ohta |
| 7,467,888 | B2 | 12/2008 | Fiene |
| D585,588 | S | 1/2009 | Alexander |
| D585,589 | S | 1/2009 | Alexander |
| 7,481,552 | B2 | 1/2009 | Mayfield, III |
| 7,482,567 | B2 | 1/2009 | Hoelen |
| D586,498 | S | 2/2009 | Wu |
| D587,389 | S | 2/2009 | Benensohn |
| 7,494,248 | B2 | 2/2009 | Li |
| 7,497,581 | B2 | 3/2009 | Beeson |
| 7,513,675 | B2 | 4/2009 | Mier-Langner |
| D591,894 | S | 5/2009 | Flank |
| D592,799 | S | 5/2009 | Scott |
| 7,532,324 | B2 | 5/2009 | Liu |
| 7,537,464 | B2 | 5/2009 | Brandenburg |
| 7,539,028 | B2 | 5/2009 | Stefan |
| D593,512 | S | 6/2009 | Lin |
| 7,540,761 | B2 | 6/2009 | Weber |
| 7,549,786 | B2 | 6/2009 | Higley |
| D597,246 | S | 7/2009 | Meyer, IV |
| D597,247 | S | 7/2009 | Meyer, IV |
| 7,559,784 | B2 | 7/2009 | Hsiao |
| 7,564,180 | B2 | 7/2009 | Brandes |
| D597,704 | S | 8/2009 | Peng |
| D599,040 | S | 8/2009 | Alexander |
| 7,575,332 | B2 | 8/2009 | Cok |
| 7,575,338 | B1 | 8/2009 | Verfuerth |
| 7,580,192 | B1 | 8/2009 | Chu |
| D601,276 | S | 9/2009 | Grajcar |
| 7,582,915 | B2 | 9/2009 | Hsing Chen |
| 7,591,572 | B1 | 9/2009 | Levine |
| 7,592,637 | B2 | 9/2009 | Zimmerman |
| 7,594,738 | B1 | 9/2009 | Lin |
| D602,868 | S | 10/2009 | Vogt |
| 7,604,365 | B2 | 10/2009 | Chang |
| 7,607,802 | B2 | 10/2009 | Kang |
| 7,621,770 | B1 | 11/2009 | Finizio |
| 7,626,345 | B2 | 12/2009 | Young |
| 7,628,506 | B2 | 12/2009 | Verfuerth |
| 7,637,635 | B2 | 12/2009 | Xiao |
| D608,043 | S | 1/2010 | Ko |
| D610,543 | S | 2/2010 | Coushaine |
| D610,723 | S | 2/2010 | Grajcar |
| D610,729 | S | 2/2010 | Kushinskaya |
| 7,665,862 | B2 | 2/2010 | George |
| 7,674,018 | B2 | 3/2010 | Holder |
| 7,679,281 | B2 | 3/2010 | Kim |
| 7,686,481 | B1 | 3/2010 | Condon |
| 7,690,810 | B2 | 4/2010 | Saitoh |
| 7,703,942 | B2 | 4/2010 | Narendran |
| 7,703,945 | B2 | 4/2010 | Leung |
| 7,703,951 | B2 | 4/2010 | Piepgras |
| 7,722,227 | B2 | 5/2010 | Zhang |
| 7,727,009 | B2 | 6/2010 | Goto |
| 7,731,395 | B2 | 6/2010 | Parkyn |
| 7,731,396 | B2 | 6/2010 | Fay |
| 7,736,029 | B2 | 6/2010 | Chen |
| 7,737,634 | B2 | 6/2010 | Leng |
| 7,740,380 | B2 | 6/2010 | Thrailkill |
| 7,744,259 | B2 | 6/2010 | Walczak |
| 7,744,266 | B2 | 6/2010 | Higley |
| 7,748,870 | B2 | 7/2010 | Chang |
| 7,759,881 | B1 | 7/2010 | Melanson |
| 7,766,508 | B2 | 8/2010 | George |
| 7,766,518 | B2 | 8/2010 | Piepgras |
| 7,784,966 | B2 | 8/2010 | Verfuerth |
| 7,785,124 | B2 | 8/2010 | Lin |
| D625,870 | S | 10/2010 | Feigenbaum |
| D626,094 | S | 10/2010 | Alexander |
| 7,806,562 | B2 | 10/2010 | Behr |
| 7,810,951 | B1 | 10/2010 | Lee |
| 7,810,955 | B2 | 10/2010 | Stimac |
| 7,810,995 | B2 | 10/2010 | Fadler |
| 7,813,111 | B2 | 10/2010 | Anderson |
| 7,819,549 | B2 | 10/2010 | Narendran |
| D627,507 | S | 11/2010 | Lai |
| D627,727 | S | 11/2010 | Alexander |
| D628,156 | S | 11/2010 | Alexander |
| 7,828,576 | B2 | 11/2010 | Lin |
| 7,829,899 | B2 | 11/2010 | Hutchins |
| 7,837,348 | B2 | 11/2010 | Narendran |
| 7,841,739 | B2 | 11/2010 | Liu |
| 7,841,753 | B2 | 11/2010 | Liu |
| D629,365 | S | 12/2010 | Garcia De Vicuna |
| 7,845,393 | B2 | 12/2010 | Kao |
| 7,857,482 | B2 | 12/2010 | Reo |
| 7,857,498 | B2 | 12/2010 | Smith |
| 7,858,408 | B2 | 12/2010 | Mueller |
| 7,862,212 | B2 | 1/2011 | Huang |
| 7,866,845 | B2 | 1/2011 | Man |
| 7,866,850 | B2 | 1/2011 | Alexander |
| 7,874,700 | B2 | 1/2011 | Patrick |
| D633,244 | S | 2/2011 | Kramer |
| D633,248 | S | 2/2011 | Alexander |
| 7,889,421 | B2 | 2/2011 | Narendran |
| 7,896,517 | B2 | 3/2011 | Mandy |
| 7,901,108 | B2 | 3/2011 | Kabuki |
| 7,914,162 | B1 | 3/2011 | Huang |
| 7,914,198 | B2 | 3/2011 | Mier-Langner |
| 7,918,581 | B2 | 4/2011 | Van De Ven |
| 7,918,589 | B2 | 4/2011 | Mayfield, III |
| 7,922,364 | B2 | 4/2011 | Tessnow |
| 7,923,907 | B2 | 4/2011 | Tessnow |
| 7,942,559 | B2 | 5/2011 | Holder |
| 7,952,114 | B2 | 5/2011 | Gingrich, III |
| 7,963,666 | B2 | 6/2011 | Leung |

(56) References Cited

U.S. PATENT DOCUMENTS

| | | | |
|---|---|---|---|
| 7,965,494 | B1 | 6/2011 | Morris |
| 7,967,477 | B2 | 6/2011 | Bloemen |
| 7,972,038 | B2 | 7/2011 | Albright |
| 7,972,054 | B2 | 7/2011 | Alexander |
| 7,976,194 | B2 | 7/2011 | Wilcox |
| 7,985,005 | B2 | 7/2011 | Alexander |
| 7,988,336 | B1 | 8/2011 | Harbers |
| 7,993,031 | B2 | 8/2011 | Grajcar |
| 8,002,438 | B2 | 8/2011 | Ko |
| 8,007,131 | B2 | 8/2011 | Liu |
| D645,007 | S | 9/2011 | Alexander |
| D645,594 | S | 9/2011 | Grawe |
| 8,021,008 | B2 | 9/2011 | Ramer |
| 3,031,393 | A1 | 10/2011 | Nadarajah |
| 8,029,157 | B2 | 10/2011 | Li |
| 8,033,680 | B2 | 10/2011 | Sharrah |
| 3,066,408 | A1 | 11/2011 | Kari |
| 8,047,696 | B2 | 11/2011 | Ijzerman |
| 8,052,310 | B2 | 11/2011 | Raymond, III |
| 8,066,403 | B2 | 11/2011 | Sanfilippo |
| D650,504 | S | 12/2011 | Kim |
| D650,935 | S | 12/2011 | Beghelli |
| 8,080,819 | B2 | 12/2011 | Mueller |
| 8,083,364 | B2 | 12/2011 | Allen |
| 8,096,668 | B2 | 1/2012 | Abu-Ageel |
| 8,100,560 | B2 | 1/2012 | Ahland, III |
| 8,100,564 | B2 | 1/2012 | Ono |
| 8,102,167 | B2 | 1/2012 | Irissou |
| 8,102,683 | B2 | 1/2012 | Gaknoki |
| D654,607 | S | 2/2012 | Kim |
| 8,118,450 | B2 | 2/2012 | George |
| 8,118,454 | B2 | 2/2012 | Rains, Jr. |
| 8,123,376 | B2 | 2/2012 | Van De Ven |
| 8,125,776 | B2 | 2/2012 | Alexander |
| D655,432 | S | 3/2012 | Beghelli |
| D655,840 | S | 3/2012 | Heaton |
| D655,842 | S | 3/2012 | Sabernig |
| 8,129,669 | B2 | 3/2012 | Chen |
| 8,136,958 | B2 | 3/2012 | Verfuerth |
| 8,138,690 | B2 | 3/2012 | Chemel |
| 8,142,047 | B2 | 3/2012 | Acampora et al. |
| 8,143,803 | B2 | 3/2012 | Beij et al. |
| 8,152,336 | B2 | 4/2012 | Alexander |
| 8,154,864 | B1 | 4/2012 | Nearman |
| 8,162,498 | B2 | 4/2012 | Ramer |
| 8,164,825 | B2 | 4/2012 | Narendran |
| D659,871 | S | 5/2012 | Lee |
| D660,229 | S | 5/2012 | Tseng |
| 8,172,425 | B2 | 5/2012 | Wen |
| 8,172,436 | B2 | 5/2012 | Coleman |
| 8,177,395 | B2 | 5/2012 | Alexander |
| 8,182,122 | B2 | 5/2012 | Chiu |
| 8,191,613 | B2 | 6/2012 | Yuan |
| 8,193,738 | B2 | 6/2012 | Chu |
| 8,201,965 | B2 | 6/2012 | Luiz |
| 8,205,998 | B2 | 6/2012 | Ramer |
| 8,210,722 | B2 | 7/2012 | Holder |
| 8,212,469 | B2 | 7/2012 | Rains, Jr. |
| 8,215,798 | B2 | 7/2012 | Rains, Jr. |
| 8,231,250 | B2 | 7/2012 | Bailey |
| 8,232,745 | B2 | 7/2012 | Chemel |
| D665,340 | S | 8/2012 | Obata |
| 8,242,766 | B2 | 8/2012 | Gaknoki |
| 8,246,212 | B2 | 8/2012 | Schaefer |
| 8,287,150 | B2 | 10/2012 | Schaefer |
| 8,292,482 | B2 | 10/2012 | Harbers |
| 8,297,788 | B2 | 10/2012 | Bishop |
| 8,297,792 | B1 | 10/2012 | Wang |
| 8,297,808 | B2 | 10/2012 | Yuan |
| 8,319,437 | B2 | 11/2012 | Carlin |
| 8,324,838 | B2 | 12/2012 | Shah |
| 8,328,403 | B1 | 12/2012 | Morgan |
| 8,330,378 | B2 | 12/2012 | Maehara |
| 8,337,043 | B2 | 12/2012 | Verfuerth |
| 8,344,602 | B2 | 1/2013 | Lai |
| 8,360,609 | B2 | 1/2013 | Lee |
| 8,360,621 | B2 | 1/2013 | Avila |
| 8,378,563 | B2 | 2/2013 | Reed |
| 8,385,071 | B2 | 2/2013 | Lin |
| 8,403,541 | B1 | 3/2013 | Rashidi |
| 8,410,716 | B2 | 4/2013 | Yao |
| 8,414,178 | B2 | 4/2013 | Alexander |
| 8,434,898 | B2 | 5/2013 | Sanfilippo |
| 8,436,556 | B2 | 5/2013 | Eisele |
| 8,454,193 | B2 | 6/2013 | Simon |
| 8,459,841 | B2 | 6/2013 | Huang |
| 8,462,523 | B2 | 6/2013 | Gaknoki |
| 8,466,611 | B2 | 6/2013 | Negley |
| 8,469,542 | B2 | 6/2013 | Zampini, II |
| 8,503,083 | B2 | 8/2013 | Seo |
| 8,508,116 | B2 | 8/2013 | Negley |
| 8,529,102 | B2 | 9/2013 | Pickard |
| 8,531,134 | B2 | 9/2013 | Chemel |
| 8,536,802 | B2 | 9/2013 | Chemel |
| 8,536,805 | B2 | 9/2013 | Shah |
| 8,540,394 | B2 | 9/2013 | Veerasamy |
| 8,541,795 | B2 | 9/2013 | Keller |
| 8,543,249 | B2 | 9/2013 | Chemel |
| D690,859 | S | 10/2013 | Mollaghaffari |
| 8,545,045 | B2 | 10/2013 | Tress |
| 8,545,049 | B2 | 10/2013 | Davis |
| 8,547,034 | B2 | 10/2013 | Melanson |
| 8,552,664 | B2 | 10/2013 | Chemel |
| 8,556,469 | B2 | 10/2013 | Pickard |
| 8,558,518 | B2 | 10/2013 | Irissou |
| 8,562,180 | B2 | 10/2013 | Alexander |
| 8,569,972 | B2 | 10/2013 | Melanson |
| 8,573,807 | B2 | 11/2013 | Borkar |
| 8,573,816 | B2 | 11/2013 | Negley |
| 8,575,858 | B2 | 11/2013 | Policy |
| 8,579,467 | B1 | 11/2013 | Szeto |
| 8,581,504 | B2 | 11/2013 | Kost |
| 8,581,521 | B2 | 11/2013 | Welten |
| 8,585,245 | B2 | 11/2013 | Black |
| 8,587,211 | B2 | 11/2013 | Melanson |
| 8,593,074 | B2 | 11/2013 | Hatley |
| 8,593,129 | B2 | 11/2013 | Gaknoki |
| 8,593,814 | B2 | 11/2013 | Ji |
| D694,925 | S | 12/2013 | Naoto |
| 8,598,809 | B2 | 12/2013 | Negley |
| 8,602,591 | B2 | 12/2013 | Lee |
| 8,602,605 | B2 | 12/2013 | Park |
| 8,610,364 | B2 | 12/2013 | Melanson |
| 8,610,365 | B2 | 12/2013 | King |
| 8,611,106 | B2 | 12/2013 | Fang |
| 8,616,724 | B2 | 12/2013 | Pickard |
| 8,624,505 | B2 | 1/2014 | Huang |
| 8,632,225 | B2 | 1/2014 | Koo |
| D699,179 | S | 2/2014 | Alexander |
| 8,643,038 | B2 | 2/2014 | Collins |
| 8,646,944 | B2 | 2/2014 | Villard |
| 8,646,949 | B2 | 2/2014 | Brunt, Jr. |
| 8,651,685 | B2 | 2/2014 | Roberts |
| 8,652,357 | B2 | 2/2014 | Ryu |
| 8,653,750 | B2 | 2/2014 | Deurenberg |
| 8,657,467 | B2 | 2/2014 | Hsieh |
| 8,657,479 | B2 | 2/2014 | Morgan |
| D700,728 | S | 3/2014 | Naoto |
| 8,672,519 | B2 | 3/2014 | Schaefer |
| 8,678,605 | B2 | 3/2014 | Leadford |
| 8,684,556 | B2 | 4/2014 | Negley |
| 8,684,569 | B2 | 4/2014 | Pickard |
| 8,690,383 | B2 | 4/2014 | Zampini, II |
| 8,698,421 | B2 | 4/2014 | Ludorf |
| D704,369 | S | 5/2014 | Lindsley |
| 8,723,427 | B2 | 5/2014 | Collins |
| 8,740,444 | B2 | 6/2014 | Reynolds |
| 8,742,684 | B2 | 6/2014 | Melanson |
| 8,749,131 | B2 | 6/2014 | Rains, Jr. |
| 8,749,173 | B1 | 6/2014 | Melanson |
| 8,757,840 | B2 | 6/2014 | Pickard |
| 8,760,073 | B2 | 6/2014 | Ko |
| 8,760,080 | B2 | 6/2014 | Yu |
| 8,764,225 | B2 | 7/2014 | Narendran |

(56) References Cited

U.S. PATENT DOCUMENTS

| | | | |
|---|---|---|---|
| 8,770,787 | B2 | 7/2014 | Vissenberg |
| 8,777,455 | B2 | 7/2014 | Pickard |
| 8,783,938 | B2 | 7/2014 | Alexander |
| 8,786,201 | B2 | 7/2014 | Hamamoto |
| 8,786,210 | B2 | 7/2014 | Delucia |
| 8,786,211 | B2 | 7/2014 | Gilliom |
| 8,786,212 | B2 | 7/2014 | Terazawa |
| 8,786,213 | B2 | 7/2014 | Yang |
| 8,791,642 | B2 | 7/2014 | Van De Ven |
| 8,794,792 | B1 | 8/2014 | Moghal |
| 8,796,948 | B2 | 8/2014 | Weaver |
| 8,810,227 | B2 | 8/2014 | Flaibani |
| 8,814,385 | B2 | 8/2014 | Onaka |
| 8,816,593 | B2 | 8/2014 | Lys |
| 8,820,964 | B2 | 9/2014 | Gould |
| 8,827,476 | B2 | 9/2014 | Harbers |
| 8,836,226 | B2 | 9/2014 | Mercier |
| 8,840,278 | B2 | 9/2014 | Pickard |
| 8,845,137 | B2 | 9/2014 | Paul |
| 8,847,515 | B2 | 9/2014 | King |
| 8,853,958 | B2 | 10/2014 | Athalye |
| 8,858,028 | B2 | 10/2014 | Kim |
| 8,876,322 | B2 | 11/2014 | Alexander |
| 8,882,298 | B2 | 11/2014 | Gershaw |
| 8,888,315 | B2 | 11/2014 | Edwards |
| 8,888,506 | B2 | 11/2014 | Nishimura |
| 8,901,838 | B2 | 12/2014 | Akiyama |
| 8,905,575 | B2 | 12/2014 | Durkee |
| 8,931,929 | B2 | 1/2015 | Tarsa |
| 8,944,642 | B2 | 2/2015 | Kuo |
| 8,944,647 | B2 | 2/2015 | Bueeler |
| 8,960,953 | B2 | 2/2015 | Narendran |
| 8,960,964 | B2 | 2/2015 | Weaver |
| D724,773 | S | 3/2015 | Ryu |
| 8,970,101 | B2 | 3/2015 | Sutardja |
| 8,992,052 | B2 | 3/2015 | Cai |
| 9,010,967 | B2 | 4/2015 | Jensen |
| 9,022,618 | B2 | 5/2015 | Park |
| 9,028,129 | B2 | 5/2015 | McCollum |
| 9,041,286 | B2 | 5/2015 | Fisher |
| 9,052,067 | B2 | 6/2015 | Van De Ven |
| 9,052,071 | B2 | 6/2015 | Hsu |
| 9,052,100 | B2 | 6/2015 | Blackstone |
| 9,054,019 | B2 | 6/2015 | Ibbetson |
| 9,091,417 | B2 | 7/2015 | Castillo |
| 9,105,816 | B2 | 8/2015 | Narendran |
| 9,157,602 | B2 | 10/2015 | Pickard |
| 9,164,268 | B2 | 10/2015 | Bigliatti |
| 9,166,127 | B2 | 10/2015 | Kato |
| 9,182,098 | B2 | 11/2015 | Caldwell |
| 9,184,350 | B2 | 11/2015 | Mastin |
| 9,234,638 | B2 | 1/2016 | Hussell |
| 9,287,474 | B2 | 3/2016 | Keller |
| 9,307,588 | B2 | 4/2016 | Li |
| 9,329,322 | B2 | 5/2016 | Yamada |
| 9,360,186 | B2 | 6/2016 | Choi |
| 9,388,963 | B2 | 7/2016 | Dai |
| 9,410,687 | B2 | 8/2016 | Hussell |
| 9,416,926 | B2 | 8/2016 | Wilcox |
| 9,429,296 | B2 | 8/2016 | Randolph |
| 9,437,786 | B2 | 9/2016 | Mastin |
| 9,447,945 | B2 | 9/2016 | Narendran |
| 9,453,622 | B2 | 9/2016 | Zhang |
| 9,453,633 | B2 | 9/2016 | Kim |
| 9,557,099 | B2 | 1/2017 | Wang |
| 9,568,156 | B2 | 2/2017 | Tetsuo |
| 9,574,739 | B2 | 2/2017 | Yu |
| 9,601,670 | B2 | 3/2017 | Bhat |
| 9,631,790 | B2 | 4/2017 | Pelka |
| 9,664,356 | B2 | 5/2017 | Pelka |
| 9,714,751 | B2 | 7/2017 | Pelka |
| 9,806,242 | B2 | 10/2017 | Chiu |
| 9,869,450 | B2 | 1/2018 | Pickard |
| 9,897,789 | B2 | 2/2018 | Park |
| 9,915,409 | B2 | 3/2018 | Wilcox |
| 9,921,428 | B2 | 3/2018 | Van De Ven |
| 10,119,662 | B2 | 11/2018 | Wilcox |
| 10,288,261 | B2 | 5/2019 | Ibbetson |
| 10,323,828 | B2 | 6/2019 | Castillo |
| 10,378,726 | B2 * | 8/2019 | Zhang ..... F21V 13/04 |
| 10,451,251 | B2 | 10/2019 | Leung |
| 10,551,010 | B2 | 2/2020 | Petluri |
| 10,801,696 | B2 * | 10/2020 | Ashraf ..... F21V 7/0008 |
| 11,306,897 | B2 * | 4/2022 | Latsis ..... F21V 5/046 |
| 2001/0006463 | A1 | 7/2001 | Fischer |
| 2001/0053628 | A1 | 12/2001 | Hayakawa |
| 2002/0046826 | A1 | 4/2002 | Kao |
| 2002/0067613 | A1 | 6/2002 | Grove |
| 2002/0106925 | A1 | 8/2002 | Yamagishi |
| 2002/0117692 | A1 | 8/2002 | Lin |
| 2003/0058658 | A1 | 3/2003 | Lee |
| 2003/0072156 | A1 | 4/2003 | Pohlert |
| 2003/0128543 | A1 | 7/2003 | Rekow |
| 2003/0174517 | A1 | 9/2003 | Kiraly |
| 2003/0185005 | A1 | 10/2003 | Sommers |
| 2003/0209963 | A1 | 11/2003 | Altgilbers |
| 2004/0005800 | A1 | 1/2004 | Hou |
| 2004/0090781 | A1 | 5/2004 | Yeoh |
| 2004/0090784 | A1 | 5/2004 | Ward |
| 2004/0212991 | A1 | 10/2004 | Galli |
| 2004/0218372 | A1 | 11/2004 | Hamasaki |
| 2005/0032402 | A1 | 2/2005 | Takanashi |
| 2005/0047170 | A1 | 3/2005 | Hilburger |
| 2005/0083698 | A1 | 4/2005 | Zampini |
| 2005/0122713 | A1 | 6/2005 | Hutchins |
| 2005/0130336 | A1 | 6/2005 | Collins |
| 2005/0146884 | A1 | 7/2005 | Scheithauer |
| 2005/0174780 | A1 | 8/2005 | Park |
| 2005/0205878 | A1 | 9/2005 | Kan |
| 2005/0242362 | A1 | 11/2005 | Shimizu |
| 2005/0269060 | A1 | 12/2005 | Ku |
| 2005/0270775 | A1 | 12/2005 | Harbers |
| 2005/0286265 | A1 | 12/2005 | Zampini |
| 2006/0001381 | A1 | 1/2006 | Robinson |
| 2006/0039156 | A1 | 2/2006 | Chen |
| 2006/0062019 | A1 | 3/2006 | Young |
| 2006/0076672 | A1 | 4/2006 | Petroski |
| 2006/0141851 | A1 | 6/2006 | Matsui |
| 2006/0146422 | A1 | 7/2006 | Koike |
| 2006/0146531 | A1 | 7/2006 | Reo |
| 2006/0152140 | A1 | 7/2006 | Brandes |
| 2006/0221272 | A1 | 10/2006 | Negley |
| 2006/0262544 | A1 | 11/2006 | Piepgras |
| 2006/0262545 | A1 | 11/2006 | Piepgras |
| 2007/0025103 | A1 | 2/2007 | Chan |
| 2007/0064428 | A1 | 3/2007 | Beauchamp |
| 2007/0096057 | A1 | 5/2007 | Hampden-Smith |
| 2007/0109795 | A1 | 5/2007 | Gabrius |
| 2007/0139923 | A1 | 6/2007 | Negley |
| 2007/0153521 | A1 | 7/2007 | Konuma |
| 2007/0158668 | A1 | 7/2007 | Tarsa |
| 2007/0170447 | A1 | 7/2007 | Negley |
| 2007/0223219 | A1 | 9/2007 | Medendorp |
| 2007/0238327 | A1 | 10/2007 | Hsu |
| 2007/0242461 | A1 | 10/2007 | Reisenauer |
| 2007/0253201 | A1 | 11/2007 | Blincoe |
| 2007/0253202 | A1 | 11/2007 | Wu |
| 2007/0253209 | A1 | 11/2007 | Loh |
| 2007/0268698 | A1 | 11/2007 | Chen |
| 2007/0269915 | A1 | 11/2007 | Leong |
| 2007/0275576 | A1 | 11/2007 | Yang |
| 2007/0285028 | A1 | 12/2007 | Tsinker |
| 2007/0295969 | A1 | 12/2007 | Chew |
| 2007/0297177 | A1 | 12/2007 | Wang |
| 2008/0012036 | A1 | 1/2008 | Loh |
| 2008/0013316 | A1 | 1/2008 | Chiang |
| 2008/0030993 | A1 | 2/2008 | Narendran |
| 2008/0042153 | A1 | 2/2008 | Beeson |
| 2008/0043470 | A1 | 2/2008 | Wimberly |
| 2008/0076272 | A1 | 3/2008 | Hsu |
| 2008/0080190 | A1 | 4/2008 | Walczak |
| 2008/0084700 | A1 | 4/2008 | Van De Ven |
| 2008/0106907 | A1 | 5/2008 | Trott |
| 2008/0112121 | A1 | 5/2008 | Cheng |

(56) References Cited

U.S. PATENT DOCUMENTS

| | | | |
|---|---|---|---|
| 2008/0117500 | A1 | 5/2008 | Narendran |
| 2008/0121921 | A1 | 5/2008 | Loh |
| 2008/0130275 | A1 | 6/2008 | Higley |
| 2008/0142194 | A1 | 6/2008 | Zhou |
| 2008/0157112 | A1 | 7/2008 | He |
| 2008/0158881 | A1 | 7/2008 | Liu |
| 2008/0158887 | A1 | 7/2008 | Zhu |
| 2008/0165530 | A1 | 7/2008 | Hendrikus |
| 2008/0170413 | A1 | 7/2008 | Beeson |
| 2008/0173884 | A1 | 7/2008 | Chitnis |
| 2008/0179611 | A1 | 7/2008 | Chitnis |
| 2008/0182353 | A1 | 7/2008 | Zimmerman |
| 2008/0192478 | A1 | 8/2008 | Chen |
| 2008/0198112 | A1 | 8/2008 | Roberts |
| 2008/0219002 | A1 | 9/2008 | Sommers |
| 2008/0219303 | A1 | 9/2008 | Chen |
| 2008/0224598 | A1 | 9/2008 | Baretz |
| 2008/0224631 | A1 | 9/2008 | Melanson |
| 2008/0247172 | A1 | 10/2008 | Beeson |
| 2008/0274641 | A1 | 11/2008 | Weber |
| 2008/0298058 | A1 | 12/2008 | Kan |
| 2008/0308825 | A1 | 12/2008 | Chakraborty |
| 2009/0021936 | A1 | 1/2009 | Stimac |
| 2009/0026913 | A1 | 1/2009 | Mrakovich |
| 2009/0034283 | A1 | 2/2009 | Albright |
| 2009/0046464 | A1 | 2/2009 | Liu |
| 2009/0050907 | A1 | 2/2009 | Yuan |
| 2009/0050908 | A1 | 2/2009 | Yuan |
| 2009/0052158 | A1 | 2/2009 | Bierhuizen |
| 2009/0073683 | A1 | 3/2009 | Chen |
| 2009/0080185 | A1 | 3/2009 | McMillan |
| 2009/0086474 | A1 | 4/2009 | Chou |
| 2009/0091935 | A1 | 4/2009 | Tsai |
| 2009/0103299 | A1 | 4/2009 | Boyer |
| 2009/0129084 | A1 | 5/2009 | Tsao |
| 2009/0140272 | A1 | 6/2009 | Beeson |
| 2009/0141500 | A1 | 6/2009 | Peng |
| 2009/0154166 | A1 | 6/2009 | Zhang |
| 2009/0167203 | A1 | 7/2009 | Dahlman |
| 2009/0180276 | A1 | 7/2009 | Benitez |
| 2009/0184616 | A1 | 7/2009 | Van De Ven |
| 2009/0195168 | A1 | 8/2009 | Greenfeld |
| 2009/0225551 | A1 | 9/2009 | Chang |
| 2009/0236997 | A1 | 9/2009 | Liu |
| 2009/0294114 | A1 | 12/2009 | Yang |
| 2009/0296388 | A1 | 12/2009 | Wu |
| 2009/0310354 | A1 | 12/2009 | Zampini, II |
| 2009/0317988 | A1 | 12/2009 | Lin |
| 2010/0015821 | A1 | 1/2010 | Hsu |
| 2010/0019697 | A1 | 1/2010 | Korsunsky |
| 2010/0026158 | A1 | 2/2010 | Wu |
| 2010/0027258 | A1 | 2/2010 | Maxik |
| 2010/0046234 | A1 | 2/2010 | Abu-Ageel |
| 2010/0060202 | A1 | 3/2010 | Melanson |
| 2010/0072505 | A1 | 3/2010 | Gingrich, III |
| 2010/0073783 | A1 | 3/2010 | Sun |
| 2010/0073884 | A1 | 3/2010 | Peloza |
| 2010/0091487 | A1 | 4/2010 | Shin |
| 2010/0091497 | A1 | 4/2010 | Chen |
| 2010/0102696 | A1 | 4/2010 | Sun |
| 2010/0110684 | A1 | 5/2010 | Abdelsamed |
| 2010/0110728 | A1 | 5/2010 | Dubrow |
| 2010/0128475 | A1 | 5/2010 | Kovalchick |
| 2010/0128484 | A1 | 5/2010 | Peng |
| 2010/0132918 | A1 | 6/2010 | Lin |
| 2010/0141173 | A1 | 6/2010 | Negrete |
| 2010/0142189 | A1 | 6/2010 | Hong |
| 2010/0149818 | A1 | 6/2010 | Ruffin |
| 2010/0157605 | A1 | 6/2010 | Chang |
| 2010/0174345 | A1 | 7/2010 | Ashdown |
| 2010/0195323 | A1 | 8/2010 | Schaefer |
| 2010/0230709 | A1 | 9/2010 | Kanno |
| 2010/0238630 | A1 | 9/2010 | Shou-Biao |
| 2010/0243219 | A1 | 9/2010 | Jian |
| 2010/0246179 | A1 | 9/2010 | Long |
| 2010/0260945 | A1 | 10/2010 | Kites |
| 2010/0284181 | A1 | 11/2010 | O'Brien |
| 2010/0296289 | A1 | 11/2010 | George |
| 2010/0301360 | A1 | 12/2010 | Van De Ven |
| 2010/0301774 | A1 | 12/2010 | Chemel |
| 2010/0308361 | A1 | 12/2010 | Beeson |
| 2010/0308742 | A1 | 12/2010 | Melanson |
| 2010/0319953 | A1 | 12/2010 | Yochum |
| 2011/0013397 | A1 | 1/2011 | Catone |
| 2011/0043129 | A1 | 2/2011 | Koolen |
| 2011/0044046 | A1 | 2/2011 | Abu-Ageel |
| 2011/0049749 | A1 | 3/2011 | Bailey |
| 2011/0050100 | A1 | 3/2011 | Bailey |
| 2011/0050101 | A1 | 3/2011 | Bailey |
| 2011/0050124 | A1 | 3/2011 | Bailey |
| 2011/0051407 | A1 | 3/2011 | Laurence |
| 2011/0051414 | A1 | 3/2011 | Bailey |
| 2011/0090684 | A1 | 4/2011 | Logan |
| 2011/0097921 | A1 | 4/2011 | Hsu |
| 2011/0103070 | A1 | 5/2011 | Zhang |
| 2011/0115381 | A1 | 5/2011 | Carlin |
| 2011/0122643 | A1 | 5/2011 | Spork |
| 2011/0134634 | A1 | 6/2011 | Gingrich, III |
| 2011/0136374 | A1 | 6/2011 | Mostoller |
| 2011/0140620 | A1 | 6/2011 | Lin |
| 2011/0180841 | A1 | 7/2011 | Chang |
| 2011/0193490 | A1 | 8/2011 | Kumar |
| 2011/0210360 | A1 | 9/2011 | Negley |
| 2011/0215707 | A1 | 9/2011 | Brunt, Jr. |
| 2011/0222270 | A1 | 9/2011 | Porciatti |
| 2011/0222277 | A1 | 9/2011 | Negley |
| 2011/0253358 | A1 | 10/2011 | Huang |
| 2011/0255287 | A1 | 10/2011 | Li |
| 2011/0273079 | A1 | 11/2011 | Pickard |
| 2011/0279015 | A1 | 11/2011 | Negley |
| 2011/0285308 | A1 | 11/2011 | Crystal |
| 2011/0285314 | A1 | 11/2011 | Carney |
| 2011/0292483 | A1 | 12/2011 | Pakhchyan |
| 2011/0306219 | A1 | 12/2011 | Swanger |
| 2011/0309773 | A1 | 12/2011 | Beers |
| 2011/0316441 | A1 | 12/2011 | Huynh |
| 2011/0316446 | A1 | 12/2011 | Kang |
| 2012/0002417 | A1 | 1/2012 | Li |
| 2012/0014115 | A1 | 1/2012 | Park |
| 2012/0018754 | A1 | 1/2012 | Lowes |
| 2012/0019127 | A1 | 1/2012 | Hirosaki |
| 2012/0021623 | A1 | 1/2012 | Gorman |
| 2012/0025729 | A1 | 2/2012 | Melanson |
| 2012/0038280 | A1 | 2/2012 | Zoorob |
| 2012/0038291 | A1 | 2/2012 | Hasnain |
| 2012/0051041 | A1 | 3/2012 | Edmond |
| 2012/0051048 | A1 | 3/2012 | Smit |
| 2012/0051056 | A1 | 3/2012 | Derks |
| 2012/0051068 | A1 | 3/2012 | Pelton |
| 2012/0086028 | A1 | 4/2012 | Beeson |
| 2012/0092860 | A1 | 4/2012 | Blackstone |
| 2012/0106152 | A1 | 5/2012 | Zheng |
| 2012/0112661 | A1 | 5/2012 | Van De Ven |
| 2012/0119658 | A1 | 5/2012 | McDaniel |
| 2012/0140468 | A1 | 6/2012 | Chang |
| 2012/0140474 | A1 | 6/2012 | Jurik |
| 2012/0146519 | A1 | 6/2012 | Briggs |
| 2012/0169242 | A1 | 7/2012 | Olson |
| 2012/0175653 | A1 | 7/2012 | Weber |
| 2012/0187830 | A1 | 7/2012 | Shum |
| 2012/0218624 | A1 | 8/2012 | Narendran |
| 2012/0223657 | A1 | 9/2012 | Van De Ven |
| 2012/0224177 | A1 | 9/2012 | Harbers |
| 2012/0236553 | A1 | 9/2012 | Cash |
| 2012/0250309 | A1 | 10/2012 | Handsaker |
| 2012/0268894 | A1 | 10/2012 | Alexander |
| 2012/0280264 | A1 | 11/2012 | Beeson |
| 2012/0286304 | A1 | 11/2012 | Letoquin |
| 2012/0286319 | A1 | 11/2012 | Lee |
| 2012/0287642 | A1 | 11/2012 | Zeng |
| 2012/0292660 | A1 | 11/2012 | Kanno |
| 2012/0307487 | A1 | 12/2012 | Eckel |
| 2012/0307494 | A1 | 12/2012 | Zlotnikov |
| 2012/0313124 | A1 | 12/2012 | Clatterbuck |

(56) References Cited

U.S. PATENT DOCUMENTS

| | | | |
|---|---|---|---|
| 2012/0327650 | A1 | 12/2012 | Lay |
| 2013/0002167 | A1 | 1/2013 | Van De Ven |
| 2013/0003370 | A1 | 1/2013 | Watanabe |
| 2013/0003388 | A1 | 1/2013 | Jensen |
| 2013/0026942 | A1 | 1/2013 | Ryan |
| 2013/0042510 | A1 | 2/2013 | Nall |
| 2013/0049602 | A1 | 2/2013 | Raj |
| 2013/0049603 | A1 | 2/2013 | Bradford |
| 2013/0049627 | A1 | 2/2013 | Roberts |
| 2013/0069561 | A1 | 3/2013 | Melanson |
| 2013/0070441 | A1 | 3/2013 | Moon |
| 2013/0070442 | A1 | 3/2013 | Negley |
| 2013/0082612 | A1 | 4/2013 | Kim |
| 2013/0083510 | A1 | 4/2013 | Park |
| 2013/0094225 | A1 | 4/2013 | Leichner |
| 2013/0095673 | A1 | 4/2013 | Brandon |
| 2013/0140490 | A1 | 6/2013 | Fujinaga |
| 2013/0162140 | A1 | 6/2013 | Shamoto |
| 2013/0170220 | A1 | 7/2013 | Bueeler |
| 2013/0170221 | A1 | 7/2013 | Isogai |
| 2013/0176728 | A1 | 7/2013 | Alessandro |
| 2013/0193869 | A1 | 8/2013 | Hong |
| 2013/0214666 | A1 | 8/2013 | Leung |
| 2013/0221489 | A1 | 8/2013 | Cao |
| 2013/0229114 | A1 | 9/2013 | Eisele |
| 2013/0229804 | A1 | 9/2013 | Holder |
| 2013/0235555 | A1 | 9/2013 | Tanaka |
| 2013/0235579 | A1 | 9/2013 | Smith |
| 2013/0235580 | A1 | 9/2013 | Smith |
| 2013/0241392 | A1 | 9/2013 | Pickard |
| 2013/0241440 | A1 | 9/2013 | Gaknoki |
| 2013/0249434 | A1 | 9/2013 | Medendorp, Jr. |
| 2013/0250573 | A1 | 9/2013 | Nikhil |
| 2013/0250581 | A1 | 9/2013 | Te-Lung |
| 2013/0258636 | A1 | 10/2013 | Rettke |
| 2013/0265777 | A1 | 10/2013 | Zollers |
| 2013/0277643 | A1 | 10/2013 | Williamson |
| 2013/0300303 | A1 | 11/2013 | Liu |
| 2013/0301252 | A1 | 11/2013 | Hussell |
| 2013/0322072 | A1 | 12/2013 | Pu |
| 2013/0329429 | A1 | 12/2013 | Lowes |
| 2014/0015419 | A1 | 1/2014 | Shah |
| 2014/0016318 | A1 | 1/2014 | Pokrajac |
| 2014/0036510 | A1 | 2/2014 | James |
| 2014/0043813 | A1 | 2/2014 | Jean-Guy |
| 2014/0048743 | A1 | 2/2014 | Le-Mercier |
| 2014/0049241 | A1 | 2/2014 | Gaknoki |
| 2014/0049962 | A1 | 2/2014 | Holder |
| 2014/0055038 | A1 | 2/2014 | Cappitelli |
| 2014/0055054 | A1 | 2/2014 | Borkar |
| 2014/0062330 | A1 | 3/2014 | Neundorfer |
| 2014/0063779 | A1 | 3/2014 | Bradford |
| 2014/0071685 | A1 | 3/2014 | Black |
| 2014/0071696 | A1 | 3/2014 | Park, II |
| 2014/0078715 | A1 | 3/2014 | Pickard |
| 2014/0078722 | A1 | 3/2014 | Caldwell |
| 2014/0078746 | A1 | 3/2014 | Caldwell |
| 2014/0103796 | A1 | 4/2014 | Jansen |
| 2014/0126205 | A1 | 5/2014 | Davis |
| 2014/0126224 | A1 | 5/2014 | Brunt, Jr. |
| 2014/0134880 | A1 | 5/2014 | Yeh |
| 2014/0140052 | A1 | 5/2014 | Villard |
| 2014/0159077 | A1 | 6/2014 | Kuenzler |
| 2014/0159600 | A1 | 6/2014 | Sutardja |
| 2014/0167601 | A1 | 6/2014 | Harry |
| 2014/0167646 | A1 | 6/2014 | Zukauskas |
| 2014/0175966 | A1 | 6/2014 | Tan |
| 2014/0176016 | A1 | 6/2014 | Li |
| 2014/0198531 | A1 | 7/2014 | Iwasaki |
| 2014/0217433 | A1 | 8/2014 | Tudorica |
| 2014/0217443 | A1 | 8/2014 | Heikman |
| 2014/0217907 | A1 | 8/2014 | Harris |
| 2014/0218909 | A1 | 8/2014 | Tetsuo |
| 2014/0225132 | A1 | 8/2014 | Livesay |
| 2014/0225511 | A1 | 8/2014 | Pickard |
| 2014/0225532 | A1 | 8/2014 | Groeneveld |
| 2014/0233193 | A1 | 8/2014 | Alexander |
| 2014/0268631 | A1 | 9/2014 | Pickard |
| 2014/0268724 | A1 | 9/2014 | Yanping |
| 2014/0268737 | A1 | 9/2014 | Athalye |
| 2014/0286016 | A1 | 9/2014 | Montagne |
| 2014/0286018 | A1 | 9/2014 | Zhang |
| 2014/0354145 | A1 | 12/2014 | Fisher |
| 2014/0355276 | A1 | 12/2014 | Fisher |
| 2014/0361701 | A1 | 12/2014 | Siessegger |
| 2014/0362563 | A1 | 12/2014 | Zimmerman |
| 2014/0367633 | A1 | 12/2014 | Bibl |
| 2015/0002034 | A1 | 1/2015 | Van De Ven |
| 2015/0029717 | A1 | 1/2015 | Shen |
| 2015/0036339 | A1 | 2/2015 | Ashdown |
| 2015/0043218 | A1 | 2/2015 | Hu |
| 2015/0060922 | A1 | 3/2015 | Wilcox |
| 2015/0176776 | A1 | 6/2015 | Pelka |
| 2015/0204509 | A1 | 7/2015 | Pelka |
| 2015/0211723 | A1 | 7/2015 | Athalye |
| 2015/0236225 | A1 | 8/2015 | David |
| 2015/0241024 | A1 | 8/2015 | Smith |
| 2015/0252982 | A1 | 9/2015 | Demuynck |
| 2015/0260905 | A1 | 9/2015 | Yuan |
| 2015/0276146 | A1 | 10/2015 | Wu |
| 2015/0295144 | A1 | 10/2015 | Weiler |
| 2015/0325754 | A1 | 11/2015 | Narendran |
| 2015/0338056 | A1 | 11/2015 | Pelka |
| 2015/0338057 | A1 | 11/2015 | Kim |
| 2016/0025296 | A1 | 1/2016 | Bigliatti |
| 2016/0033108 | A1 | 2/2016 | Ji |
| 2016/0109096 | A1 | 4/2016 | Park |
| 2016/0174319 | A1 | 6/2016 | Li |
| 2016/0195238 | A1 | 7/2016 | Han |
| 2016/0216561 | A1 | 7/2016 | Lee |
| 2016/0230958 | A1 | 8/2016 | Pickard |
| 2016/0252233 | A1 | 9/2016 | Han |
| 2016/0320002 | A1 | 11/2016 | Tai |
| 2016/0334079 | A1 | 11/2016 | Donnini |
| 2017/0002994 | A1 | 1/2017 | Fisher |
| 2017/0003000 | A1 | 1/2017 | Narendran |
| 2017/0009957 | A1 | 1/2017 | Lim |
| 2017/0084802 | A1 | 3/2017 | Chiu |
| 2017/0114979 | A1 | 4/2017 | Kang |
| 2017/0159896 | A1 | 6/2017 | Tran |
| 2017/0343167 | A1 | 11/2017 | Petluri |
| 2018/0135833 | A1 | 5/2018 | Pickard |

FOREIGN PATENT DOCUMENTS

| | | | |
|---|---|---|---|
| CN | 201739849 | U | 2/2011 |
| CN | 202040752 | U | 11/2011 |
| CN | 102269351 | A | 12/2011 |
| CN | 206347348 | | 7/2017 |
| EP | 0071052 | | 2/1983 |
| GB | 2457016 | A | 8/2009 |
| JP | 61070306 | | 5/1986 |
| JP | 2003092022 | | 3/2003 |
| JP | 2004179048 | | 6/2004 |
| JP | 2004265626 | | 9/2004 |
| JP | 2005017554 | | 1/2005 |
| JP | 2005071818 | | 3/2005 |
| JP | 2005235//8 | | 9/2005 |
| JP | 2005267964 | | 9/2005 |
| JP | 2006236796 | | 9/2006 |
| JP | 2006253274 | | 9/2006 |
| JP | 2006310138 | | 11/2006 |
| JP | D1307268 | | 8/2007 |
| JP | D1307434 | | 8/2007 |
| JP | 2007273205 | | 10/2007 |
| JP | 2007273209 | | 10/2007 |
| JP | 2011508406 | T | 3/2011 |
| JP | 2011204495 | A | 10/2011 |
| JP | 2011204658 | A | 10/2011 |
| KR | 20070039683 | | 4/2007 |
| KR | 20090013704 | A | 2/2009 |
| KR | 100974942 | B1 | 8/2010 |
| KR | 20120050280 | | 5/2012 |
| TW | 296481 | | 1/1997 |

(56) References Cited

FOREIGN PATENT DOCUMENTS

| | | | |
|---|---|---|---|
| TW | 200425542 | | 11/2004 |
| TW | 290967 | | 5/2006 |
| TW | 1273858 | | 2/2007 |
| TW | 1318461 | | 12/2009 |
| WO | 0215281 | | 2/2002 |
| WO | 2002012788 | | 2/2002 |
| WO | 2004071143 | | 8/2004 |
| WO | 2005093862 | | 10/2005 |
| WO | 2006066531 | | 6/2006 |
| WO | 2007128070 | | 11/2007 |
| WO | 2008108832 | | 9/2008 |
| WO | 2009044330 | | 4/2009 |
| WO | 2009108799 | | 9/2009 |
| WO | 2009120555 | | 10/2009 |
| WO | 2010016002 | | 2/2010 |
| WO | 2010059647 | | 5/2010 |
| WO | DM057383 | | 11/2010 |
| WO | 2011019945 | | 2/2011 |
| WO | 2013059298 | A1 | 4/2013 |
| WO | 2013192014 | | 12/2013 |
| WO | 2014099681 | A2 | 6/2014 |
| WO | 2016130464 | | 8/2016 |
| WO | 2019112634 | | 6/2019 |

OTHER PUBLICATIONS

Knight, Colette, "XICATO—Investigations on the use of LED modules for optimized color appearance in retail applications," downloaded on May 28, 2014 from http://www.xicato.com/sites/default/files/documents/Summary.sub- .-investigations.sub.-on.sub.-the.sub.-use.sub.-of LED.sub.-modules.sub.-for.sub.--optimized.sub.--color.sub.-appearance.- sub.-in.sub.--retail.sub.-applications.pdf, 5pp.

International Patent Application No. PCT/US2016/015402; Int'l Search Report and the Written Opinion; dated Apr. 22, 2016; 15 pages.

PCT/US2012/060588, International Application Serial No. PCT/US2012/060588, International Search Report and Written Opinion dated Mar. 29, 2013, Ecosense Lighting Inc. et al., 10 pages.

PCT/US2013/075172, "International Application Serial No. PCT/US2013/075172, International Search Report and Written Opinion dated Sep. 26, 2014", Ecosense Lighting Inc., 16 Pages.

Commonly-owned PCT International Patent Application PCT/US2018/016662, filed on Feb. 2, 2018, 82pp.

International Search Report and Opinion in PCT/US2018/016662, dated Apr. 30, 2018, 8pp.

Commonly-owned PCT International Patent Application PCT/US2016/016972, filed on Feb. 8, 2016, 64pp.

International Search Report and Opinion in PCT/US2016/016972, dated Apr. 11, 2016, 10pp.

International Preliminary Report on Patentability in PCT/US2016/016972, dated Aug. 24, 2017, 9pp.

Acuity Brands Lighting Inc. Product Catalog, downloaded from www.acuitybrands.com, dated Apr. 2013, 90pp.

Alanod GmbH, "WhiteOptics," downloaded from www.alanod.com, dated Apr. 2014, 12pp.

Lumitronix, "Carclo lens for side emitting 360 degrees," downloaded from http://www.leds.de/en/High-Power-LEDs/Lenses-and-optics/Carclo-lens-for-side-emitting-360.html on May 28, 2014, 2pp.

Kahen, Keith, "High-Efficiency Colloidal Quantum Dot Phosphors," University at Buffalo, Suny, Doe SSL R&D Workshop, Long Beach, California, Jan. 29-31, 2013, 12pp.

Freyssinier, Jean P. et al., "Class A Lighting," Rensselaer Polytechnic Institute, Strategies in Light 2012, 27 pp.

Oh, Jeong et al., "Full down-conversion of amber-emitting phosphor-converted light-emitting diodes with powder phosphors and a long-wave pass filter," Optics Express, vol. 18, No. 11, May 24, 2010, pp. 11063-11072.

"Microcellular Reflective Sheet MCPET," downloaded on Feb. 3, 2015 from www.furukawa.co.jp/foam/, 6pp.

Overton, Gail, "LEDS: White LED comprises blue LED and inexpensive dye," LaserFocusWorld, Feb. 12, 2013, downloaded from http://www.laserfocusworld.com/articles/print/volume-49/issue-02/world-news/leds--white-led-comprises-blue-led-and-inexpensive-dye.html, 5pp.

"LEDIL TIR Lens Guide," downloaded from www.ledil.com on Jan. 22, 2015, 8pp.

"Alanod MIRO Catalog," downloaded on Jan. 30, 2015 from www.alanod.com, 8pp.

"Nanoco Group—Cadmium Free Quantum Dots," downloaded on May 30, 2014 from www.nanocotechnologies.com/what-we-do/products/cadmium-free-quantum-dots, 3pp.

"Nanosys—Quantum Dots," downloaded on May 30, 2014 from www.nanosysinc.com/what-we-do/quantum-dots/, 3pp.

"Ocean NanoTech—Products," downloaded on May 30, 2014 from www.oceannanotech.com/Products.php, 1p.

"Lighting Global Technical Notes, Optical Control Techniques for Off-grid Lighting Products," Jul. 2011 and May 2012, 6pp.

"Pacific Light Technologies—Quantum Dots in Solid State Lighting," downloaded on Oct. 23, 2015 from www.pacificlighttech.com/quantum-dots-in-ssl/, 2pp.

Wikipedia, "Quantum dot,", downloaded on May 30, 2014 from http://en.wikipedia.org/wiki/Quantum_dot, 15pp.

Wikipedia, "Reflectivity,", downloaded on Jan. 22, 2015 from www.wikipedia.org, 3pp.

Wikipedia, "Transmittance," downloaded on Jan. 22, 2015 from www.wikipedia.org, 4pp.

"United Lumen—A Volumetric Displaced Phosphor Light Engine which elegantly and efficiently distributes light in a pattern similar to an incandescent bulb," downloaded on Jul. 9, 2014 from www.unitedlumen.com, 1p.

"United Lumen—Solid State Volumetric Technology," downloaded on Jul. 9, 2014 from www.unitedlumen.com, 1p.

"United Lumen—High Brightness V-LED Technology," downloaded on May 15, 2014 from www.unitedlumen.com, 1p.

Pickard et al., International PCT patent application serial No. PCT/US2016/016972, filed on Feb. 8, 2016, International Preliminary Report on Patentability dated Aug. 24, 2017 (9pp.).

Ashraf et al., U.S. Appl. No. 62/666,079, filed May 2, 2018, 112pp.

Knight, Colette, "Xicato-Investigations on the use of LED modules for optimized color appearance in retail applications," downloaded on May 28, 2014 from http://www.xicato.com/sites/default/files/documents/Summary.sub- .-investigations.sub.--on.sub.-the.sub.-use.sub.-of.sub.-LED.sub.-mo- dules.sub.-for.sub.-optimized.sub.-color.sub.-appearance.sub.--in.sub.- --retail.sub.-applications.pdf, 6pp.

"Zumtobel—IYON Tunable White,", downloaded on Oct. 19, 2015 from http://www.zumtobel.com/tunablewhite/en/index.html#topic.sub.-04, 1p.

"Zumtobel—IYON LED Spotlight Catalog,"downloaded on Oct. 19, 2015 from http://www.zumtobel.com/PDB/Ressource/teaser/en/com/lyon.pdf, 40pp.

"Lumenpulse-Lumenbeam Large Pendant Dynamic White," downloaded on May 28, 2014 from http://www.lumenpulse.com/en/product/72/lumenbeam-large-pendant- -dynamic-white, 1 p.

"Lumileds Application Brief AB08-Optical Testing for SuperFlux, SnapLED and Luxeon Emitters," downloaded on Sep. 24, 2014 from www.lumileds.com, 15pp.

"Lumileds Luxeon Z,", downloaded on May 2, 2015 from www.lumileds.com, 2pp.

"A Warmer, Cozier White Light: NXP Transforms LED Color Quality," dated Jan. 9, 2013, downloaded from http://www.nxp.com/news/press-releases/2013/01/a-warmer-cozier-white-ligh- t-nxp-transforms-led-color-quality.html, 2pp.

"Philips Lighting—Dim Tone,", downloaded on May 27, 2014 from www.usa.lighting.philips.com/lightcommunity/trends/led/dimtone/, 1p.

"Philips—Dimmable to warm light for the perfect ambience," downloaded on May 27, 2014 from www.usa.lighting.philipscom, 2pp.

"Philips—Turn up Ambience and Tone Down Energy Use with Philips BR30 DimTone," downloaded on May 27, 2014 from www.usa.lighting.philips.com, 11pp.

(56) References Cited

OTHER PUBLICATIONS

Wikipedia, "Planckian locus," downloaded on May 30, 2014 from www.wikipedia.org, 5pp.
"Phosphortech—Flexible Phosphor Sheet-RadiantFlex Datasheet," Aug. 2014, downloaded from www.phosphortech.com, 10pp.
"Relaction by lenses," downloaded on Feb. 17, 2015 from www.physicsclassroom.com, 5pp.
"RTLED—White Paper: Binning and LED," downloaded on Oct. 13, 2014 from www.rtled.com, 3pp.
Near, Al, "Seeing Beyond CRI," LED Testing & Application, Nov. 2011, downloaded from www.ies.org/lda/hottopics/led/4.pdf, 2pp.
"Selux-Olivio luminaire," press release dated Mar. 26, 2014, downloaded from http://www.selux.com/be/en/news/press/press-detail/article/evolution- ary-progress-the-olivio-family-of-system-luminaires-now-with-premium-quali- ty-white-and.html, 3pp.
"LEDIL-Strada-F Series," downloaded on May 5, 2015 from www.ledil.com, 7pp.
"Sylvania-Ultra SE(tm) LED Lamp Family," downloaded on May 27, 2014 from www.sylvania.com, 3pp.
"Sylvania Ultra SE(tm) LED Light Bulbs with Color Dimming Sunset Effects," downloaded on May 27, 2014 from https://www.youtube.com/watch?v=oZEc-VfJ8EU, 2pp.
"USAI Lighting Catalog," downloaded on May 27, 2014 from http://www.usaillumination.com/pdf/Warm.sub.-Glow.sub.-Dimming.pdf, 50pp.
"Winona-Parata 700 Series Cove," downloaded on May 28, 2014 from www.acuitybrands.com, 2pp.
"Winona Parata Catalog," downloaded on May 28, 2014 from www.acuitybrands.com, 24pp.
PCT/US2016/030613, Ecosense Lighting Inc., International Search Report and Opinion dated Aug. 5, 2016.
PCT/US2016/046245, Ecosense Lighting Inc., Filed on Aug. 10, 2016.
PCT/US2016/015470, Ecosense Lighting Inc., International Search Report and Opinion dated Jul. 8, 2016.
POT/US2016/015385, Ecosense Lighting Inc., International Search Report and Opinion dated Apr. 8, 2016.
POT/US2016/015435, Ecosense Lighting Inc., International Search Report and Opinion dated Mar. 31, 2016.
POT/US2016/015437, Ecosense Lighting Inc., International Search Report and Opinion dated Mar. 31, 2016.
PCT/US2016/015441, Ecosense Lighting Inc., International Search Report and Opinion dated Mar. 31, 2016.
Petluri et al., U.S. Appl. No. 14/526,504, filed Oct. 28, 2014, entitled "Lighting Systems Having Multiple Light Sources," 92pp.
Petluri et al., U.S. Appl. No. 14/636,204, filed Mar. 3, 2015, entitled "Lighting Systems Including Lens Modules for Selectable Light Distribution," 119pp.
Pickard et al., U.S. Appl. No. 14/636,205, filed Mar. 3, 2015, entitled "Low-Profile Lighting System Having Pivotable Lighting Enclosure," 56pp.
Fletcher et al., U.S. Appl. No. 29/533,667, filed Jul. 20, 2015, entitled "LED Luminaire Having a Mounting System," 10pp.
Rodgers et al., U.S. Appl. No. 14/702,800, filed May 4, 2015, entitled "Lighting Systems Including Asymmetric Lens Modules for Selectable Light Distribution," 116pp.
Fletcher et al., U.S. Appl. No. 14/702,765, filed May 4, 2015, entitled "Lighting System Having a Sealing System," 92pp.
Fletcher et al., U.S. Appl. No. 29/519,149, filed Mar. 3, 2015, entitled "LED Luminaire," 8pp.
Fletcher et al., U.S. Appl. No. 29/519,153, filed Mar. 3, 2015, entitled "LED Luminaire," 8pp.
Fletcher et al., U.S. Appl. No. 14/816,827, filed Aug. 3, 2015, entitled "Lighting System Having a Mounting Device," 126pp.
Rodgers et al., U.S. Appl. No. 62/202,936, filed Aug. 10, 2015, entitled "Optical Devices and Systems Having a Converging Lens With Grooves," 133pp.
Fletcher et al., U.S. Appl. No. 29/532,383, filed Jul. 6, 2015, entitled "LED Luminaire Having a Mounting System," 10pp.
Fletcher et al., U.S. Appl. No. 29/533,635, filed Jul. 20, 2015, entitled "LED Luminaire Having a Mounting System," 10pp.
Fletcher et al., U.S. Appl. No. 29/533,666, filed Jul. 20, 2015, entitled "LED Luminaire Having a Mounting System," 10pp.
Acuity Brands, "Acuity Brands Introduces Luminaire for Tunable White Technology," downloaded from http://news.acuitybrands.com/US/acuity-brands-introduces-luminaires-with-tunable-white-technology/s/54ae242f-1222-4b8b-be0d-36637bde8cd2 on May 28, 2014, 2pp.
Acuity Brands, "A Guided Tour of Area Light Sources-Past, Present and Future," downloaded from www.acuitybrands.com, version dated Jun. 20, 2013, 72pp.
Altman Lighting, "Spectra Cube," downloaded from http://altmanstagelighting.com/altman-led-green-lighting/led-spectra-cube- /Altman-Spectra-Cube-Data-Sheet-v3.pdf on May 28, 2014, 1p.
Bega Lighting, "In-ground luminaire RGBW IP 67 Product data sheet," downloaded from http://www.bega.com/download/datenblaetter/en/7926.pdf on May 28, 2014, 1p.
CORM 2011 Conference, Gaithersburg, MD, "Calculation of CCT and Duv and Practical Conversion Formulae," dated May 3-5, 2011, National Institute of Standards and Technology, 28pp.
"Introduction to Catmull-Rom Splines," downloaded on Aug. 7, 2015 from www.mvps.org/directx/articles/catmull/, 2pp.
Wikipedia, "CIE 1931 color space," version dated Apr. 23, 2014, downloaded from www.wikipedia.org, 12pp.
Osram Sylvania, "ColorCalculator User Guide", downloaded on Jun. 3, 2014 from www.sylvania.com, 44pp.
Osram Sylvania, "ColorCalculator User Guide", downloaded on Oct. 19, 2015 from www.sylvania.com, 50pp.
Philips Color Kinetics, "IntelliWhite LED Lighting Systems," downloaded on May 28, 2014 from http://www.colorkinetics.com/ls/intelliwhite/, 2pp.
Philips Color Kinetics, "Color-Changing LED Lighting Systems," downloaded on May 27, 2014 from http://www.colorkinetics.com/ls/rgb/, 2pp.
"Ecosense to reveal new TROV LED Linear Platform at 2015 Lighffair International in New York City," May 4, 2015, blog downloaded from www.ecosense.com, 3pp.
Freyssinier, Jean P. et al., "Class A Color Designation for Light Sources Used in General Illumination," J. Light & Vis. Env., vol. 37, Nos. 2-3, Nov. 7, 2013, pp. 10-14.
Rea et al., "White lighting for residential applications," Lighting Res. Technol., Mar. 27, 2012, downloaded from www.sagepublications.com at http://lrt.sagepub com/content/early/2012/03/27/1477153512442936, 15pp.
"KKDC Catalog 2.0," downloaded on May 28, 2014 from http://www.kkdc.co.uk/media/kkdc-catalogue.pdf, 134pp.
"KKDC UK—Linear LED Lighting," downloaded from www.kkdc.co.uk/application/interior.php on Oct. 22, 2015, 6pp.
"Lightolier—Solid-State Lighting," downloaded on May 28, 2014 from http://www.lightolier.com/prospots/leds.sub.--solidstate.jsp, 1p.
PCT/US2007/023110, Journee Lighting Inc., International Preliminary Report on Patentability dated Sep. 8, 2009.
PCT/US2009/035321, Journee Lighting Inc., International Preliminary Report on Patentability dated Aug. 31, 2010.
PCT/US2009/064858, Journee Lighting Inc., International Preliminary Report on Patentability dated May 24, 2011.
PCT/US2010/045361, Journee Lighting Inc., International Preliminary Report on Patentability dated Feb. 14, 2012.
PCT/US2012/060588, Ecosense Lighting Inc., Filed on Oct. 17, 2012.
PCT/US2012/060588, Ecosense Lighting Inc., International Preliminary Report on Patentability dated Apr. 22, 2014.
PCT/US2013/045708, Journee Lighting Inc., International Search Report and Opinion dated Nov. 27, 2013.
PCT/US2013/045708, Journee Lighting Inc., International Preliminary Report on Patentability dated May 12, 2015.
Freyssinier et al, "The Class A Color Designation for Light Sources," 2013 DOE Solid-State Lighting R&D Workshop, Jan. 29-31, 2013, 26pp.
Rea et al, "White Lighting: A Provisional Model for Predicting Perceived Tint in 'White' Illumination," COLOR Research and Application, vol. 39, No. 5, Oct. 2014, pp. 466-479, 14pp.

(56) References Cited

OTHER PUBLICATIONS

International Search Report dated Jan. 24, 2022, in commonly-owned corresponding PCT/US21/71807, 7 pp.
PCT/US2013/075172, Ecosense Lighting Inc., Filed on Dec. 13, 2013.
PCT/US2013/075172, Ecosense Lighting Inc., International Preliminary Report on Patentability dated Jun. 23, 2015.
PCT/US2016/020521, Ecosense Lighting Inc., Filed on Mar. 2, 2016.
PCT/US2016/020521, Ecosense Lighting Inc., International Search Report and Opinion dated May 3, 2016.
PCT/US2016/030613, Ecosense Lighting Inc., Filed on May 3, 2016.
PCT/US2016/020523, Ecosense Lighting Inc., Filed on Mar. 2, 2016.
PCT/US2016/020523, Ecosense Lighting Inc., International Search Report and Opinion dated May 6, 2016.
PCT/US2016/015470, Ecosense Lighting Inc., Filed on Jan. 28, 2016, Entitled "Zoned Optical Cup."
PCT/US2016/015473, Ecosense Lighting Inc., Filed on Jan. 28, 2016, Entitled "Illuminating With a Multizone Mixing Cup."
PCT/US2016/015473, Ecosense Lighting Inc., International Search Report and Opinion dated Apr. 22, 2016.
Petluri et al., U.S. Appl. No. 15/170,806, filed Jun. 1, 2016, entitled "Illuminating With a Multizone Mixing Cup."
PCT/US2016/015318, Ecosense Lighting Inc., Filed on Jan. 28, 2016, Entitled "Compositions for LED Light Conversions."
PCT/US2016/015318, Ecosense Lighting Inc., International Search Report and Opinion, dated Apr. 11, 2016.
"Optagon Targetti—Shopping Like You've Never Seen Before," downloaded on Mar. 28, 2017 from: https://download.architonic.com/pdf/310/0370/targetti-optagon-en.pdf; 12 pages.
PCT/US2016/015348, Ecosense Lighting Inc., Filed on Jan. 28, 2016, Entitled "Systems for Providing Tunable White Light With High Color Rendering."
PCT/US2016/015348, Ecosense Lighting Inc., International Search Report and Opinion dated Apr. 11, 2016.
PCT/US2016/015368, Ecosense Lighting Inc., Filed on Jan. 28, 2016, Entitled "Systems for Providing Tunable White Light With High Color Rendering."
PCT/US2016/015368, Ecosense Lighting Inc., International Search Report and Opinion dated Apr. 19, 2016.
Petluri et al., U.S. Appl. No. 15/173,538, filed Jun. 3, 2016, entitled "System for Providing Tunable White Light With High Color Rendering."
Petluri et al., U.S. Appl. No. 15/173,554, filed Jun. 3, 2016, entitled "System for Providing Tunable White Light With High Color Rendering."
PCT/US2016/015385, Ecosense Lighting Inc., Filed on Jan. 28, 2016, Entitled "Methods for Generating Tunable White Light With High Color Rendering."
PCT/US2016/015402, Ecosense Lighting Inc., Filed on Jan. 28, 2016, Entitled "Methods for Generating Tunable White Light With High Color Rendering."
PCT/US2016/015435, Ecosense Lighting Inc., Filed on Jan. 28, 2016, Entitled "Methods for Generating Melatonin-Response-Tuned White Light With High Color Rendering."
PCT/US2016/015437, Ecosense Lighting Inc., Filed on Jan. 28, 2016, Entitled "Methods for Generating Melatonin-Response-Tuned White Light With High Color Rendering."
PCT/US2016/015441, Ecosense Lighting Inc., Filed on Jan. 28, 2016, Entitled "Methods for Generating Melatonin-Response-Tuned White Light With High Color Rendering."
Petluri et al., U.S. Appl. No. 15/176,083, filed Jun. 7, 2016, entitled "Compositions for LED Light Conversions."
"CandlePowerForums—SOLD: Luxeon III side-emitter white LED," downloaded on May 28, 2014 from http://www.candlepowerforums.com/vb/showthread.php?140276-SOLD-Luxeon-III- -side-emitter-white-LED, 4pp.
PCT/US2016/016972, Ecosense Lighting Inc., filed on Feb. 8, 2016.
"NNCrystal-blog post-May 17, 2010," downloaded from http://led-lights-led.blogspot.c,om/2010/05/nncrystal-us-corporation-to-s- upply.html, 4pp.
Kenneth Kelly, "Color Designations for Lights," U.S. Department of Commerce, National Bureau of Standards, Research Paper RP1565, Journal of Research of the National Bureau of Standards, vol. 31, Nov. 1943, pp. 271-278.
Philips Color Kinetics, "LED Cove Lighting," downloaded on May 28, 2014 from http://www.colorkinetics.com/ls/guides-brochures/pck-led-cove-lighti- ng.pdf, 32pp.
Wikipedia, "Color temperature," version dated May 21, 2014, downloaded on Jun. 3, 2014 from www.wikipedia.org, 17pp.
Cree, "LED Color Mixing: Basics and Background," downloaded on Sep. 24, 2014 from www.cree.com, 24pp.
Cree, "Cree(r) LMH2 LED Modules," Product Family Data Sheet, downloaded on May 27, 2014 from http://www.cree.com/.about/media/Files/Cree/LED%20Components%20and%20Mod- ules/Modules/Data%20Sheets/LEDModules.sub.-LMH2.pdf, 18pp.
"Dialight ES Series RGB LED Luminaire," downloaded on May 28, 2014 from http://www.dialight.com/Assets/Brochures.sub.-And.sub.--Catalogs/Illumin- ation/MDEXESTEMORGB.sub.-A.pdf, 2pp.
Naomi Miller, "Color Spaces and Planckian Loci: Understanding all those Crazy Color Metrics," U.S. Department of Energy, Pacific Northwest National Laboratory, Portland, Oregon, downloaded on May 30, 2014, 49pp.
Bush, Steve, "Chip gives dim-to-warm LED lighting without MCU," dated Apr. 1, 2014, downloaded from http://www.electronicsweekly.com/news/components/led-lighting/chip-gives-- dim-warm-led-lighting-without-mcu-2014-04/, 6pp.
Freyssinier, Jean P. et al., "White Lighting," Color Res. & App'n, (volume unknown), Sep. 3, 2011, downloaded from http://www.lrc.rpi.edu/programs/solidstate/assist/pdf/SIL-2012.sub.--Frey- ssinierRea.sub.-WhiteLighting.pdf, 12pp.
"Aculux-Black Body Dimming and Tunable White Responsive Technologies," downloaded on May 28, 2014 from http://www.junolightinggroup.com/literature/LIT-AX-LED-BBD-TW.pdf, 28pp.
"Khatod—Symmetric & Asymmetric Strip Lens," downloaded on May 5, 2015 from www.khatod.com, 3pp.
"LED Linear-linear lighting solutions, product overview," downloaded on May 28, 2014 from http://www.led-linear.com/en/product-overview/system-catalogue/, 3pp.
"LEDnovation—BR30 Warm Dimming," downloaded on May 28, 2014 from www.lednovation.com/products/ BR30.sub.-LED.asp, 2pp.
Wikipedia, "Lenticular lens," downloaded on Feb. 18, 2015 from www.wikipedia.org, 5pp.
"Lenticular Sheets," downloaded on Feb. 24, 2015 from www.lenticular-sheets.lpceurope.eu/, 2pp.
Unzner, Norbert, "Light Analysis in lighting technology," B&S Electronische Geralte GmbH, 2001, 14pp.
Wikipedia, "Line of purples," downloaded on Oct. 20, 2015 from www.wikipedia.org, 2pp.
"Lumenbeam Catalog," downloaded on May 27, 2014 from 11.sub.-160.sub.--en.sub.-lumenpulse.sub.--lumenbeam.sub.-rgb.sub.-lb- I.sub.-rgb.sub.--brochure.zip, 63pp.
"Lumenetix—Araya Technology," downloaded on May 28, 2014 from www.lumenetix.com/araya-technology, 3pp.
"Lumenpulse-Lumenbeam Large Color Changing,", downloaded on May 27, 2014 from www.lumenpulse.com/en/product/11/lumenbeam-large-color-changing, 4pp.
"Lumenpulse-Lumencove Family," downloaded on May 28, 2014 from http://www.lumenpulse.com/en/products#! 3/0/0/0/0/0, 2pp.

* cited by examiner

LIGHTING SYSTEMS GENERATING PARTIALLY-COLLIMATED LIGHT EMISSIONS

CROSS-REFERENCE TO RELATED APPLICATIONS

This patent application is a continuation of commonly-owned U.S. patent application Ser. No. 17/067,744 filed on Oct. 11, 2020, which is a continuation-in-part of commonly-owned U.S. patent application Ser. No. 16/401,170 filed on May 2, 2019, which claims the benefit of commonly-owned provisional U.S. patent application Ser. No. 62/666,079 filed on May 2, 2018. U.S. patent application Ser. No. 16/401,170 is a continuation-in-part of commonly-owned U.S. patent application Ser. No. 15/921,206 filed on Mar. 14, 2018 which was issued on Aug. 13, 2019 as U.S. Pat. No. 10,378,726. U.S. patent application Ser. No. 15/921,206 is: a continuation of commonly-owned Patent Cooperation Treaty (PCT) International Patent Application serial number PCT/US2018/016662 filed on Feb. 2, 2018; and a continuation-in-part of commonly-owned U.S. patent application Ser. No. 15/835,610 filed on Dec. 8, 2017. U.S. patent application Ser. No. 15/835,610 is: a continuation of commonly-owned PCT International Patent Application serial number PCT/US2016/016972 filed on Feb. 8, 2016; and a continuation of commonly-owned U.S. patent application Ser. No. 14/617,849 which was issued on Jan. 16, 2018 as U.S. Pat. No. 9,869,450. The entireties of all of the foregoing patent applications, having the following serial numbers, are hereby incorporated herein by reference: Ser. Nos. 17/067,744; 16/401,170; 62/666,079; 15/921,206; PCT/US2018/016662; Ser. No. 15/835,610; PCT/US2016/016972; and Ser. No. 14/617,849.

BACKGROUND OF THE INVENTION

1. Field of the Invention

The present invention relates to the field of lighting systems that include semiconductor light-emitting devices, and processes related to such lighting systems.

2. Background of the Invention

Numerous lighting systems that include semiconductor light-emitting devices have been developed. As examples, some of such lighting systems may control the propagation of light emitted by the semiconductor light-emitting devices. Despite the existence of these lighting systems, further improvements are still needed in lighting systems that include semiconductor light-emitting devices and that control the propagation of some of the emitted light, and in processes related to such lighting systems.

SUMMARY

In an example of an implementation, a lighting system is provided that includes a bowl reflector, a visible-light source, a central reflector, and an optically-transparent body. In this example of the lighting system, the bowl reflector has: a central axis; a rim defining an emission aperture; and a first visible-light-reflective surface defining a portion of a cavity in the bowl reflector. Further in this example of the lighting system, a portion of the first visible-light-reflective surface is a parabolic surface. In this example of the lighting system, the visible-light source includes a semiconductor light-emitting device, the visible-light source being located in the cavity, the visible-light source being configured for generating visible-light emissions from the semiconductor light-emitting device. Also in this example of the lighting system, the central reflector has a second visible-light-reflective surface, the second visible-light-reflective surface having a convex flared funnel shape and having a first peak, the first peak facing toward the visible-light source. The optically-transparent body in this example of the lighting system has a first base being spaced apart from a second base and having a side wall extending between the first base and the second base, a surface of the second base having a concave flared funnel shape, the concave flared funnel-shaped surface of the second base facing toward the convex flared funnel-shaped second visible-light reflective surface of the central reflector, and the first base including a central region having a convex paraboloidal-shaped surface and a second peak, the second peak facing toward the visible-light source.

In some examples of the lighting system, the central reflector may be aligned along the central axis, and a cross-section of the convex flared funnel-shaped second visible-light-reflective surface of the central reflector, taken along the central axis, may include two concave curved sections meeting at the first peak.

In further examples of the lighting system, a cross-section of the convex flared funnel-shaped second visible-light-reflective surface of the central reflector, taken along the central axis, may include the two concave curved sections as being parabolic-curved sections meeting at the first peak.

In additional examples of the lighting system, a cross-section of the convex flared funnel-shaped second visible-light-reflective surface of the central reflector, taken along the central axis, may include each one of two concave curved sections as being a step-curved section, wherein each step-curved section may include two curved subsections meeting at an inflection point.

In other examples of the lighting system, the convex flared funnel-shaped second visible-light reflective surface of the central reflector may be in contact with the concave flared funnel-shaped surface of the second base.

In some examples of the lighting system, the convex flared funnel-shaped second visible-light reflective surface of the central reflector may be spaced apart by a gap away from the concave flared funnel-shaped surface of the second base of the optically-transparent body.

In further examples of the lighting system, such a gap may be an ambient air gap.

In additional examples of the lighting system, the gap may be filled with a material having a refractive index being higher than a refractive index of ambient air.

In other examples of the lighting system, such a gap may be filled with a material having a refractive index being lower than a refractive index of the optically-transparent body.

In some examples of the lighting system, the central reflector may have a first perimeter located transversely away from the central axis, and the second base of the optically-transparent body may have a second perimeter located transversely away from the central axis, and the first perimeter of the central reflector may be in contact with the second perimeter of the second base of the optically-transparent body.

In further examples of the lighting system, the central reflector and the second base of the optically-transparent body may be spaced apart by a gap except for the first perimeter of the central reflector as being in contact with the second perimeter of the second base of the optically-transparent body.

In additional examples of the lighting system, such a gap may be an ambient air gap.

In other examples of the lighting system, the gap may be filled with a material having a refractive index being higher than a refractive index of ambient air.

In some examples of the lighting system, such a gap may be filled with a material having a refractive index being lower than a refractive index of the optically-transparent body.

In further examples of the lighting system, the convex paraboloidal-shaped surface of the central region of the first base may be a spheroidal-shaped surface.

In additional examples of the lighting system, the optically-transparent body may be aligned along the central axis, and the second peak of the central region of the first base may be spaced apart by a distance along the central axis away from the visible-light source.

In other examples of the lighting system, the first base of the optically-transparent body may include an annular lensed optic region surrounding the central region, and the annular lensed optic region of the first base may extend, as defined in a direction parallel with the central axis, toward the visible-light source from a valley surrounding the central region.

In some examples of the lighting system, an annular lensed optic region of the first base may extend, as defined in such a direction being parallel with the central axis, from such a valley surrounding the central region of the first base to a third peak of the first base.

In additional examples of the lighting system, such a third peak of the first base may be located, as defined in such a direction being parallel with the central axis, at about such a distance away from the visible-light source.

In further examples of the lighting system, an annular lensed optic region of the first base may define pathways for some of the visible-light emissions, and the annular lensed optic region may include an optical output interface being spaced apart across the annular lensed optic region from an optical input interface, and the visible-light source may be positioned for an average angle of incidence at the optical input interface being selected for causing visible-light entering the optical input interface to be refracted in propagation directions toward the bowl reflector and away from the third peak of the first base, and the optical output interface may be positioned relative to the propagation directions for another average angle of incidence at the optical output interface being selected for causing visible-light exiting the optical output interface to be refracted in propagation directions toward the bowl reflector and being further away from the third peak of the first base.

In additional examples of the lighting system, such an optical input interface may extend between the valley and the third peak of the first base, and a distance between the valley and the central axis may be smaller than another distance between the third peak and the central axis.

In other examples of the lighting system, a cross-section of the annular lensed optic region taken along the central axis may have a biconvex lens shape, the optically-transparent body being shaped for directing visible-light emissions into a convex-lensed optical input interface for passage through the annular biconvex-lensed optic region to then exit from a convex-lensed optical output interface for propagation toward the bowl reflector.

In some examples of the lighting system, the first base of the optically-transparent body may include a lateral region being located between the annular lensed optic region and the central region.

In further examples, the lighting system may further include a semiconductor light-emitting device holder, and the holder may include a chamber for holding the semiconductor light-emitting device, and the chamber may include a wall having a fourth peak facing toward the first base of the optically-transparent body, and the fourth peak may have an edge being chamfered for permitting unobstructed propagation of the visible-light emissions from the visible-light source to the optically-transparent body.

In additional examples of the lighting system, such a fourth peak may have the edge as being chamfered at an angle being within a range of between about 30 degrees and about 60 degrees In other examples of the lighting system, the first visible-light-reflective surface of the bowl reflector may be a specular light-reflective surface.

In some examples of the lighting system, the first visible-light-reflective surface may be a metallic layer on the bowl reflector.

In further examples of the lighting system, the first visible-light-reflective surface of the bowl reflector may have a minimum visible-light reflection value from any incident angle being at least about ninety percent (90%).

In additional examples of the lighting system, the first visible-light-reflective surface of the bowl reflector may have a minimum visible-light reflection value from any incident angle being at least about ninety-five percent (95%).

In other examples of the lighting system, the first visible-light-reflective surface of the bowl reflector may have a maximum visible-light transmission value from any incident angle being no greater than about ten percent (10%).

In some examples of the lighting system, the first visible-light-reflective surface of the bowl reflector may have a maximum visible-light transmission value from any incident angle being no greater than about five percent (5%).

In further examples of the lighting system, the first visible-light reflective surface of the bowl reflector may include a plurality of vertically-faceted sections being mutually spaced apart around and joined together around the central axis.

In additional examples of the lighting system, each one of such vertically-faceted sections may have a generally pie-wedge-shaped perimeter.

In other examples of the lighting system, each one of such vertically-faceted sections may form a one of a plurality of facets of the first visible-light-reflective surface, and each one of such facets may have a concave visible-light reflective surface.

In some examples of the lighting system, each one of such vertically-faceted sections may form a one of such a plurality of facets of the first visible-light-reflective surface, and each one of such facets may have a convex visible-light reflective surface.

In further examples of the lighting system, each one of such vertically-faceted sections may form a one of such a plurality of facets of the first visible-light-reflective surface, and each one of such facets may have a generally flat visible-light reflective surface.

In additional examples of the lighting system, the second visible-light-reflective surface of the central reflector may be a specular surface.

In other examples of the lighting system, the second visible-light-reflective surface of the central reflector may be a metallic layer on the central reflector.

In some examples of the lighting system, the second visible-light-reflective surface of the of the central reflector may have a minimum visible-light reflection value from any incident angle being at least about ninety percent (90%).

In further examples of the lighting system, the second visible-light-reflective surface of the central reflector may have a minimum visible-light reflection value from any incident angle being at least about ninety-five percent (95%).

In additional examples of the lighting system, the second visible-light-reflective surface of the central reflector may have a maximum visible-light transmission value from any incident angle being no greater than about ten percent (10%).

In other examples of the lighting system, the second visible-light-reflective surface of the central reflector may have a maximum visible-light transmission value from any incident angle being no greater than about five percent (5%).

In some examples of the lighting system, the optically-transparent body may be aligned along the central axis, and the first base may be spaced apart along the central axis from the second base.

In further examples of the lighting system, the side wall of the optically-transparent body may have a generally-cylindrical shape.

In additional examples of the lighting system, the first and second bases of the optically-transparent body may have circular perimeters located transversely away from the central axis, and the optically-transparent body may have a generally circular-cylindrical shape.

In other examples of the lighting system: the first and second bases of the optically-transparent body may have circular perimeters located transversely away from the central axis; and the optically-transparent body may have a circular-cylindrical shape; and the central reflector may have a circular perimeter located transversely away from the central axis; and the rim of the bowl reflector may have a circular perimeter.

In some examples of the lighting system: the first and second bases of the optically-transparent body may have elliptical perimeters located transversely away from the central axis; and the optically-transparent body may have an elliptical-cylindrical shape; and the central reflector may have an elliptical perimeter located transversely away from the central axis; and the rim of the bowl reflector may have an elliptical perimeter.

In further examples of the lighting system: each of the first and second bases of the optically-transparent body may have a multi-faceted perimeter being rectangular, hexagonal, octagonal, or otherwise polygonal; and the optically-transparent body may have a multi-faceted shape being rectangular-, hexagonal-, octagonal-, or otherwise polygonal-cylindrical; and the central reflector may have a multi-faceted perimeter being rectangular-, hexagonal-, octagonal-, or otherwise polygonal-shaped; and the rim of the bowl reflector may have a multi-faceted perimeter being rectangular, hexagonal, octagonal, or otherwise polygonal.

In additional examples of the lighting system, the optically-transparent body may have a spectrum of transmission values of visible-light having an average value being at least about ninety percent (90%).

In other examples of the lighting system, the optically-transparent body may have a spectrum of absorption values of visible-light having an average value being no greater than about ten percent (10%).

In some examples of the lighting system, the optically-transparent body may have a refractive index of at least about 1.41.

In further examples, the lighting system may include another surface defining another portion of the cavity, and the visible-light source may be located on the another surface of the lighting system.

In additional examples of the lighting system, the visible-light source may be aligned along the central axis.

In other examples of the lighting system, the first base of the optically-transparent body may be spaced apart by another gap away from the visible-light source.

In some examples of the lighting system, such an another gap may be an ambient air gap.

In further examples of the lighting system, such an another gap may be filled with a material having a refractive index being higher than a refractive index of ambient air.

In additional examples of the lighting system, such an another gap may be filled with a material having a refractive index being lower than a refractive index of the optically-transparent body.

In other examples of the lighting system, the visible-light source may include a plurality of semiconductor light-emitting devices.

In some examples of the lighting system, the visible-light source may include such a plurality of the semiconductor light-emitting devices as being arranged in an array.

In further examples of the lighting system, such a plurality of the semiconductor light-emitting devices may be collectively configured for generating the visible-light emissions as having a selectable perceived color.

In additional examples, the lighting system may include a controller for the visible-light source, such a controller being configured for causing the visible-light emissions to have a selectable perceived color.

In other examples, the lighting system may further include a lens defining a further portion of the cavity, such a lens being shaped for covering the emission aperture of the bowl reflector.

In some examples of the lighting system, such a lens may be a bi-planar lens having non-refractive anterior and posterior surfaces.

In further examples of the lighting system, such a lens may have a central orifice being configured for attachment of accessory lenses to the lighting system.

In additional examples, such a lighting system may include a removable plug being configured for closing the central orifice.

In further examples of the lighting system, the optically-transparent body and the visible-light source may be configured for causing some of the visible-light emissions from the semiconductor light-emitting device to enter into the optically-transparent body through the first base and to then be refracted within the optically-transparent body toward an alignment along the central axis.

In additional examples of the lighting system, the optically-transparent body and the gap may be configured for causing some of the visible-light emissions that are refracted toward an alignment along the central axis within the optically-transparent body to then be refracted by total internal reflection at the second base away from the alignment along the central axis.

In other examples of the lighting system, the central reflector may be configured for causing some of the visible-light emissions that are so refracted toward an alignment along the central axis within the optically-transparent body to then be reflected by the convex flared funnel-shaped second visible-light-reflective surface of the central reflector after passing through the gap.

In some examples, the lighting system may be configured for causing some of the visible-light emissions to be refracted within the optically-transparent body toward an alignment along the central axis and to then be refracted by the gap or reflected by the central reflector, and to then be reflected by the bowl reflector.

In further examples of the lighting system, the visible-light source may include a phosphor-converted semiconductor light-emitting device that emits light having an angular correlated color temperature deviation.

In additional examples, the lighting system may be configured for causing some of the visible-light emissions to be refracted within the optically-transparent body and to be reflected by the central reflector and by the bowl reflector, thereby reducing an angular correlated color temperature deviation of the visible-light emissions.

Other systems, processes, features and advantages of the invention will be or will become apparent to one with skill in the art upon examination of the following figures and detailed description. It is intended that all such additional systems, processes, features and advantages be included within this description, be within the scope of the invention, and be protected by the accompanying claims.

BRIEF DESCRIPTION OF THE FIGURES

The invention can be better understood with reference to the following figures. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
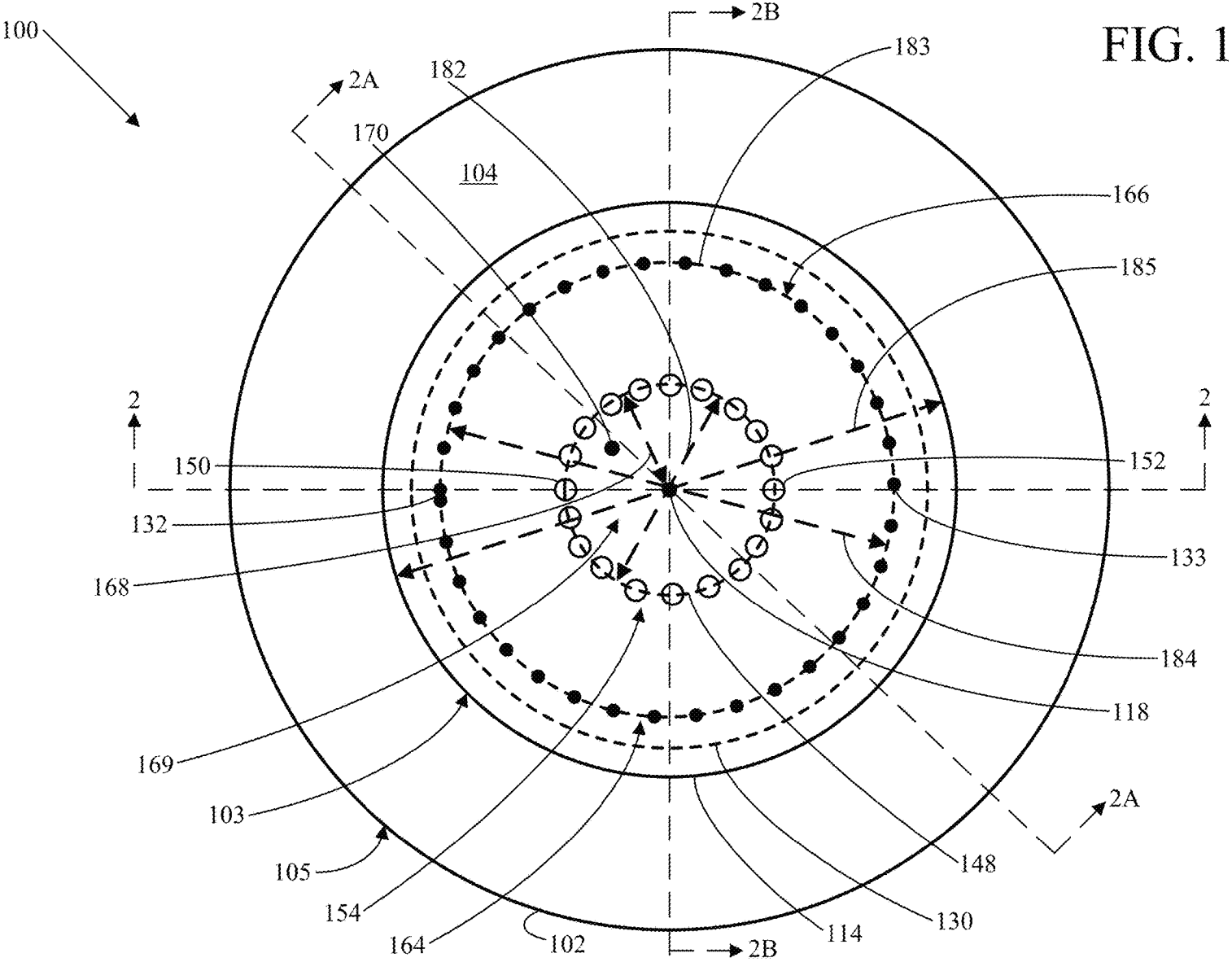
FIG. 1 is a schematic top view showing an example [100] of an implementation of a lighting system.

Various lighting systems and processes that utilize semiconductor light-emitting devices have been designed. Many such lighting systems and processes exist that are capable of emitting light from an emission aperture. However, existing lighting systems and processes often have demonstrably failed to provide partially-collimated or substantially-collimated light emissions having a perceived uniform brightness and a perceived uniform correlated color temperature ("CCT") and propagating in a controllable manner including a controllable beam angle range and a controllable field angle range; and often have generated light emissions being perceived as having aesthetically-unpleasing glare. As an example, light that may be emitted from a lighting system after propagating in directions not being controlled by the lighting system may cause glare conditions.

Lighting systems accordingly are provided herein, that include a bowl reflector, a visible-light source, a central reflector, and an optically-transparent body. In some examples of the lighting system, the bowl reflector has a central axis, a rim defining an emission aperture, and a first visible-light-reflective surface defining a portion of a cavity in the bowl reflector. Further in these examples of the lighting system, a portion of the first visible-light-reflective surface is a parabolic surface. In these examples of the lighting system, the visible-light source includes a semiconductor light-emitting device, the visible-light source being located in the cavity, the visible-light source being configured for generating visible-light emissions from the semiconductor light-emitting device. Also in these examples of the lighting system, the central reflector has a second visible-light-reflective surface, the second visible-light-reflective surface having a convex flared funnel shape and having a first peak, the first peak facing toward the visible-light source. The optically-transparent body in these examples of the lighting system has a first base being spaced apart from a second base and having a side wall extending between the first base and the second base, a surface of the second base having a concave flared funnel shape, the concave flared funnel-shaped surface of the second base facing toward the convex flared funnel-shaped second visible-light reflective surface of the central reflector, and the first base including a central region having a convex paraboloidal-shaped surface and a second peak, the second peak facing toward the visible-light source. This structure of the examples of the lighting system may cause the visible-light emissions to pass through the side surface of the optically-transparent body and to then be directed in a controlled manner to the first visible-light-reflective surface of the bowl reflector. Further, for example, these lighting system structures may cause relatively more of the visible-light emissions to be reflected by the first visible-light-reflective surface of the bowl reflector, and may accordingly cause relatively less of the visible-light emissions to directly reach the emission aperture by bypassing the bowl reflector. Visible-light emissions that directly reach the emission aperture while bypassing reflection from the bowl reflector may, as examples, cause glare or otherwise not be emitted in intended directions. Further, the reductions in glare and visible-light emissions in unintended directions that may accordingly be achieved by these examples of the lighting system may facilitate a reduction in a depth of the bowl reflector in directions along the central axis. Hence, the combined elements of these examples of the lighting system may facilitate a more low-profiled structure of the lighting system producing reduced glare and providing greater control over directions of visible-light emissions.

The following definitions of terms, being stated as applying "throughout this specification", are hereby deemed to be incorporated throughout this specification, including but not limited to the Summary, Brief Description of the Figures, Detailed Description, and Claims.

Throughout this specification, the term "semiconductor" means: a substance, examples including a solid chemical element or compound, that can conduct electricity under some conditions but not others, making the substance a good medium for the control of electrical current.

Throughout this specification, the term "semiconductor light-emitting device" (also being abbreviated as "SLED") means: a light-emitting diode; an organic light-emitting diode; a laser diode; or any other light-emitting device having one or more layers containing inorganic and/or organic semiconductor(s). Throughout this specification, the term "light-emitting diode" (herein also referred to as an "LED") means: a two-lead semiconductor light source having an active pn-junction. As examples, an LED may include a series of semiconductor layers that may be epitaxially grown on a substrate such as, for example, a substrate that includes sapphire, silicon, silicon carbide, gallium nitride or gallium arsenide. Further, for example, one or more semiconductor p-n junctions may be formed in these epitaxial layers. When a sufficient voltage is applied across the p-n junction, for example, electrons in the n-type semiconductor layers and holes in the p-type semiconductor layers may flow toward the p-n junction. As the electrons and holes flow toward each other, some of the electrons may recombine with corresponding holes, and emit photons. The energy release is called electroluminescence, and the color of the light, which corresponds to the energy of the photons, is determined by the energy band gap of the semiconductor. As examples, a spectral power distribution of the light generated by an LED may generally depend on the particular semiconductor materials used and on the structure of the thin epitaxial layers that make up the "active region" of the device, being the area where the light is generated. As examples, an LED may have a light-emissive electroluminescent layer including an inorganic semiconductor, such as a Group III-V semiconductor, examples including: gallium nitride; silicon; silicon carbide; and zinc oxide. Throughout this specification, the term "organic light-emitting diode" (herein also referred to as an "OLED") means: an LED having a light-emissive electroluminescent layer including an organic semiconductor, such as small organic molecules or an organic polymer. It is understood throughout this specification that a semiconductor light-emitting device may include: a non-semiconductor-substrate or a semiconductor-substrate; and may include one or more electrically-conductive contact layers. Further, it is understood throughout this specification that an LED may include a substrate formed of materials such as, for example: silicon carbide; sapphire; gallium nitride; or silicon. It is additionally understood throughout this specification that a semiconductor light-emitting device may have a cathode contact on one side and an anode contact on an opposite side, or may alternatively have both contacts on the same side of the device.

Further background information regarding semiconductor light-emitting devices is provided in the following documents, the entireties of all of which hereby are incorporated by reference herein: U.S. Pat. Nos. 7,564,180; 7,456,499; 7,213,940; 7,095,056; 6,958,497; 6,853,010; 6,791,119; 6,600,175; 6,201,262; 6,187,606; 6,120,600; 5,912,477; 5,739,554; 5,631,190; 5,604,135; 5,523,589; 5,416,342; 5,393,993; 5,359,345; 5,338,944; 5,210,051; 5,027,168; 5,027,168; 4,966,862; and 4,918,497; and U.S. Patent Application Publication Nos. 2014/0225511; 2014/0078715; 2013/0241392; 2009/0184616; 2009/0080185; 2009/0050908; 2009/0050907; 2008/0308825; 2008/0198112; 2008/0179611; 2008/0173884; 2008/0121921; 2008/0012036; 2007/0253209; 2007/0223219; 2007/0170447; 2007/0158668; 2007/0139923; and 2006/0221272.

Throughout this specification, the term "spectral power distribution" means: the emission spectrum of the one or more wavelengths of light emitted by a semiconductor light-emitting device. Throughout this specification, the term "peak wavelength" means: the wavelength where the spectral power distribution of a semiconductor light-emitting device reaches its maximum value as detected by a photo-detector. As an example, an LED may be a source of nearly monochromatic light and may appear to emit light having a single color. Thus, the spectral power distribution of the light emitted by such an LED may be centered about its peak wavelength. As examples, the "width" of the spectral power distribution of an LED may be within a range of between about 10 nanometers and about 30 nanometers, where the width is measured at half the maximum illumination on each side of the emission spectrum.

Throughout this specification, both of the terms "beam width" and "full-width-half-maximum" ("FWHM") mean: the measured angle, being collectively defined by two mutually-opposed angular directions away from a center emission direction of a visible-light beam, at which an intensity of the visible-light emissions is half of a maximum intensity measured at the center emission direction. Throughout this specification, in the case of a visible-light beam having a non-circular shape, e.g. a visible-light beam having an elliptical shape, then the terms "beam width" and "full-width-half-maximum" ("FWHM") mean: the measured maximum and minimum angles, being respectively defined in two mutually-orthogonal pairs of mutually-opposed angular directions away from a center emission direction of a visible-light beam, at which a respective intensity of the visible-light emissions is half of a corresponding maximum intensity measured at the center emission direction. Throughout this specification, the term "field angle" means: the measured angle, being collectively defined by two opposing angular directions away from a center emission direction of a visible-light beam, at which an intensity of the visible-light emissions is one-tenth of a maximum intensity measured at the center emission direction. Throughout this specification, in the case of a visible-light beam having a non-circular shape, e.g. a visible-light beam having an elliptical shape, then the term "field angle" means: the measured maximum and minimum angles, being respectively defined in two mutually-orthogonal pairs of mutually-opposed angular directions away from a center emission direction of a visible-light beam, at which a respective intensity of the visible-light emissions is one-tenth of a corresponding maximum intensity measured at the center emission direction.

Throughout this specification, the term "dominant wavelength" means: the wavelength of monochromatic light that has the same apparent color as the light emitted by a semiconductor light-emitting device, as perceived by the human eye. As an example, since the human eye perceives yellow and green light better than red and blue light, and because the light emitted by a semiconductor light-emitting device may extend across a range of wavelengths, the color perceived (i.e., the dominant wavelength) may differ from the peak wavelength.

Throughout this specification, the term "luminous flux", also referred to as "luminous power", means: the measure in lumens of the perceived power of light, being adjusted to reflect the varying sensitivity of the human eye to different wavelengths of light. Throughout this specification, the term "radiant flux" means: the measure of the total power of electromagnetic radiation without being so adjusted. Throughout this specification, the term "central axis" means a direction along which the light emissions of a semiconductor light-emitting device have a greatest radiant flux. It is understood throughout this specification that light emissions "along a central axis" means light emissions that: include light emissions in the direction of the central axis; and may further include light emissions in a plurality of other generally similar directions.

Throughout this specification, the term "color bin" means: the designated empirical spectral power distribution and related characteristics of a particular semiconductor light-emitting device. For example, individual light-emitting diodes (LEDs) are typically tested and assigned to a designated color bin (i.e., "binned") based on a variety of characteristics derived from their spectral power distribution. As an example, a particular LED may be binned based on the value of its peak wavelength, being a common metric to characterize the color aspect of the spectral power distribution of LEDs. Examples of other metrics that may be utilized to bin LEDs include: dominant wavelength; and color point.

Throughout this specification, the term "luminescent" means: characterized by absorption of electromagnetic radiation (e.g., visible-light, UV light or infrared light) causing the emission of light by, as examples: fluorescence; and phosphorescence.

Throughout this specification, the term "object" means a material article or device. Throughout this specification, the term "surface" means an exterior boundary of an object. Throughout this specification, the term "incident visible-light" means visible-light that propagates in one or more directions towards a surface. Throughout this specification, the term "any incident angle" means any one or more directions from which visible-light may propagate towards a surface. Throughout this specification, the term "reflective surface" means a surface of an object that causes incident visible-light, upon reaching the surface, to then propagate in one or more different directions away from the surface without passing through the object. Throughout this specification, the term "planar reflective surface" means a generally flat reflective surface.

Throughout this specification, the term "reflection value" means a percentage of a radiant flux of incident visible-light having a specified wavelength that is caused by a reflective surface of an object to propagate in one or more different directions away from the surface without passing through the object. Throughout this specification, the term "reflected light" means the incident visible-light that is caused by a reflective surface to propagate in one or more different directions away from the surface without passing through the object. Throughout this specification, the term "Lambertian reflection" means diffuse reflection of visible-light from a surface, in which the reflected light has uniform radiant flux in all of the propagation directions. Throughout this specification, the term "specular reflection" means mirror-like reflection of visible-light from a surface, in which light from a single incident direction is reflected into a single propagation direction. Throughout this specification, the term "spectrum of reflection values" means a spectrum of values of percentages of radiant flux of incident visible-light, the values corresponding to a spectrum of wavelength values of visible-light, that are caused by a reflective surface to propagate in one or more different directions away from the surface without passing through the object. Throughout this specification, the term "transmission value" means a percentage of a radiant flux of incident visible-light having a specified wavelength that is permitted by a reflective surface to pass through the object having the reflective surface. Throughout this specification, the term "transmitted light" means the incident visible-light that is permitted by a reflective surface to pass through the object having the reflective surface. Throughout this specification, the term "spectrum of transmission values" means a spectrum of values of percentages of radiant flux of incident visible-light, the values corresponding to a spectrum of wavelength values of visible-light, that are permitted by a surface to pass through the object having the surface. Throughout this specification, the term "absorption value" means a percentage of a radiant flux of incident visible-light having a specified wavelength that is permitted by a surface to pass through the surface and is absorbed by the object having the surface. Throughout this specification, the term "spectrum of absorption values" means a spectrum of values of percentages of radiant flux of incident visible-light, the values corresponding to a spectrum of wavelength values of visible-light, that are permitted by a surface to pass through the surface and are absorbed by the object having the surface. Throughout this specification, it is understood that a surface, or an object, may have a spectrum of reflection values, and a spectrum of transmission values, and a spectrum of absorption values. The spectra of reflection values, absorption values, and transmission values of a surface or of an object may be measured, for example, utilizing an ultraviolet-visible-near infrared (UV-VIS-NIR) spectrophotometer. Throughout this specification, the term "visible-light reflector" means an object having a reflective surface. In examples, a visible-light reflector may be selected as having a reflective surface characterized by light reflections that are more Lambertian than specular. Throughout this specification, the term "visible-light absorber" means an object having a visible-light-absorptive surface.

Throughout this specification, the term "lumiphor" means: a medium that includes one or more luminescent materials being positioned to absorb light that is emitted at a first spectral power distribution by a semiconductor light-emitting device, and to re-emit light at a second spectral power distribution in the visible or ultra violet spectrum being different than the first spectral power distribution, regardless of the delay between absorption and re-emission. Lumiphors may be categorized as being down-converting, i.e., a material that converts photons to a lower energy level (longer wavelength); or up-converting, i.e., a material that converts photons to a higher energy level (shorter wavelength). As examples, a luminescent material may include: a phosphor; a quantum dot; a quantum wire; a quantum well; a photonic nanocrystal; a semiconducting nanoparticle; a scintillator; a lumiphoric ink; a lumiphoric organic dye; a day glow tape; a phosphorescent material; or a fluorescent material. Throughout this specification, the term "quantum material" means any luminescent material that includes: a quantum dot; a quantum wire; or a quantum well. Some quantum materials may absorb and emit light at spectral power distributions having narrow wavelength ranges, for example, wavelength ranges having spectral widths being within ranges of between about 25 nanometers and about 50 nanometers. In examples, two or more different quantum materials may be included in a lumiphor, such that each of the quantum materials may have a spectral power distribution for light emissions that may not overlap with a spectral power distribution for light absorption of any of the one or more other quantum materials. In these examples, cross-absorption of light emissions among the quantum materials of the lumiphor may be minimized. As examples, a lumiphor may include one or more layers or bodies that may contain one or more luminescent materials that each may be: (1) coated or sprayed directly onto an semiconductor light-emitting device; (2) coated or sprayed onto surfaces of a lens or other elements of packaging for an semiconductor light-emitting device; (3) dispersed in a matrix medium; or (4) included within a clear encapsulant (e.g., an epoxy-based or silicone-based curable resin or glass or ceramic) that may be positioned on or over an semiconductor light-emitting device. A lumiphor may include one or multiple types of luminescent materials. Other materials may also be included with a lumiphor such as, for example, fillers, diffusants, colorants, or other materials that may as examples improve the performance of or reduce the overall cost of the lumiphor. In examples where multiple types of luminescent materials may be included in a lumiphor, such materials may, as examples, be mixed together in a single layer or deposited sequentially in successive layers.

Throughout this specification, the term "volumetric lumiphor" means a lumiphor being distributed in an object having a shape including defined exterior surfaces. In some examples, a volumetric lumiphor may be formed by dispersing a lumiphor in a volume of a matrix medium having suitable spectra of visible-light transmission values and visible-light absorption values. As examples, such spectra may be affected by a thickness of the volume of the matrix medium, and by a concentration of the lumiphor being distributed in the volume of the matrix medium. In examples, the matrix medium may have a composition that includes polymers or oligomers of: a polycarbonate; a silicone; an acrylic; a glass; a polystyrene; or a polyester such as polyethylene terephthalate. Throughout this specification, the term "remotely-located lumiphor" means a lumiphor being spaced apart at a distance from and positioned to receive light that is emitted by a semiconductor light-emitting device.

Throughout this specification, the term "light-scattering particles" means small particles formed of a non-luminescent, non-wavelength-converting material. In some examples, a volumetric lumiphor may include light-scattering particles being dispersed in the volume of the matrix medium for causing some of the light emissions having the first spectral power distribution to be scattered within the volumetric lumiphor. As an example, causing some of the light emissions to be so scattered within the matrix medium may cause the luminescent materials in the volumetric lumiphor to absorb more of the light emissions having the first spectral power distribution. In examples, the light-scattering particles may include: rutile titanium dioxide; anatase titanium dioxide; barium sulfate; diamond; alumina; magnesium oxide; calcium titanate; barium titanate; strontium titanate; or barium strontium titanate. In examples, light-scattering particles may have particle sizes being within a range of about 0.01 micron (10 nanometers) and about 2.0 microns (2,000 nanometers).

In some examples, a visible-light reflector may be formed by dispersing light-scattering particles having a first index of refraction in a volume of a matrix medium having a second index of refraction being suitably different from the first index of refraction for causing the volume of the matrix medium with the dispersed light-scattering particles to have suitable spectra of reflection values, transmission values, and absorption values for functioning as a visible-light reflector. As examples, such spectra may be affected by a thickness of the volume of the matrix medium, and by a concentration of the light-scattering particles being distributed in the volume of the matrix medium, and by physical characteristics of the light-scattering particles such as the particle sizes and shapes, and smoothness or roughness of exterior surfaces of the particles. In an example, the smaller the difference between the first and second indices of refraction, the more light-scattering particles may need to be dispersed in the volume of the matrix medium to achieve a given amount of light-scattering. As examples, the matrix medium for forming a visible-light reflector may have a composition that includes polymers or oligomers of: a polycarbonate; a silicone; an acrylic; a glass; a polystyrene; or a polyester such as polyethylene terephthalate. In further examples, the light-scattering particles may include: rutile titanium dioxide; anatase titanium dioxide; barium sulfate; diamond; alumina; magnesium oxide; calcium titanate; barium titanate; strontium titanate; or barium strontium titanate. In other examples, a visible-light reflector may include a reflective polymeric or metallized surface formed on a visible-light-transmissive polymeric or metallic object such as, for example, a volume of a matrix medium. Additional examples of visible-light reflectors may include microcellular foamed polyethylene terephthalate sheets ("MCPET"). Suitable visible-light reflectors may be commercially available under the trade names White Optics® and MIRO® from WhiteOptics LLC, 243-G Quigley Blvd., New Castle, Del. 19720 USA. Suitable MCPET visible-light reflectors may be commercially available from the Furukawa Electric Co., Ltd., Foamed Products Division, Tokyo, Japan. Additional suitable visible-light reflectors may be commercially available from CVI Laser Optics, 200 Dorado Place SE, Albuquerque, N.M. 87123 USA.

In further examples, a volumetric lumiphor and a visible-light reflector may be integrally formed. As examples, a volumetric lumiphor and a visible-light reflector may be integrally formed in respective layers of a volume of a matrix medium, including a layer of the matrix medium having a dispersed lumiphor, and including another layer of the same or a different matrix medium having light-scattering particles being suitably dispersed for causing the another layer to have suitable spectra of reflection values, transmission values, and absorption values for functioning as the visible-light reflector. In other examples, an integrally-formed volumetric lumiphor and visible-light reflector may incorporate any of the further examples of variations discussed above as to separately-formed volumetric lumiphors and visible-light reflectors.

Throughout this specification, the term "phosphor" means: a material that exhibits luminescence when struck by photons. Examples of phosphors that may utilized include: $CaAlSiN_3$:Eu, $SrAlSiN_3$:Eu, $CaAlSiN_3$:Eu, $Ba_3Si_6O_{12}N_2$:Eu, $Ba_2SiO_4$:Eu, $Sr_2SiO_4$:Eu, $Ca_2SiO_4$:Eu, $Ca_3Sc_2Si_3O_{12}$:Ce, $Ca_3Mg_2Si_3O_{12}$:Ce, $CaSc_2O_4$:Ce, $CaSi_2O_2N_2$:Eu, $SrSi_2O_2N_2$:Eu, $BaSi_2O_2N_2$:Eu, $Ca_5(PO_4)_3Cl$:Eu, $Ba_5(PO_4)_3Cl$:Eu, $Cs_2CaP_2O_7$, $Cs_2SrP_2O_7$, $SrGa_2S_4$:Eu, $Lu_3Al_5O_{12}$:Ce, $Ca_8Mg(SiO_4)_4Cl_2$:Eu, $Sr_8Mg(SiO_4)_4Cl_2$:Eu, $La_3Si_6N_{11}$:Ce, $Y_3Al_5O_{12}$:Ce, $Y_3Ga_5O_{12}$:Ce, $Gd_3Al_5O_{12}$:Ce, $Gd_3Ga_5O_{12}$:Ce, $Tb_3Al_5O_{12}$:Ce, $Tb_3Ga_5O_{12}$:Ce, $Lu_3Ga_5O_{12}$:Ce, (SrCa)$AlSiN_3$:Eu, LuAG:Ce, $(Y,Gd)_2Al_5)_{12}$:Ce, CaS:Eu, SrS:Eu, $SrGa_2S_4$:$E_4$, $Ca_2(Sc,Mg)_2SiO_{12}$:Ce, $Ca_2Sc_2Si_2)_{12}$:C2, $Ca_2Sc_2O_4$:Ce, $Ba_2Si_6O_{12}N_2$:Eu, (Sr,Ca)$AlSiN_2$:Eu, and $CaAlSiN_2$:Eu.

Throughout this specification, the term "quantum dot" means: a nanocrystal made of semiconductor materials that are small enough to exhibit quantum mechanical properties, such that its excitons are confined in all three spatial dimensions.

Throughout this specification, the term "quantum wire" means: an electrically conducting wire in which quantum effects influence the transport properties.

Throughout this specification, the term "quantum well" means: a thin layer that can confine (quasi-)particles (typically electrons or holes) in the dimension perpendicular to the layer surface, whereas the movement in the other dimensions is not restricted.

Throughout this specification, the term "photonic nanocrystal" means: a periodic optical nanostructure that affects the motion of photons, for one, two, or three dimensions, in much the same way that ionic lattices affect electrons in solids.

Throughout this specification, the term "semiconducting nanoparticle" means: a particle having a dimension within a range of between about 1 nanometer and about 100 nanometers, being formed of a semiconductor.

Throughout this specification, the term "scintillator" means: a material that fluoresces when struck by photons.

Throughout this specification, the term "lumiphoric ink" means: a liquid composition containing a luminescent material. For example, a lumiphoric ink composition may contain semiconductor nanoparticles. Examples of lumiphoric ink compositions that may be utilized are disclosed in Cao et al., U.S. Patent Application Publication No. 20130221489 published on Aug. 29, 2013, the entirety of which hereby is incorporated herein by reference.

Throughout this specification, the term "lumiphoric organic dye" means an organic dye having luminescent up-converting or down-converting activity. As an example, some perylene-based dyes may be suitable.

Throughout this specification, the term "day glow tape" means: a tape material containing a luminescent material.

Throughout this specification, the term "CIE 1931 XY chromaticity diagram" means: the 1931 International Commission on Illumination two-dimensional chromaticity diagram, which defines the spectrum of perceived color points of visible-light by (x, y) pairs of chromaticity coordinates that fall within a generally U-shaped area that includes all of the hues perceived by the human eye. Each of the x and y axes of the CIE 1931 XY chromaticity diagram has a scale of between 0.0 and 0.8. The spectral colors are distributed around the perimeter boundary of the chromaticity diagram, the boundary encompassing all of the hues perceived by the human eye. The perimeter boundary itself represents maximum saturation for the spectral colors. The CIE 1931 XY chromaticity diagram is based on the three-dimensional CIE 1931 XYZ color space. The CIE 1931 XYZ color space utilizes three color matching functions to determine three corresponding tristimulus values which together express a given color point within the CIE 1931 XYZ three-dimensional color space. The CIE 1931 XY chromaticity diagram is a projection of the three-dimensional CIE 1931 XYZ color space onto a two-dimensional (x, y) space such that brightness is ignored. A technical description of the CIE 1931 XY chromaticity diagram is provided in, for example, the "Encyclopedia of Physical Science and Technology", vol. 7, pp. 230-231 (Robert A Meyers ed., 1987); the entirety of which hereby is incorporated herein by reference. Further background information regarding the CIE 1931 XY chromaticity diagram is provided in Harbers et al., U.S. Patent Application Publication No. 2012/0224177A1 published on Sep. 6, 2012, the entirety of which hereby is incorporated herein by reference.

Throughout this specification, the term "color point" means: an (x, y) pair of chromaticity coordinates falling within the CIE 1931 XY chromaticity diagram. Color points located at or near the perimeter boundary of the CIE 1931 XY chromaticity diagram are saturated colors composed of light having a single wavelength, or having a very small spectral power distribution. Color points away from the perimeter boundary within the interior of the CIE 1931 XY chromaticity diagram are unsaturated colors that are composed of a mixture of different wavelengths.

Throughout this specification, the term "combined light emissions" means: a plurality of different light emissions that are mixed together. Throughout this specification, the term "combined color point" means: the color point, as perceived by human eyesight, of combined light emissions. Throughout this specification, a "substantially constant" combined color points are: color points of combined light emissions that are perceived by human eyesight as being uniform, i.e., as being of the same color.

Throughout this specification, the term "Planckian-black-body locus" means the curve within the CIE 1931 XY chromaticity diagram that plots the chromaticity coordinates (i.e., color points) that obey Planck's equation: $E(\lambda)=A\lambda-5/(eB/T-1)$, where E is the emission intensity, X is the emission wavelength, T is the color temperature in degrees Kelvin of a black-body radiator, and A and B are constants. The Planckian-black-body locus corresponds to the locations of color points of light emitted by a black-body radiator that is heated to various temperatures. As a black-body radiator is gradually heated, it becomes an incandescent light emitter (being referred to throughout this specification as an "incandescent light emitter") and first emits reddish light, then yellowish light, and finally bluish light with increasing temperatures. This incandescent glowing occurs because the wavelength associated with the peak radiation of the black-body radiator becomes progressively shorter with gradually increasing temperatures, consistent with the Wien Displacement Law. The CIE 1931 XY chromaticity diagram further includes a series of lines each having a designated corresponding temperature listing in units of degrees Kelvin spaced apart along the Planckian-black-body locus and corresponding to the color points of the incandescent light emitted by a black-body radiator having the designated temperatures. Throughout this specification, such a temperature listing is referred to as a "correlated color temperature" (herein also referred to as the "CCT") of the corresponding color point. Correlated color temperatures are expressed herein in units of degrees Kelvin (K). Throughout this specification, each of the lines having a designated temperature listing is referred to as an "isotherm" of the corresponding correlated color temperature.

Throughout this specification, the term "chromaticity bin" means: a bounded region within the CIE 1931 XY chromaticity diagram. As an example, a chromaticity bin may be defined by a series of chromaticity (x,y) coordinates, being connected in series by lines that together form the bounded region. As another example, a chromaticity bin may be defined by several lines or other boundaries that together form the bounded region, such as: one or more isotherms of CCT's; and one or more portions of the perimeter boundary of the CIE 1931 chromaticity diagram.

Throughout this specification, the term "delta(uv)" means: the shortest distance of a given color point away from (i.e., above or below) the Planckian-black-body locus. In general, color points located at a delta(uv) of about equal to or less than 0.015 may be assigned a correlated color temperature (CCT).

Throughout this specification, the term "greenish-blue light" means: light having a perceived color point being within a range of between about 490 nanometers and about 482 nanometers (herein referred to as a "greenish-blue color point.").

Throughout this specification, the term "blue light" means: light having a perceived color point being within a range of between about 482 nanometers and about 470 nanometers (herein referred to as a "blue color point.").

Throughout this specification, the term "purplish-blue light" means: light having a perceived color point being within a range of between about 470 nanometers and about 380 nanometers (herein referred to as a "purplish-blue color point.").

Throughout this specification, the term "reddish-orange light" means: light having a perceived color point being within a range of between about 610 nanometers and about 620 nanometers (herein referred to as a "reddish-orange color point.").

Throughout this specification, the term "red light" means: light having a perceived color point being within a range of between about 620 nanometers and about 640 nanometers (herein referred to as a "red color point.").

Throughout this specification, the term "deep red light" means: light having a perceived color point being within a range of between about 640 nanometers and about 670 nanometers (herein referred to as a "deep red color point.").

Throughout this specification, the term "visible-light" means light having one or more wavelengths being within a range of between about 380 nanometers and about 670 nanometers; and "visible-light spectrum" means the range of wavelengths of between about 380 nanometers and about 670 nanometers.

Throughout this specification, the term "white light" means: light having a color point located at a delta(uv) of about equal to or less than 0.006 and having a CCT being within a range of between about 10000K and about 1800K (herein referred to as a "white color point."). Many different hues of light may be perceived as being "white." For example, some "white" light, such as light generated by a tungsten filament incandescent lighting device, may appear yellowish in color, while other "white" light, such as light generated by some fluorescent lighting devices, may appear more bluish in color. As examples, white light having a CCT of about 3000K may appear yellowish in color, while white light having a CCT of about equal to or greater than 8000K may appear more bluish in color and may be referred to as "cool" white light. Further, white light having a CCT of between about 2500K and about 4500K may appear reddish or yellowish in color and may be referred to as "warm" white light. "White light" includes light having a spectral power distribution of wavelengths including red, green and blue color points. In an example, a CCT of a lumiphor may be tuned by selecting one or more particular luminescent materials to be included in the lumiphor. For example, light emissions from a semiconductor light-emitting device that includes three separate emitters respectively having red, green and blue color points with an appropriate spectral power distribution may have a white color point. As another example, light perceived as being "white" may be produced by mixing light emissions from a semiconductor light-emitting device having a blue, greenish-blue or purplish-blue color point together with light emissions having a yellow color point being produced by passing some of the light emissions having the blue, greenish-blue or purplish-blue color point through a lumiphor to down-convert them into light emissions having the yellow color point. General background information on systems and processes for generating light perceived as being "white" is provided in "Class A Color Designation for Light Sources Used in General Illumination", Freyssinier and Rea, *J. Light & Vis. Env.*, Vol. 37, No. 2 & 3 (Nov. 7, 2013, Illuminating Engineering Institute of Japan), pp. 10-14; the entirety of which hereby is incorporated herein by reference.

Throughout this specification, the term "color rendition index" (herein also referred to as "CRT-Ra") means: the quantitative measure on a scale of 1-100 of the capability of a given light source to accurately reveal the colors of one or more objects having designated reference colors, in comparison with the capability of a black-body radiator to accurately reveal such colors. The CRI-Ra of a given light source is a modified average of the relative measurements of color renditions by that light source, as compared with color renditions by a reference black-body radiator, when illuminating objects having the designated reference color(s). The CRT is a relative measure of the shift in perceived surface color of an object when illuminated by a particular light source versus a reference black-body radiator. The CRI-Ra will equal 100 if the color coordinates of a set of test colors being illuminated by the given light source are the same as the color coordinates of the same set of test colors being irradiated by the black-body radiator. The CRT system is administered by the International Commission on Illumination (CIE). The CIE selected fifteen test color samples (respectively designated as $R_{1-15}$) to grade the color properties of a white light source. The first eight test color samples (respectively designated as $R_{1-8}$) are relatively low saturated colors and are evenly distributed over the complete range of hues. These eight samples are employed to calculate the general color rendering index Ra. The general color rendering index Ra is simply calculated as the average of the first eight color rendering index values, $R_{1-8}$. An additional seven samples (respectively designated as $R_{9-15}$) provide supplementary information about the color rendering properties of a light source; the first four of them focus on high saturation, and the last three of them are representative of well-known objects. A set of color rendering index values, $R_{1-15}$, can be calculated for a particular correlated color temperature (CCT) by comparing the spectral response of a light source against that of each test color sample, respectively. As another example, the CRI-Ra may consist of one test color, such as the designated red color of $R_9$.

As examples, sunlight generally has a CRI-Ra of about 100; incandescent light bulbs generally have a CRI-Ra of about 95; fluorescent lights generally have a CRI-Ra of about 70 to 85; and monochromatic light sources generally have a CRI-Ra of about zero. As an example, a light source for general illumination applications where accurate rendition of object colors may not be considered important may generally need to have a CRI-Ra value being within a range of between about 70 and about 80. Further, for example, a light source for general interior illumination applications may generally need to have a CRI-Ra value being at least about 80. As an additional example, a light source for general illumination applications where objects illuminated by the lighting device may be considered to need to appear to have natural coloring to the human eye may generally need to have a CRI-Ra value being at least about 85. Further, for example, a light source for general illumination applications where good rendition of perceived object colors may be considered important may generally need to have a CRI-Ra value being at least about 90.

Throughout this specification, the term "in contact with" means: that a first object, being "in contact with" a second object, is in either direct or indirect contact with the second object. Throughout this specification, the term "in indirect contact with" means: that the first object is not in direct contact with the second object, but instead that there are a plurality of objects (including the first and second objects), and each of the plurality of objects is in direct contact with at least one other of the plurality of objects (e.g., the first and second objects are in a stack and are separated by one or more intervening layers). Throughout this specification, the term "in direct contact with" means: that the first object, which is "in direct contact" with a second object, is touching the second object and there are no intervening objects between at least portions of both the first and second objects.

Throughout this specification, the term "spectrophotometer" means: an apparatus that can measure a light beam's intensity as a function of its wavelength and calculate its total luminous flux.

Throughout this specification, the term "integrating sphere-spectrophotometer" means: a spectrophotometer operationally connected with an integrating sphere. An integrating sphere (also known as an Ulbricht sphere) is an optical component having a hollow spherical cavity with its interior covered with a diffuse white reflective coating, with small holes for entrance and exit ports. Its relevant property is a uniform scattering or diffusing effect. Light rays incident on any point on the inner surface are, by multiple scattering reflections, distributed equally to all other points. The effects of the original direction of light are minimized. An integrating sphere may be thought of as a diffuser which preserves power but destroys spatial information. Another type of integrating sphere that can be utilized is referred to as a focusing or Coblentz sphere. A Coblentz sphere has a mirror-like (specular) inner surface rather than a diffuse inner surface. Light scattered by the interior of an integrating sphere is evenly distributed over all angles. The total power (radiant flux) of a light source can then be measured without inaccuracy caused by the directional characteristics of the source. Background information on integrating sphere-spectrophotometer apparatus is provided in Liu et al., U.S. Pat. No. 7,532,324 issued on May 12, 2009, the entirety of which hereby is incorporated herein by reference. It is understood throughout this specification that color points may be measured, for example, by utilizing a spectrophotometer, such as an integrating sphere-spectrophotometer. The spectra of reflection values, absorption values, and transmission values of a reflective surface or of an object may be measured, for example, utilizing an ultraviolet-visible-near infrared (UV-VIS-NIR) spectrophotometer.

Throughout this specification, the term "diffuse refraction" means refraction from an object's surface that scatters the visible-light emissions, casting multiple jittered light rays forming combined light emissions having a combined color point.

Throughout this specification, each of the words "include", "contain", and "have" is interpreted broadly as being open to the addition of further like elements as well as to the addition of unlike elements.

Figure 2:
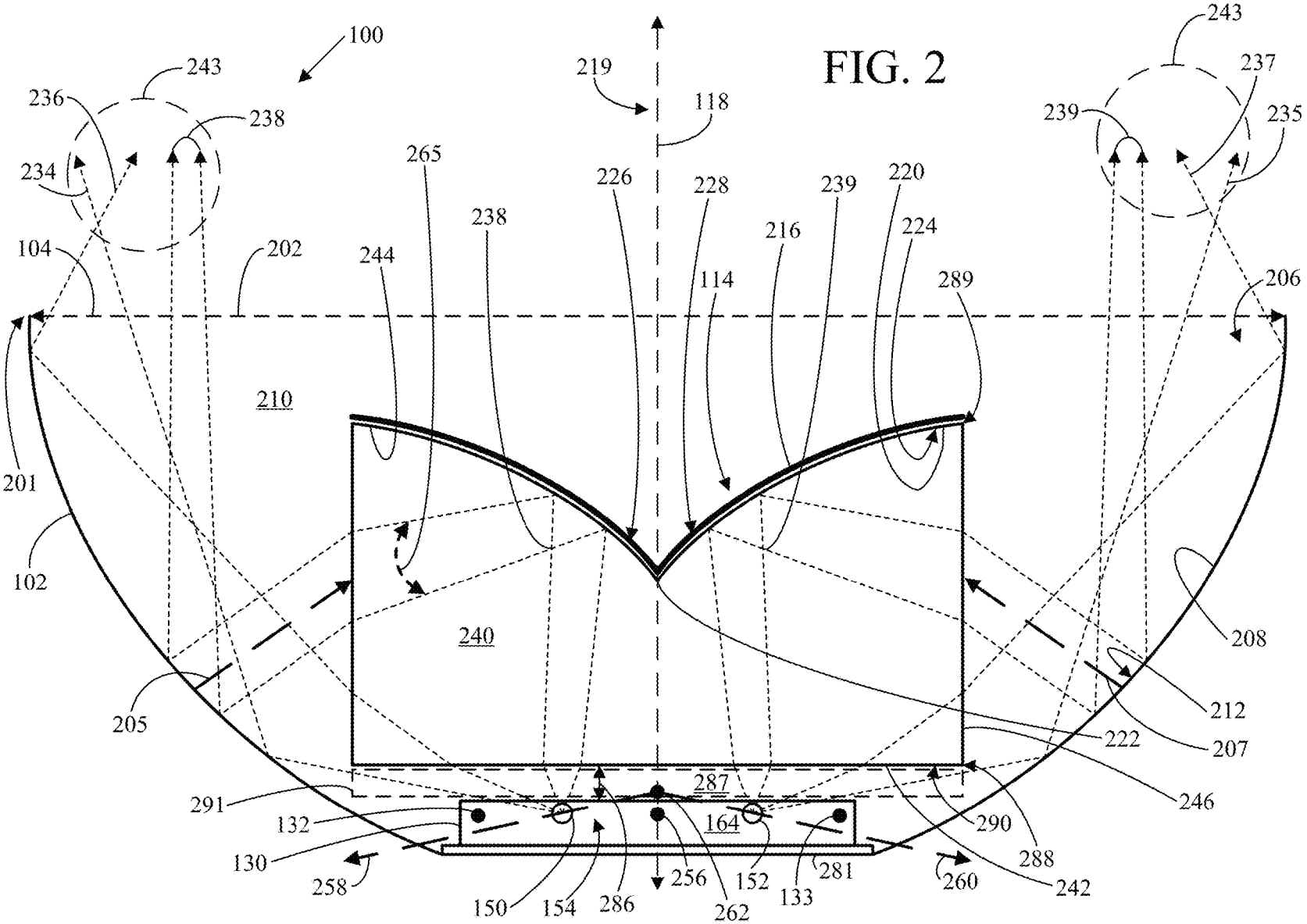
FIG. 2 is a schematic cross-sectional view taken along the line 2-2 showing the example of the lighting system.

FIG. 1 is a schematic top view showing an example [100] of an implementation of a lighting system. FIG. 2 is a schematic cross-sectional view taken along the line 2-2 showing the example [100] of the lighting system. Another example [300] of an implementation of the lighting system will subsequently be discussed in connection with FIGS. 3-4. An additional example [500] of an alternative optically-transparent body that may be included in the examples [100], [300] of the lighting system will be discussed in connection with FIGS. 5-6; and an additional example [700] of another alternative optically-transparent body that may be included in the examples [100], [300] of the lighting system will be discussed in connection with FIGS. 7-8. An additional example [900] of an alternative bowl reflector that may be included in the examples [100], [300] of the lighting system will be discussed in connection with FIGS. 9-11; and an additional example [1200] of another alternative bowl reflector that may be included in the examples [100], [300] of the lighting system will be discussed in connection with FIGS. 12-14; a further example [1500] of another alternative bowl reflector that may be included in the examples [100], [300] of the lighting system will be discussed in connection with FIGS. 15-17; yet another example [1800] of another alternative bowl reflector that may be included in the examples [100], [300] of the lighting system will be discussed in connection with FIGS. 18-19; and yet a further example [2000] of another alternative bowl reflector that may be included in the examples [100], [300] of the lighting system will be discussed in connection with FIGS. 20-21.

It is understood throughout this specification that the example [100] of an implementation of the lighting system may be modified as including any of the features or combinations of features that are disclosed in connection with: the another example [300] of an implementation of the lighting system; or the examples [500], [700] of alternative optically-transparent bodies; or the additional examples [900], [1200], [1500], [1800], [2000] of alternative bowl reflectors. Accordingly, FIGS. 3-21 and the entireties of the subsequent discussions of the examples [300], [500], [700], [900], [1200], [1500], [1800] and [2000] of implementations of the lighting system are hereby incorporated into the following discussion of the example [100] of an implementation of the lighting system. Further, FIGS. 22-49 collectively show an example [2200] of a lighting assembly that includes a bowl reflector, an optically-transparent body, and a funnel reflector, that may be substituted for such elements in the examples [100], [300] of the lighting system. FIGS. 50-62 collectively show an example [5000] of a combination of an optically-transparent body, and a reflector or absorber, that may respectively be substituted for the optically-transparent body and the funnel reflector in the examples [100], [300] of the lighting system. FIGS. 63-70 collectively show an example [6300] of a combination of an optically-transparent body, and a reflector or absorber, that may respectively be substituted for the optically-transparent body and the funnel reflector in the examples [100], [300] of the lighting system. Accordingly, FIGS. 22-70 and the entireties of the subsequent discussions of the examples [2200], [5000] and [6300] are hereby incorporated into the following discussion of the example [100] of an implementation of the lighting system. FIGS. 71-75 collectively show a further example [7100] of a lighting system that includes an optically-transparent body and a central reflector that may respectively be substituted for the optically-transparent body and the funnel reflector in the examples [100], [300] of the lighting system. Accordingly, FIGS. 71-75 and the entireties of the subsequent discussions of the example [7100] of the lighting system are hereby incorporated into the following discussion of the example [100] of an implementation of the lighting system.

As shown in FIGS. 1 and 2, the example [100] of the implementation of the lighting system includes a bowl reflector [102] having a rim [201] defining a horizon [104] and defining an emission aperture [206], the bowl reflector [102] having a first visible-light-reflective surface [208] defining a portion of a cavity [210], a portion of the first visible-light-reflective surface [208] being a first light-reflective parabolic surface [212]. The example [100] of the implementation of the lighting system further includes a funnel reflector [114] having a flared funnel-shaped body [216], the funnel-shaped body [216] having a central axis [118] and having a second visible-light-reflective surface [220] being aligned along the central axis [118]. In examples [100] of the lighting system, the schematic cross-sectional view shown in FIG. 2 is taken along the line 2-2 as shown in FIG. 1, in a direction being orthogonal to and having an indicated orientation around the central axis [118]. In examples [100] of the lighting system, the same schematic cross-sectional view that is shown in FIG. 2 may alternatively be taken, as shown in FIG. 1, along the line 2A-2A or along the line 2B-2B, or along another direction being orthogonal to and having another orientation around the central axis [118]. In the example [100] of the lighting system, the funnel-shaped body [216] also has a tip [222] being located within the cavity [210] along the central axis [118]. In addition, in the example [100] of the lighting system, a portion of the second visible-light-reflective surface [220] is a second light-reflective parabolic surface [224], having a cross-sectional profile defined in directions along the central axis [118] that includes two parabolic curves [226], [228] that converge towards the tip [222] of the funnel-shaped body [216]. The example [100] of the lighting system additionally includes a visible-light source being schematically-represented by a dashed line [130] and including a semiconductor light-emitting device schematically-represented by a dot [132]. In the example [100] of the lighting system, the visible-light source [130] is configured for generating visible-light emissions [234], [236], [238] from the semiconductor light-emitting device [132]. The example [100] of the lighting system further includes an optically-transparent body [240] being aligned with the second visible-light-reflective surface [220] along the central axis [118]. In the example [100] of the lighting system, the optically-transparent body [240] has a first base [242] being spaced apart along the central axis [118] from a second base [244], and a side surface [246] extending between the bases [242], [244]; and the first base [242] faces toward the visible-light source [130]. Further in the example [100] of the lighting system, the second light-reflective parabolic surface [224] has a ring [148] of focal points including focal points [150], [152], the ring [148] being located at a first position [154] within the cavity [210]. In the example [100] of the lighting system, each one of the focal points [150], [152] is equidistant from the second light-reflective parabolic surface [224]; and the ring [148] encircles a first point [256] on the central axis [118]. Additionally in the example [100] of the lighting system, the second light-reflective parabolic surface [224] has an array of axes of symmetry being schematically-represented by arrows [258], [260] intersecting with and radiating in directions all around the central axis [118] from a second point [262] on the central axis [118]. In the example [100] of the lighting system, each one of the axes of symmetry [258], [260] intersects with a corresponding one of the focal points [150], [152] of the ring [148]; and the second point [262] on the central axis [118] is located between the first point [256] and the horizon [104] of the bowl reflector [102]. Further in the example [100] of the lighting system, the visible-light source [130] is within the cavity [210] at a second position [164] being located, relative to the first position [154] of the ring [148] of focal points [150], [152], for causing some of the visible-light emissions [238] to be reflected by the second light-reflective parabolic surface [224] as having a partially-collimated distribution being represented by an arrow [265].

In some examples [100] of the lighting system, the visible-light source [130] may include a plurality of semiconductor light-emitting devices schematically-represented by dots [132], [133] configured for respectively generating visible-light emissions [234], [236], [238] and [235], [237], [239]. Further, for example, the visible-light source [130] of the example [100] of the lighting system may include a plurality of semiconductor light-emitting devices [132], [133] being arranged in an array schematically represented by a dotted ring [166]. As examples of an array [166] in the example [100] of the lighting system, a plurality of semiconductor light-emitting devices [132], [133] may be arranged in a chip-on-board (not shown) array [166], or in a discrete (not shown) array [166] of the semiconductor light-emitting devices [132], [133] on a printed circuit board (not shown). Semiconductor light-emitting device arrays [166] including chip-on-board arrays and discrete arrays may be conventionally fabricated by persons of ordinary skill in the art. Further, the semiconductor light-emitting devices [132], [133], [166] of the example [100] of the lighting system may be provided with drivers (not shown) and power supplies (not shown) being conventionally fabricated and configured by persons of ordinary skill in the art.

In further examples [100] of the lighting system, the visible-light source [130] may include additional semiconductor light-emitting devices schematically-represented by the dots [166] being co-located together with each of the plurality of semiconductor light-emitting devices [132], [133], so that each of the co-located pluralities of the semiconductor light-emitting devices [166] may be configured for collectively generating the visible-light emissions [234]-[239] as having a selectable perceived color. For example, in additional examples [100] of the lighting system, each of the plurality of semiconductor light-emitting devices [132], [133] may include two or three or more co-located semiconductor light-emitting devices [166] being configured for collectively generating the visible-light emissions [234]-[239] as having a selectable perceived color. As additional examples [100], the lighting system may include a controller (not shown) for the visible-light source [130], and the controller may be configured for causing the visible-light emissions [234]-[239] to have a selectable perceived color.

In additional examples [100] of the lighting system, the ring [148] of focal points [150], [152] may have a ring radius [168], and the semiconductor light-emitting device [132] or each one of the plurality of semiconductor light-emitting devices [132], [133], [166] may be located, as examples: within a distance of or closer than about twice the ring radius [168] away from the ring [148]; or within a distance of or closer than about one-half of the ring radius [168] away from the ring [148]. In other examples [100] of the lighting system, one or a plurality of semiconductor light-emitting devices [132], [133], [166] may be located at a one of the focal points [150], [152]. As further examples [100] of the lighting system, the ring [148] of focal points [150], [152] may define a space [169] being encircled by the ring [148]; and a one or a plurality of semiconductor light-emitting devices [132], [133], [166] may be at an example of a location [170] intersecting the space [169]. In additional examples [100] of the lighting system, a one or a plurality of the focal points [150], [152] may be within the second position [164] of the visible-light source [130]. As other examples [100] of the lighting system, the second position [164] of the visible-light source [130] may intersect with a one of the axes of symmetry [258], [260] of the second light-reflective parabolic surface [224].

In other examples [100] of the lighting system, the visible-light source [130] may be at the second position [164] being located, relative to the first position [154] of the ring [148] of focal points [150], [152], for causing some of the visible-light emissions [238]-[239] to be reflected by the second light-reflective parabolic surface [224] in the partially-collimated beam [265] being shaped as a ray fan of the visible-light emissions [238], [239]. As examples [100] of the lighting system, the ray fan [265] may expand, upon reflection of the visible-light emissions [238]-[239] away from the second visible-light-reflective surface [224], by a fan angle defined in directions represented by the arrow [265], having an average fan angle value being no greater than about forty-five degrees. Further in those examples [100] of the lighting system, the ring [148] of focal points [150], [152] may have the ring radius [168], and each one of a plurality of semiconductor light-emitting devices [132], [133], [166] may be located within a distance of or closer than about twice the ring radius [168] away from the ring [148].

In some examples [100] of the lighting system, the visible-light source [130] may be at the second position [164] being located, relative to the first position [154] of the ring [148] of focal points [150], [152], for causing some of the visible-light emissions [238]-[239] to be reflected by the second light-reflective parabolic surface [224] as a substantially-collimated beam [265] being shaped as a ray fan [265] of the visible-light emissions [238], [239]. As examples [100] of the lighting system, the ray fan [265] may expand, upon reflection of the visible-light emissions [238]-[239] away from the second visible-light-reflective surface [224], by a fan angle defined in directions represented by the arrow [265], having an average fan angle value being no greater than about twenty-five degrees. Additionally in those examples [100] of the lighting system, the ring [148] of focal points [150], [152] may have the ring radius [168], and each one of a plurality of semiconductor light-emitting devices [132], [133], [166] may be located within a distance of or closer than about one-half the ring radius [168] away from the ring [148].

In further examples [100] of the lighting system, the visible-light source [130] may be located at the second position [164] as being at a minimized distance away from the first position [154] of the ring [148] of focal points [150], [152]. In those examples [100] of the lighting system, minimizing the distance between the first position [154] of the ring [148] and the second position [164] of the visible-light source [130] may cause some of the visible-light emissions [238]-[239] to be reflected by the second light-reflective parabolic surface [224] as a generally-collimated beam [265] being shaped as a ray fan [265] of the visible-light emissions [238], [239] expanding by a minimized fan angle defined in directions represented by the arrow [265] upon reflection of the visible-light emissions [238]-[239] away from the second visible-light-reflective surface [224]. In additional examples [100] of the lighting system, the first position [154] of the ring [148] of focal points [150], [152] may be within the second position [164] of the visible-light source [130].

In additional examples [100], the lighting system may include another surface [281] defining another portion of the cavity [210], and the visible-light source [130] may be located on the another surface [281] of the lighting system [100]. Further in those examples [100] of the lighting system, a plurality of semiconductor light-emitting devices [132], [133], [166] may be arranged in an emitter array [183] being on the another surface [281]. Also in those examples [100] of the lighting system: the emitter array [183] may have a maximum diameter represented by an arrow [184] defined in directions being orthogonal to the central axis [118]; and the funnel reflector [114] may have another maximum diameter represented by an arrow [185] defined in additional directions being orthogonal to the central axis [118]; and the another maximum diameter [185] of the funnel reflector [114] may be at least about 10% greater than the maximum diameter [184] of the emitter array [183]. Additionally in those examples [100] of the lighting system: the ring [148] of focal points [150], [152] may have a maximum ring diameter represented by an arrow [182] defined in further directions being orthogonal to the central axis [118]; and the another maximum diameter [185] of the funnel reflector [114] may be about 10% greater than the maximum diameter [184] of the emitter array [183]; and the maximum ring diameter [182] may be about half of the maximum diameter [184] of the emitter array [183]. Further in those examples [100] of the lighting system, the rim [201] of the bowl reflector [102] may define the horizon [104] as having a diameter [202]. As an example [100] of the lighting system, the ring [148] of focal points [150], [152] may have a uniform diameter [182] of about 6.5 millimeters; and the emitter array [183] may have a maximum diameter [184] of about 13 millimeters; and the funnel reflector [114] may have another maximum diameter [185] of about 14.5 millimeters; and the bowl reflector [102] may have a uniform diameter [203] at the horizon [104] of about 50 millimeters.

In examples [100] of the lighting system, the second position [164] of the visible-light source [130] may be a small distance represented by an arrow [286] away from the first base [242] of the optically-transparent body [240]. In some of those examples [100] of the lighting system, the small distance [286] may be less than or equal to about one (1) millimeter. As examples [100] of the lighting system, minimizing the distance [286] between the second position [164] of the visible-light source [130] and the first base [242] of the optically-transparent body [240] may cause relatively more of the visible-light emissions [236]-[239] from the semiconductor light-emitting device(s) [132], [133], [166] to enter into the optically-transparent body [240], and may cause relatively less of the visible-light emissions [234]-[235] from the semiconductor light-emitting device(s) [132], [133], [166] to bypass the optically-transparent body [240]. Further in those examples [100] of the lighting system, causing relatively more of the visible-light emissions [236]-[239] from the semiconductor light-emitting device(s) [132], [133], [166] to enter into the optically-transparent body [240] and causing relatively less of the visible-light emissions [234]-[235] from the semiconductor light-emitting device(s) [132], [133], [166] to bypass the optically-transparent body [240] may result in more of the visible-light emissions [238], [239] being reflected by the second light-reflective parabolic surface [224] as having a partially-collimated, substantially-collimated, or generally-collimated distribution [265]. Additionally in those examples [100] of the lighting system, a space [287] occupying the small distance [286] may be filled with an ambient atmosphere, e.g., air.

In further examples [100] of the lighting system, the side surface [246] of the optically-transparent body [240] may have a generally-cylindrical shape. In other examples (not shown) the side surface [246] of the optically-transparent body [240] may have a concave (hyperbolic)-cylindrical shape or a convex-cylindrical shape. In some of those examples [100] of the lighting system, the first and second bases [242], [244] of the optically-transparent body [240] may respectively have circular perimeters [288], [289] and the optically-transparent body [240] may generally have a circular-cylindrical shape. As additional examples [100] of the lighting system, the first base [242] of the optically-transparent body [240] may have a generally-planar surface [290]. In further examples [100] of the lighting system (not shown), the first base [242] of the optically-transparent body [240] may have a non-planar surface, such as, for example, a convex surface, a concave surface, a surface including both concave and convex portions, or an otherwise roughened or irregular surface.

In further examples [100] of the lighting system, the optically-transparent body [240] may have a spectrum of transmission values of visible-light having an average value being at least about ninety percent (90%). In additional examples [100] of the lighting system, the optically-transparent body [240] may have a spectrum of transmission values of visible-light having an average value being at least about ninety-five percent (95%). As some examples [100] of the lighting system, the optically-transparent body [240] may have a spectrum of absorption values of visible-light having an average value being no greater than about ten percent (10%). As further examples [100] of the lighting system, the optically-transparent body [240] may have a spectrum of absorption values of visible-light having an average value being no greater than about five percent (5%).

As additional examples [100] of the lighting system, the optically-transparent body [240] may have a refractive index of at least about 1.41. In further examples [100] of the lighting system, the optically-transparent body [240] may be formed of: a silicone composition having a refractive index of about 1.42; or a polymethyl-methacrylate composition having a refractive index of about 1.49; or a polycarbonate composition having a refractive index of about 1.58; or a silicate glass composition having a refractive index of about 1.67. As examples [100] of the lighting system, the visible-light emissions [238], [239] entering into the optically-transparent body [240] through the first base [242] may be refracted toward the normalized directions of the central axis [118] because the refractive index of the optically-transparent body [240] may be greater than the refractive index of an ambient atmosphere, e.g. air, filling the space [287] occupying the small distance [286].

In some examples [100] of the lighting system, the side surface [246] of the optically-transparent body [240] may be configured for causing diffuse refraction; as examples, the side surface [246] may be roughened, or may have a plurality of facets, lens-lets, or micro-lenses.

As further examples [100] of the lighting system, the optically-transparent body [240] may include light-scattering particles for causing diffuse refraction. Additionally in these examples [100] of the lighting system, the optically-transparent body [240] may be configured for causing diffuse refraction, and the lighting system may include a plurality of semiconductor light-emitting devices [132], [133], [166] being collectively configured for generating the visible-light emissions [234]-[239] as having a selectable perceived color.

In other examples [100], the lighting system may include another optically-transparent body being schematically represented by a dashed box [291], the another optically-transparent body [291] being located between the visible-light source [130] and the optically-transparent body [240]. In those examples [100] of the lighting system, the optically-transparent body [240] may have a refractive index being greater than another refractive index of the another optically-transparent body [291]. Further in those examples [100] of the lighting system, the visible-light emissions [238], [239] entering into the another optically-transparent body [291] before entering into the optically-transparent body [240] through the first base [242] may be further refracted toward the normalized directions of the central axis [118] if the refractive index of the optically-transparent body

[240] is greater than the refractive index of the another optically-transparent body [291].

In additional examples [100] of the lighting system, the optically-transparent body [240] may be integrated with the funnel-shaped body [216] of the funnel reflector [114]. As examples [100] of the lighting system, the funnel-shaped body [216] may be attached to the second base [244] of the optically-transparent body [240]. Further in those examples of the lighting system, the second visible-light-reflective surface [220] of the funnel-shaped body [216] may be attached to the second base [244] of the optically-transparent body [240]. In additional examples [100] of the lighting system, the second visible-light-reflective surface [220] of the funnel-shaped body [216] may be directly attached to the second base [244] of the optically-transparent body [240] to provide a gapless interface between the second base [244] of the optically-transparent body [240] and the second visible-light-reflective surface [220] of the funnel-shaped body [216]. In examples [100] of the lighting system, providing the gapless interface may minimize refraction of the visible-light emissions [238], [239] that may otherwise occur at the second visible-light-reflective surface [220]. As additional examples [100] of the lighting system, the gapless interface may include a layer (not shown) of an optical adhesive having a refractive index being matched to the refractive index of the optically-transparent body [240].

In examples, a process for making the example [100] of the lighting system may include steps of: injection-molding the flared funnel-shaped body [216]; forming the second visible-light-reflective surface [220] by vacuum deposition of a metal layer on the funnel-shaped body [216]; and over-molding the optically-transparent body [240] on the second visible-light-reflective surface [220]. In these examples, the optically-transparent body [240] may be formed of a flexible material such as a silicone rubber if forming an optically-transparent body [240] having a convex side surface [246], since the flexible material may facilitate the removal of the optically-transmissive body [240] from injection-molding equipment.

In further examples, a process for making the example [100] of the lighting system may include steps of: injection-molding the optically-transparent body [240]; and forming the flared funnel-shaped body [216] on the optically-transparent body [240] by vacuum deposition of a metal layer on the second base [244]. In these examples, the optically-transparent body [240] may be formed of a rigid composition such as a polycarbonate or a silicate glass, serving as a structural support for the flared funnel-shaped body [216]; and the vacuum deposition of the metal layer may form both the flared funnel-shaped body [216] and the second visible-light reflective surface [220].

In further examples [100] of the lighting system, each one of the array of axes of symmetry [258], [260] of the second light-reflective parabolic surface [224] may form an acute angle with a portion of the central axis [118] extending from the second point [262] to the first point [256]. In some of those examples [100] of the lighting system, each one of the array of axes of symmetry [258], [260] of the second light-reflective parabolic surface [224] may form an acute angle being greater than about 80 degrees with the portion of the central axis [118] extending from the second point [262] to the first point [256]. Further, in some of those examples [100] of the lighting system, each one of the array of axes of symmetry [258], [260] of the second light-reflective parabolic surface [224] may form an acute angle being greater than about 85 degrees with the portion of the central axis [118] extending from the second point [262] to the first point [256]. In these further examples [100] of the lighting system, the acute angles formed by the axes of symmetry [258], [260] of the second light-reflective parabolic surface [224] with the portion of the central axis [118] extending from the second point [262] to the first point [256] may cause the visible-light emissions [238], [239] to pass through the side surface [246] of the optically-transparent body [240] at downward angles (as shown in FIG. 2) in directions below being parallel with the horizon [104] of the bowl reflector [102]. Upon reaching the side surface [246] of the optically-transparent body [240] at such downward angles, the visible-light emissions [238], [239] may there be further refracted downward in directions below being parallel with the horizon [104] of the bowl reflector [102], because the refractive index of the optically-transparent body [240] may be greater than the refractive index of an ambient atmosphere, e.g. air, or of another material, filling the cavity [210]. In examples [100] of the lighting system, the downward directions of the visible-light emissions [238], [239] upon passing through the side surface [246] may cause relatively more of the visible-light emissions [238], [239] to be reflected by the first visible-light-reflective surface [208] of the bowl reflector [102] and may accordingly cause relatively less of the visible-light emissions [238], [239] to directly reach the emission aperture [206] after bypassing the first visible-light-reflective surface [208] of the bowl reflector [102]. Visible-light emissions [238], [239] that directly reach the emission aperture [206] after so bypassing the bowl reflector [102] may, as examples, cause glare or otherwise not be emitted in intended directions. Further in these examples [100] of the lighting system, the reductions in glare and of visible-light emissions propagating in unintended directions that may accordingly be achieved by the examples [100] of the lighting system may facilitate a reduction in a depth of the bowl reflector [102] in directions along the central axis [118]. Hence, the combined elements of the examples [100] of the lighting system may facilitate a more low-profiled lighting system structure having reduced glare and providing greater control over propagation directions of visible-light emissions [234]-[239].

In additional examples [100] of the lighting system, the second light-reflective parabolic surface [224] may be a specular light-reflective surface. Further, in examples [100] of the lighting system, the second visible-light-reflective surface [220] may be a metallic layer on the flared funnel-shaped body [216]. In some of those examples [100] of the lighting system [100], the metallic layer of the second visible-light-reflective surface [220] may have a composition that includes: silver, platinum, palladium, aluminum, zinc, gold, iron, copper, tin, antimony, titanium, chromium, nickel, or molybdenum.

In further examples [100] of the lighting system, the second visible-light-reflective surface [220] of the funnel-shaped body [216] may have a minimum visible-light reflection value from any incident angle being at least about ninety percent (90%). As some examples [100] of the lighting system, the second visible-light-reflective surface [220] of the funnel-shaped body [216] may have a minimum visible-light reflection value from any incident angle being at least about ninety-five percent (95%). In an example [100] of the lighting system wherein the second visible-light-reflective surface [220] of the funnel-shaped body [216] may have a minimum visible-light reflection value from any incident angle being at least about ninety-five percent (95%), the metallic layer of the second visible-light-reflective surface [220] may have a composition that includes silver. In additional examples [100] of the lighting system, the second visible-light-reflective surface [220] of the funnel-shaped body [216] may have a maximum visible-light transmission value from any incident angle being no greater than about ten percent (10%). As some examples [100] of the lighting system, the second visible-light-reflective surface [220] of the funnel-shaped body [216] may have a maximum visible-light transmission value from any incident angle being no greater than about five percent (5%). In an example [100] of the lighting system wherein the second visible-light-reflective surface [220] of the funnel-shaped body [216] may have a maximum visible-light transmission value from any incident angle being no greater than about five percent (5%), the metallic layer of the second visible-light-reflective surface [220] may have a composition that includes silver.

In additional examples [100] of the lighting system, the first visible-light-reflective surface [208] of the bowl reflector [102] may be a specular light-reflective surface. As examples [100] of the lighting system, the first visible-light-reflective surface [208] may be a metallic layer on the bowl reflector [102]. In some of those examples [100] of the lighting system, the metallic layer of the first visible-light-reflective surface [208] may have a composition that includes: silver, platinum, palladium, aluminum, zinc, gold, iron, copper, tin, antimony, titanium, chromium, nickel, or molybdenum.

In further examples [100] of the lighting system, the first visible-light-reflective surface [208] of the bowl reflector [102] may have a minimum visible-light reflection value from any incident angle being at least about ninety percent (90%). As some examples [100] of the lighting system, the first visible-light-reflective surface [208] of the bowl reflector [102] may have a minimum visible-light reflection value from any incident angle being at least about ninety-five percent (95%). In an example [100] of the lighting system wherein the first visible-light-reflective surface [208] of the bowl reflector [102] may have a minimum visible-light reflection value from any incident angle being at least about ninety-five percent (95%), the metallic layer of the first visible-light-reflective surface [208] may have a composition that includes silver. In additional examples [100] of the lighting system, the first visible-light-reflective surface [208] of the bowl reflector [102] may have a maximum visible-light transmission value from any incident angle being no greater than about ten percent (10%). As some examples [100] of the lighting system, the first visible-light-reflective surface [208] of the bowl reflector [102] may have a maximum visible-light transmission value from any incident angle being no greater than about five percent (5%). In an example [100] of the lighting system wherein the first visible-light-reflective surface [208] of the bowl reflector [102] may have a maximum visible-light transmission value from any incident angle being no greater than about five percent (5%), the metallic layer of the first visible-light-reflective surface [208] may have a composition that includes silver.

In other examples [100] of the lighting system, the first visible-light-reflective surface [208] of the bowl reflector [102] may have another central axis [219]; and the another central axis [219] may be aligned with the central axis [118] of the funnel-shaped body [216]. In some of those examples [100] of the lighting system, the first and second bases [242], [244] of the optically-transparent body [240] may respectively have circular perimeters [288], [289], and the optically-transparent body [240] may generally have a circular-cylindrical shape, and the funnel reflector [114] may have a circular perimeter [103]; and the horizon [104] of the bowl reflector [102] may likewise have a circular perimeter [105]. In other examples [100] of the lighting system, the first and second bases [242], [244] of the optically-transparent body [240] may respectively have elliptical perimeters [288], [289], and the optically-transparent body [240] may generally have an elliptical-cylindrical shape (not shown), and the funnel reflector [114] may likewise have an elliptical perimeter (not shown); and the horizon [104] of the bowl reflector [102] may likewise have an elliptical perimeter (not shown).

In further examples [100] of the lighting system, the first and second bases [242], [244] of the optically-transparent body [240] may respectively have multi-faceted perimeters [288], [289] being rectangular, hexagonal, octagonal, or otherwise polygonal, and the optically-transparent body [240] may generally have a side wall bounded by multi-faceted perimeters [288], [289] being rectangular-, hexagonal-, octagonal-, or otherwise polygonal-cylindrical (not shown), and the funnel reflector [114] may have a perimeter [103] being rectangular-, hexagonal-, octagonal-, or otherwise polygonal-cylindrical (not shown); and the horizon [104] of the bowl reflector [102] may likewise have a multi-faceted perimeter [105] being rectangular, hexagonal, octagonal, or otherwise polygonal (not shown).

In additional examples [100] of the lighting system, the first visible-light-reflective surface [208] of the bowl reflector [102] may have another central axis [219]; and the another central axis [219] may be spaced apart from and not aligned with (not shown) the central axis [118] of the funnel-shaped body [216]. As another example [100] of the lighting system, the first and second bases [242], [244] of the optically-transparent body [240] may respectively have circular perimeters [288], [289] and the optically-transparent body [240] may generally have a circular-cylindrical shape (not shown), and the funnel reflector [114] may have a circular perimeter [103]; and the horizon [104] of the bowl reflector [102] may have a multi-faceted perimeter [105] being rectangular, hexagonal, octagonal, or otherwise polygonal (not shown) not conforming with the circular shape of the perimeter [288] of the first base [242] or with the circular perimeter [103] of the funnel reflector [114].

In examples [100] of the lighting system as earlier discussed, the visible-light source [130] may be at the second position [164] being located, relative to the first position [154] of the ring [148] of focal points [150], [152], for causing some of the visible-light emissions [238]-[239] to be reflected by the second light-reflective parabolic surface [224] in a partially-collimated, substantially-collimated, or generally-collimated beam [265] being shaped as a ray fan of the visible-light emissions [238], [239]. Further in those examples [100] of the lighting system, the first light-reflective parabolic surface [212] of the bowl reflector [102] may have a second array of axes of symmetry being represented by arrows [205], [207] being generally in alignment with directions of propagation of visible-light emissions [238], [239] from the semiconductor light-emitting devices [132], [133] having been refracted by the side surface [246] of the optically-transparent body [240] after being reflected by the second light-reflective parabolic surface [224] of the funnel-shaped body [216]. In examples [100] of the lighting system, providing the first light-reflective parabolic surface [212] of the bowl reflector [102] as having the second array of axes of symmetry as represented by the arrows [205], [207] may cause some of the visible-light emissions [238], [239] to be remain as a partially-collimated, substantially-collimated, or generally-collimated beam upon reflection by the bowl reflector [102].

As additional examples [100] of the lighting system, the first light-reflective parabolic surface [212] of the bowl reflector [102] may be configured for reflecting the visible-light emissions [234]-[239] toward the emission aperture [206] of the bowl reflector [102] for emission from the lighting system in a partially-collimated beam of combined visible-light emissions being schematically represented by dashed circles [243] having an average crossing angle of the visible-light emissions [234]-[239], as defined in directions deviating from being parallel with the central axis [118], being no greater than about forty-five degrees. As further examples [100] of the lighting system, the first light-reflective parabolic surface [212] of the bowl reflector [102] may be configured for reflecting the visible-light emissions [234]-[239] toward the emission aperture [206] of the bowl reflector [102] for emission from the lighting system in a substantially-collimated beam of combined visible-light emissions being schematically represented by dashed circles [243] having an average crossing angle of the visible-light emissions [234]-[239], as defined in directions deviating from being parallel with the central axis [118], being no greater than about twenty-five degrees.

In other examples [100] of the lighting system, the first light-reflective parabolic surface [212] may be configured for reflecting the visible-light emissions [234]-[239] toward the emission aperture [206] of the bowl reflector [102] for emission from the lighting system with the beam as having a beam angle being within a range of between about three degrees (3°) and about seventy degrees (70°). Still further in these examples [100] of the lighting system, the first light-reflective parabolic surface [212] may be configured for reflecting the visible-light emissions [234]-[239] toward the emission aperture [206] of the bowl reflector [102] for emission from the lighting system with the beam as having a beam angle being within a selectable range of between about three degrees (3°) and about seventy degrees (70°), being, as examples, about: 3-7°; 8-12°; 13-17°; 18-22°; 23-27°; 28-49°; 50-70°; 5°; 10°; 15°; 20°; 25°; 40°; or 60°.

In some examples [100] of the lighting system, the first light-reflective parabolic surface [212] may be configured for reflecting the visible-light emissions [234]-[239] toward the emission aperture [206] of the bowl reflector [102] for emission from the lighting system with the beam as having a beam angle being within a range of between about three degrees (3°) and about five degrees (5°); and as having a field angle being no greater than about eighteen degrees (18°). Further in those examples [100], emission of the visible-light emissions [234]-[239] from the lighting system as having a beam angle being within a range of between about 3-5° and a field angle being no greater than about 18° may result in a significant reduction of glare.

In examples [100] of the lighting system, the first visible-light-reflective surface [208] of the bowl reflector [102] may be configured for reflecting, toward the emission aperture [206] of the bowl reflector [102] for emission from the lighting system, some of the visible-light emissions [234]-[239] being partially-controlled as: propagating to the first visible-light-reflective surface [208] directly from the visible-light source [130]; and being refracted by the side surface [246] of the optically-transparent body [240] after bypassing the second visible-light-reflective surface [220]; and being refracted by the side surface [246] of the optically-transparent body [240] after being reflected by the second light-reflective parabolic surface [224] of the funnel reflector [114].

In additional examples [100] of the lighting system, the first light-reflective parabolic surface [212] of the bowl reflector [102] may be a multi-segmented surface. In other examples [100] of the lighting system, the first light-reflective parabolic surface [212] of the bowl reflector [102] may be a part of an elliptic paraboloid or a part of a paraboloid of revolution.

Figure 3:
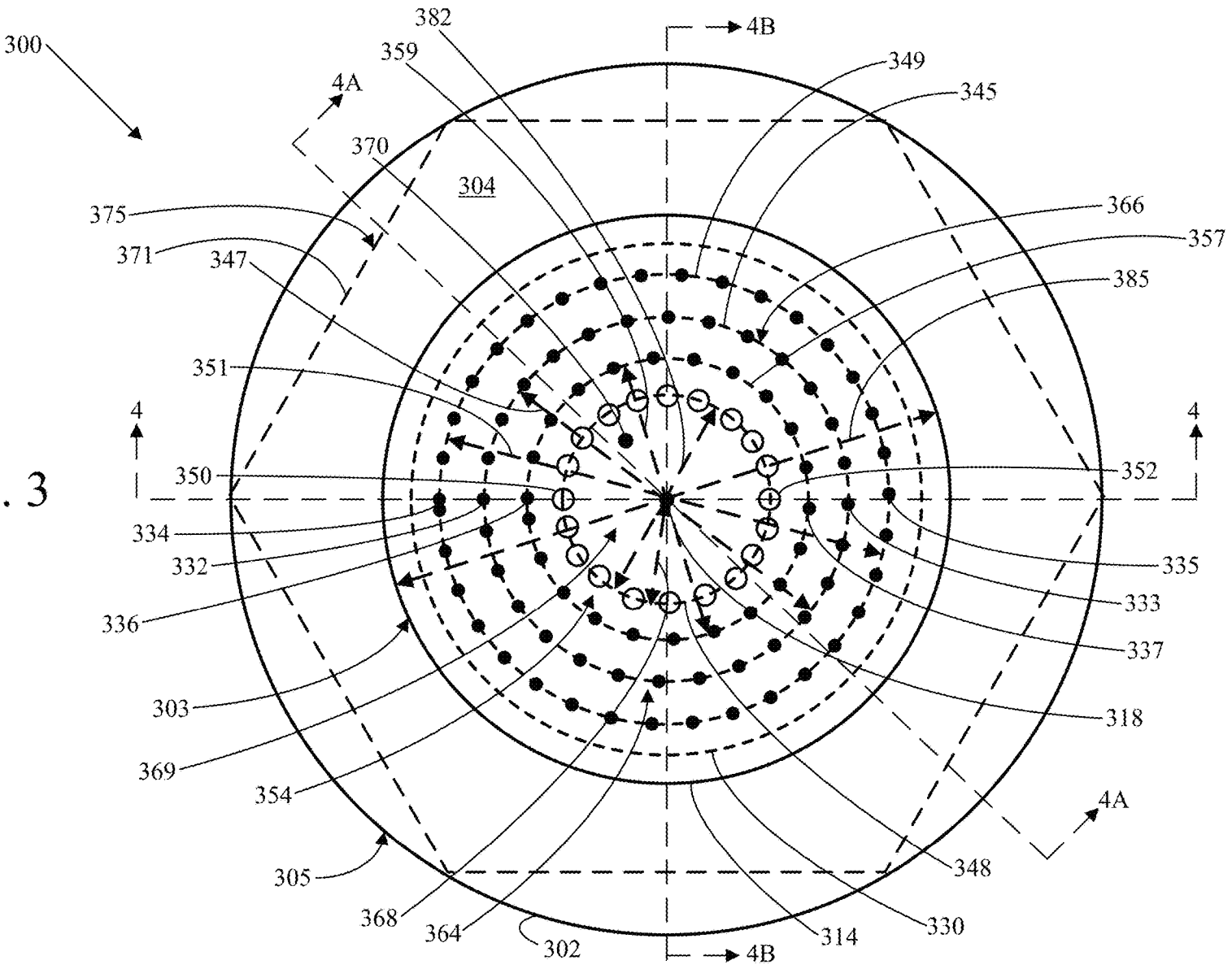
FIG. 3 is a schematic top view showing another example [300] of an implementation of a lighting system.
Figure 4:
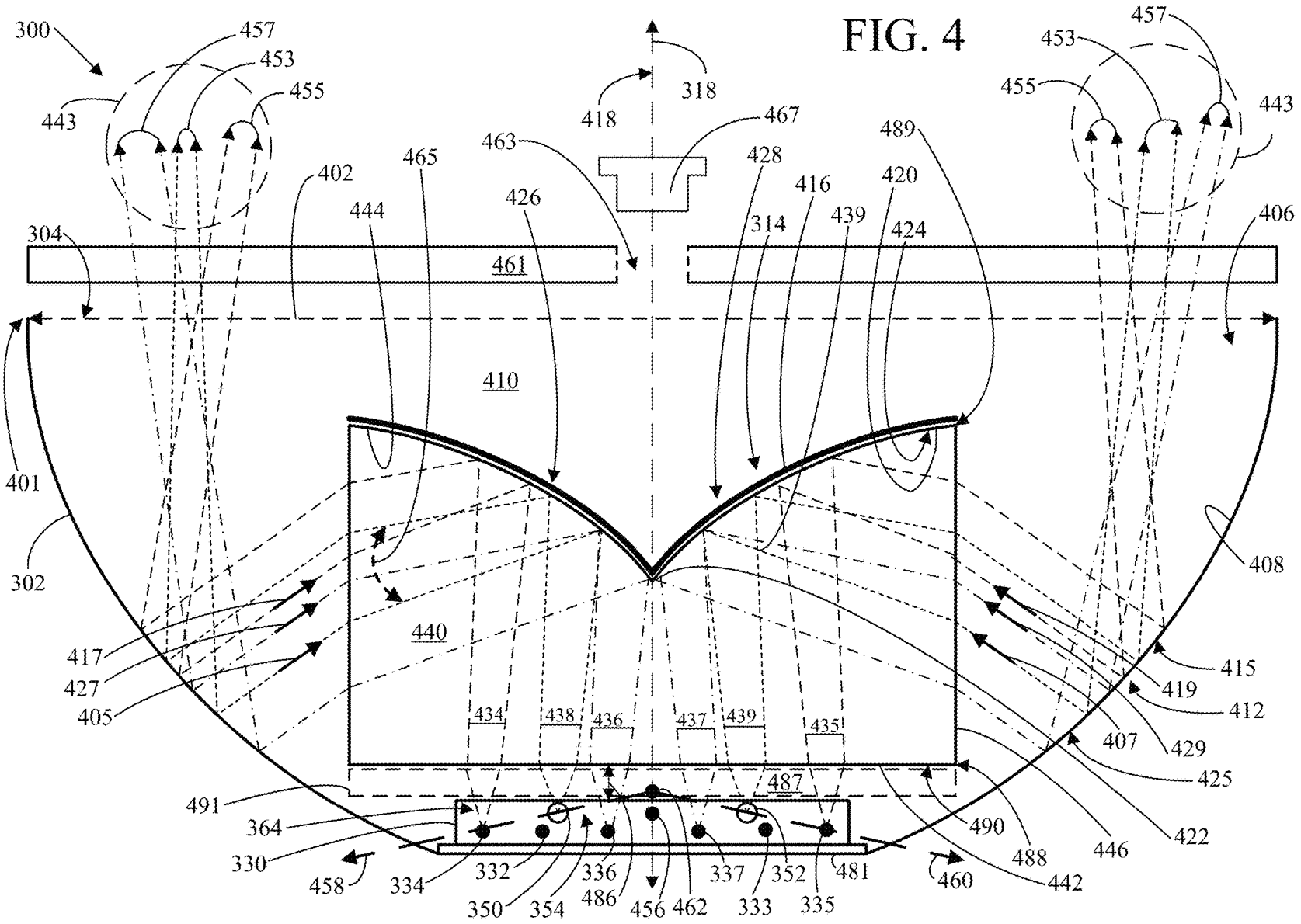
FIG. 4 is a schematic cross-sectional view taken along the line 4-4 showing the another example [300] of the lighting system.

FIG. 3 is a schematic top view showing another example [300] of an implementation of a lighting system. FIG. 4 is a schematic cross-sectional view taken along the line 4-4 showing the another example [300] of the lighting system. It is understood throughout this specification that the another example [300] of an implementation of the lighting system may be modified as including any of the features or combinations of features that are disclosed in connection with: the example [100] of an implementation of the lighting system; or the examples [500], [700] of alternative optically-transparent bodies; or the additional examples [900], [1200], [1500], [1800], [2000] of alternative bowl reflectors. Accordingly, FIGS. 1-2 and 5-21 and the entireties of the discussions herein of the examples [100], [500], [700], [900], [1200], [1500], [1800], [2000] of implementations of the lighting system are hereby incorporated into the following discussion of the another example [300] of an implementation of the lighting system. Further, FIGS. 22-49 collectively show an example [2200] of a lighting assembly that includes a bowl reflector, an optically-transparent body, and a funnel reflector, that may be substituted for such elements in the examples [100], [300] of the lighting system. FIGS. 50-62 collectively show an example [5000] of a combination of an optically-transparent body, and a reflector or absorber, that may respectively be substituted for the optically-transparent body and the funnel reflector in the examples [100], [300] of the lighting system. FIGS. 63-70 collectively show an example [6300] of a combination of an optically-transparent body, and a reflector or absorber, that may respectively be substituted for the optically-transparent body and the funnel reflector in the examples [100], [300] of the lighting system. Accordingly, FIGS. 22-70 and the entireties of the subsequent discussions of the examples [2200], [5000] and [6300] are hereby incorporated into the following discussion of the example [300] of an implementation of the lighting system. FIGS. 71-75 collectively show a further example [7100] of a lighting system that includes an optically-transparent body and a central reflector that may respectively be substituted for the optically-transparent body and the funnel reflector in the examples [100], [300] of the lighting system. Accordingly, FIGS. 71-75 and the entireties of the subsequent discussions of the example [7100] are hereby incorporated into the following discussion of the example [300] of an implementation of the lighting system.

As shown in FIGS. 3 and 4, the another example [300] of the implementation of the lighting system includes a bowl reflector [302] having a rim [401] defining a horizon [304] and defining an emission aperture [406], the bowl reflector [302] having a first visible-light-reflective surface [408] defining a portion of a cavity [410], a portion of the first visible-light-reflective surface [408] being a first light-reflective parabolic surface [412]. The another example [300] of the implementation of the lighting system further includes a funnel reflector [314] having a flared funnel-shaped body [416], the funnel-shaped body [416] having a central axis [318] and having a second visible-light-reflective surface [420] being aligned along the central axis [318]. In examples [300] of the lighting system, the schematic cross-sectional view shown in FIG. 4 is taken along the line 4-4 as shown in FIG. 3, in a direction being orthogonal to and having an indicated orientation around the central axis [318]. In examples [300] of the lighting system, the same schematic cross-sectional view that is shown in FIG. 4 may alternatively be taken, as shown in FIG. 3, along the line 4A-4A or along the line 4B-4B, or along another direction being orthogonal to and having another orientation around the central axis [318]. In the another example [300] of the lighting system, the funnel-shaped body [416] also has a tip [422] being located within the cavity [410] along the central axis [318]. In addition, in the another example [300] of the lighting system, a portion of the second visible-light-reflective surface [420] is a second light-reflective parabolic surface [424], having a cross-sectional profile defined in directions along the central axis [318] that includes two parabolic curves [426], [428] that converge towards the tip [422] of the funnel-shaped body [416]. The another example [300] of the lighting system additionally includes a visible-light source being schematically-represented by a dashed line [330] and including a semiconductor light-emitting device schematically-represented by a dot [332]. In the another example [300] of the lighting system, the visible-light source [330] is configured for generating visible-light emissions [438] from the semiconductor light-emitting device [332]. The another example [300] of the lighting system further includes an optically-transparent body [440] being aligned with the second visible-light-reflective surface [420] along the central axis [318]. In the another example [300] of the lighting system, the optically-transparent body [440] has a first base [442] being spaced apart along the central axis [318] from a second base [444], and a side surface [446] extending between the bases [442], [444]; and the first base [442] faces toward the visible-light source [330]. Further in the another example [300] of the lighting system, the second light-reflective parabolic surface [424] has a ring [348] of focal points being schematically-represented by points [350], [352], the ring [348] being located at a first position [354] within the cavity [410]. In the another example [300] of the lighting system, each one of the focal points [350], [352] is equidistant from the second light-reflective parabolic surface [424]; and the ring [348] encircles a first point [456] on the central axis [318]. Additionally in the another example [300] of the lighting system, the second light-reflective parabolic surface [424] has an array of axes of symmetry being schematically-represented by arrows [458], [460] intersecting with and radiating in directions all around the central axis [318] from a second point [462] on the central axis [318]. In the another example [300] of the lighting system, each one of the axes of symmetry [458], [460] intersects with a corresponding one of the focal points [350], [352] of the ring [348]; and the second point [462] on the central axis [318] is located between the first point [456] and the horizon [304] of the bowl reflector [302]. Further in the another example [300] of the lighting system, the visible-light source [330] is within the cavity [410] at a second position [364] being located, relative to the first position [354] of the ring [348] of focal points [350], [352], for causing some of the visible-light emissions [438] to be reflected by the second light-reflective parabolic surface [424] as having a partially-collimated distribution being represented by an arrow [465].

In some examples [300] of the lighting system, the visible-light source [330] may include a plurality of semiconductor light-emitting devices schematically-represented by dots [332], [333] configured for respectively generating visible-light emissions [438], [439]. Further, for example, the visible-light source [330] of the another example [300] of the lighting system may include a plurality of semiconductor light-emitting devices [332], [333] being arranged in an array schematically represented by a dotted ring [366].

Additionally, for example, a portion of the plurality of semiconductor light-emitting devices [332], [333] may be arranged in a first emitter ring [345] having a first average diameter [347] encircling the central axis [318]; and another portion of the plurality of semiconductor light-emitting devices including examples [334], [335] may be arranged in a second emitter ring [349] having a second average diameter [351], being greater than the first average diameter [347] and encircling the central axis [318]. In this another example [300] of the lighting system, the semiconductor light-emitting devices [332], [333] arranged in the first emitter ring [345] may collectively cause the generation of a first beam [453] of visible-light emissions [438], [439] at the emission aperture [406] of the bowl reflector [302] having a first average beam angle; and examples of semiconductor light-emitting devices [334], [335] being arranged in the second emitter ring [349] may collectively cause the generation of a second beam [455] of visible-light emissions [434], [435] at the emission aperture [406] of the bowl reflector [302] having a second average beam angle being less than or greater than or the same as the first average beam angle. Further, for example, an additional portion of the plurality of semiconductor light-emitting devices including examples [336], [337] may be arranged in a third emitter ring [357] having a third average diameter [359], being smaller than the first average diameter [347] and encircling the central axis [318]. In this another example [300] of the lighting system, the semiconductor light-emitting devices [336], [337] arranged in the third emitter ring [357] may collectively cause the generation of a third beam [457] of visible-light emissions [436], [437] at the emission aperture [406] of the bowl reflector [302] having a third average beam angle being less than or greater than or the same as the first and second average beam angles.

As examples of an array of semiconductor light-emitting devices [366] in the another example [300] of the lighting system, a plurality of semiconductor light-emitting devices [332], [333] may be arranged in a chip-on-board (not shown) array [366], or in a discrete (not shown) array [366] of the semiconductor light-emitting devices [332], [333] on a printed circuit board (not shown). Semiconductor light-emitting device arrays [366] including chip-on-board arrays and discrete arrays may be conventionally fabricated by persons of ordinary skill in the art. Further, the semiconductor light-emitting devices [332], [333], [366] of the another example [300] of the lighting system may be provided with drivers (not shown) and power supplies (not shown) being conventionally fabricated and configured by persons of ordinary skill in the art.

In further examples [300] of the lighting system, the visible-light source [330] may include additional semiconductor light-emitting devices schematically-represented by dots [366] being co-located together with each of the plurality of semiconductor light-emitting devices [332], [333], so that each of the co-located pluralities of the semiconductor light-emitting devices [366] may be configured for collectively generating the visible-light emissions [438], [439] as having a selectable perceived color. For example, in additional examples [300] of the lighting system, each of the plurality of semiconductor light-emitting devices [332], [333] may include two or three or more co-located semiconductor light-emitting devices [366] being configured for collectively generating the visible-light emissions [438], [439] as having a selectable perceived color. As additional examples [300], the lighting system may include a controller (not shown) for the visible-light source [330], and the controller may be configured for causing the visible-light emissions [438], [439] to have a selectable perceived color.

In additional examples [300] of the lighting system, the ring [348] of focal points [350], [352] may have a ring radius [368], and the semiconductor light-emitting device [332] or each one of the plurality of semiconductor light-emitting devices [332], [333], [366] may be located, as examples: within a distance of or closer than about twice the ring radius [368] away from the ring [348]; or within a distance of or closer than about one-half of the ring radius [368] away from the ring [348]. In other examples [300] of the lighting system, one of a plurality of semiconductor light-emitting devices [332], [333], [366] may be located at a one of the focal points [350], [352] of the ring [348]. As further examples [300] of the lighting system, the ring [348] of focal points [350], [352] may define a space [369] being encircled by the ring [348]; and a one of the plurality of semiconductor light-emitting devices [332], [333], [366] may be at an example of a location [370] intersecting the space [369]. In additional examples [300] of the lighting system, a one of the focal points [350], [352] may be within the second position [364] of the visible-light source [330]. As other examples [300] of the lighting system, the second position [364] of the visible-light source [330] may intersect with a one of the axes of symmetry [458], [460] of the second light-reflective parabolic surface [424].

In other examples [300] of the lighting system, the visible-light source [330] may be at the second position [364] being located, relative to the first position [354] of the ring [348] of focal points [350], [352], for causing some of the visible-light emissions [438]-[439] to be reflected by the second light-reflective parabolic surface [424] in the partially-collimated beam [465] as being shaped as a ray fan of the visible-light emissions [438], [439]. As examples [300] of the lighting system, the ray fan may expand, upon reflection of the visible-light emissions [438]-[439] away from the second visible-light-reflective surface [424], by a fan angle defined in directions represented by the arrow [465], having an average fan angle value being no greater than about forty-five degrees. Further in those examples [300] of the lighting system, the ring [348] of focal points [350], [352] may have the ring radius [368], and each one of a plurality of semiconductor light-emitting devices [332], [333], [366] may be located within a distance of or closer than about twice the ring radius [368] away from the ring [348].

In some examples [300] of the lighting system, the visible-light source [330] may be at the second position [364] being located, relative to the first position [354] of the ring [348] of focal points [350], [352], for causing some of the visible-light emissions [438]-[439] to be reflected by the second light-reflective parabolic surface [424] as a substantially-collimated beam [465] as being shaped as a ray fan of the visible-light emissions [438], [439]. As examples [300] of the lighting system, the ray fan may expand, upon reflection of the visible-light emissions [438]-[439] away from the second visible-light-reflective surface [424], by a fan angle defined in directions represented by the arrow [465], having an average fan angle value being no greater than about twenty-five degrees. Additionally in those examples [300] of the lighting system, the ring [348] of focal points [350], [352] may have the ring radius [368], and each one of a plurality of semiconductor light-emitting devices [332], [333], [366] may be located within a distance of or closer than about one-half the ring radius [368] away from the ring [348].

In further examples [300] of the lighting system, the visible-light source [330] may be located at the second position [364] as being at a minimized distance away from the first position [354] of the ring [348] of focal points [350], [352]. In those examples [300] of the lighting system, minimizing the distance between the first position [354] of the ring [348] and the second position [364] of the visible-light source [330] may cause some of the visible-light emissions [438], [439] to be reflected by the second light-reflective parabolic surface [424] as a generally-collimated beam [465] being shaped as a ray fan of the visible-light emissions [438], [439] expanding by a minimized fan angle value defined in directions represented by the arrow [465] upon reflection of the visible-light emissions [438]-[439] away from the second visible-light-reflective surface [424]. In additional examples [300] of the lighting system, the first position [354] of the ring [348] of focal points [350], [352] may be within the second position [364] of the visible-light source [330].

In additional examples [300], the lighting system may include another surface [481] defining another portion of the cavity [410], and the visible-light source [330] may be located on the another surface [481] of the lighting system [300]. Further in those examples [300] of the lighting system, a plurality of semiconductor light-emitting devices [334], [335] may be arranged in the emitter array [349] as being on the another surface [481]. Also in those examples [300] of the lighting system: the emitter array [349] may have a maximum diameter represented by the arrow [351] defined in directions being orthogonal to the central axis [318]; and the funnel reflector [314] may have another maximum diameter represented by an arrow [385] defined in additional directions being orthogonal to the central axis [318]; and the another maximum diameter [385] of the funnel reflector [314] may be at least about 10% greater than the maximum diameter [351] of the emitter array [349]. Additionally in those examples [300] of the lighting system: the ring [348] of focal points [350], [352] may have a maximum ring diameter represented by an arrow [382] defined in further directions being orthogonal to the central axis [318]; and the another maximum diameter [385] of the funnel reflector [314] may be about 10% greater than the maximum diameter [351] of the emitter array [349]; and the maximum ring diameter [382] may be about half of the maximum diameter [351] of the emitter array [349]. As an example [300] of the lighting system, the ring [348] of focal points [350], [352] may have a uniform diameter [382] of about 6.5 millimeters; and the emitter array [349] may have a maximum diameter [351] of about 13 millimeters; and the funnel reflector [314] may have another maximum diameter [385] of about 14.5 millimeters; and the bowl reflector [302] may have a uniform diameter of about 50 millimeters.

In examples [300] of the lighting system, the second position [364] of the visible-light source [330] may be a small distance represented by an arrow [486] away from the first base [442] of the optically-transparent body [440]. In some of those examples [300] of the lighting system, the small distance [486] may be less than or equal to about one (1) millimeter. As examples [300] of the lighting system, minimizing the distance [486] between the second position [364] of the visible-light source [330] and the first base [442] of the optically-transparent body [440] may cause relatively more of the visible-light emissions [438], [439] from the semiconductor light-emitting device(s) [332], [333], [366] to enter into the optically-transparent body [440], and may cause relatively less of the visible-light emissions from the semiconductor light-emitting device(s) [332], [333], [366]

to bypass the optically-transparent body [440]. Further in those examples [300] of the lighting system, causing relatively more of the visible-light emissions [438], [439] from the semiconductor light-emitting device(s) [332], [333], [366] to enter into the optically-transparent body [440] and causing relatively less of the visible-light emissions from the semiconductor light-emitting device(s) [332], [333], [366] to bypass the optically-transparent body [440] may result in more of the visible-light emissions [438], [439] being reflected by the second light-reflective parabolic surface [424] as having a partially-collimated, substantially-collimated, or generally-collimated distribution [465]. Additionally in those examples [300] of the lighting system, a space [487] occupying the small distance [486] may be filled with an ambient atmosphere, e.g., air.

In further examples [300] of the lighting system, the side surface [446] of the optically-transparent body [440] may include a plurality of vertically-faceted sections schematically represented by dashed line [371] being mutually spaced apart around and joined together around the central axis [318]. In some of those further examples [300] of the lighting system, each one of the vertically-faceted sections may form a one of a plurality of facets [371] of the side surface [446], and each one of the facets [371] may have a generally flat surface [375].

In some examples [300] of the lighting system, the first and second bases [442], [444] of the optically-transparent body [440] may respectively have circular perimeters [488], [489] and the optically-transparent body [440] may generally have a circular-cylindrical shape. As additional examples [300] of the lighting system, the first base [442] of the optically-transparent body [440] may have a generally-planar surface [490]. In further examples [300] of the lighting system (not shown), the first base [442] of the optically-transparent body [440] may have a non-planar surface, such as, for example, a convex surface, a concave surface, a surface including both concave and convex portions, or an otherwise roughened or irregular surface.

In further examples [300] of the lighting system, the optically-transparent body [440] may have a spectrum of transmission values of visible-light having an average value being at least about ninety percent (90%). In additional examples [300] of the lighting system, the optically-transparent body [440] may have a spectrum of transmission values of visible-light having an average value being at least about ninety-five percent (95%). As some examples [300] of the lighting system, the optically-transparent body [440] may have a spectrum of absorption values of visible-light having an average value being no greater than about ten percent (10%). As further examples [300] of the lighting system, the optically-transparent body [440] may have a spectrum of absorption values of visible-light having an average value being no greater than about five percent (5%).

As additional examples [300] of the lighting system, the optically-transparent body [440] may have a refractive index of at least about 1.41. In further examples [300] of the lighting system, the optically-transparent body [440] may be formed of: a silicone composition having a refractive index of about 1.42; or a polymethyl-methacrylate composition having a refractive index of about 1.49; or a polycarbonate composition having a refractive index of about 1.58; or a silicate glass composition having a refractive index of about 1.67. As examples [300] of the lighting system, the visible-light emissions [438], [439] entering into the optically-transparent body [440] through the first base [442] may be refracted toward the normalized directions of the central axis [318] because the refractive index of the optically-transparent body [440] may be greater than the refractive index of an ambient atmosphere, e.g. air, filling the space [487] occupying the small distance [486].

In some examples [300] of the lighting system, the side surface [446] of the optically-transparent body [440] may be configured for causing diffuse refraction; as examples, the side surface [446] may be roughened, or may have a plurality of facets, lens-lets, or micro-lenses.

As further examples [300] of the lighting system, the optically-transparent body [440] may include light-scattering particles for causing diffuse refraction. Additionally in these examples [300] of the lighting system, the optically-transparent body [440] may be configured for causing diffuse refraction, and the lighting system may include a plurality of semiconductor light-emitting devices [332], [333], [366] being collectively configured for generating the visible-light emissions [438], [439] as having a selectable perceived color.

In other examples [300], the lighting system may include another optically-transparent body being schematically represented by a dashed box [491], the another optically-transparent body [491] being located between the visible-light source [330] and the optically-transparent body [440]. In those examples [300] of the lighting system, the optically-transparent body [440] may have a refractive index being greater than another refractive index of the another optically-transparent body [491]. Further in those examples [300] of the lighting system, the visible-light emissions [438], [439] entering into the another optically-transparent body [491] before entering into the optically-transparent body [440] through the first base [442] may be further refracted toward the normalized directions of the central axis [318] if the refractive index of the optically-transparent body [440] is greater than the refractive index of the another optically-transparent body [491].

In additional examples [300] of the lighting system, the optically-transparent body [440] may be integrated with the funnel-shaped body [416] of the funnel reflector [314]. As examples [300] of the lighting system, the funnel-shaped body [416] may be attached to the second base [444] of the optically-transparent body [440]. Further in those examples of the lighting system, the second visible-light-reflective surface [420] of the funnel-shaped body [416] may be attached to the second base [444] of the optically-transparent body [440]. In additional examples [300] of the lighting system, the second visible-light-reflective surface [420] of the funnel-shaped body [416] may be directly attached to the second base [444] of the optically-transparent body [440] to provide a gapless interface between the second base [444] of the optically-transparent body [440] and the second visible-light-reflective surface [420] of the funnel-shaped body [416]. In examples [300] of the lighting system, providing the gapless interface may minimize refraction of the visible-light emissions [438], [439] that may otherwise occur at the second visible-light-reflective surface [420]. As additional examples [300], the gapless interface may include a layer (not shown) of an optical adhesive having a refractive index being matched to the refractive index of the optically-transparent body [440].

In further examples [300] of the lighting system, each one of the array of axes of symmetry [458], [460] of the second light-reflective parabolic surface [424] may form an acute angle with a portion of the central axis [318] extending from the second point [462] to the first point [456]. In some of those examples [300] of the lighting system, each one of the array of axes of symmetry [458], [460] of the second light-reflective parabolic surface [424] may form an acute angle being greater than about 80 degrees with the portion of the central axis [318] extending from the second point [462] to the first point [456]. Further, in some of those examples [300] of the lighting system, each one of the array of axes of symmetry [458], [460] of the second light-reflective parabolic surface [424] may form an acute angle being greater than about 85 degrees with the portion of the central axis [318] extending from the second point [462] to the first point [456]. In these further examples [300] of the lighting system, the acute angles formed by the axes of symmetry [458], [460] of the second light-reflective parabolic surface [424] with the portion of the central axis [318] extending from the second point [462] to the first point [456] may cause the visible-light emissions [438], [439] to pass through the side surface [446] of the optically-transparent body [440] at downward angles (as shown in FIG. 4) below being parallel with the horizon [304] of the bowl reflector [302]. Upon reaching the side surface [446] of the optically-transparent body [440] at such downward angles, the visible-light emissions [438], [439] may there be further refracted downward in directions being below parallel with the horizon [304] of the bowl reflector [302], because the refractive index of the optically-transparent body [440] may be greater than the refractive index of an ambient atmosphere, e.g. air, or of another material, filling the cavity [410]. In examples [300] of the lighting system, the downward directions of the visible-light emissions [438], [439] upon passing through the side surface [446] may cause relatively more of the visible-light emissions [438], [439] to be reflected by the first visible-light-reflective surface [408] of the bowl reflector [302] and may accordingly cause relatively less of the visible-light emissions [438], [439] to directly reach the emission aperture [406] after bypassing the first visible-light-reflective surface [408] of the bowl reflector [302]. Visible-light emissions [438], [439] that directly reach the emission aperture [406] after so bypassing the bowl reflector [302] may, as examples, cause glare or otherwise not be emitted in intended directions. Further in these examples [300] of the lighting system, the reductions in glare and propagation of visible-light emissions in unintended directions that may accordingly be achieved by the examples [300] of the lighting system may facilitate a reduction in a depth of the bowl reflector [302] in directions along the central axis [318]. Hence, the combined elements of the examples [300] of the lighting system may facilitate a more low-profiled structure having reduced glare and providing greater control over propagation directions of visible-light emissions [438], [439].

In additional examples [300] of the lighting system, the second light-reflective parabolic surface [424] may be a specular light-reflective surface. Further, in examples [300] of the lighting system, the second visible-light-reflective surface [420] may be a metallic layer on the flared funnel-shaped body [416]. In some of those examples [300] of the lighting system [300], the metallic layer of the second visible-light-reflective surface [420] may have a composition that includes: silver, platinum, palladium, aluminum, zinc, gold, iron, copper, tin, antimony, titanium, chromium, nickel, or molybdenum.

In further examples [300] of the lighting system, the second visible-light-reflective surface [420] of the funnel-shaped body [416] may have a minimum visible-light reflection value from any incident angle being at least about ninety percent (90%). As some examples [300] of the lighting system, the second visible-light-reflective surface [420] of the funnel-shaped body [416] may have a minimum visible-light reflection value from any incident angle being at least about ninety-five percent (95%). In an example [300] of the lighting system wherein the second visible-light-reflective surface [420] of the funnel-shaped body [416] may have a minimum visible-light reflection value from any incident angle being at least about ninety-five percent (95%), the metallic layer of the second visible-light-reflective surface [420] may have a composition that includes silver. In additional examples [300] of the lighting system, the second visible-light-reflective surface [420] of the funnel-shaped body [416] may have a maximum visible-light transmission value from any incident angle being no greater than about ten percent (10%). As some examples [300] of the lighting system, the second visible-light-reflective surface [420] of the funnel-shaped body [416] may have a maximum visible-light transmission value from any incident angle being no greater than about five percent (5%). In an example [300] of the lighting system wherein the second visible-light-reflective surface [420] of the funnel-shaped body [416] may have a maximum visible-light transmission value from any incident angle being no greater than about five percent (5%), the metallic layer of the second visible-light-reflective surface [420] may have a composition that includes silver.

In additional examples [300] of the lighting system, the first visible-light-reflective surface [408] of the bowl reflector [302] may be a specular light-reflective surface. As examples [300] of the lighting system, the first visible-light-reflective surface [408] may be a metallic layer on the bowl reflector [302]. In some of those examples [300] of the lighting system, the metallic layer of the first visible-light-reflective surface [408] may have a composition that includes: silver, platinum, palladium, aluminum, zinc, gold, iron, copper, tin, antimony, titanium, chromium, nickel, or molybdenum.

In further examples [300] of the lighting system, the first visible-light-reflective surface [408] of the bowl reflector [302] may have a minimum visible-light reflection value from any incident angle being at least about ninety percent (90%). As some examples [300] of the lighting system, the first visible-light-reflective surface [408] of the bowl reflector [302] may have a minimum visible-light reflection value from any incident angle being at least about ninety-five percent (95%). In an example [300] of the lighting system wherein the first visible-light-reflective surface [408] of the bowl reflector [302] may have a minimum visible-light reflection value from any incident angle being at least about ninety-five percent (95%), the metallic layer of the first visible-light-reflective surface [408] may have a composition that includes silver. In additional examples [300] of the lighting system, the first visible-light-reflective surface [408] of the bowl reflector [302] may have a maximum visible-light transmission value from any incident angle being no greater than about ten percent (10%). As some examples [300] of the lighting system, the first visible-light-reflective surface [408] of the bowl reflector [302] may have a maximum visible-light transmission value from any incident angle being no greater than about five percent (5%). In an example [300] of the lighting system wherein the first visible-light-reflective surface [408] of the bowl reflector [302] may have a maximum visible-light transmission value from any incident angle being no greater than about five percent (5%), the metallic layer of the first visible-light-reflective surface [408] may have a composition that includes silver.

In other examples [300] of the lighting system, the first visible-light-reflective surface [408] of the bowl reflector [302] may have another central axis [418]; and the another central axis [418] may be aligned with the central axis [318]

of the funnel-shaped body [416]. In some of those examples [300] of the lighting system, the first and second bases [442], [444] of the optically-transparent body [440] may respectively have circular perimeters [488], [489], and the optically-transparent body [440] may generally have a circular-cylindrical shape, and the funnel reflector [314] may have a circular perimeter [303]; and the horizon [304] of the bowl reflector [302] may likewise have a circular perimeter [305]. In other examples [300] of the lighting system, the first and second bases [442], [444] of the optically-transparent body [440] may respectively have elliptical perimeters [488], [489] (not shown), and the optically-transparent body [440] may generally have an elliptical-cylindrical shape (not shown), and the funnel reflector [314] may have an elliptical perimeter (not shown); and the horizon [304] of the bowl reflector [302] may likewise have an elliptical perimeter (not shown).

In further examples [300] of the lighting system, the first and second bases [442], [444] of the optically-transparent body [440] may respectively have multi-faceted perimeters [488], [489] being rectangular, hexagonal, octagonal, or otherwise polygonal, and the optically-transparent body [440] may generally have a side wall bounded by multi-faceted perimeters [488], [489] being rectangular-, hexagonal-, octagonal-, or otherwise polygonal-cylindrical (not shown), and the funnel reflector [314] may have a perimeter [303] being rectangular-, hexagonal-, octagonal-, or otherwise polygonal-cylindrical; and the horizon [304] of the bowl reflector [302] may likewise have a multi-faceted perimeter [305] being rectangular, hexagonal, octagonal, or otherwise polygonal (not shown).

In additional examples [300] of the lighting system, the first visible-light-reflective surface [408] of the bowl reflector [302] may have the another central axis [418]; and the another central axis [418] may be spaced apart from and not aligned with the central axis [318] of the funnel-shaped body [416]. As an example [300] of the lighting system, the first and second bases [442], [444] of the optically-transparent body [440] may respectively have circular perimeters [488], [489] and the optically-transparent body [440] may generally have a circular-cylindrical shape, and the funnel reflector [314] may have a circular perimeter [303]; and the horizon [304] of the bowl reflector [302] may have a multi-faceted perimeter [305] being rectangular, hexagonal, octagonal, or otherwise polygonal (not shown) not conforming with the circular shape of the perimeter [488] of the first base [442] or with the circular perimeter [303] of the funnel reflector.

In examples [300] of the lighting system as earlier discussed, the visible-light source [330] may be at the second position [364] being located, relative to the first position [354] of the ring [348] of focal points [350], [352], for causing some of the visible-light emissions [438]-[439] to be reflected by the second light-reflective parabolic surface [424] in a partially-collimated, substantially-collimated, or generally-collimated beam [465] being shaped as a ray fan of the visible-light emissions [438], [439]. Further in those examples [300] of the lighting system, the first light-reflective parabolic surface [412] of the bowl reflector [302] may have a second array of axes of symmetry being represented by arrows [405], [407] being generally in alignment with directions of propagation of visible-light emissions [438], [439] from the semiconductor light-emitting devices [332], [333] having been refracted by the side surface [446] of the optically-transparent body [440] after being reflected by the second light-reflective parabolic surface [424] of the funnel-shaped body [416]. In examples [300] of the lighting system, providing the first light-reflective parabolic surface [412] of the bowl reflector [302] as having the second array of axes of symmetry as represented by the arrows [405], [407] may cause some of the visible-light emissions [438], [439] to be remain as a partially-collimated, substantially-collimated, or generally-collimated beam upon reflection by the bowl reflector [302].

In additional examples [300] of the lighting system, the visible-light source [330] may include another semiconductor light-emitting device [334], and may also include another semiconductor light-emitting device [335]; and the first visible-light-reflective surface [408] of the bowl reflector [302] may include another portion as being a third light-reflective parabolic surface [415]; and the third light-reflective parabolic surface [415] may have a third array of axes of symmetry [417], [419] being generally in alignment with directions of propagation of visible-light emissions [434], [435] from the another semiconductor light-emitting devices [334], [335] having been refracted by the side surface [446] of the optically-transparent body [440] after being reflected by the second light-reflective parabolic surface [424] of the funnel-shaped body [416]. In examples [300] of the lighting system, providing the third light-reflective parabolic surface [415] of the bowl reflector [302] as having the third array of axes of symmetry as represented by the arrows [417], [419] may cause some of the visible-light emissions [434], [435] to be emitted as a partially-collimated or substantially-collimated beam upon reflection by the bowl reflector [302].

In further examples [300] of the lighting system, the visible-light source [330] may include a further semiconductor light-emitting device [336], and may include a further semiconductor light-emitting device [337]; and the first visible-light-reflective surface [408] of the bowl reflector [302] may include a further portion as being a fourth light-reflective parabolic surface [425]; and the fourth light-reflective parabolic surface [425] may have a fourth array of axes of symmetry [427], [429] being generally in alignment with directions of propagation of visible-light emissions [436], [437] from the further semiconductor light-emitting devices [336], [337] having been refracted by the side surface [446] of the optically-transparent body [440] after being reflected by the second light-reflective parabolic surface [424] of the funnel-shaped body [416]. In examples [300] of the lighting system, providing the fourth light-reflective parabolic surface [425] of the bowl reflector [302] as having the fourth array of axes of symmetry as represented by the arrows [427], [429] may cause some of the visible-light emissions [436], [437] to be emitted as a partially-collimated beam upon reflection by the bowl reflector [302].

As additional examples [300] of the lighting system, the first visible-light-reflective surface [408] of the bowl reflector [302] may be configured for reflecting the visible-light emissions [434]-[439] toward the emission aperture [406] of the bowl reflector [302] for emission from the lighting system in a partially-collimated beam [443] having an average crossing angle of the visible-light emissions [434]-[439], as defined in directions deviating from being parallel with the central axis [318], being no greater than about forty-five degrees. As further examples [300] of the lighting system, the first visible-light-reflective surface [408] of the bowl reflector [302] may be configured for reflecting the visible-light emissions [434]-[439] toward the emission aperture [406] of the bowl reflector [302] for emission from the lighting system in a substantially-collimated beam [443] having an average crossing angle of the visible-light emissions [434]-[439], as defined in directions deviating from being parallel with the central axis [318], being no greater than about twenty-five degrees.

In other examples [300] of the lighting system, the first visible-light-reflective surface [408] may be configured for reflecting the visible-light emissions [434]-[439] toward the emission aperture [406] of the bowl reflector [302] for emission from the lighting system with the beam as having a beam angle being within a range of between about three degrees (3°) and about seventy degrees (70°). Still further in these examples [300] of the lighting system, the first visible-light-reflective surface [408] may be configured for reflecting the visible-light emissions [434]-[439] toward the emission aperture [406] of the bowl reflector [302] for emission from the lighting system with the beam as having a beam angle being within a selectable range of between about three degrees (3°) and about seventy degrees (70°), being, as examples, about: 3-7°; 8-12°; 13-17°; 18-22°; 23-27°; 28-49°; 50-70°; 5°; 10°; 15°; 20°; 25°; 40°; or 60°.

In examples [300] of the lighting system, the rim [401] of the bowl reflector [302] may define the horizon [304] as having a diameter [402]. As examples [300] of the lighting system, configuring the first visible-light-reflective surface [408] for reflecting the visible-light emissions [434]-[439] toward the emission aperture [406] for emission from the lighting system with a selectable beam angle being within a range of between about 3° and about 70° may include selecting a bowl reflector [302] having a rim [401] defining a horizon [304] with a selected diameter [402]. In examples [300] of the lighting system, increasing the diameter [402] of the horizon [304] may cause the first beam [453] of visible-light emissions [438], [439] and the second beam [455] of visible-light emissions [434], [435] and the third beam [457] of visible-light emissions [436], [437] to mutually intersect in the beam [443] with a greater beam angle and at a relatively greater distance away from the emission aperture [406]. Further in those examples [300] of the lighting system, increasing the diameter [402] of the horizon [304] of the bowl reflector [302] may cause each of the first, second and third beams [453], [455], [457] to meet the first visible-light-reflective surface [408] at reduced incident angles.

In some examples [300] of the lighting system, the first visible-light-reflective surface may be configured for reflecting the visible-light emissions [434]-[439] toward the emission aperture [406] of the bowl reflector [302] for emission from the lighting system with the beam as having a beam angle being within a range of between about three degrees (3°) and about five degrees (5°); and as having a field angle being no greater than about eighteen degrees (18°). Further in those examples [300], emission of the visible-light emissions [434]-[439] from the lighting system as having a beam angle being within a range of between about 3-5° and a field angle being no greater than about 18° may result in a significant reduction of glare.

In examples [300] of the lighting system, the first visible-light-reflective surface [408] of the bowl reflector [302] may be configured for reflecting, toward the emission aperture [406] of the bowl reflector [302] for partially-controlled emission from the lighting system, some of the visible-light emissions from the semiconductor light-emitting devices [332], [333] and some of the visible-light emissions from the another semiconductor light-emitting devices [334], [335] and some of the visible-light emissions from the further semiconductor light-emitting devices [336], [337].

In additional examples [300] of the lighting system, the first light-reflective parabolic surface [412] of the bowl reflector [302] may be a multi-segmented surface. In further examples [300] of the lighting system, the third light-reflective parabolic surface [415] of the bowl reflector [302] may be a multi-segmented surface. In other examples [300] of the lighting system, the fourth light-reflective parabolic surface [425] of the bowl reflector [302] may be a multi-segmented surface.

In additional examples [300] of the lighting system, the first light-reflective parabolic surface [412] of the bowl reflector [302] may be a part of an elliptic paraboloid or a part of a paraboloid of revolution. In further examples [300] of the lighting system, the third light-reflective parabolic surface [415] of the bowl reflector [302] may be a part of an elliptic paraboloid or a part of a paraboloid of revolution. In other examples [300] of the lighting system, the fourth light-reflective parabolic surface [425] of the bowl reflector [302] may be a part of an elliptic paraboloid or a part of a paraboloid of revolution.

In other examples [300], the lighting system may include a lens [461] defining a further portion of the cavity [410], the lens [461] being shaped for covering the emission aperture [406] of the bowl reflector [302]. For example, the lens [461] may be a bi-planar lens having non-refractive anterior and posterior surfaces. Further, for example, the lens may have a central orifice [463] being configured for attachment of accessory lenses (not shown) to the lighting system [300]. Additionally, for example, the lighting system [300] may include a removable plug [467] being configured for closing the central orifice [463].

In examples [300], the lighting system may also include the bowl reflector [102] as being removable and interchangeable with the bowl reflector [302], with the bowl reflector [102] being referred to in these examples as another bowl reflector [102]. Additionally in these examples, the another bowl reflector [102] may have another rim [201] defining a horizon [104] and defining another emission aperture [206] and may have a third visible-light-reflective surface [208] defining a portion of another cavity [210], a portion of the third visible-light-reflective surface [208] being a fifth light-reflective parabolic surface [212]. Further in these examples, the fifth light-reflective parabolic surface [212] may be configured for reflecting the visible-light emissions [238], [239] toward the another emission aperture [206] of the another bowl reflector [102] for emission from the lighting system in a partially-collimated beam [243] having an average crossing angle of the visible-light emissions [238], [239], as defined in directions deviating from being parallel with the another central axis [118], being no greater than about forty-five degrees. Also in these examples, the fifth light-reflective parabolic surface [212] may be configured for reflecting the visible-light emissions [238], [239] toward the another emission aperture [206] of the another bowl reflector [102] for emission from the lighting system in a substantially-collimated beam [243] having an average crossing angle of the visible-light emissions [238], [239], as defined in directions deviating from being parallel with the another central axis [118], being no greater than about twenty-five degrees. In these examples [300] of the lighting system, the fifth light-reflective parabolic surface [212] may be configured for reflecting the visible-light emissions [238], [239] toward the another emission aperture [206] of the another bowl reflector [102] for emission from the lighting system with the beam [243] as having a beam angle being within a range of between about three degrees (3°) and about seventy degrees (70°). In some of these examples [300] of the lighting system, the horizon [304] may have a uniform or average diameter [402] being greater than another uniform or average diameter of the another horizon [104]. In these examples [300] of the lighting system, the bowl reflector [302] may reflect the visible-light emissions [438], [439] toward the emission aperture [406] with the beam [443] as having a beam angle being smaller than another beam angle of the visible-light emissions [238], [239] as reflected toward the emission aperture [206] by the another bowl reflector [102]. In these examples [300] of the lighting system, the fifth light-reflective parabolic surface [212] may be configured for reflecting the visible-light emissions [238], [239] toward the another emission aperture [206] of the another bowl reflector [102] for emission from the lighting system with the beam as having a field angle being no greater than about eighteen degrees (18°).

Figure 6:
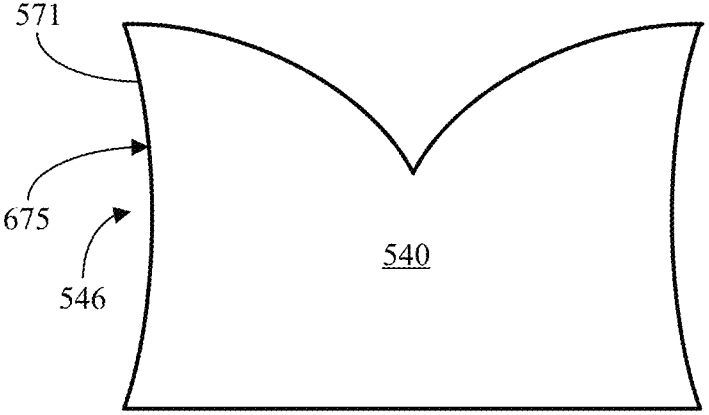
FIG. 6 is a schematic cross-sectional view taken along the line 6-6 showing the additional example of the alternative optically-transparent body.
Figure 5:
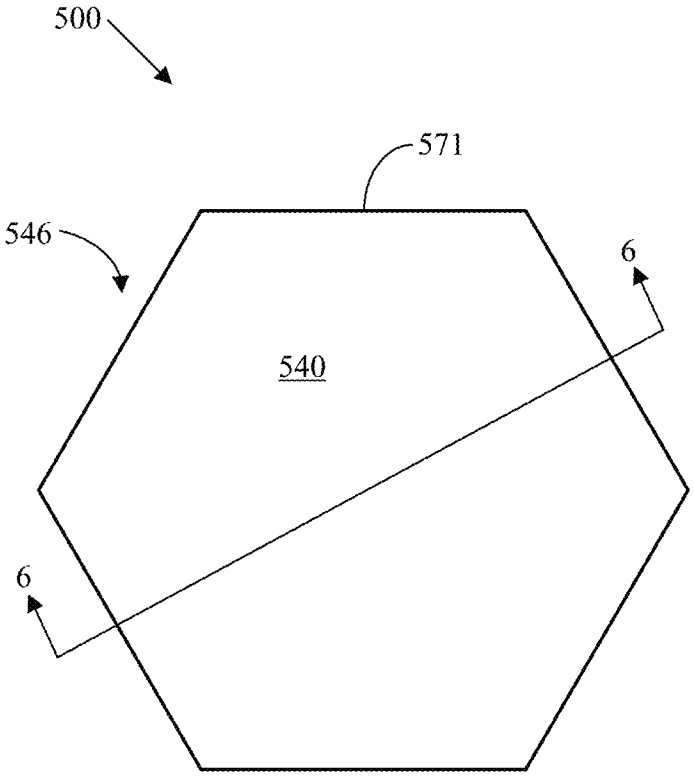
FIG. 5 is a schematic top view showing an additional example of an alternative optically-transparent body that may be included in the examples of the lighting system.

FIG. 5 is a schematic top view showing an additional example [500] of an alternative optically-transparent body [540] that may be substituted for the optically-transparent bodies [240], [440] in the examples [100], [300] of the lighting system. FIG. 6 is a schematic cross-sectional view taken along the line 6-6 showing the additional example [500] of the alternative optically-transparent body [540]. Referring to FIGS. 5-6, the additional example [500] of an alternative optically-transparent body [540] may include a plurality of vertically-faceted sections each forming one of a plurality of facets [571] of a side surface [546] of the optically-transparent body [540], and each one of the facets [571] may have a concave surface [675].

Figure 8:
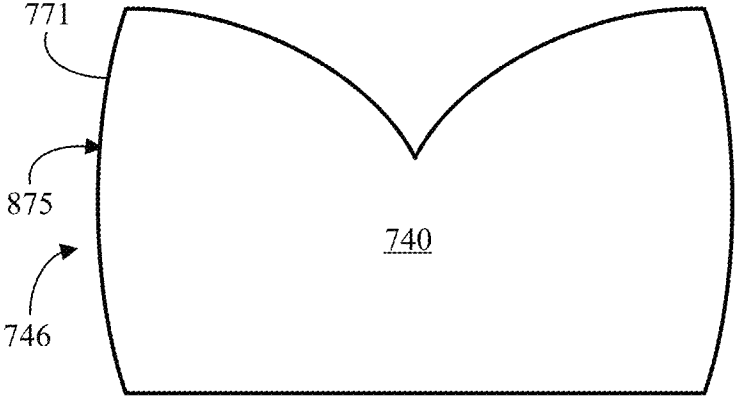
FIG. 8 is a schematic cross-sectional view taken along the line 8-8 showing the further example of the alternative optically-transparent body.
Figure 7:
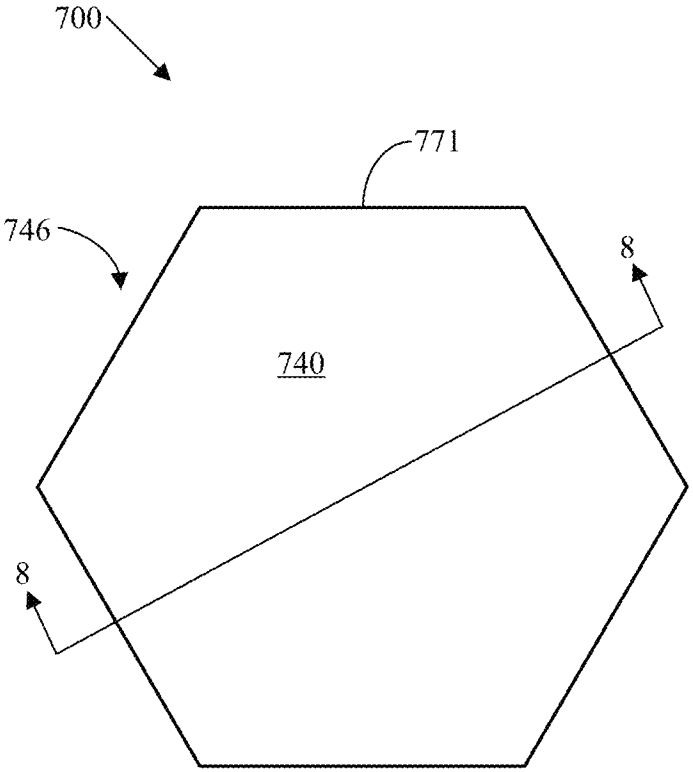
FIG. 7 is a schematic top view showing a further example of an alternative optically-transparent body that may be included in the examples of the lighting system.

FIG. 7 is a schematic top view showing a further example [700] of an alternative optically-transparent body [740] that may be substituted for the optically-transparent bodies [240], [440] in the examples [100], [300] of the lighting system. FIG. 8 is a schematic cross-sectional view taken along the line 8-8 showing the further example [700] of the alternative optically-transparent body [740]. Referring to FIGS. 7-8, the further example [700] of an alternative optically-transparent body [740] may include a plurality of vertically-faceted sections each forming one of a plurality of facets [771] of a side surface [746] of the optically-transparent body [740], and each one of the facets [771] may have a convex surface [875].

Figure 10:
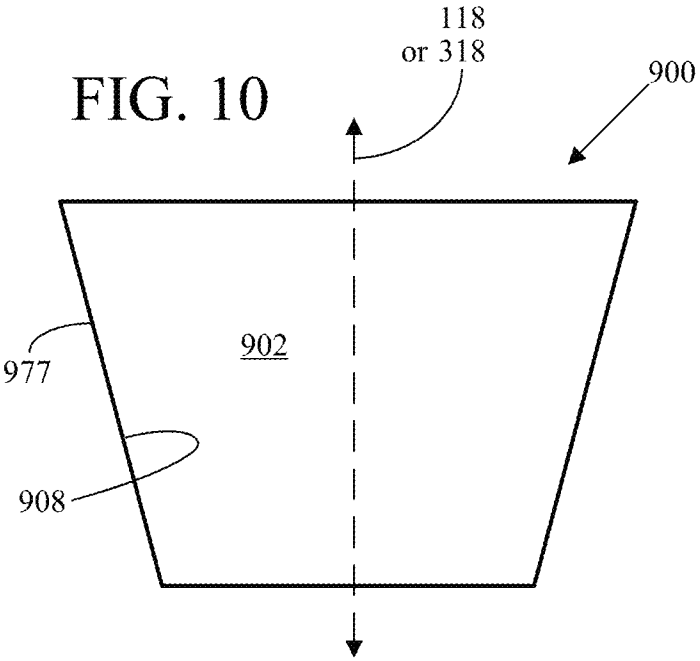
FIG. 10 is a schematic cross-sectional view taken along the line 10-10 showing the example of an alternative bowl reflector.
Figure 11:
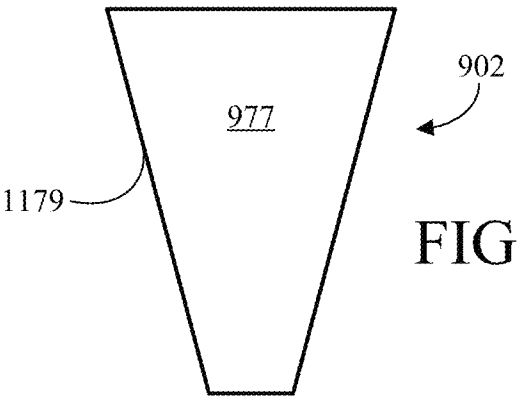
FIG. 11 shows a portion of the example of an alternative bowl reflector.
Figure 9:
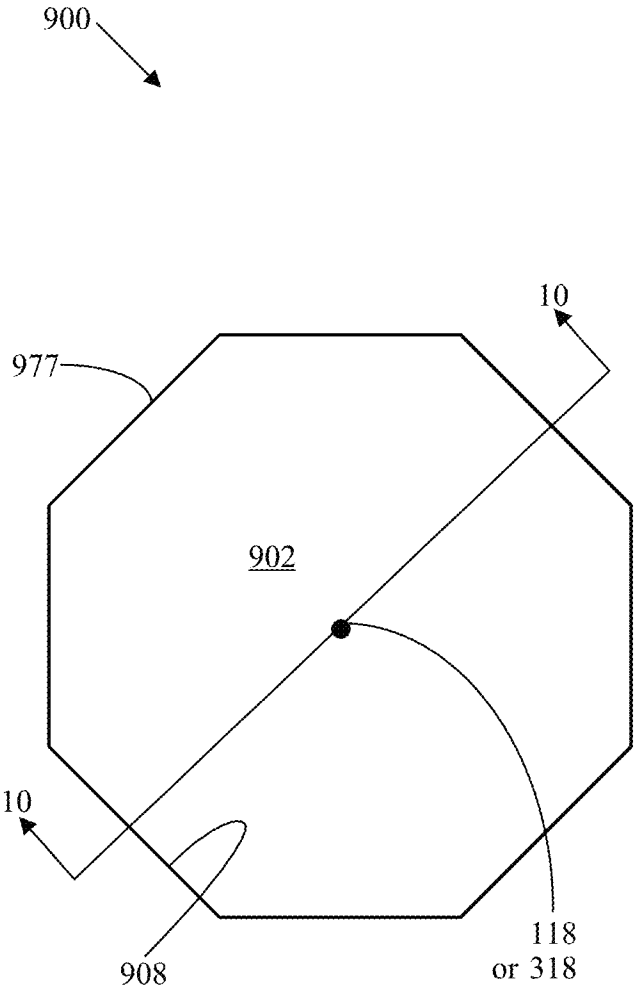
FIG. 9 is a schematic top view showing an example of an alternative bowl reflector that may be included in the examples of the lighting system.

FIG. 9 is a schematic top view showing an example [900] of an alternative bowl reflector [902] that may be substituted for the bowl reflectors [102], [302] in the examples [100], [300] of the lighting system. FIG. 10 is a schematic cross-sectional view taken along the line 10-10 showing the example [900] of an alternative bowl reflector [902]. FIG. 11 shows a portion of the example [900] of an alternative bowl reflector [902]. Referring to FIGS. 9-11, a first visible-light reflective surface [908] of the bowl reflector [902] may include a plurality of vertically-faceted sections [977] being mutually spaced apart around and joined together around the central axis [118], [318] of the examples [100], [300] of the lighting system. Additionally in the examples [900], each one of the vertically-faceted sections may form a one of a plurality of facets [977] of the first visible-light-reflective surface [908], and each one of the facets [977] may have a generally flat visible-light reflective surface [908]. In some of the further examples [900], each one of the vertically-faceted sections [977] may have a generally pie-wedge-shaped perimeter [1179].

Figure 13:
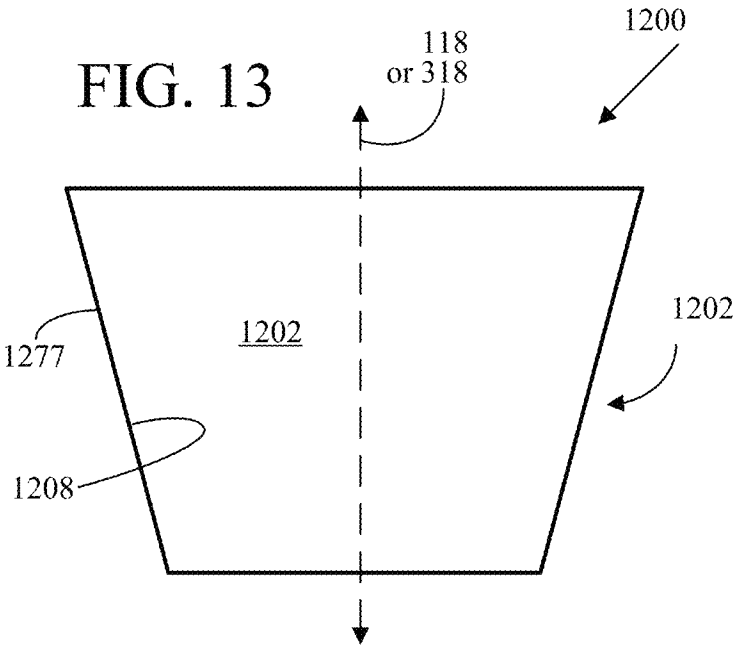
FIG. 13 is a schematic cross-sectional view taken along the line 13-13 showing the example of an alternative bowl reflector.
Figure 14:
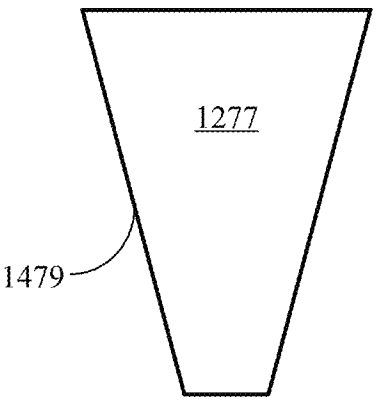
FIG. 14 shows a portion of the example of an alternative bowl reflector.
Figure 12:
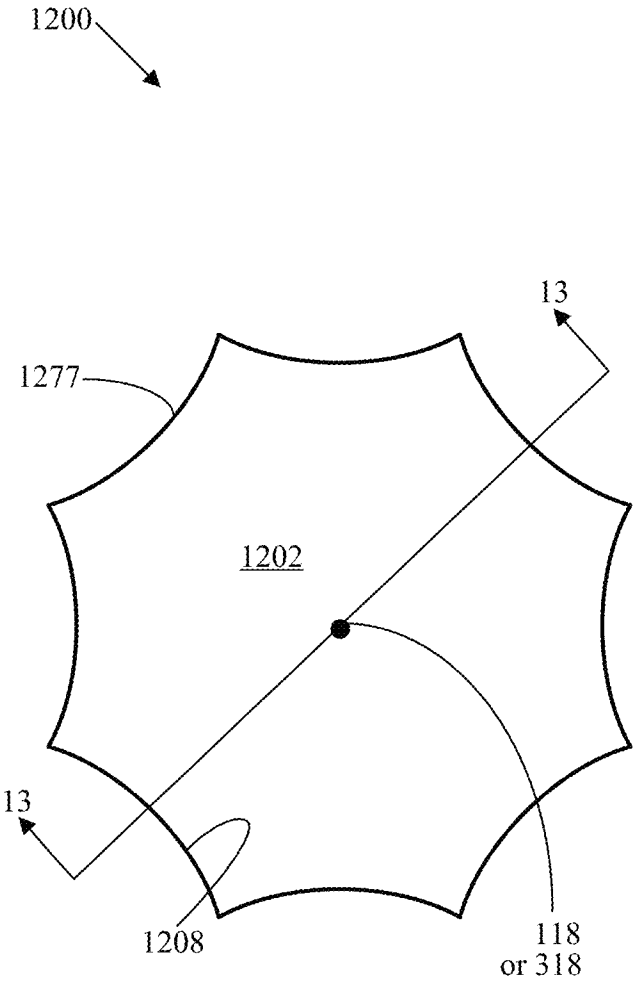
FIG. 12 is a schematic top view showing an example of an alternative bowl reflector that may be included in the examples of the lighting system.

FIG. 12 is a schematic top view showing an example [1200] of an alternative bowl reflector [1202] that may be substituted for the bowl reflectors [102], [302] in the examples [100], [300] of the lighting system. FIG. 13 is a schematic cross-sectional view taken along the line 13-13 showing the example [1200] of an alternative bowl reflector [1202]. FIG. 14 shows a portion of the example [1200] of an alternative bowl reflector [1202]. Referring to FIGS. 12-14, a first visible-light reflective surface [1208] of the bowl reflector [1202] may include a plurality of vertically-faceted sections [1277] being mutually spaced apart around and joined together around the central axis [118], [318] of the examples [100], [300] of the lighting system. Additionally in the examples [1200], each one of the vertically-faceted sections may form a one of a plurality of facets [1277] of the first visible-light-reflective surface [1208], and each one of the facets [1277] may have a generally convex visible-light reflective surface [1208]. In some of the further examples [1200], each one of the vertically-faceted sections [1277] may have a generally pie-wedge-shaped perimeter [1479].

Figure 16:
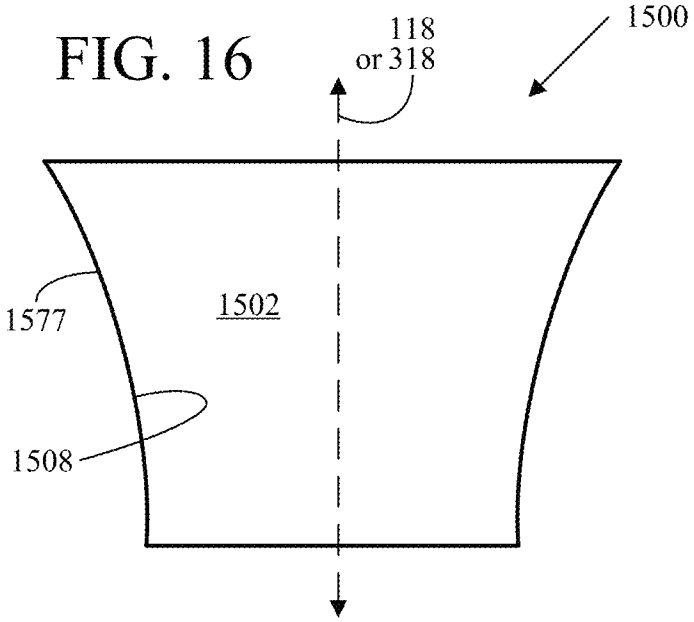
FIG. 16 is a schematic cross-sectional view taken along the line 16-16 showing the example of an alternative bowl reflector.
Figure 17:
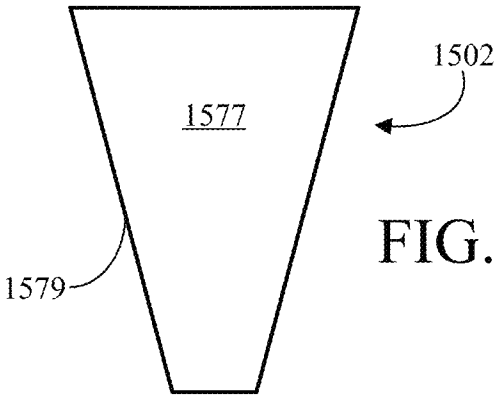
FIG. 17 shows a portion of the example of an alternative bowl reflector.
Figure 15:
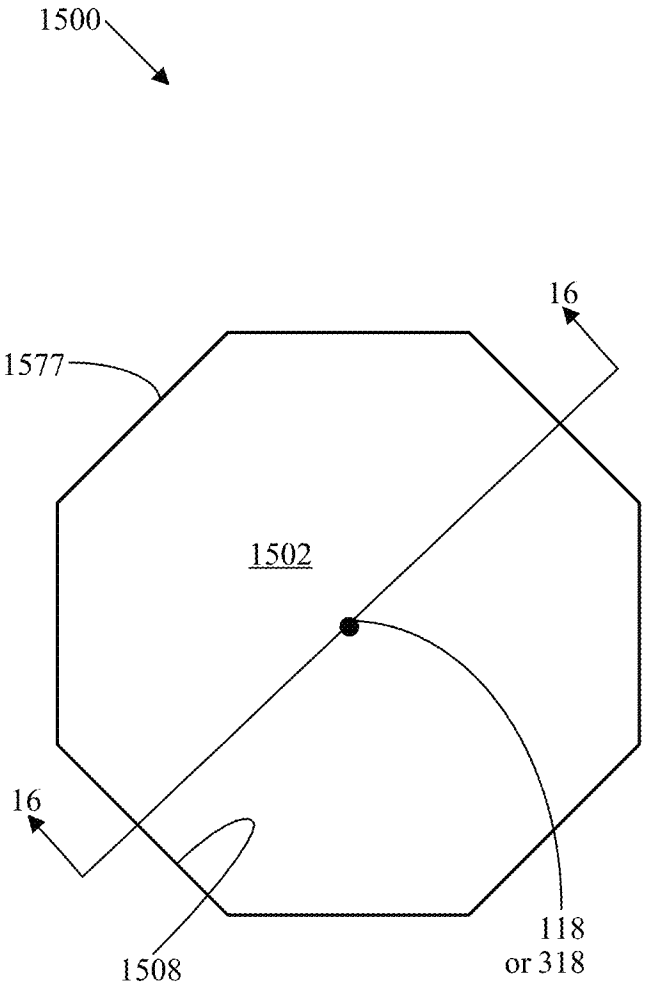
FIG. 15 is a schematic top view showing an example of an alternative bowl reflector that may be included in the examples of the lighting system.

FIG. 15 is a schematic top view showing an example [1500] of an alternative bowl reflector [1502] that may be substituted for the bowl reflectors [102], [302] in the examples [100], [300] of the lighting system. FIG. 16 is a schematic cross-sectional view taken along the line 16-16 showing the example [1500] of an alternative bowl reflector [1502]. FIG. 17 shows a portion of the example [1500] of an alternative bowl reflector [1502].

Referring to FIGS. 15-17, a first visible-light reflective surface [1508] of the bowl reflector [1502] may include a plurality of vertically-faceted sections [1577] being mutually spaced apart around and joined together around the central axis [118], [318] of the examples [100], [300] of the lighting system. Additionally in the examples [1500], each one of the vertically-faceted sections may form a one of a plurality of facets [1577] of the first visible-light-reflective surface [1508], and each one of the facets [1577] may have a visible-light reflective surface [1508] being concave, as shown in FIG. 16, in directions along the central axis [118], [318]. In some of the further examples [1500], each one of the vertically-faceted sections [1577] may also have a generally pie-wedge-shaped perimeter [1779].

EXAMPLES

Figure 19:
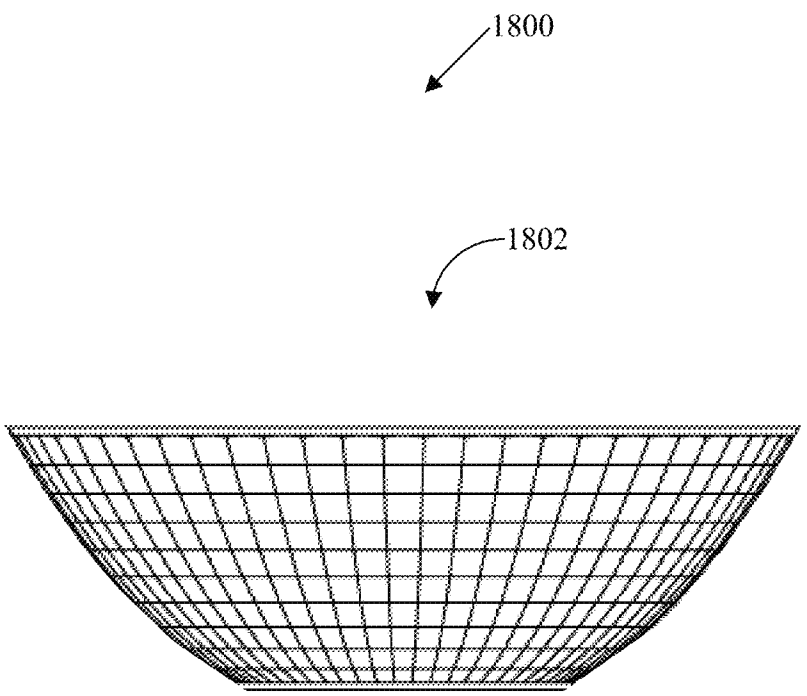
FIG. 19 is a schematic cross-sectional view taken along the line 19-19 showing the example of an alternative bowl reflector.
Figure 18:
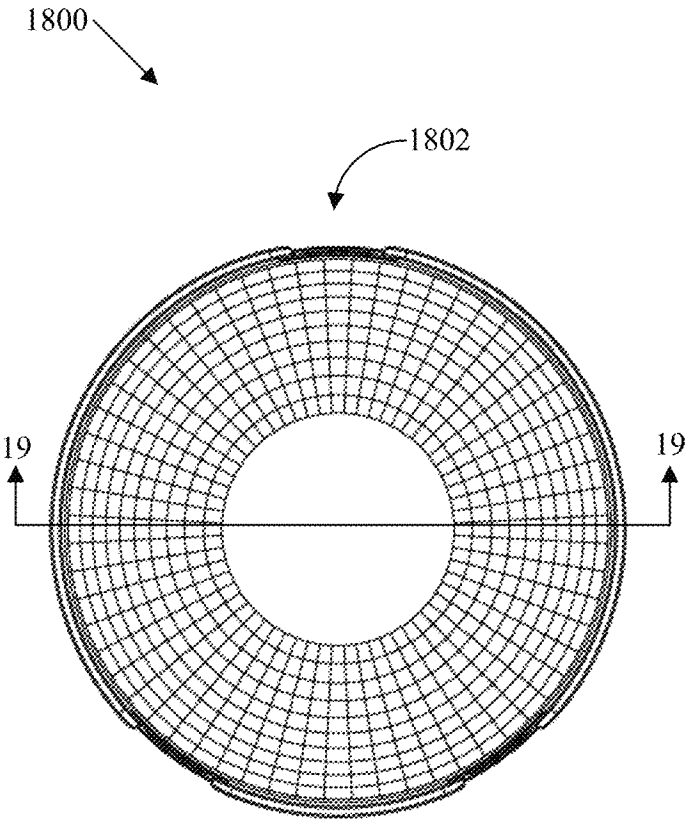
FIG. 18 is a schematic top view showing an example of an alternative bowl reflector that may be included in the examples of the lighting system.
Figure 21:
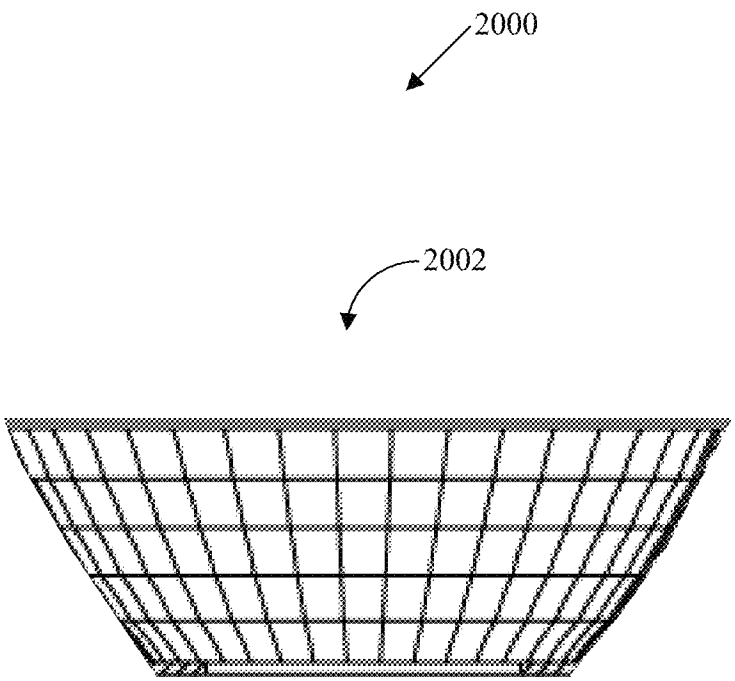
FIG. 21 is a schematic cross-sectional view taken along the line 21-21 showing the example of an alternative bowl reflector.
Figure 20:
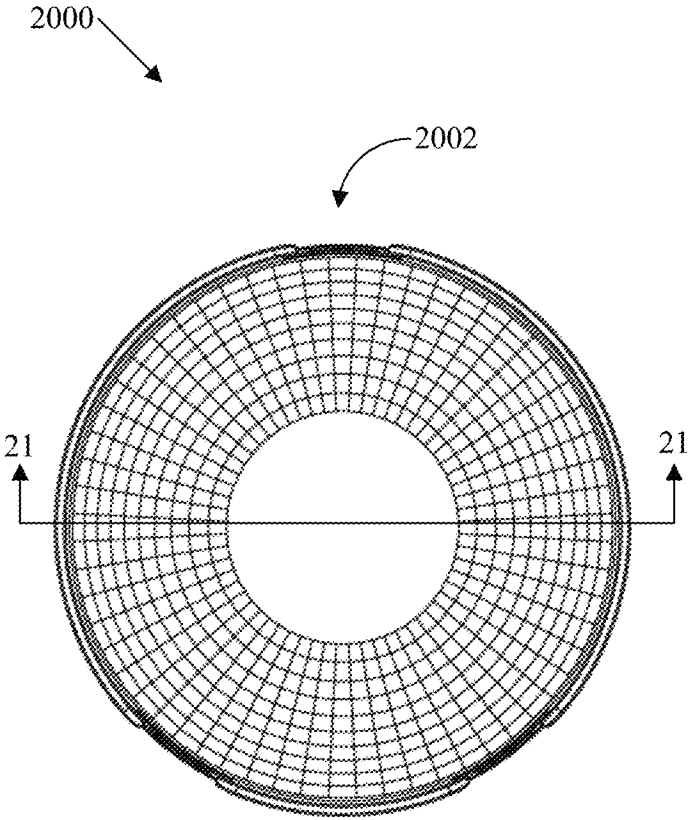
FIG. 20 is a schematic top view showing an example of an alternative bowl reflector that may be included in the examples of the lighting system.
Figure 22:
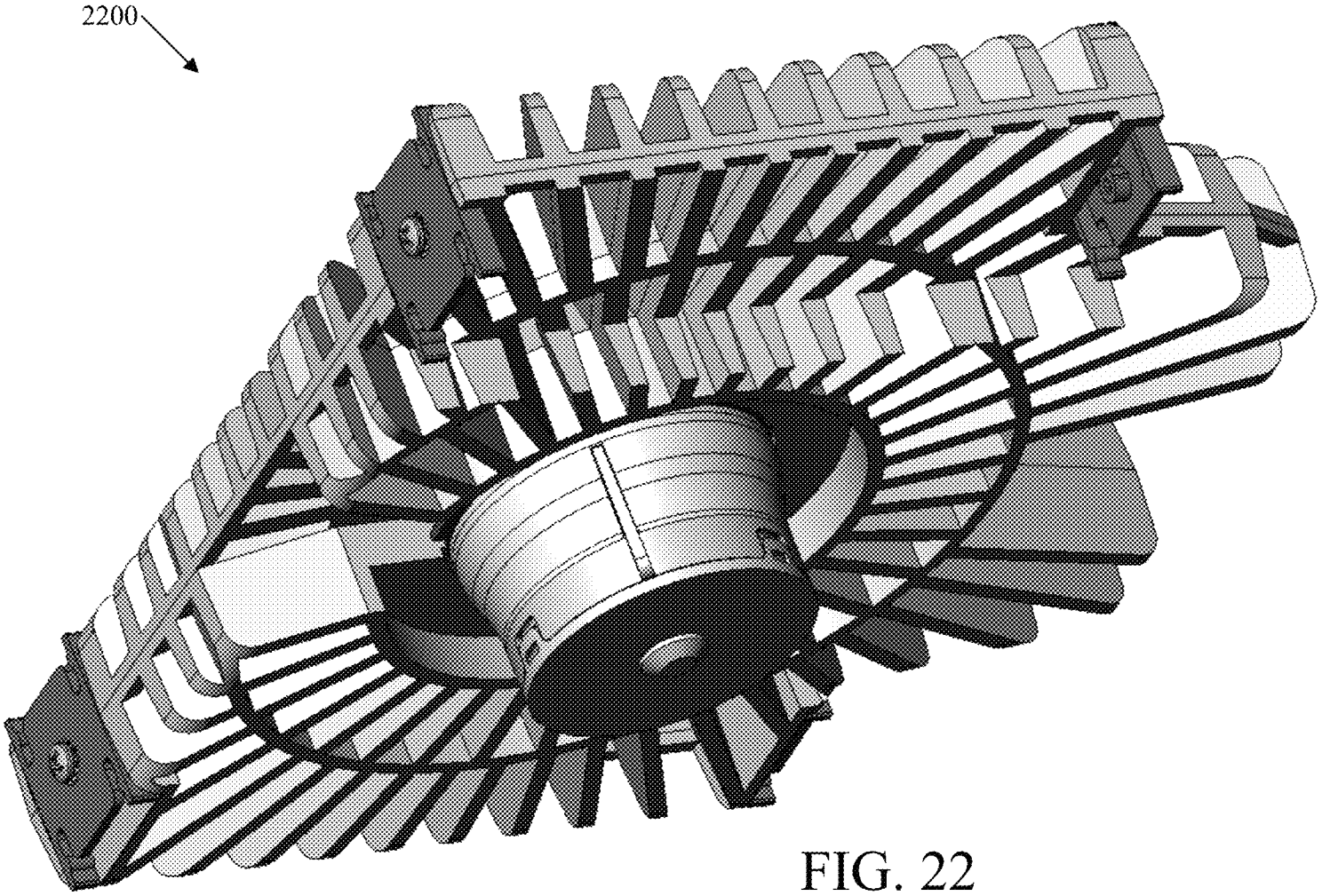
FIGS. 22-49 collectively show an example [2200] of a lighting assembly that includes a bowl reflector, an optically-transparent body, and a funnel reflector, that may be substituted for such elements in the examples [100], [300] of the lighting system.
Figure 23:
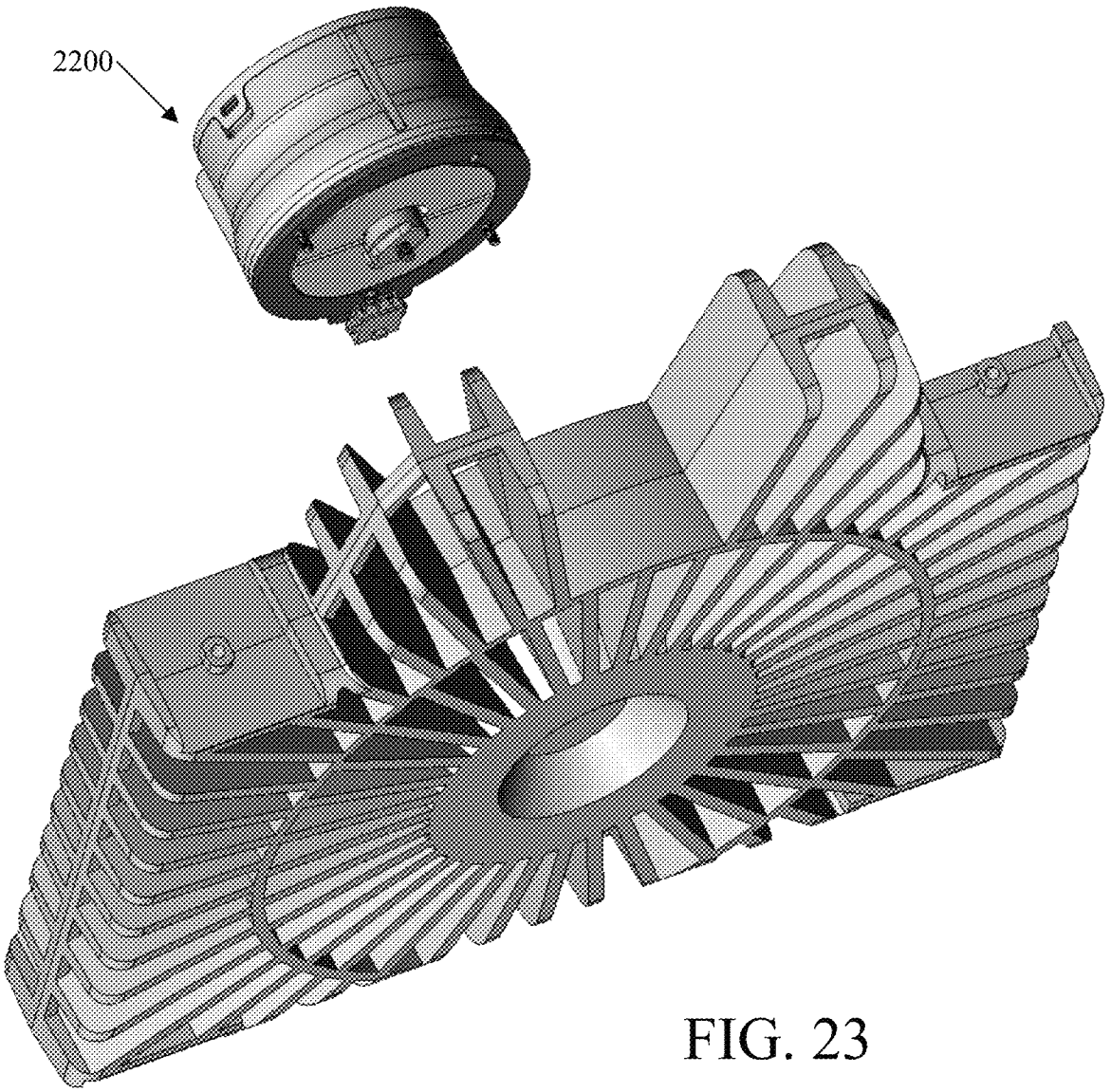
Figure 24:
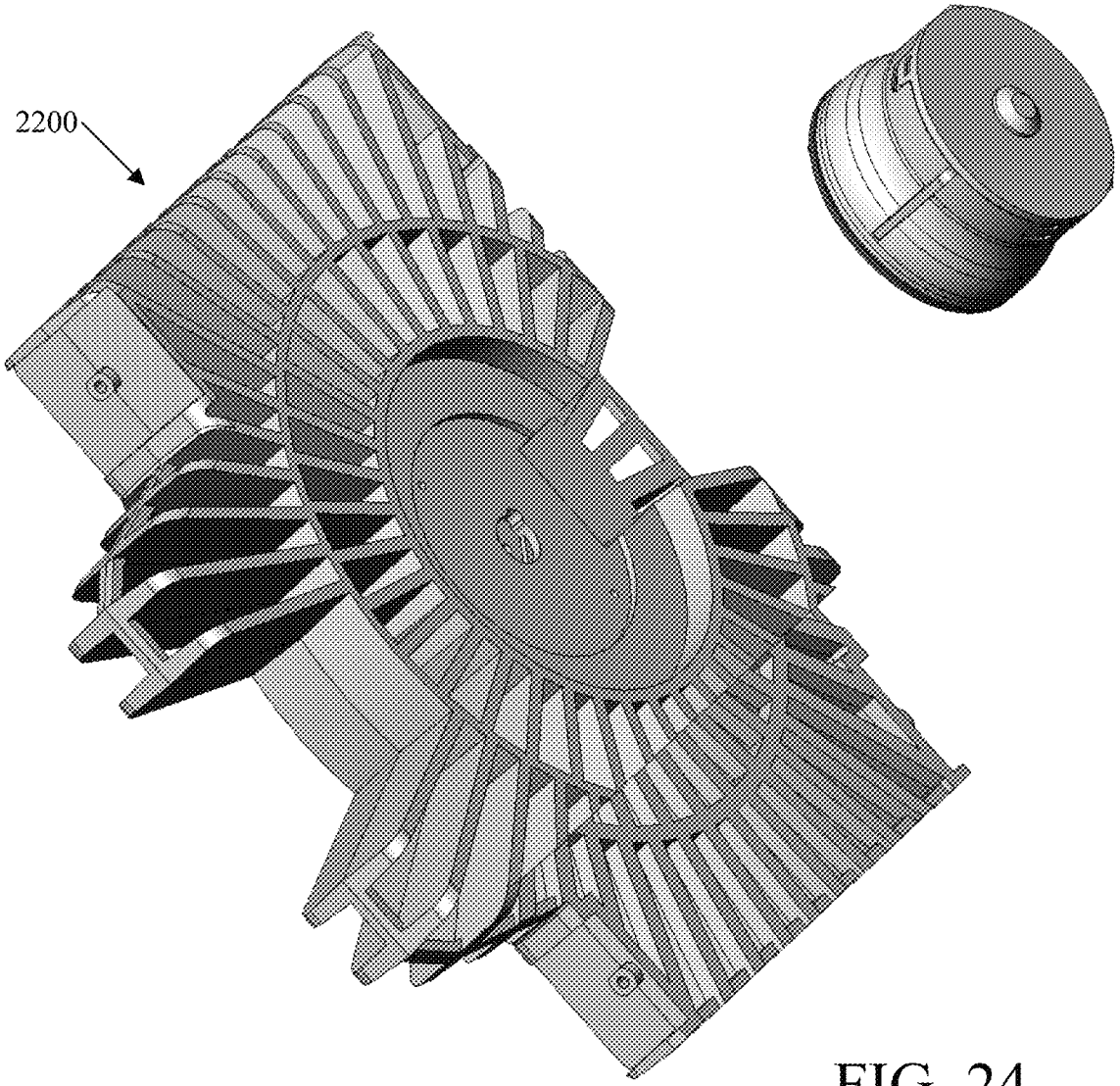
Figure 25:
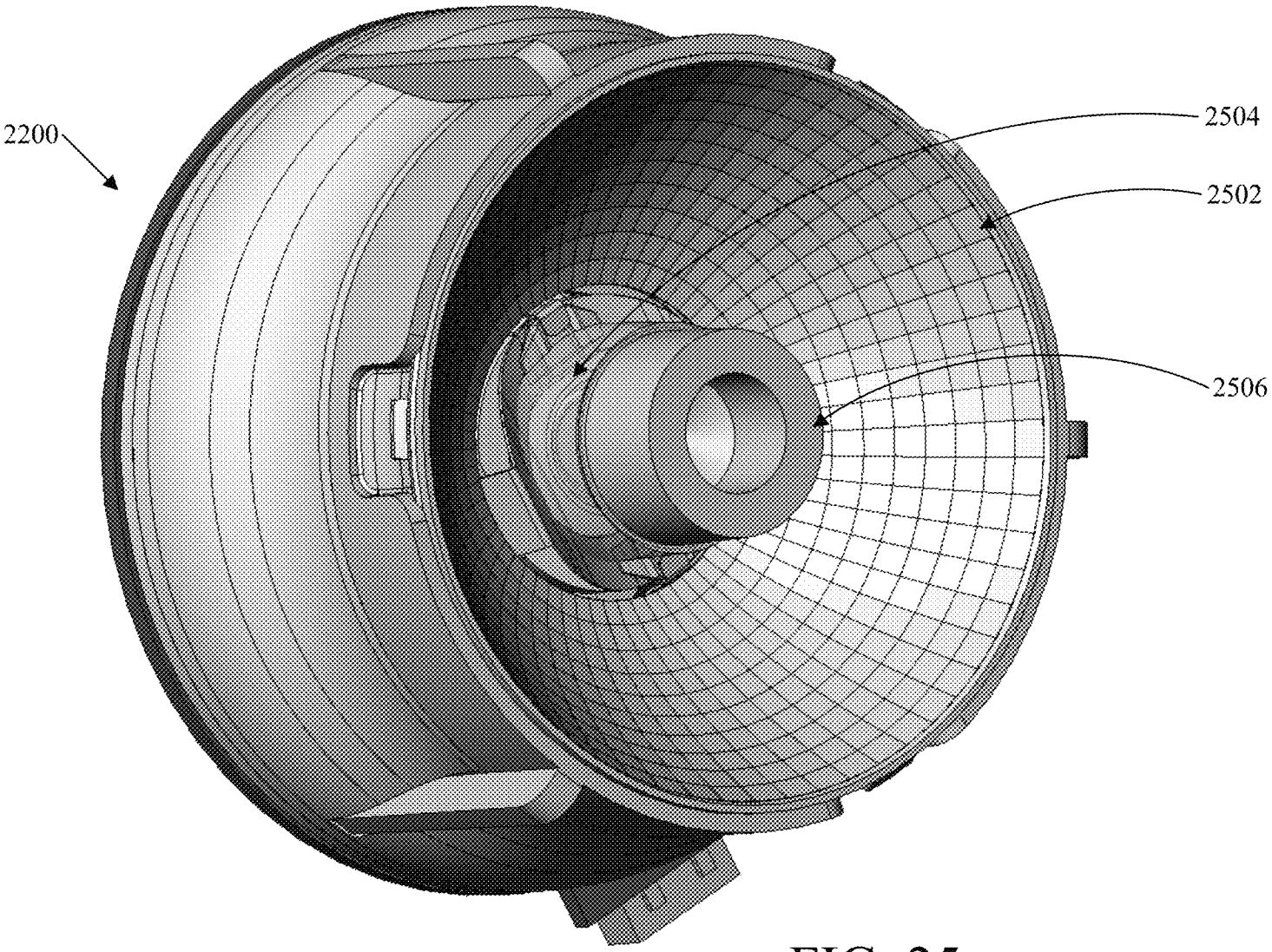
Figure 26:
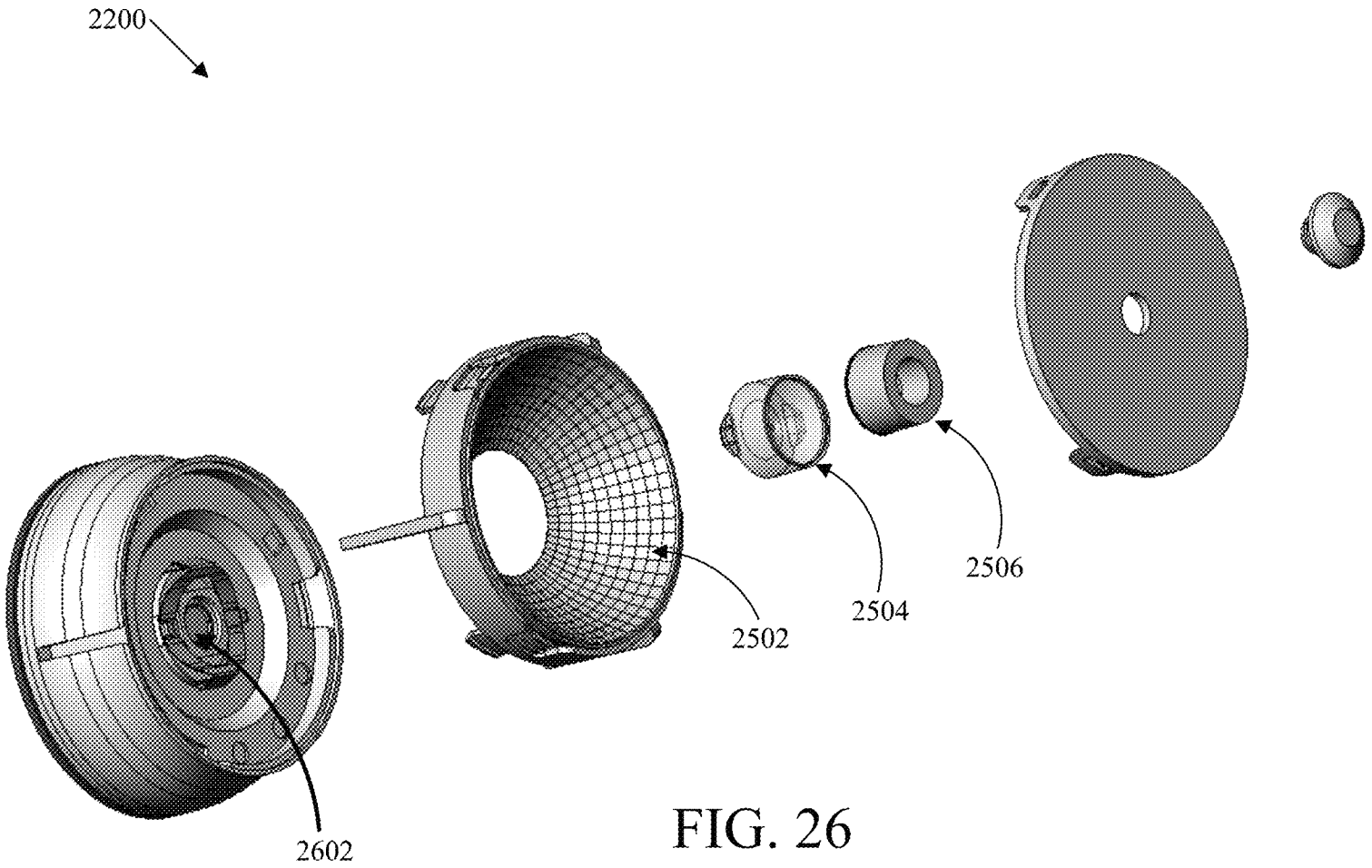
Figure 27:
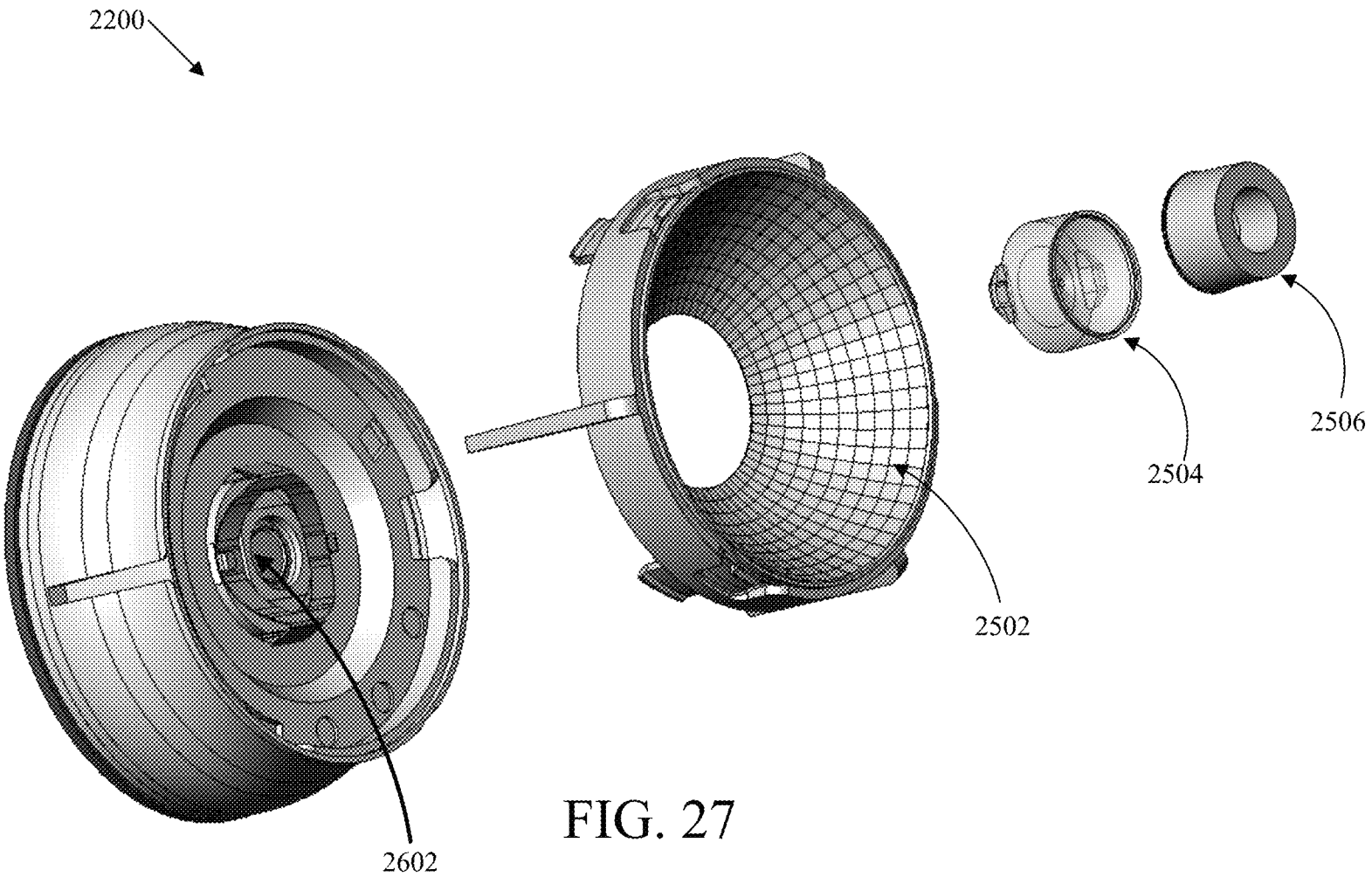
Figure 28:
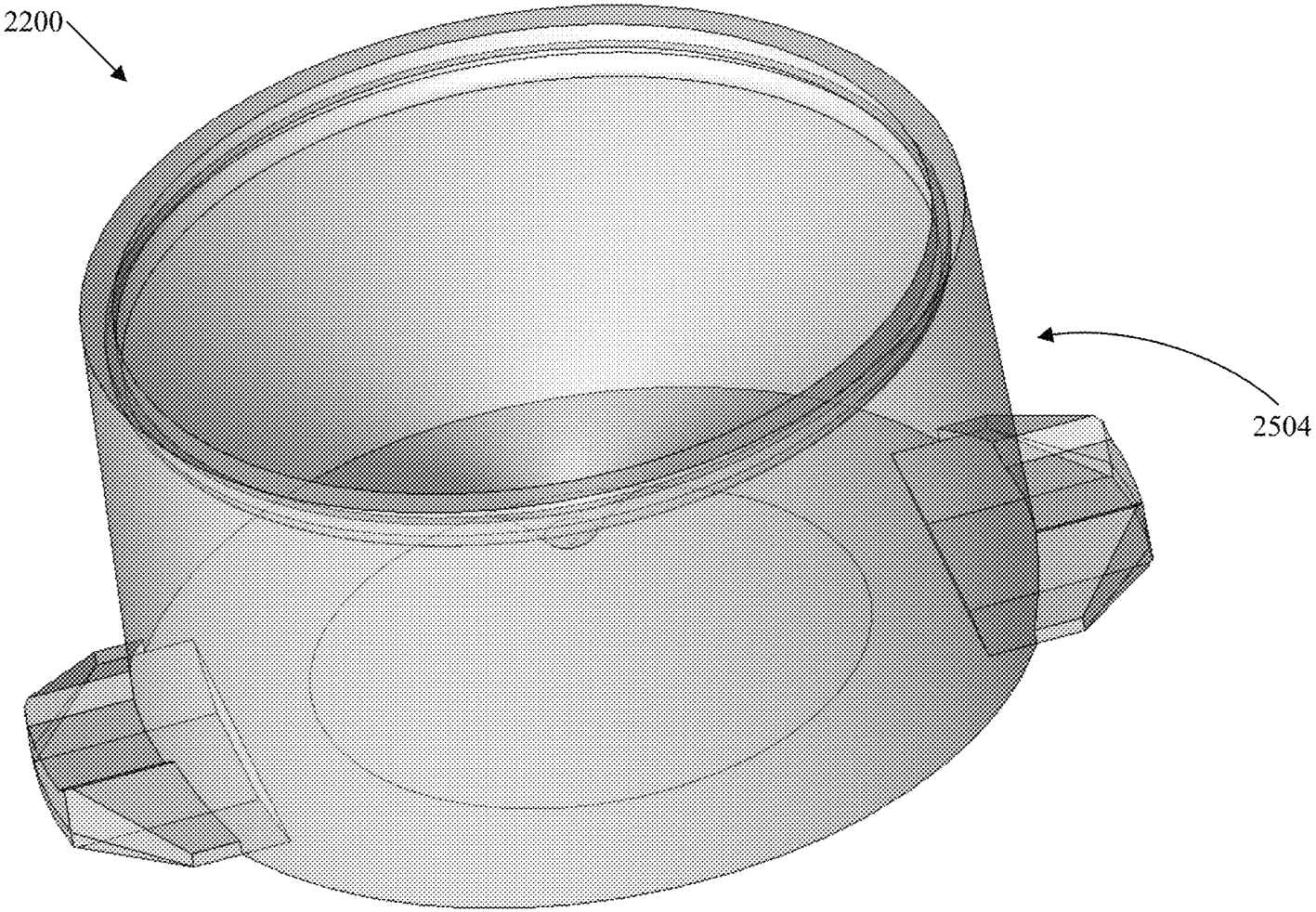
Figure 29:
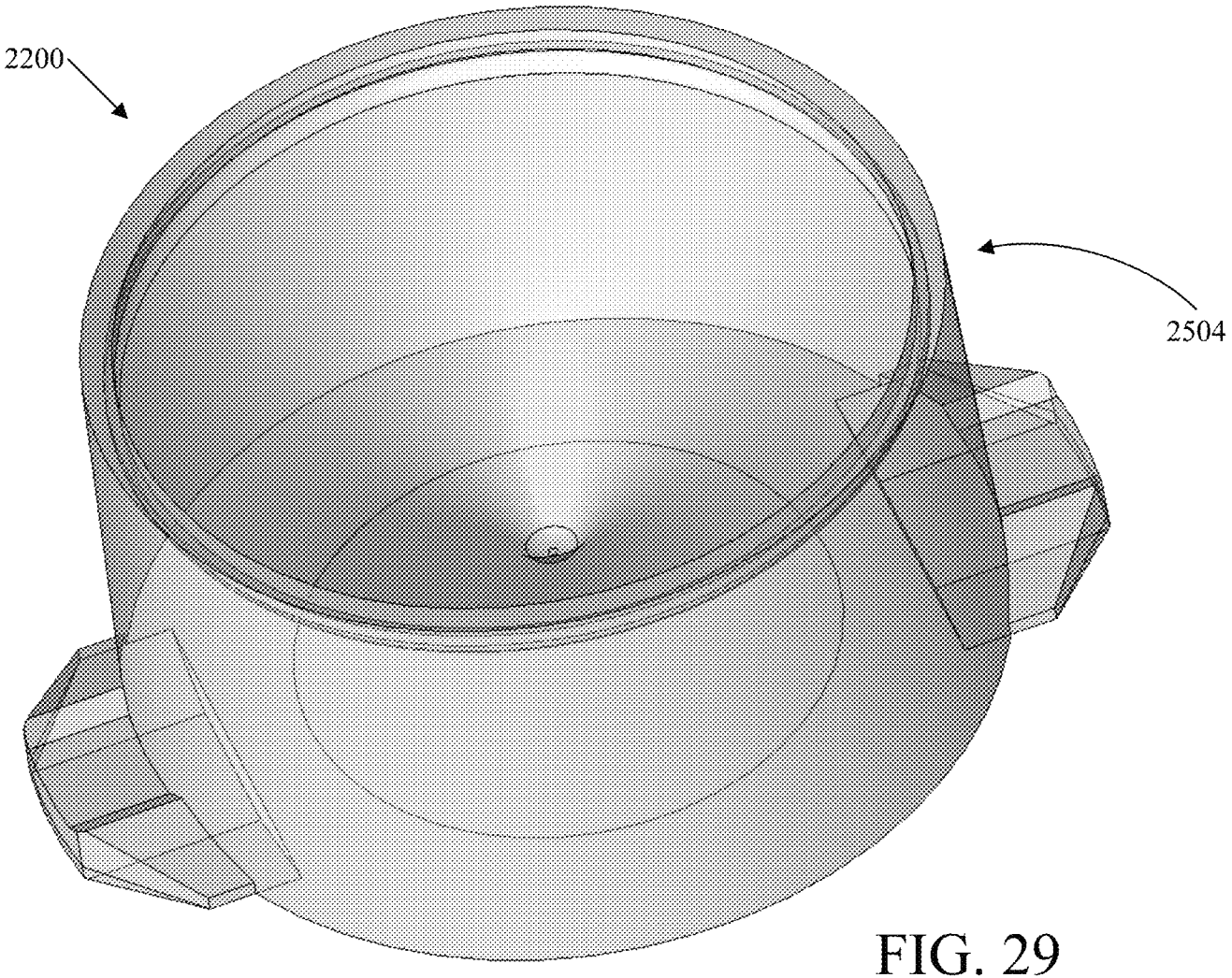
Figure 30:
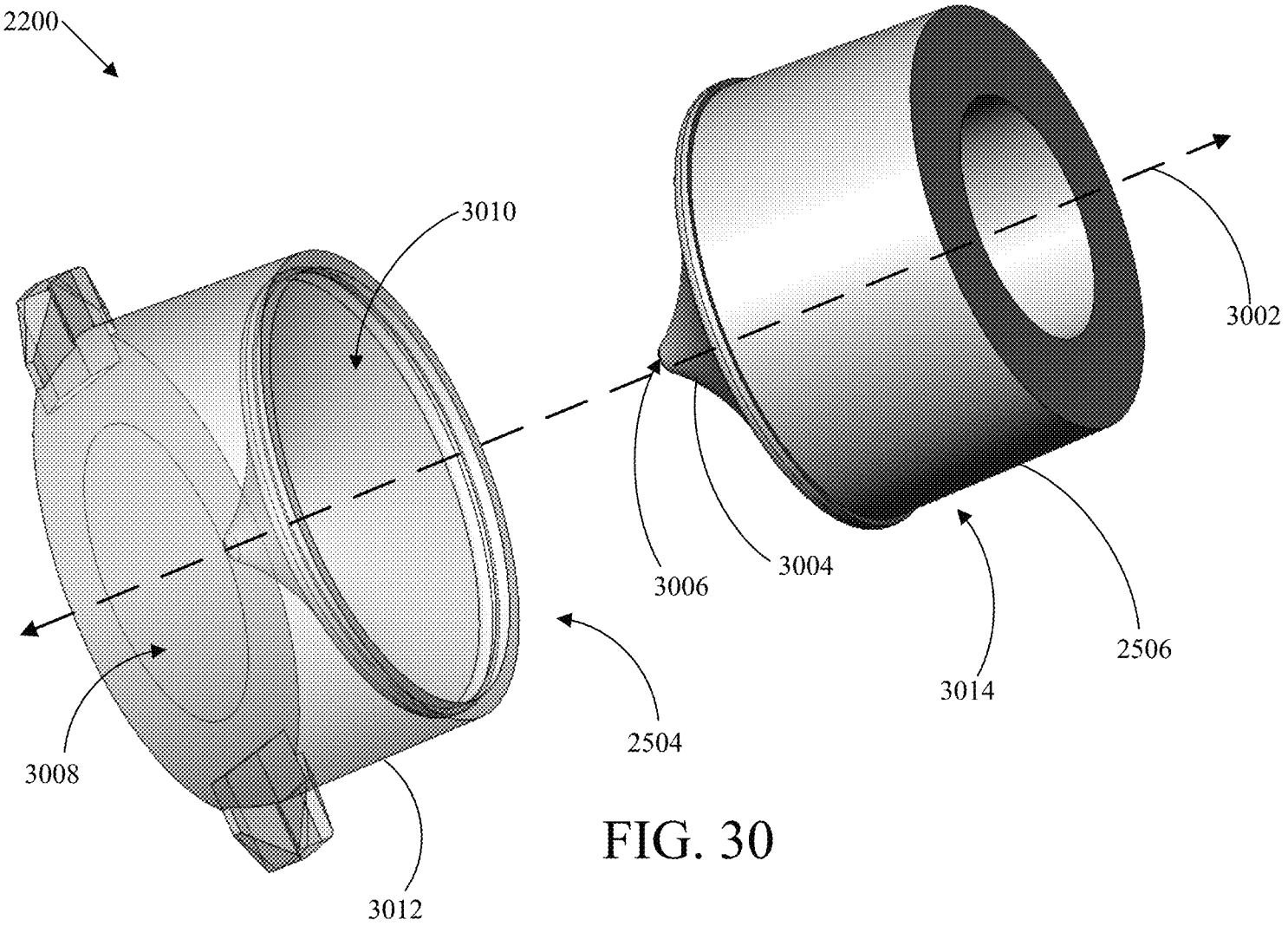
Figure 31:
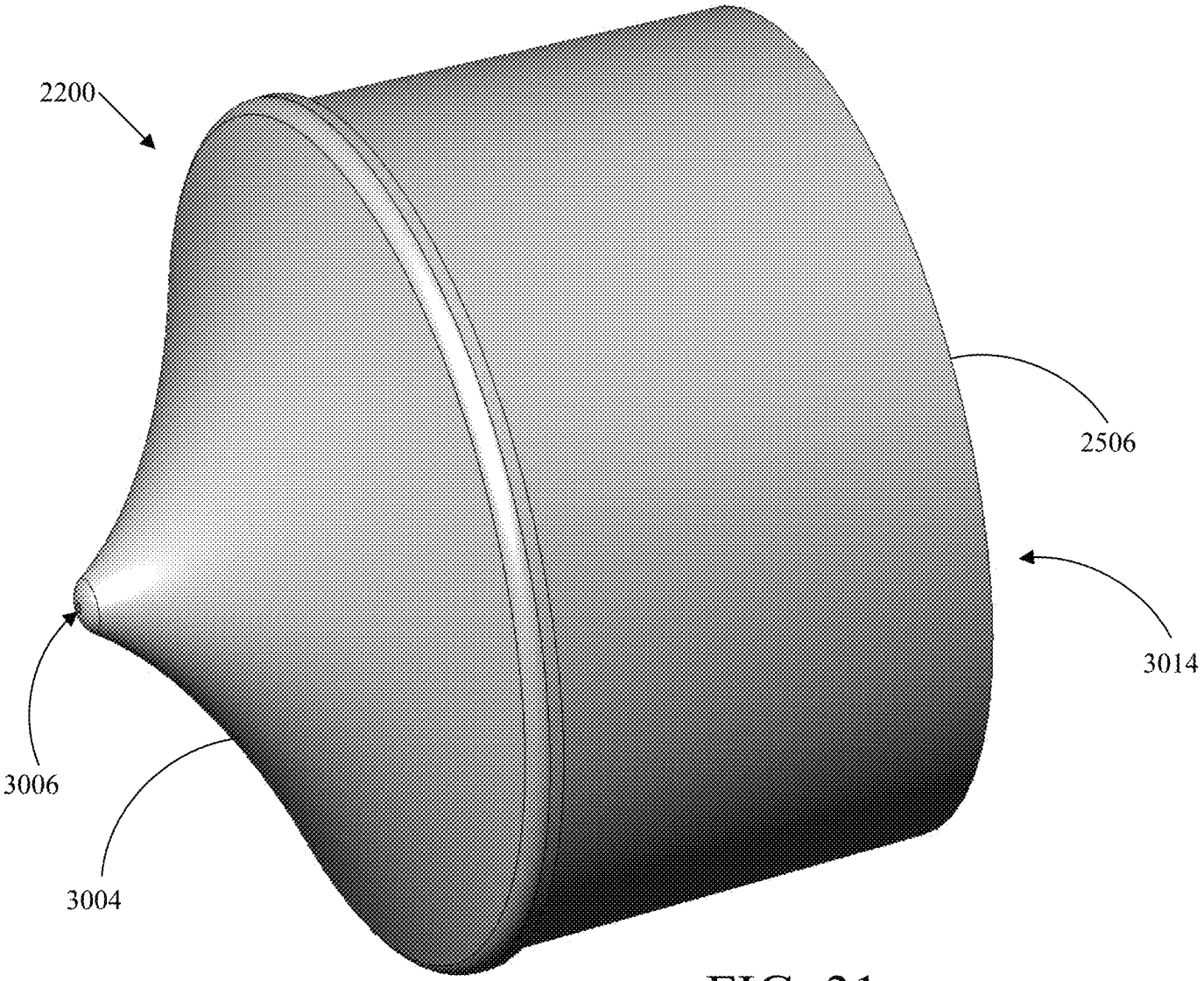
Figure 32:
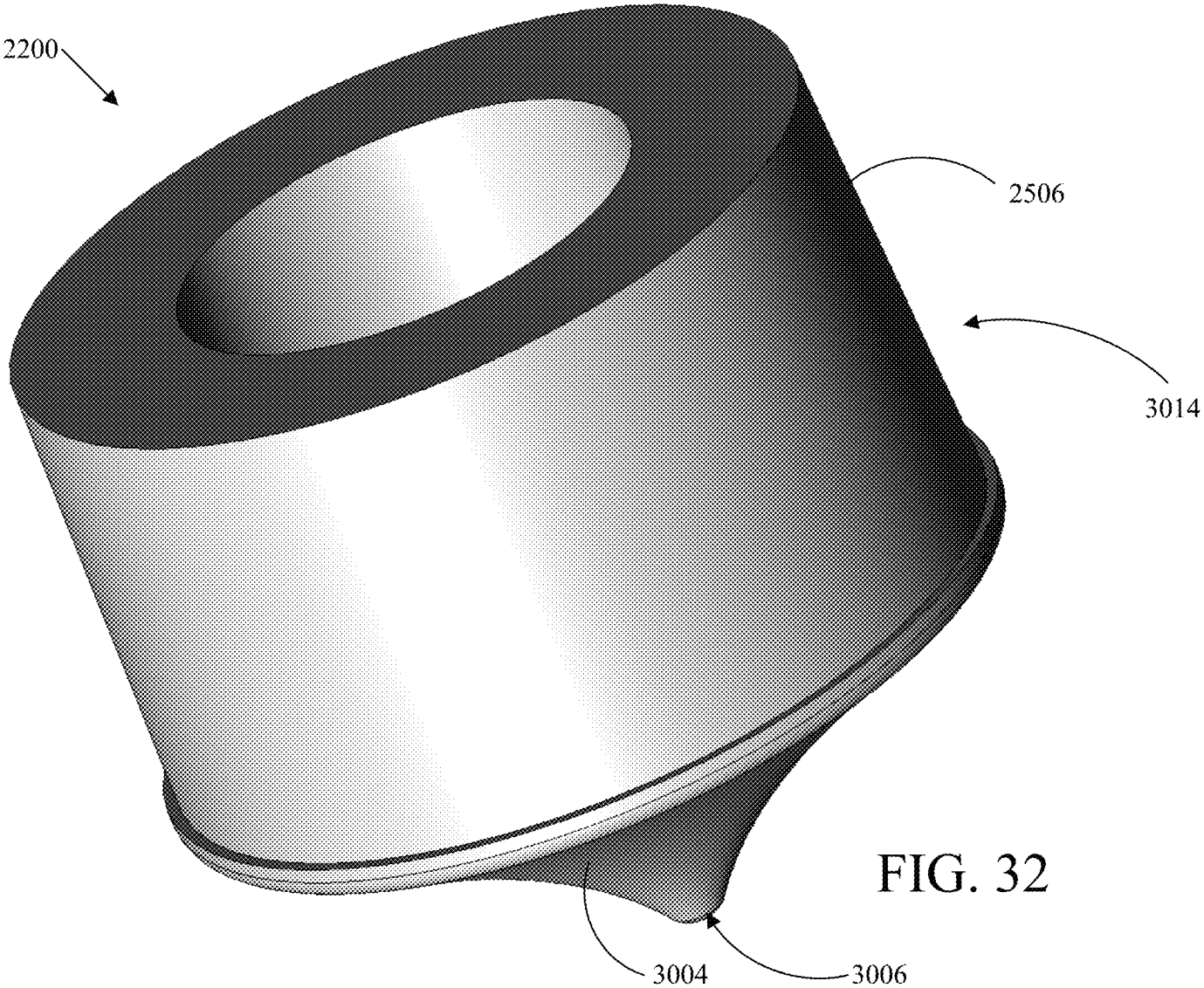
Figure 33:
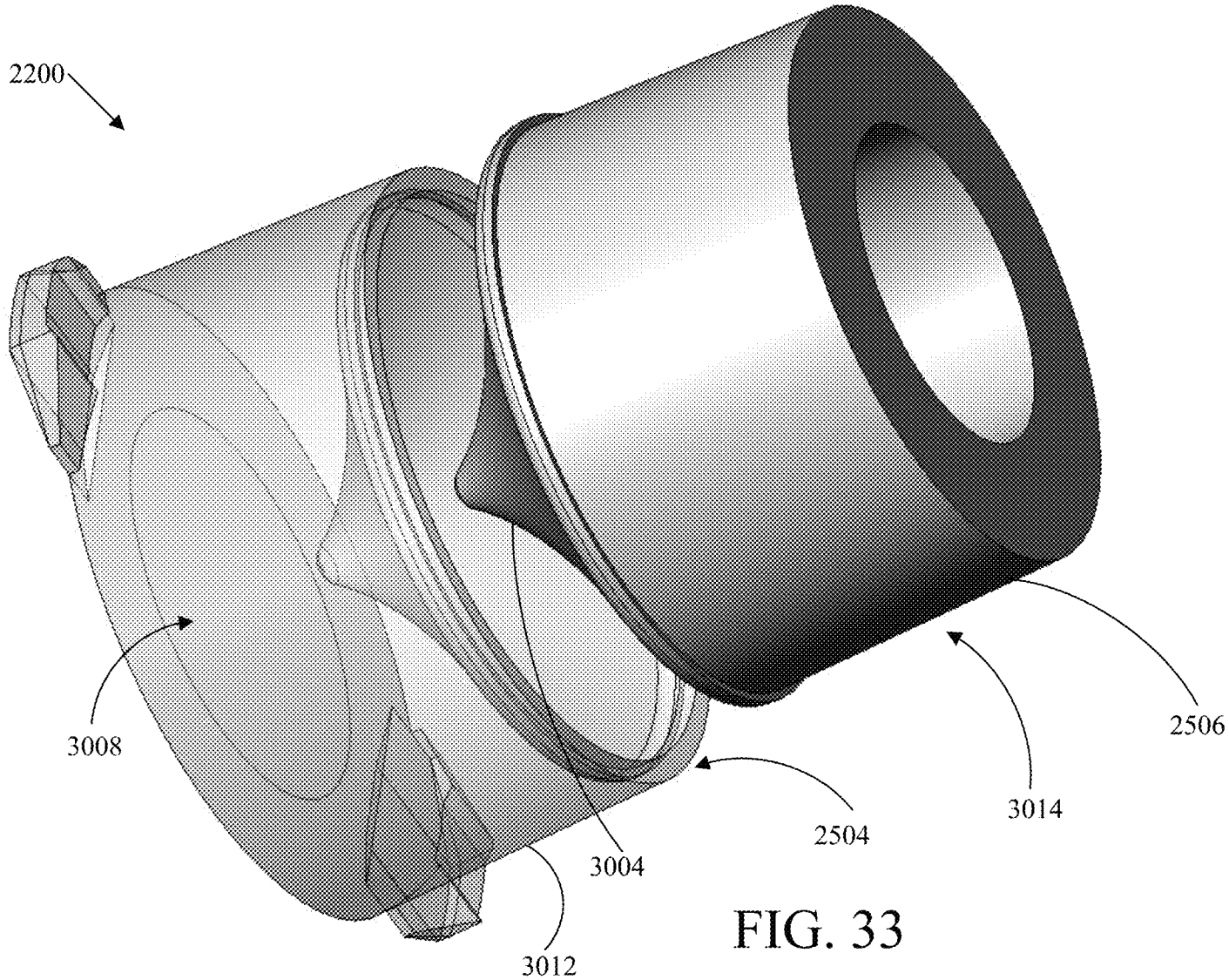
Figure 34:
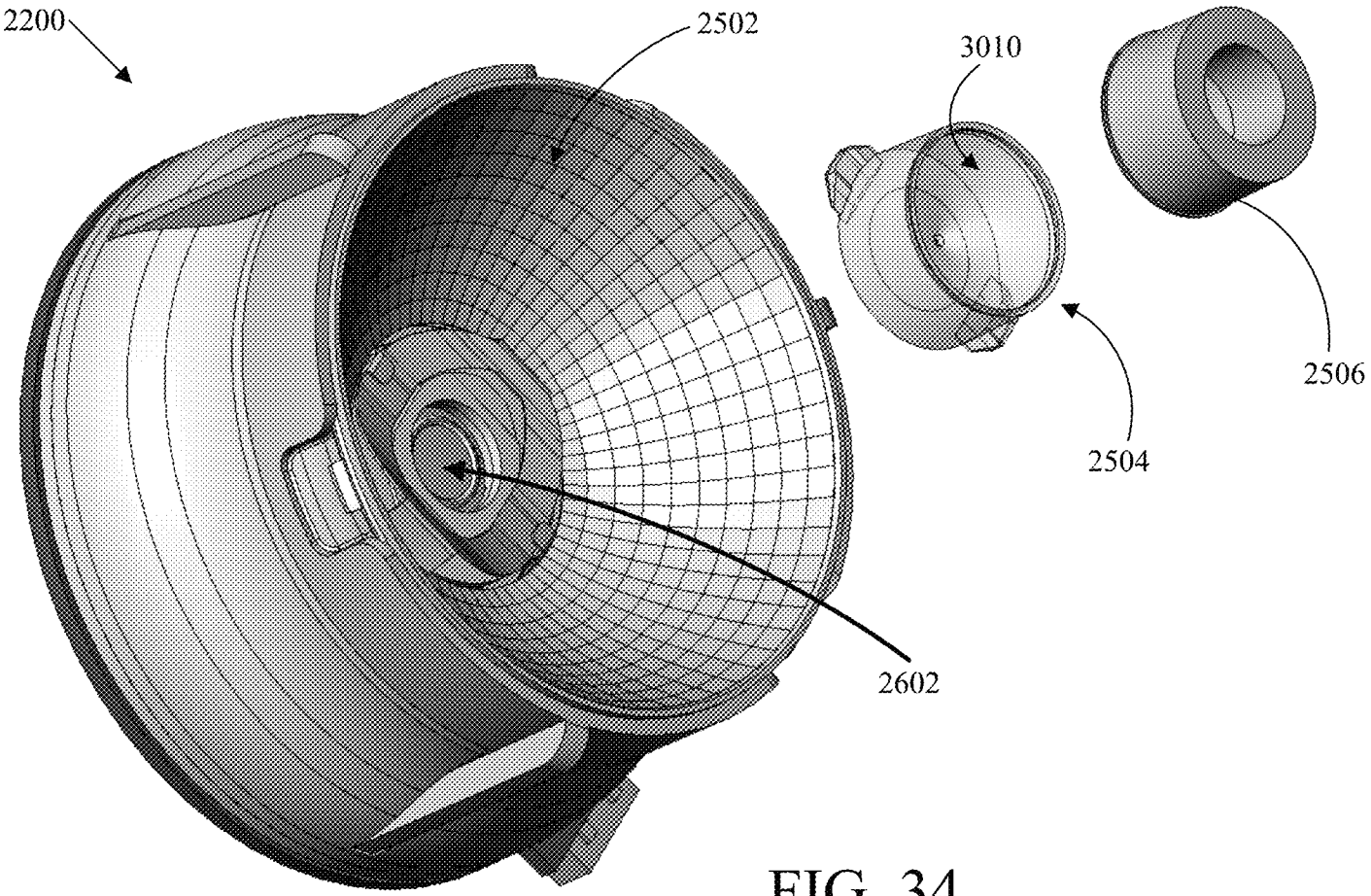
Figure 35:
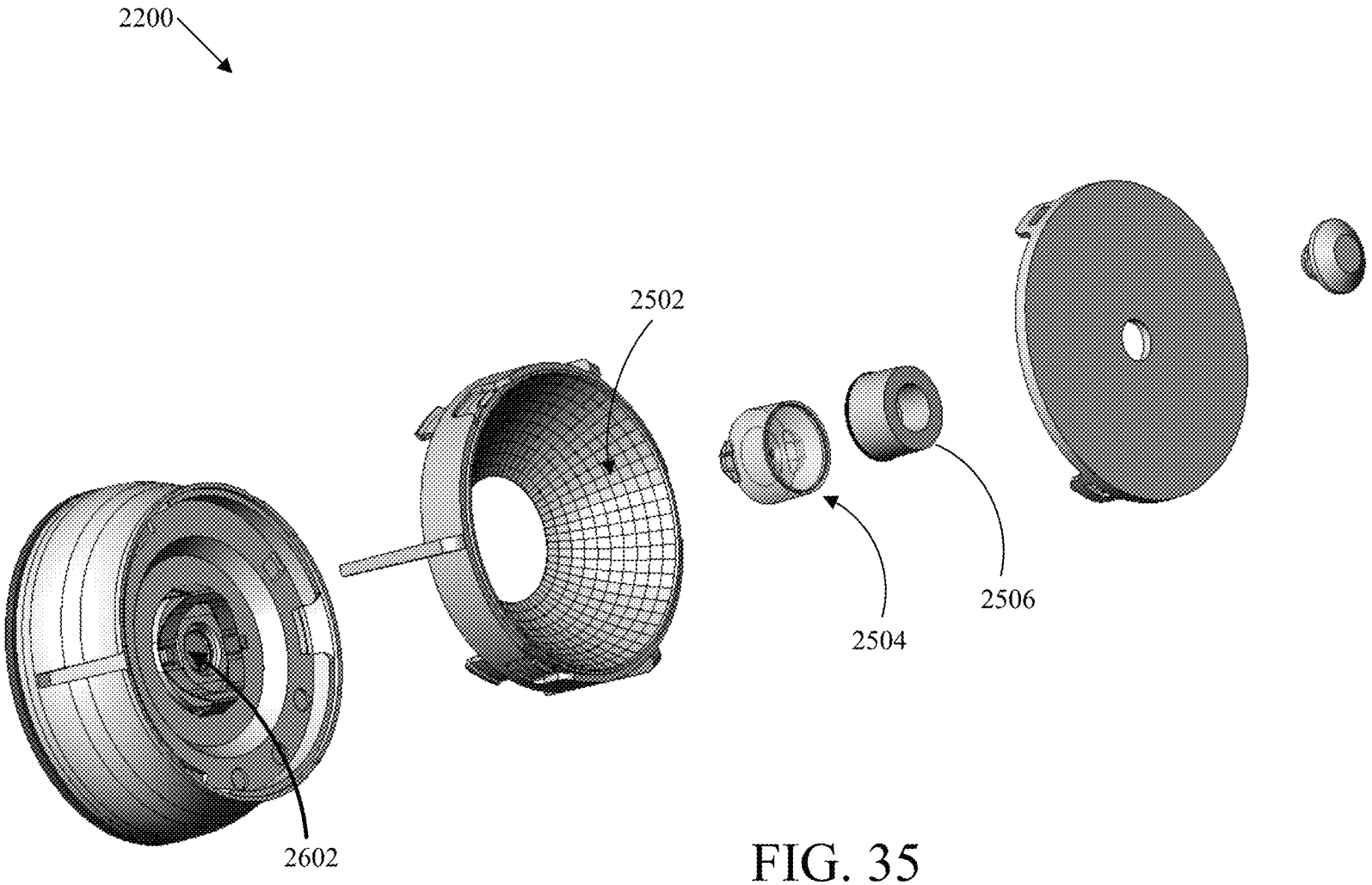
Figure 36:
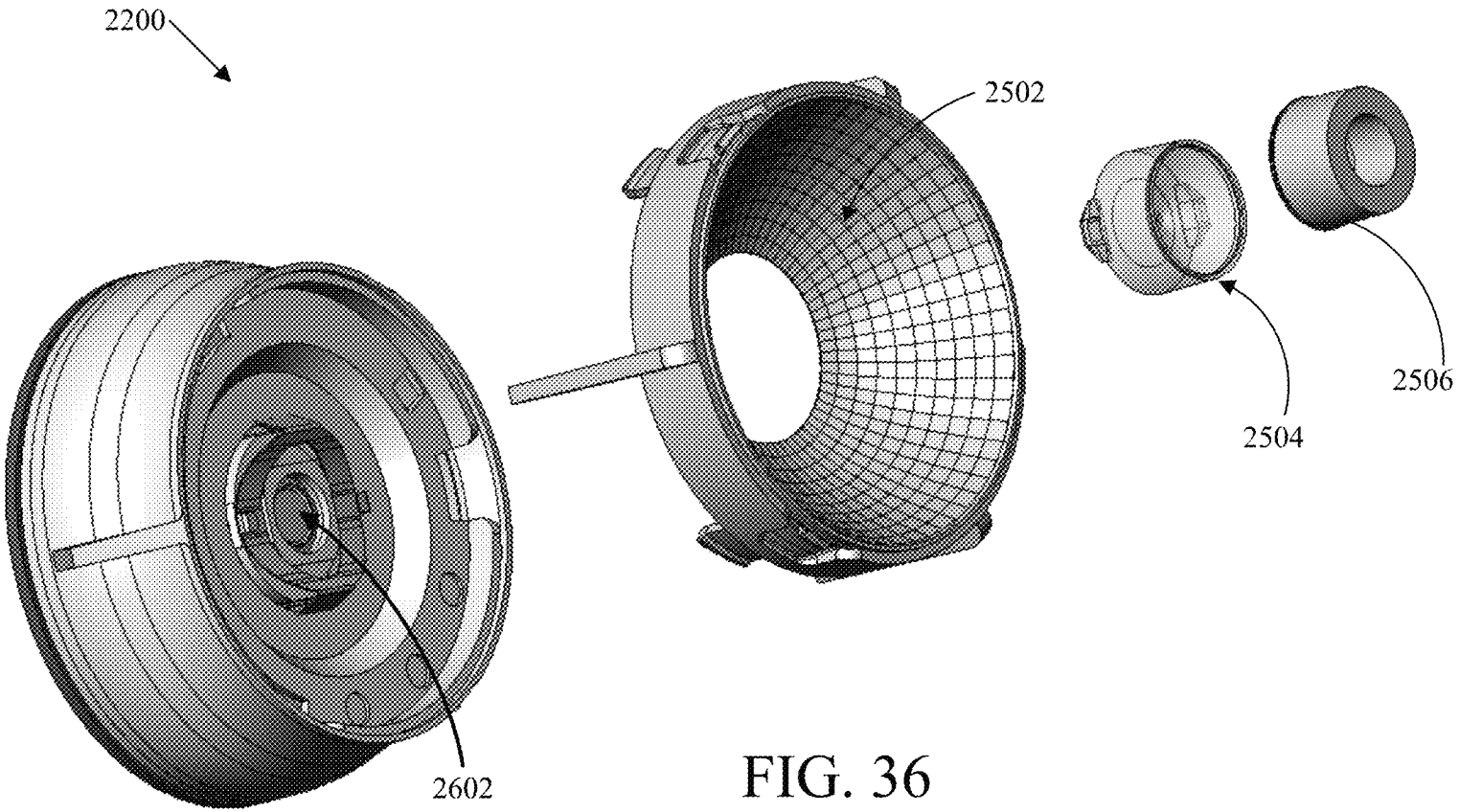
Figure 37:
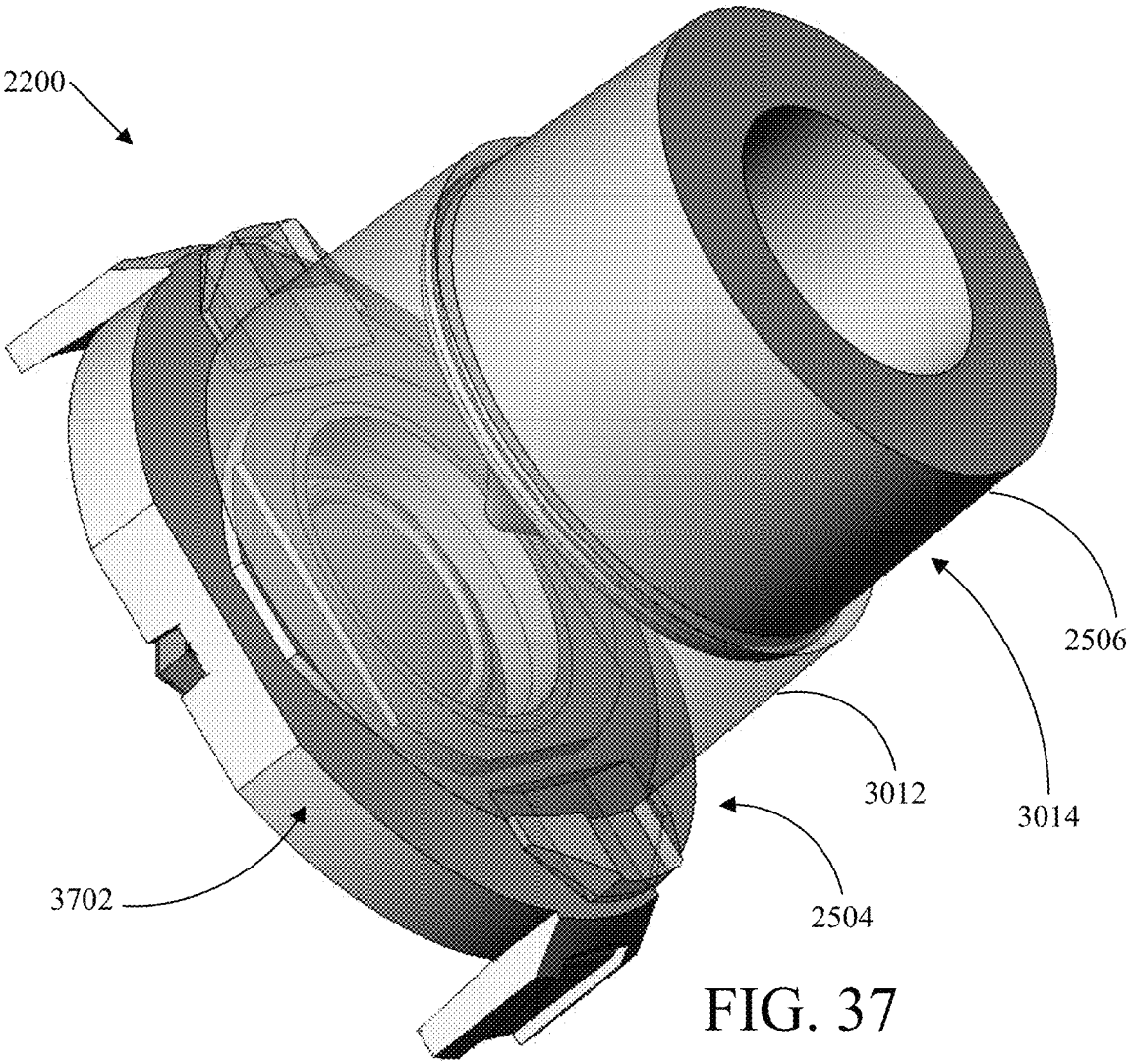
Figure 38:
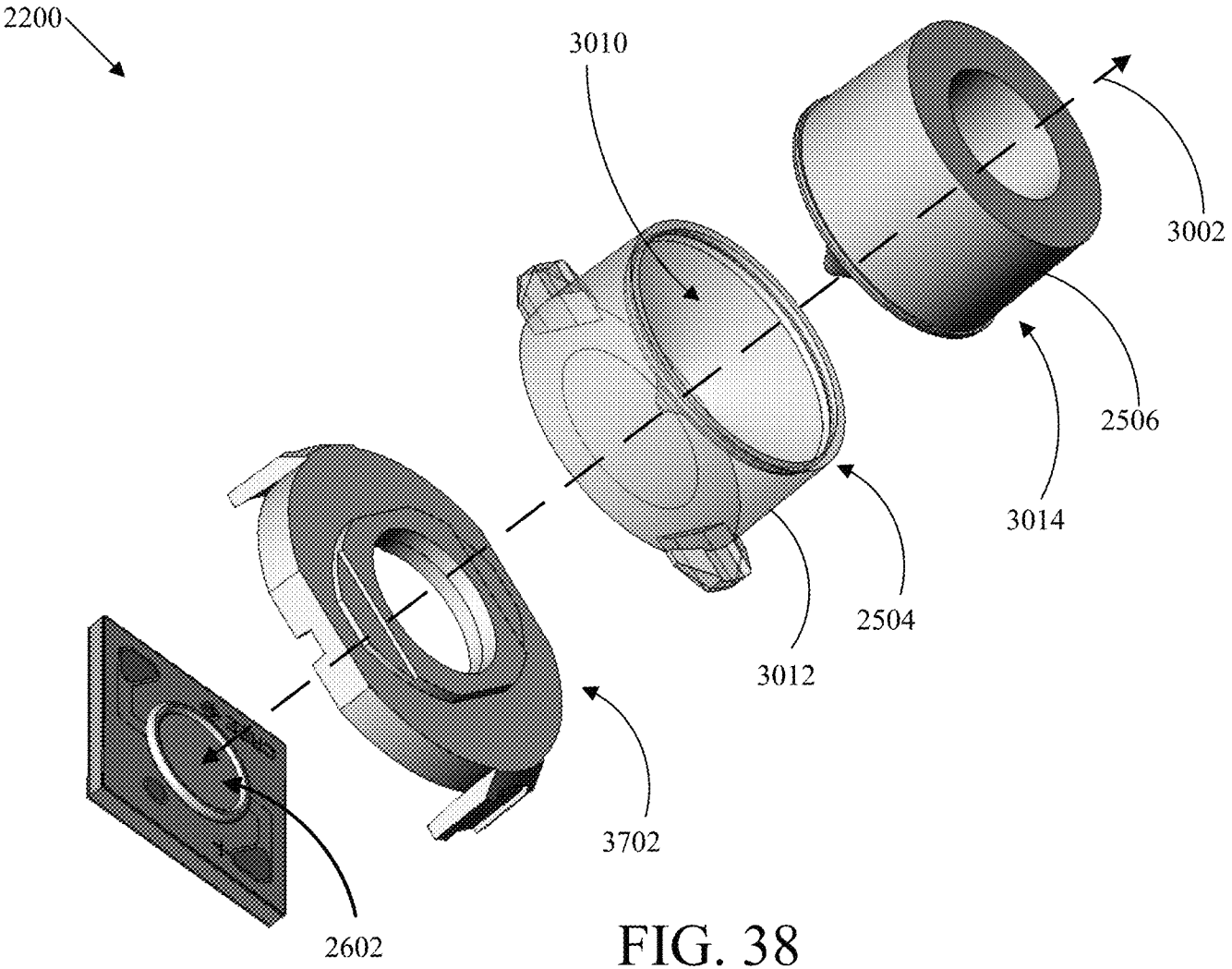
Figure 39:
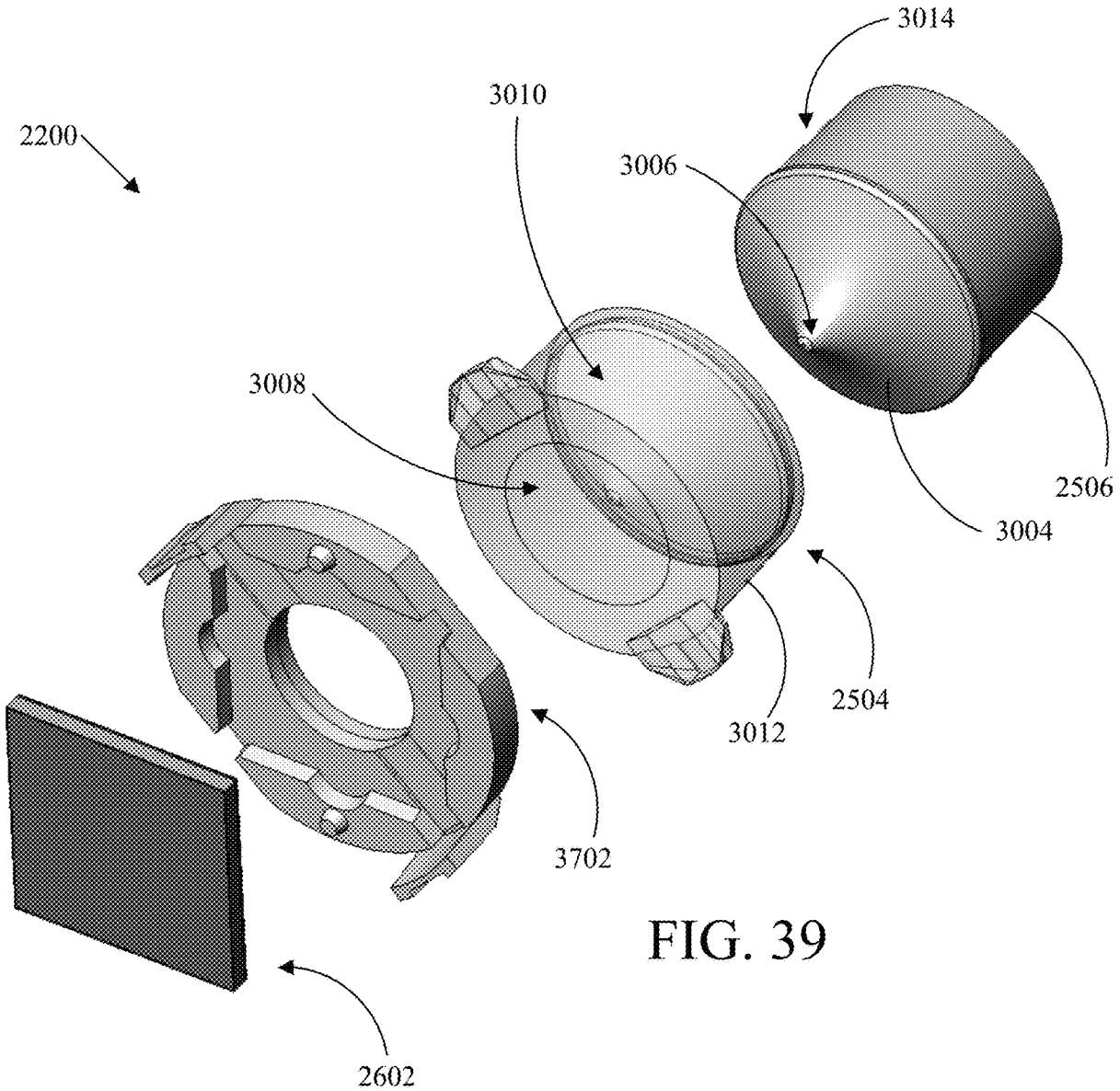
Figure 40:
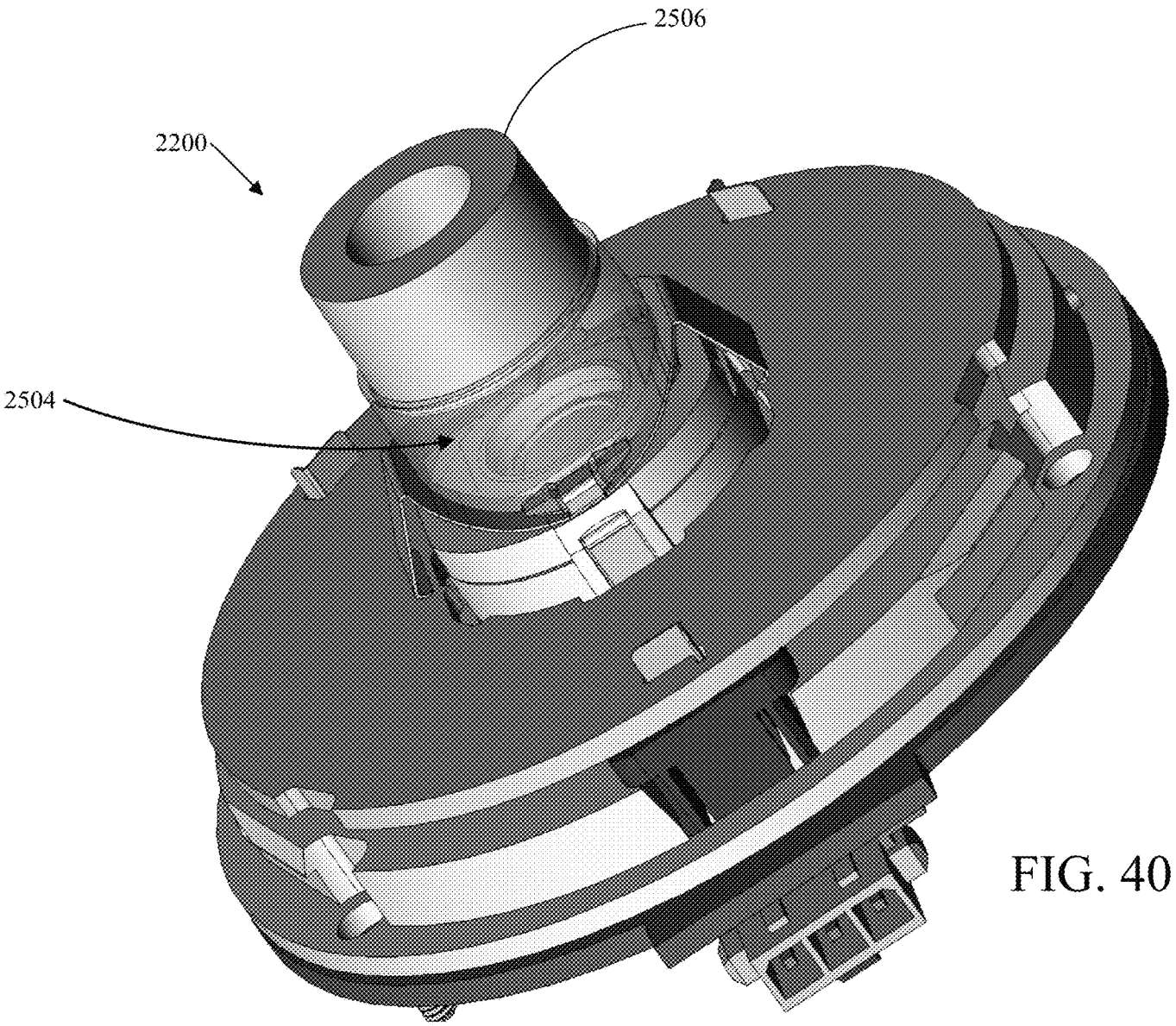
Figure 41:
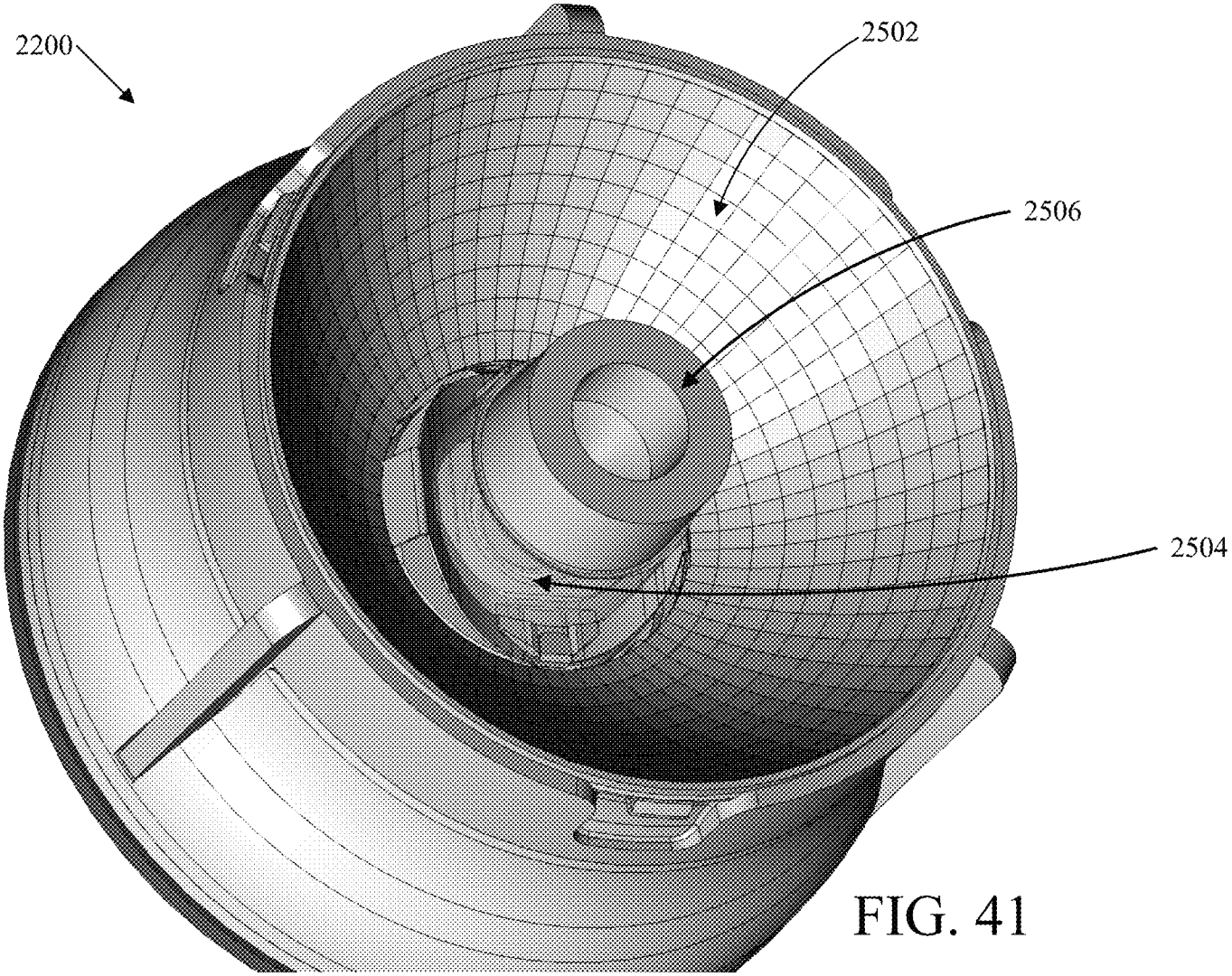
Figure 42:
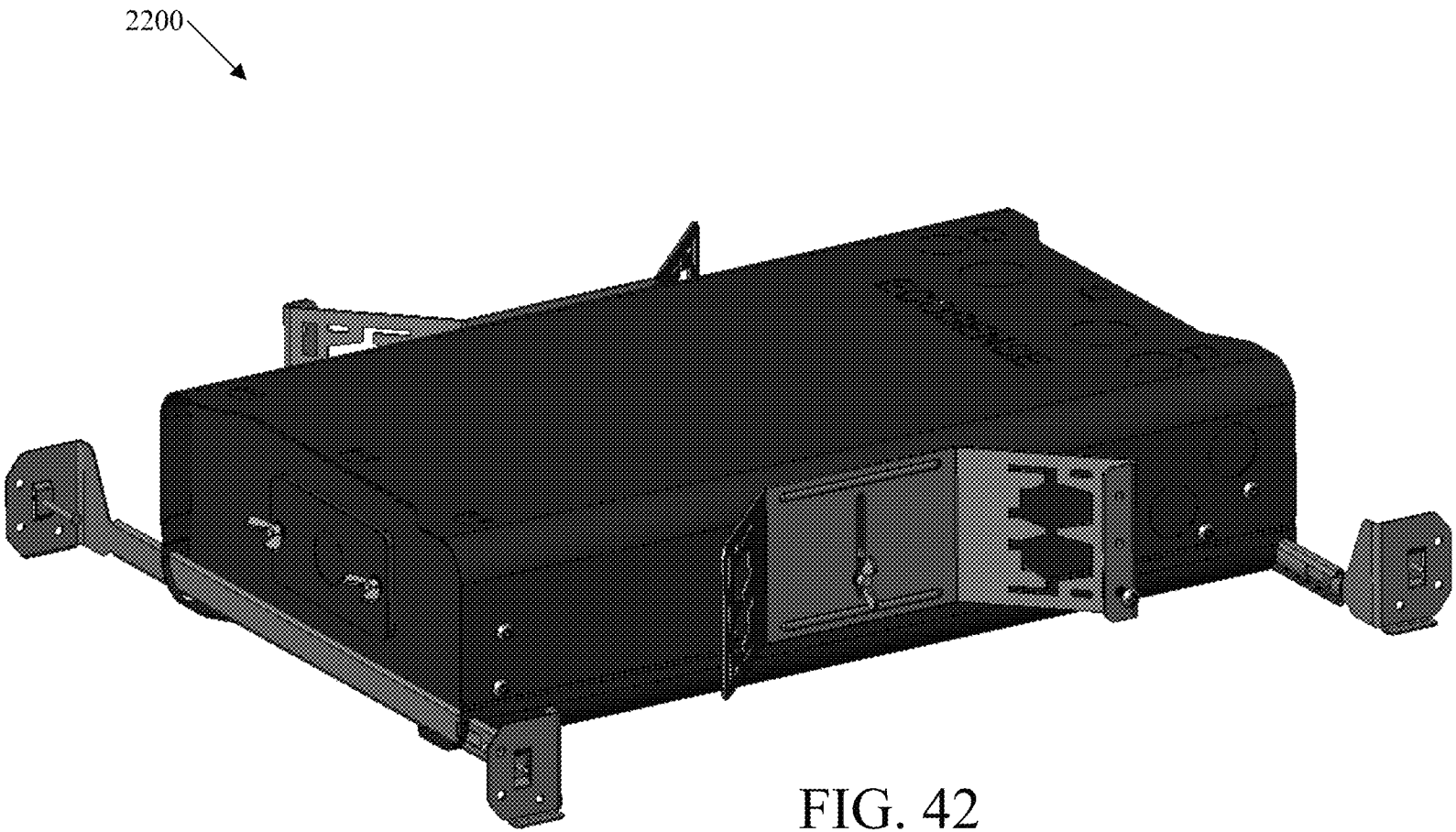
Figure 43:
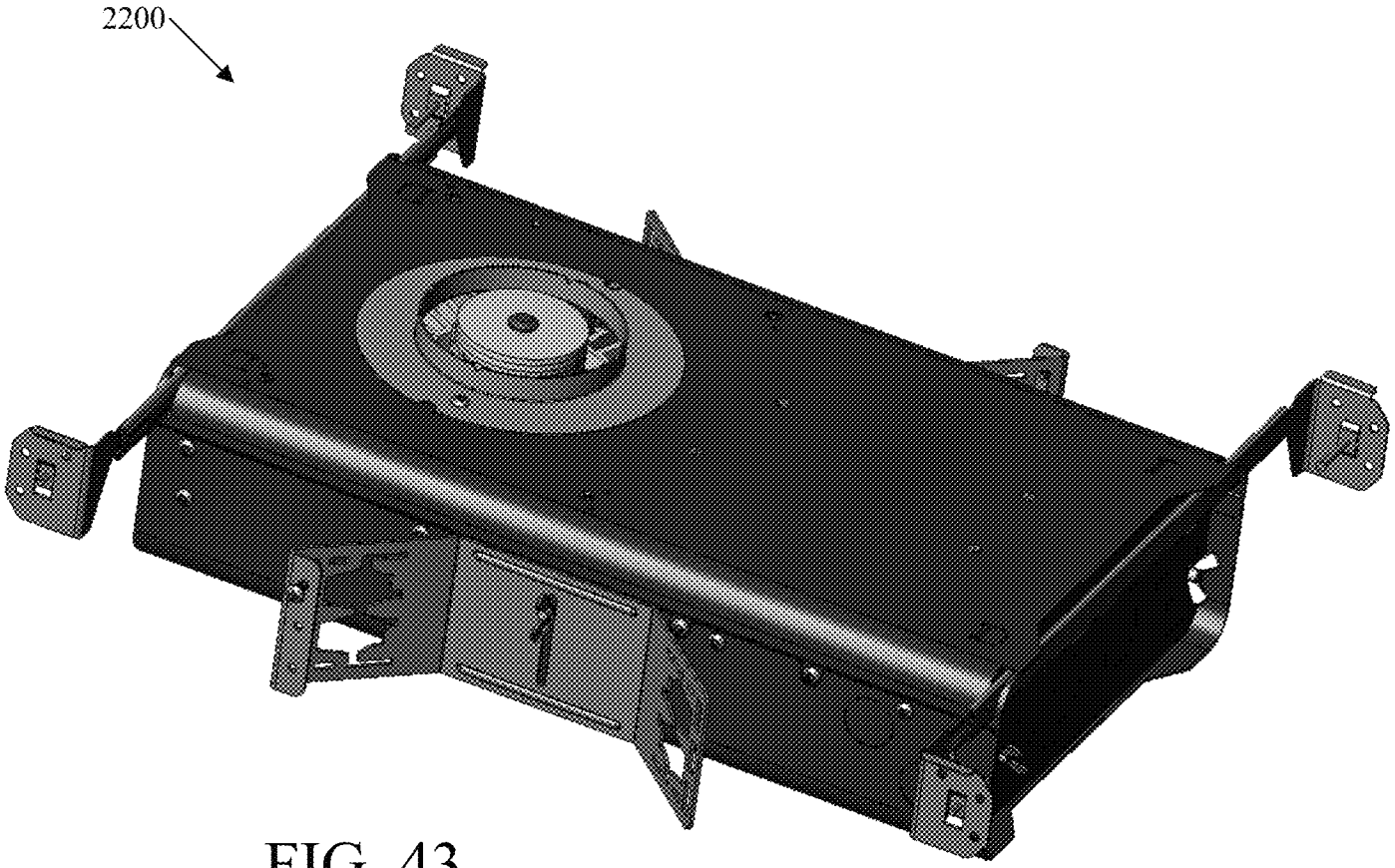
Figure 44:
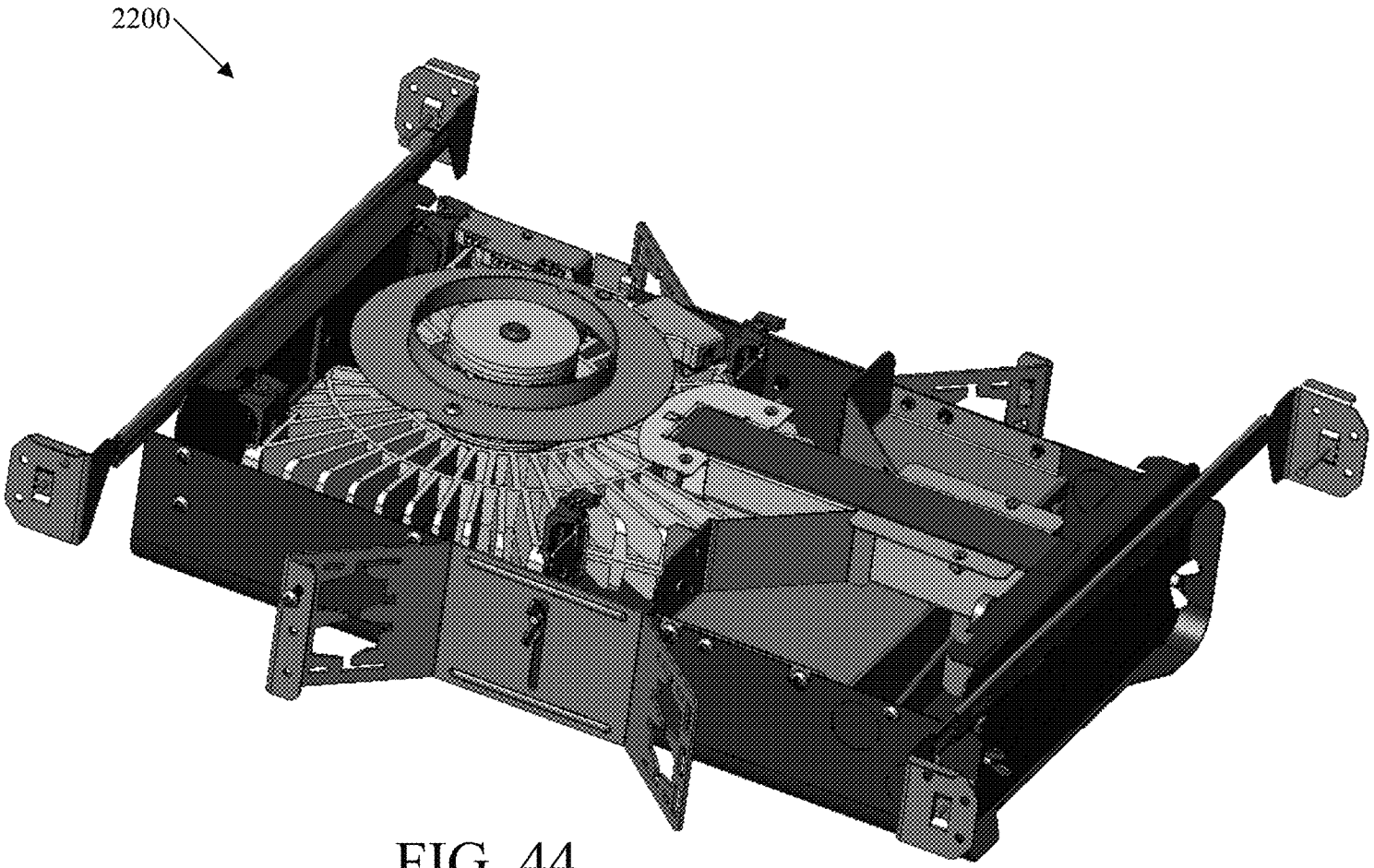
Figure 45:
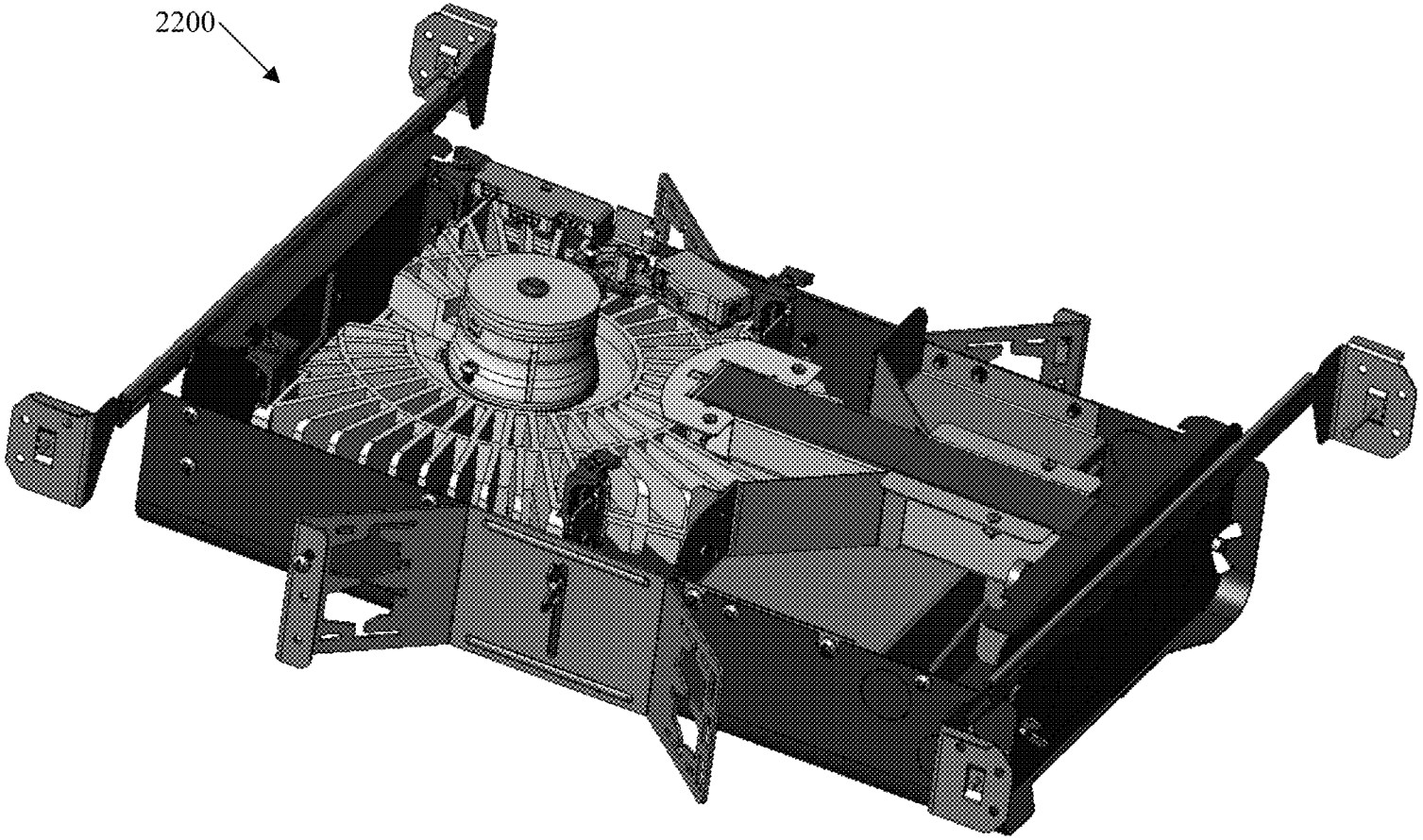
Figure 46:
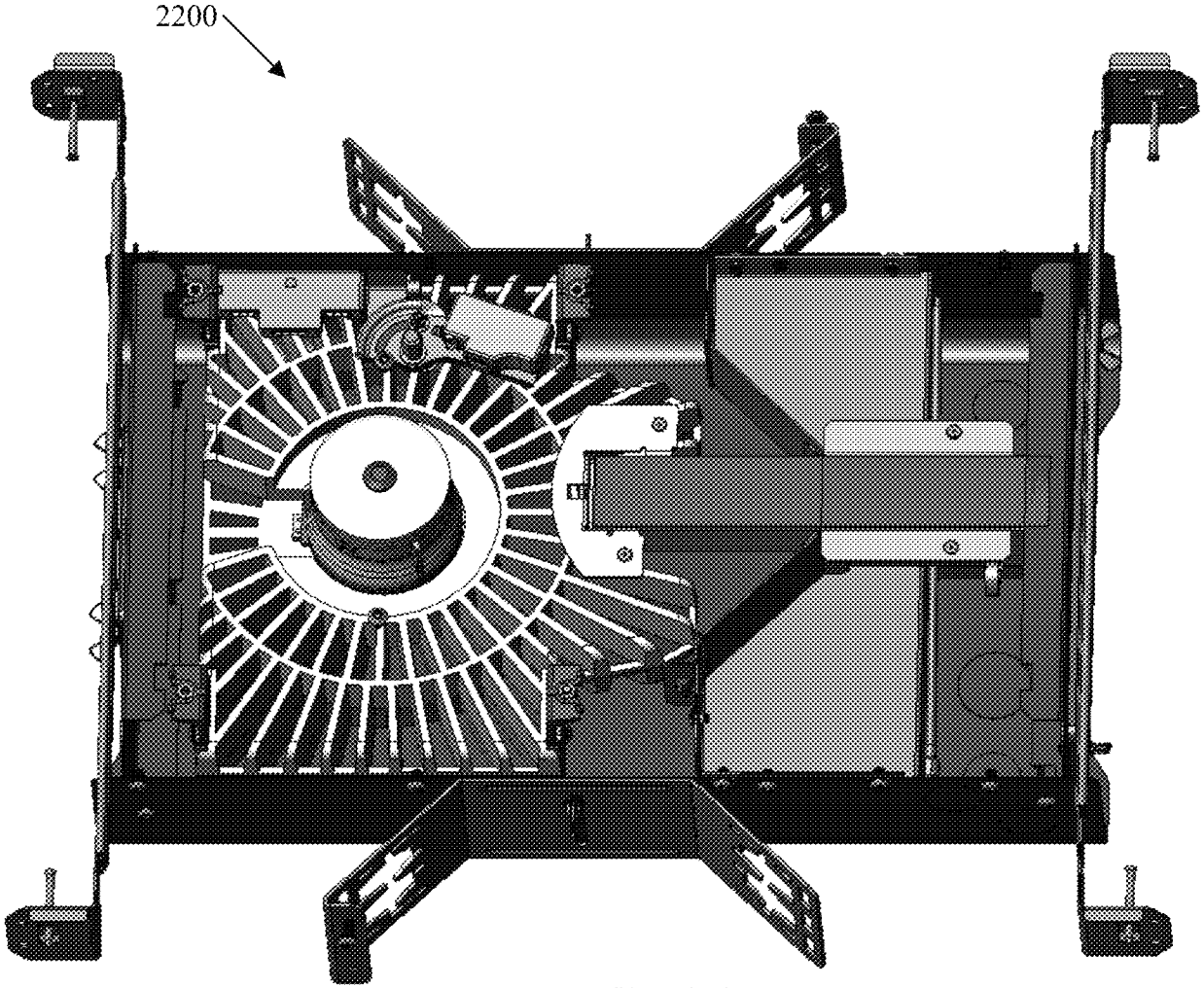
Figure 47:
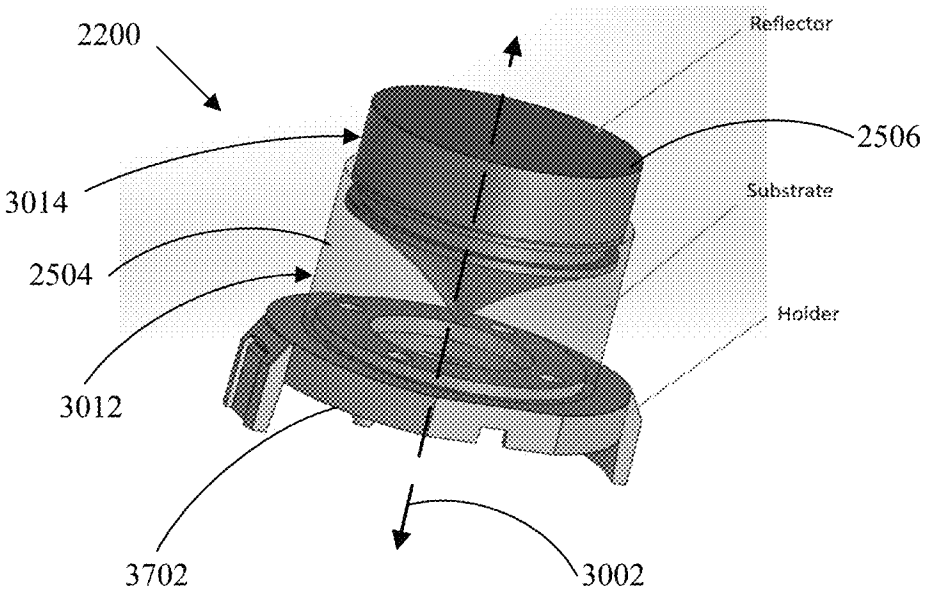
Figure 48:
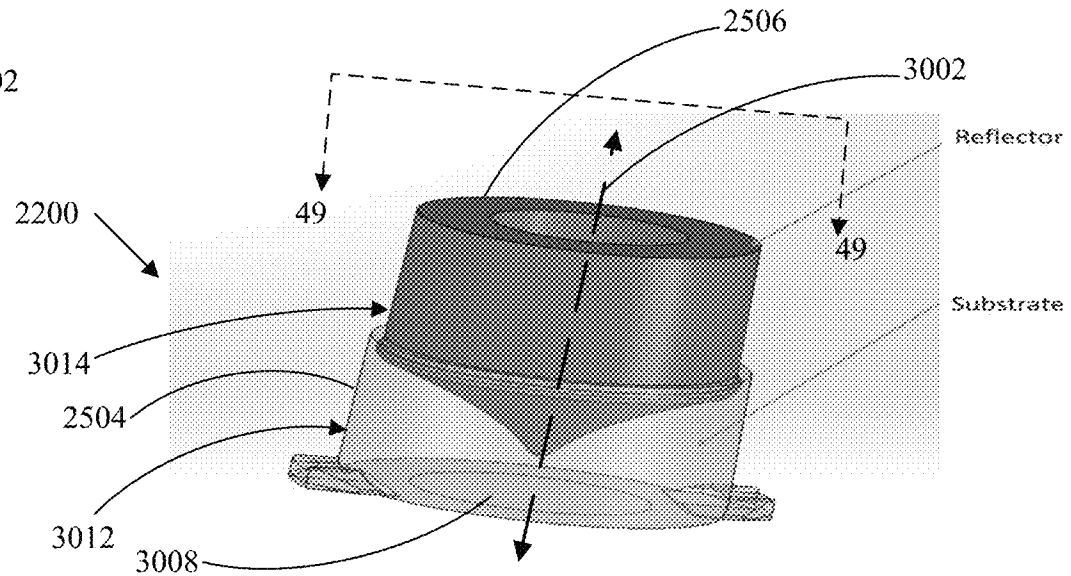

A simulated lighting system is provided that includes some of the features that are discussed herein in connection with the examples of the lighting systems [100], [300], [500], [700], [900], [1200], [1500]. FIG. 18 is a schematic top view showing an example [1800] of an alternative bowl reflector [1802] that may be substituted for the bowl reflectors [102], [302] in the examples [100], [300] of the lighting system. FIG. 19 is a schematic cross-sectional view taken along the line 19-19 showing the example [1802] of an alternative bowl reflector. FIG. 20 is a schematic top view showing another example [2000] of an alternative bowl reflector [2002] that may be substituted for the bowl reflectors [102], [302] in the examples [100], [300] of the lighting system. FIG. 21 is a schematic cross-sectional view taken along the line 21-21 showing the example [2002] of an alternative bowl reflector. In the following simulations, the lighting system further includes the features of the example [100] that are discussed in the earlier paragraph herein that begins with "As shown in FIGS. 1 and 2." In a first simulation, the example of the lighting system [100] includes the bowl reflector [1802] shown in FIGS. 18-19. In this first simulation, the lighting system [100] generates visible-light emissions having a beam angle being within a range of between about 17.5° and about 17.8°; and as having a field angle being within a range of between about 41.9° and about 42.0°. In a second simulation, the example of the lighting system [100] includes the bowl reflector [2002] shown in FIGS. 20-21. In this second simulation, the lighting system [100] generates visible-light emissions having a beam angle being within a range of between about 57.4° and about 58.5°; and as having a field angle being within a range of between about 100.2° and about 101.6°.

Figure 49:
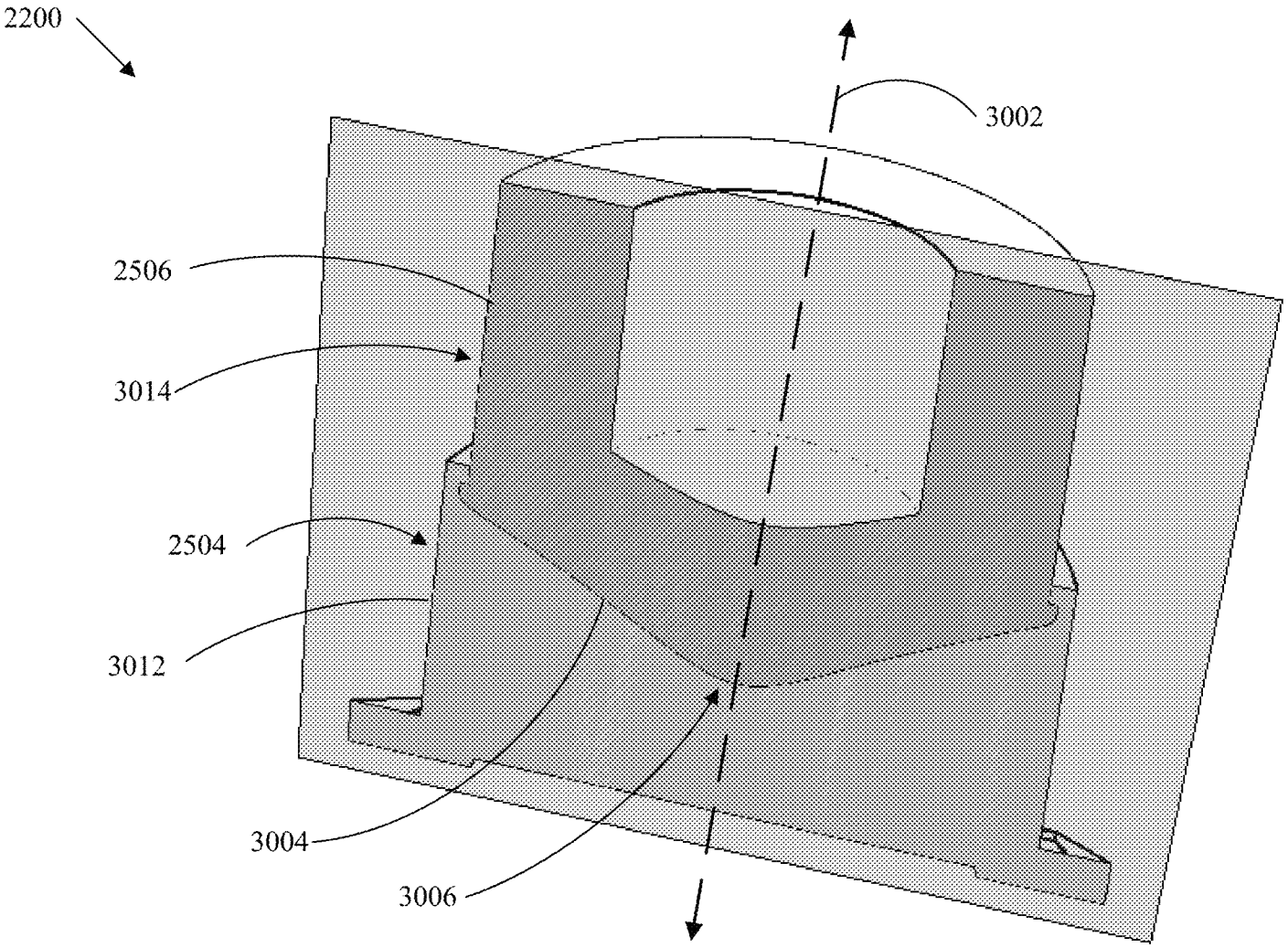
Figure 50:
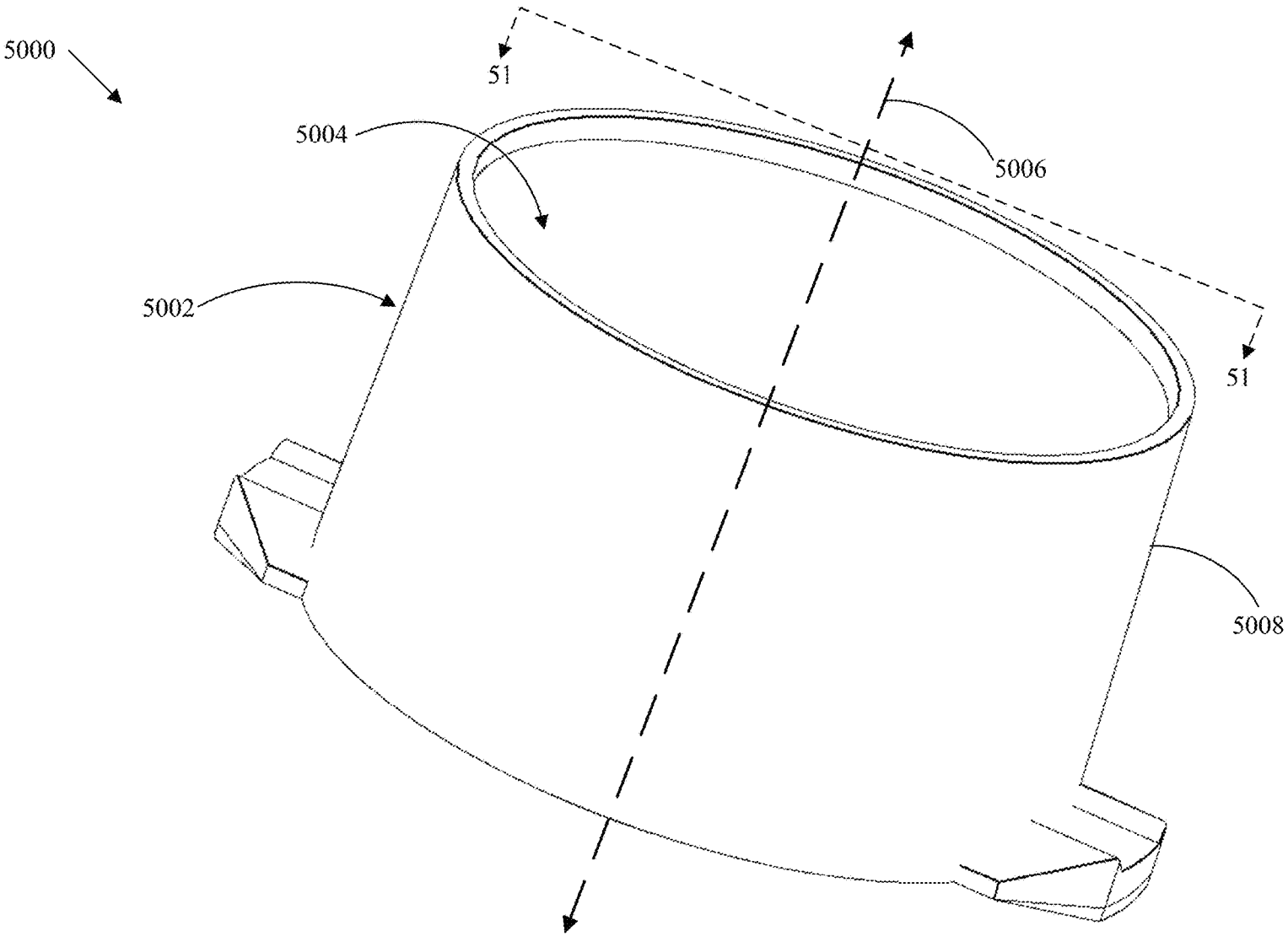
FIGS. 50-62 collectively show an example [5000] of a combination of an optically-transparent body, and a reflector or absorber, that may respectively be substituted for the optically-transparent body and the funnel reflector in the examples [100], [300] of the lighting system.

FIGS. 22-49 collectively show an example [2200] of a lighting assembly that includes: a bowl reflector [2502] that may be substituted for the bowl reflectors [102], [302], [1802], [2002] in the examples [100], [300] of the lighting system; and an optically-transparent body [2504] that may be substituted for the optically-transparent bodies [240], [440], [540], [740] in the examples [100], [300] of the lighting system; and a funnel reflector [2506] that may be substituted for the funnel reflectors [216], [416] in the examples [100], [300] of the lighting system. FIG. 49 is a cross-sectional view taken along line 49-49. In the example [2200] of the lighting assembly, the funnel reflector [2506] has a central axis [3002] and has a second visible-light-reflective surface [3004] being aligned along the central axis [3002]. In the example [2200] of the lighting assembly, the funnel reflector [2506] also has a tip [3006] being aligned with the central axis [3002]. In addition, in the example [2200] of the lighting assembly, a portion of the second visible-light-reflective surface [3004] is a second light-reflective parabolic surface [3004]. The example [2200] of the lighting assembly further includes the optically-transparent body [2504] as being aligned with the second visible-light-reflective surface [3004] along the central axis [3002]. In the example [2200] of the lighting assembly, the optically-transparent body [2504] has a first base [3008] being spaced apart along the central axis [3002] from a second base [3010], and a side surface [3012] extending between the bases [3008], [3010]; and the first base [3008] faces toward a visible-light source [2602]. In some examples [2200], the lighting assembly may further include a mounting base [3702] for attaching the optically-transparent body [2504] together with the visible-light source [2602] and for registering both the optically-transparent body [2504] and the visible-light source [2602] in mutual alignment with the central axis [3002]. In some examples [2200] of the lighting assembly, the funnel reflector [2506] may include a body [3014] of heat-resistant or heat-conductive material, for absorbing and dissipating thermal energy generated at the second visible-light-reflective surface [3004]. In further examples [2200] of the lighting assembly, the funnel reflector [2506] may include the second visible-light-reflective surface [3004] as being either attached to or integrally formed together with the body [3014] of heat-resistant or heat-conductive material.

Figure 51:
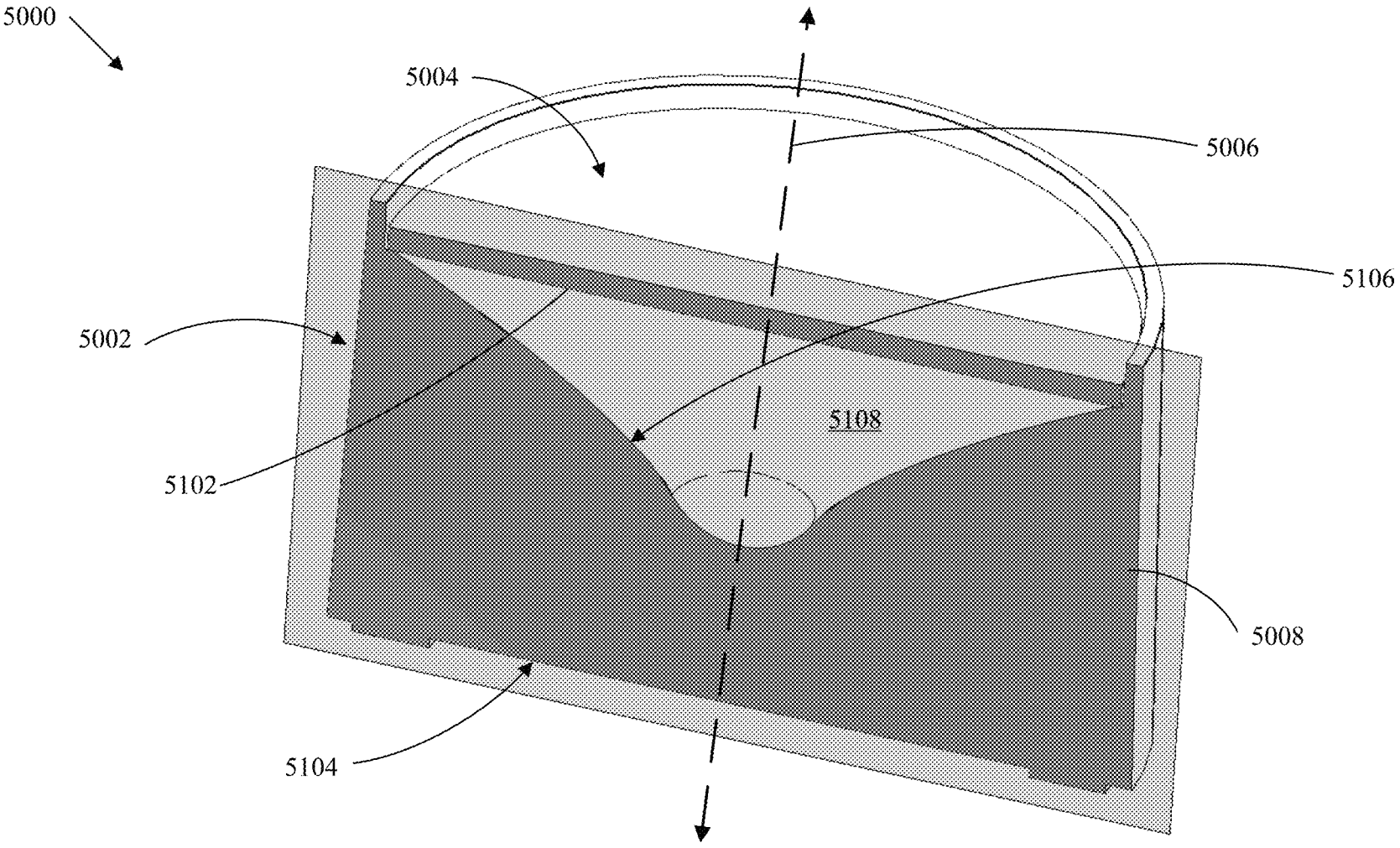
Figure 52:
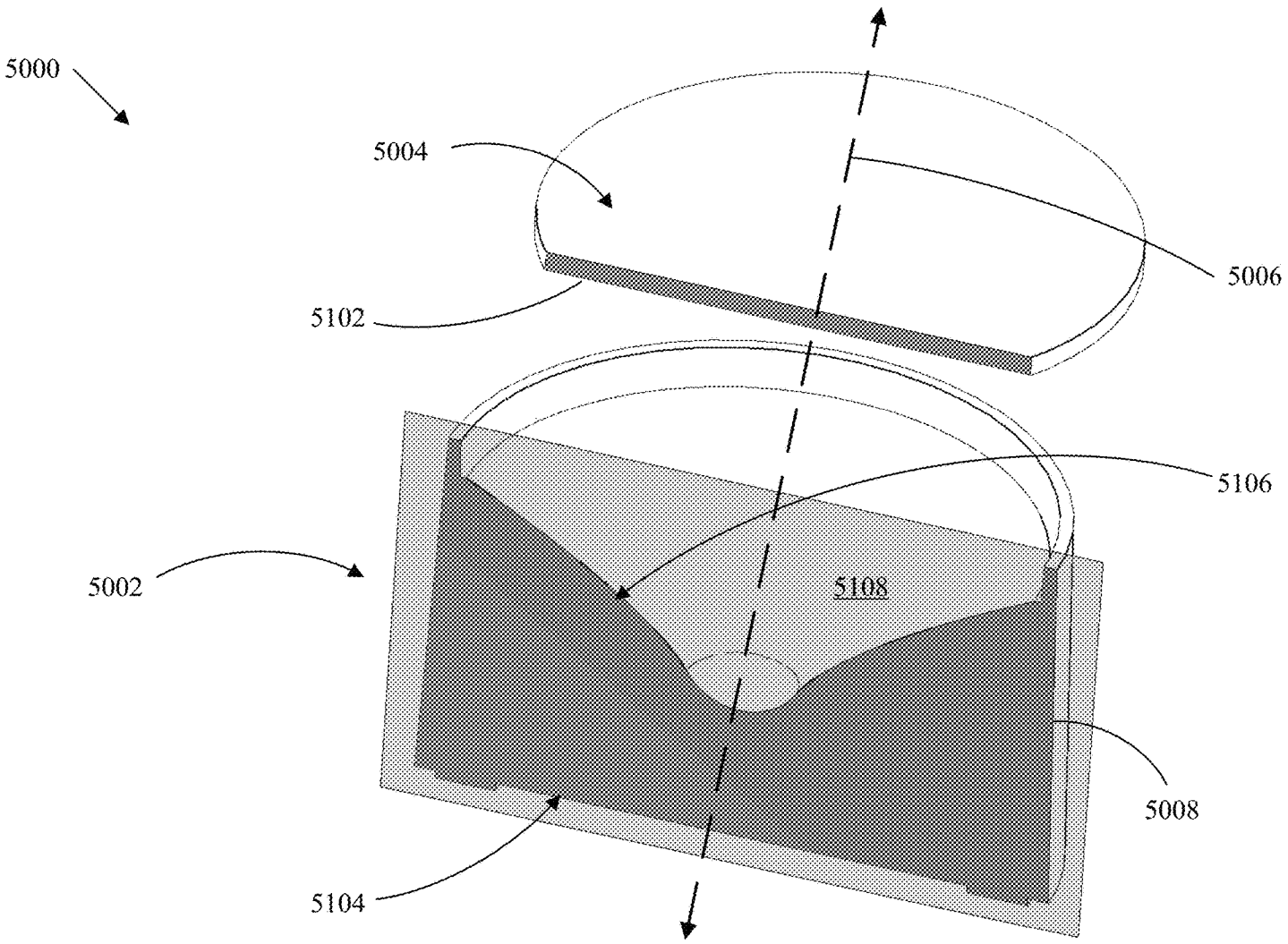
Figure 53:
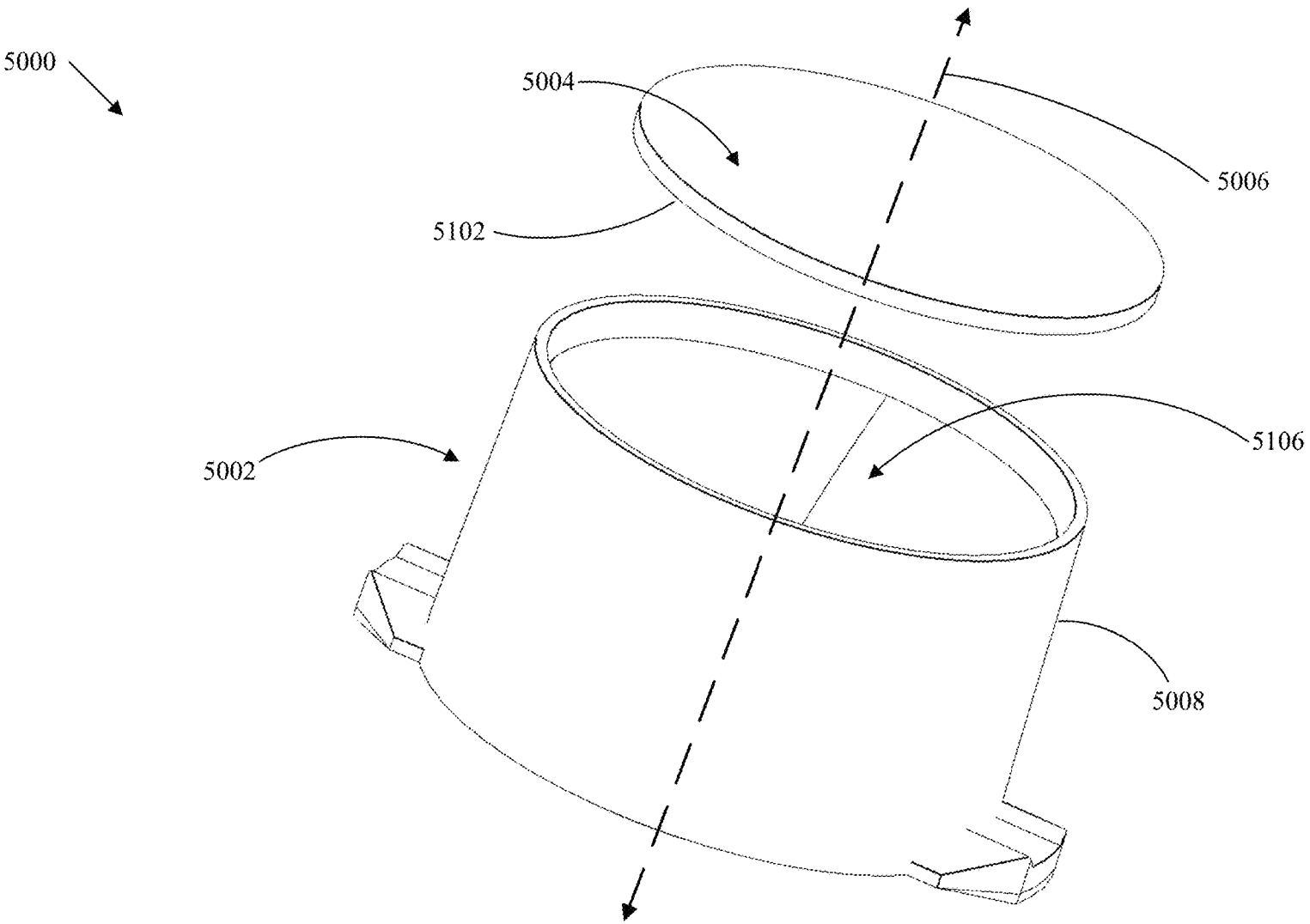
Figure 54:
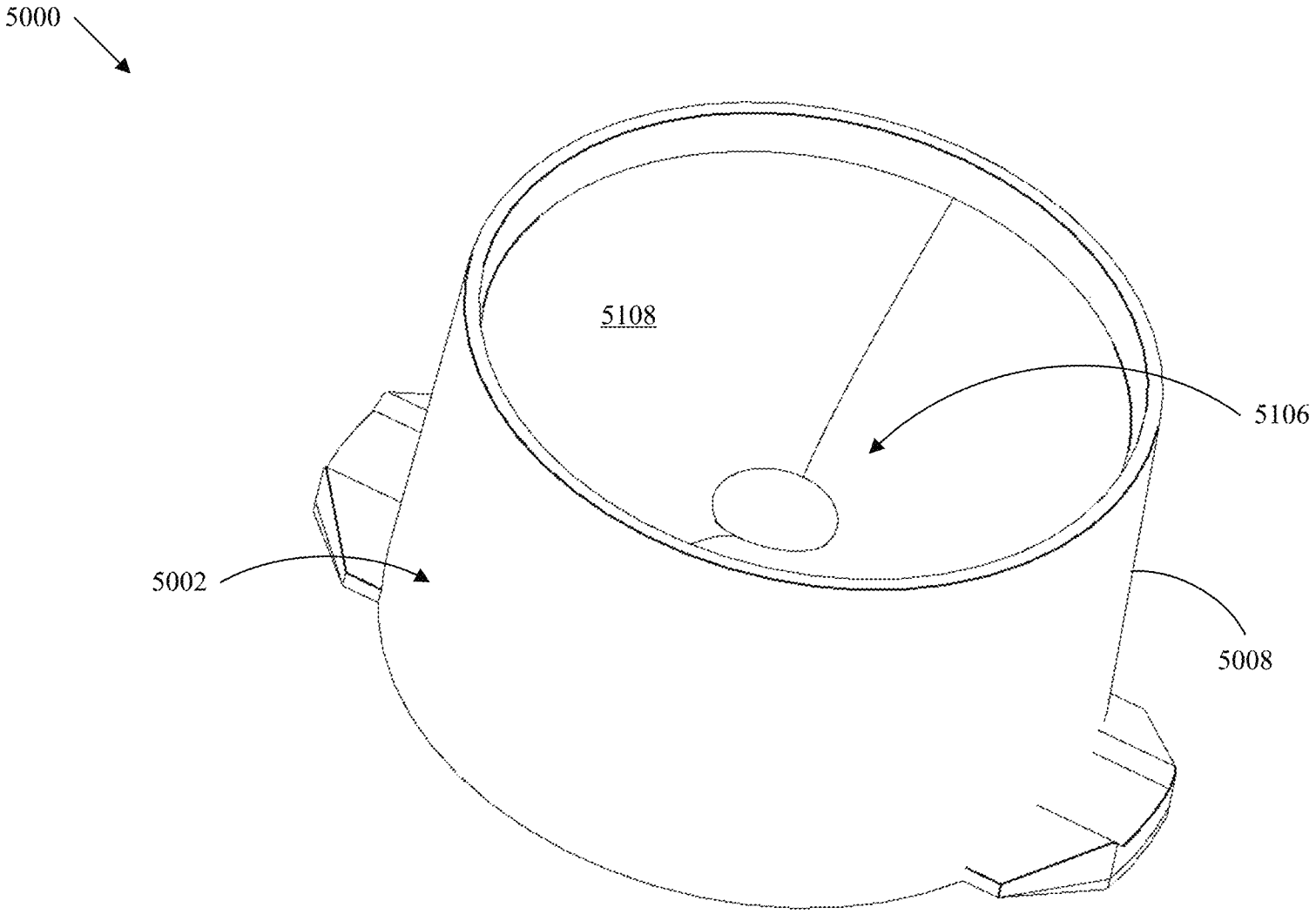
Figure 55:
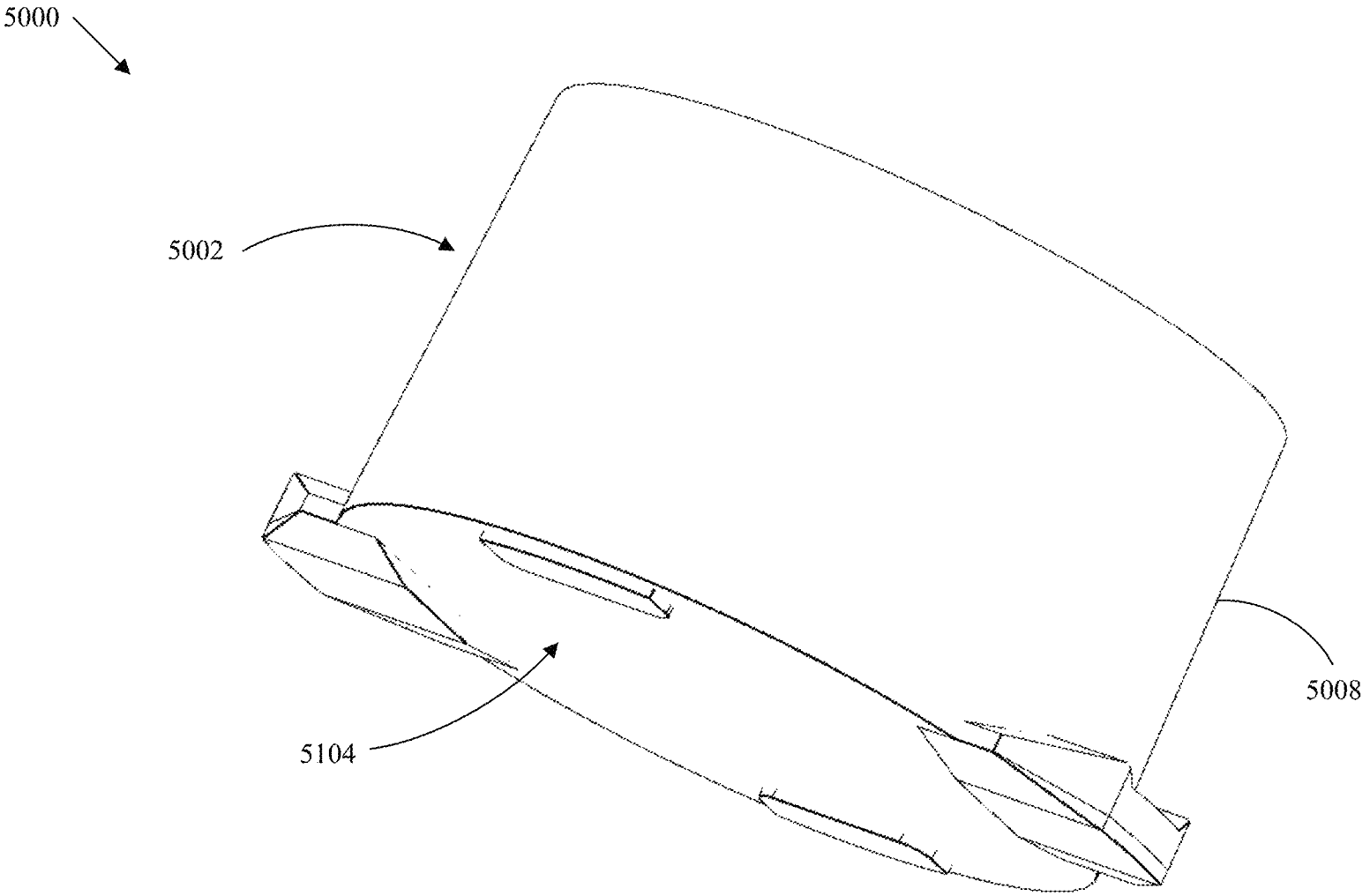
Figure 57:
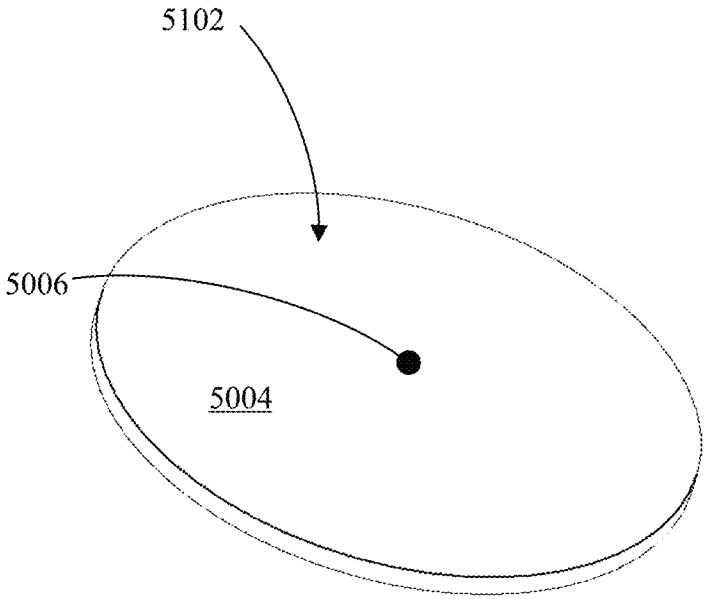
Figure 56:
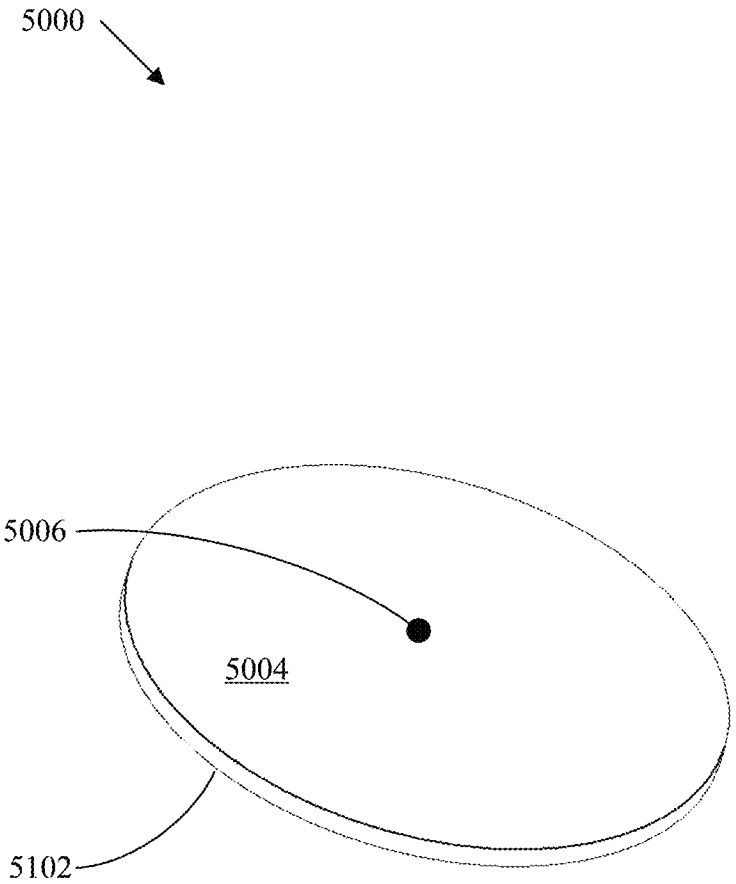
Figure 58:
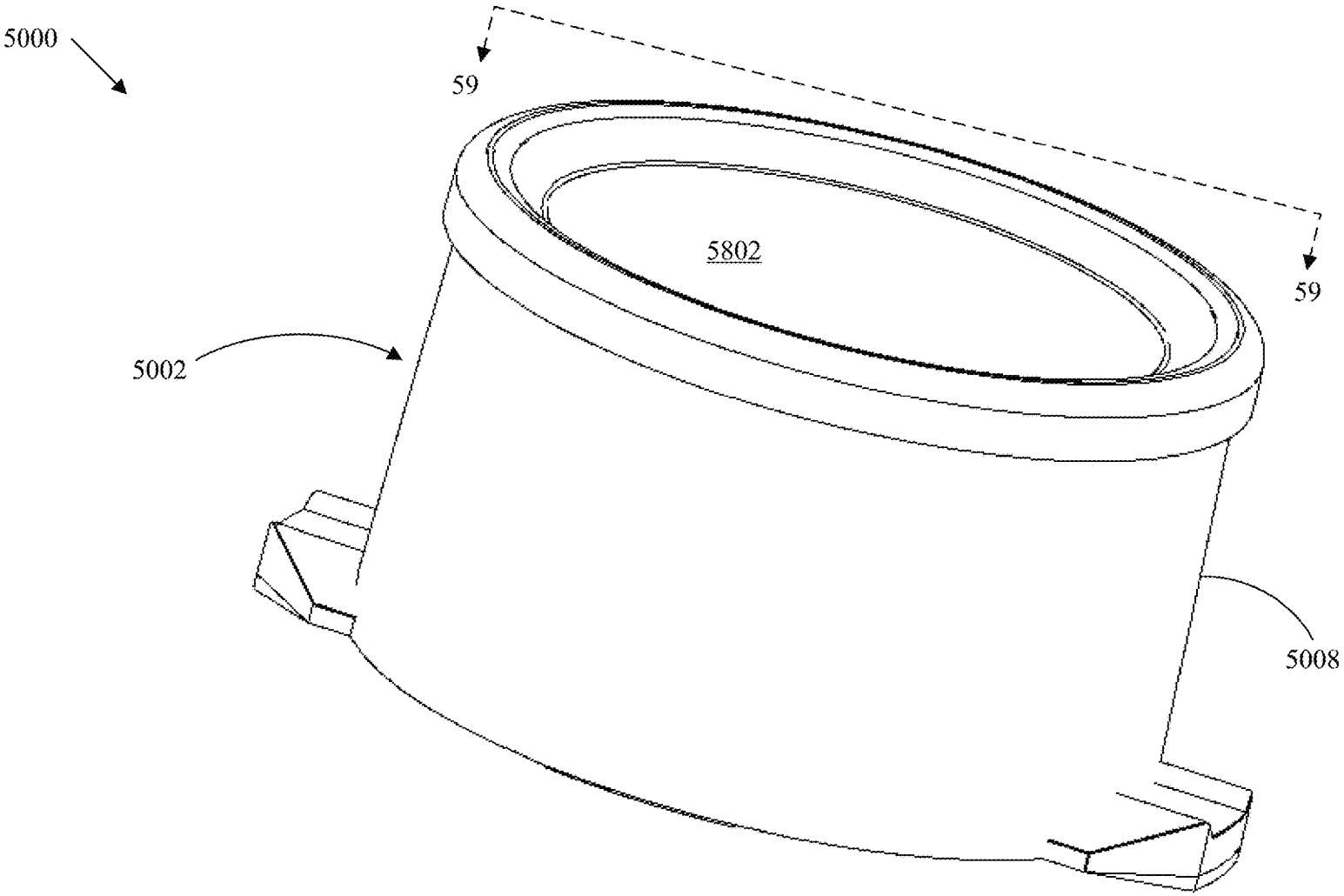
Figure 59:
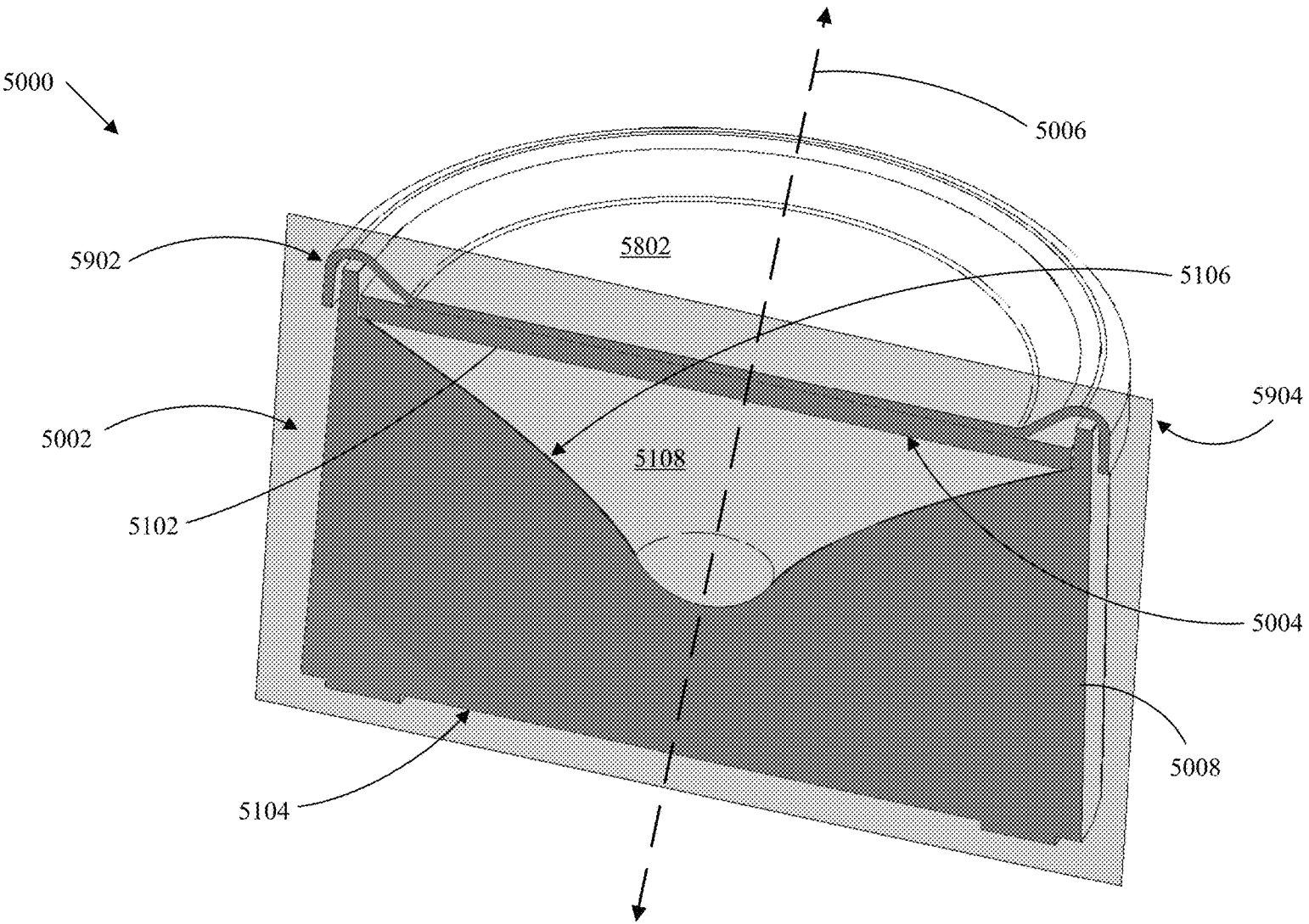
Figure 60:
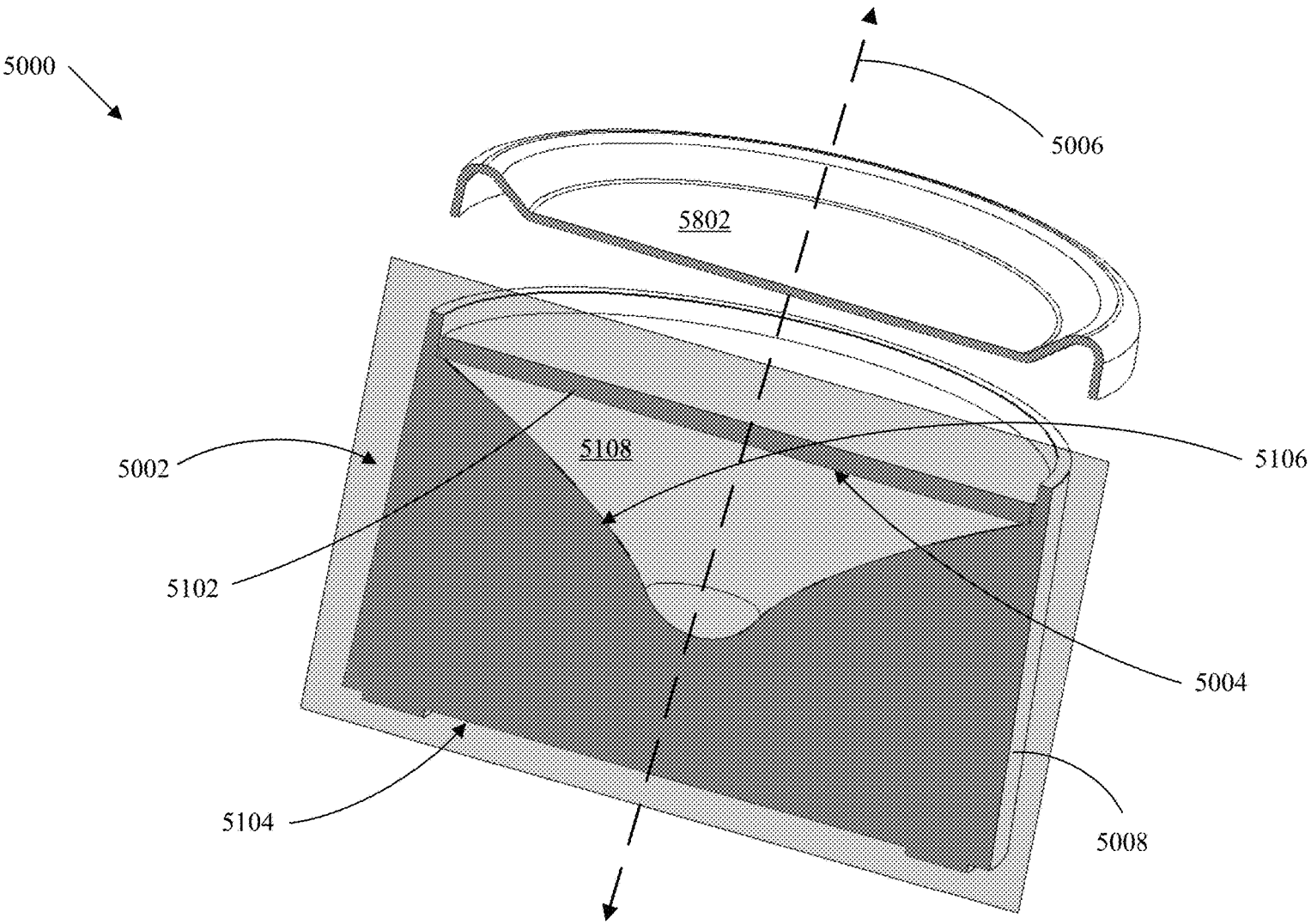
Figure 61:
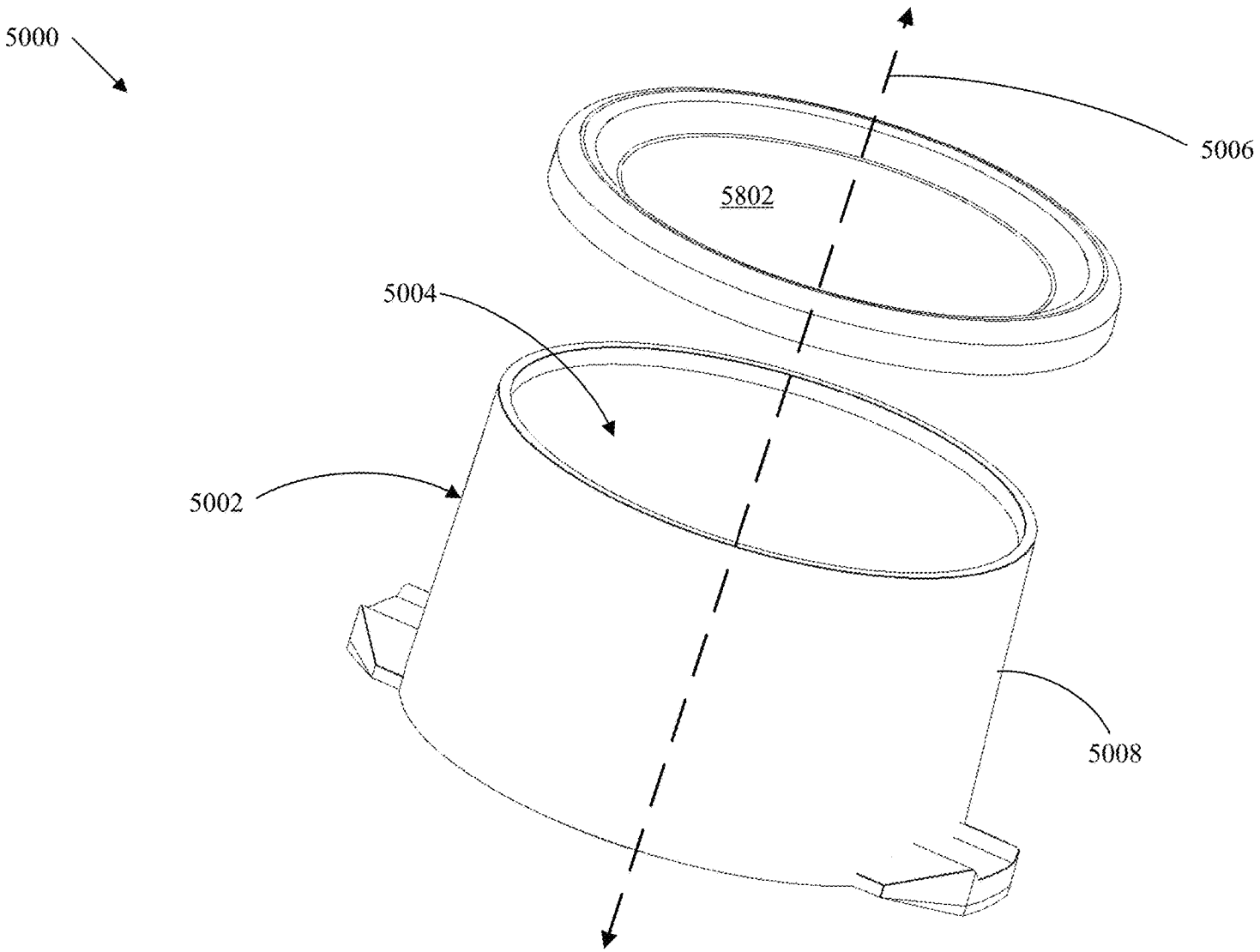
Figure 62:
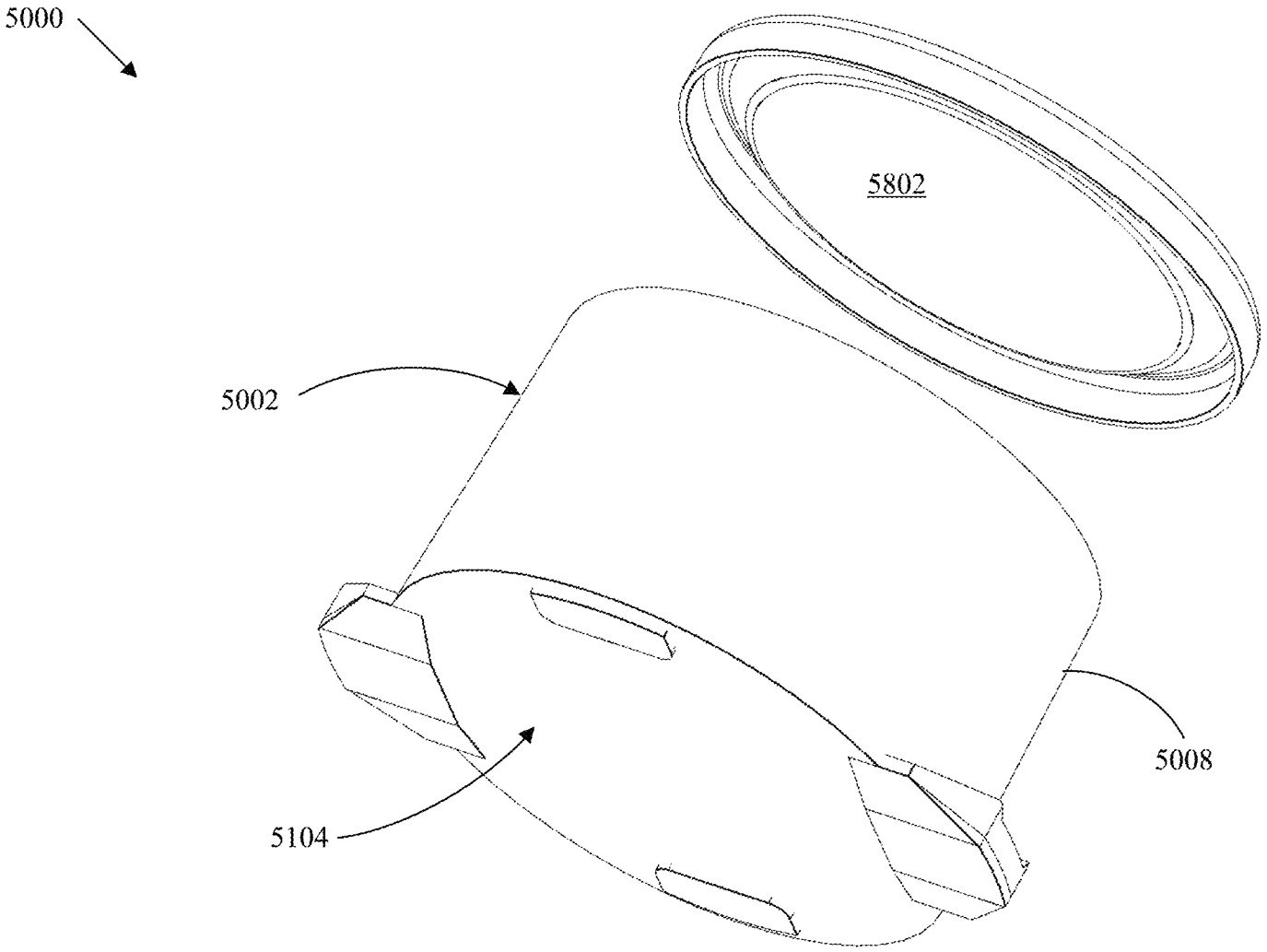
Figure 63:
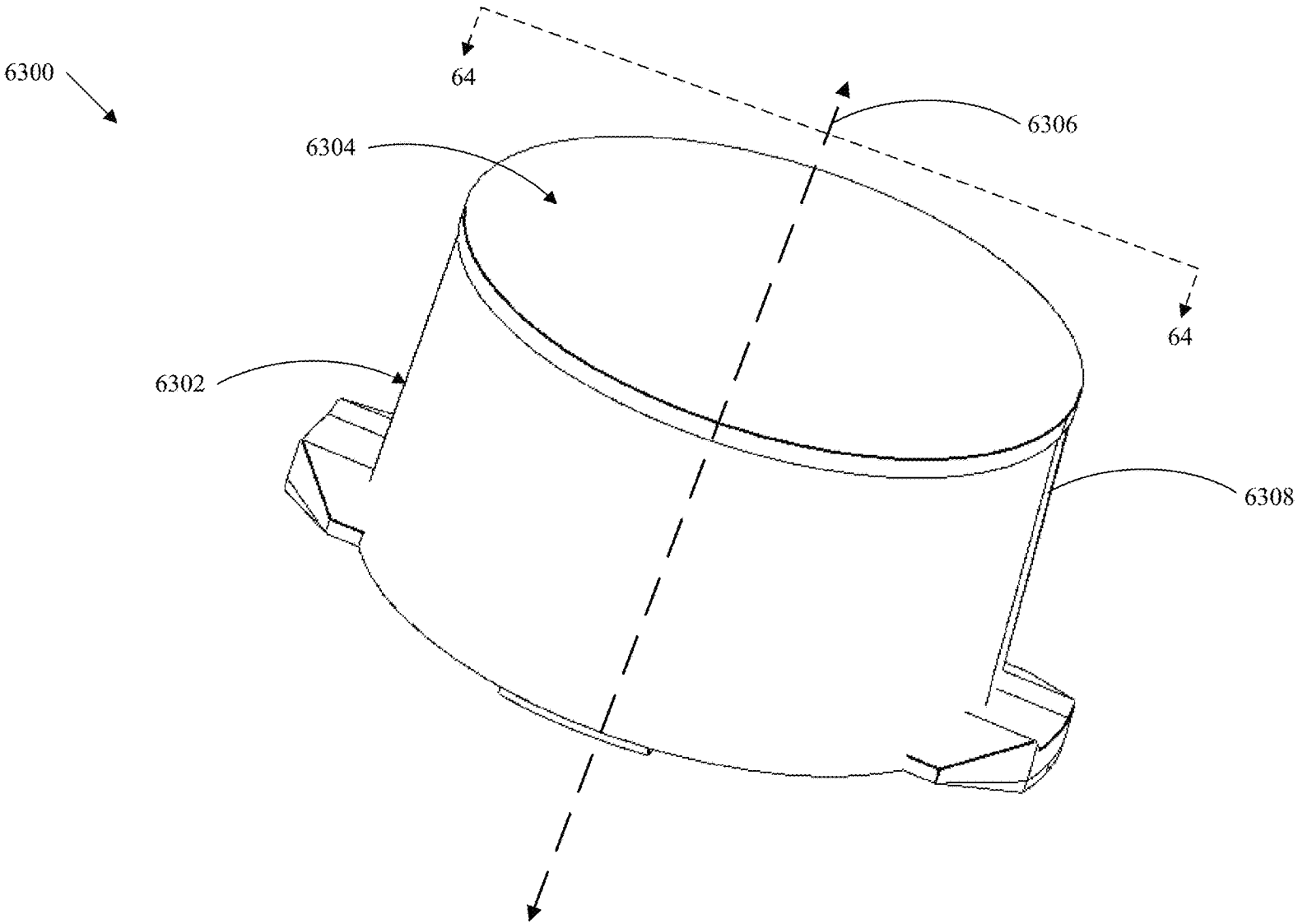
FIGS. 63-70 collectively show an example [6300] of a combination of an optically-transparent body, and a reflector or absorber, that may respectively be substituted for the optically-transparent body and the funnel reflector in the examples [100], [300] of the lighting system.

FIGS. 50-62 collectively show an example [5000] of a combination of an optically-transparent body [5002] that may be substituted for the optically-transparent bodies [240], [440], [540], [740] in the examples [100], [300] of the lighting system; and a visible-light reflector [5004] that may be substituted for the funnel reflectors [216], [416] in the examples [100], [300] of the lighting system. FIGS. 51 and 52 are cross-sectional views taken along line 51-51; and FIGS. 59 and 60 are cross-sectional views taken along line 59-59. In the example [5000] of the combination of the optically-transparent body [5002] and the visible-light reflector [5004], the visible-light reflector [5004] has a central axis [5006] and has a second visible-light-reflective surface [5102] being aligned along the central axis [5006]. The example [5000] of the combination of the optically-transparent body [5002] and the visible-light reflector [5004] further includes the optically-transparent body [5002] as being aligned with the second visible-light-reflective surface [5102] along the central axis [5006]. In the example [5000] of the combination of the optically-transparent body [5002] and the visible-light reflector [5004], the optically-transparent body [5002] has a first base [5104] being spaced apart along the central axis [5006] from a second base [5106], and a side surface [5008] extending between the bases [5104], [5106]; and the first base [5104] faces toward a visible-light source (not shown) in the same manner as discussed earlier in connection with the lighting systems [100], [300]. In some examples [5000] of the combination of the optically-transparent body [5002] and the visible-light reflector [5004], the visible-light reflector [5004] may be disk-shaped as may be seen in FIGS. 56-57. Further, as examples [5000] of the combination of the optically-transparent body [5002] and the visible-light reflector [5004], the visible-light reflector [5004] may include a disk-shaped body [5004] having a visible-light-reflective coating as forming the second visible-light-reflective surface [5102]. In some examples [5000], the combination of the optically-transparent body [5002] and the visible-light reflector [5004] may further include a cap [5802] for capturing visible-light emissions that may pass through the visible-light reflector [5004], for example, near perimeter regions [5902], [5904] of the visible-light reflector.

As examples [5000] of the combination of the optically-transparent body [5002] and the visible-light reflector [5004], the visible-light reflector [5004] may be formed of heat-resistant material. In some examples [5000] of the combination of the optically-transparent body [5002] and the visible-light reflector [5004], the visible-light reflector [5004] may include a disk-shaped body [5004] being formed of a heat-resistant material. As examples [5000] of the combination of the optically-transparent body [5002] and the visible-light reflector [5004], suitable heat-resistant materials may include metals, metal alloys, ceramics, glasses, and plastics having high melting or degradation temperature ratings. In further examples [5000] of the combination of the optically-transparent body [5002] and the visible-light reflector [5004], the visible-light reflector [5004] may include a second visible-light-reflective surface [5102] as being either attached to or integrally formed together with the body [5004] of heat-resistant material. In examples [5000] of the combination of the optically-transparent body [5002] and the visible-light reflector [5004], the second visible-light-reflective surface [5102] may be formed of a highly-visible-light-reflective material such as, for example, specular silver-anodized aluminum, or a white coating material. In some examples [5000] of the combination of the optically-transparent body [5002] and the visible-light reflector [5004], the visible-light reflector [5004] may include a disk-shaped body [5004] formed of anodized aluminum having a second visible-light-reflective surface [5102] being formed of silver; an example of such a metal-coated body being commercially-available from Alanod GmbH under the trade name "Miro 4 (tm)".

In some examples [5000] of the combination of the optically-transparent body [5002] and the visible-light reflector [5004], visible-light emissions (not shown) may enter the first base [5104] and travel through the optically-transparent body [5002] in the same manner as discussed earlier in connection with the optically-transparent bodies [240], [440], [540], [740] of the examples [100], [300] of the lighting system. As examples [5000] of the combination of the optically-transparent body [5002] and the visible-light reflector [5004], some of the visible-light emissions entering into the optically-transparent body [5002] through the first base [5104] may be refracted toward the normalized directions of the central axis [5006] because the refractive index of the optically-transparent body [5002] may be greater than the refractive index of an ambient atmosphere, e.g. air, being adjacent and exterior to the first base [5104]. In further examples [5000] of the combination of the optically-transparent body [5002] and the visible-light reflector [5004], some of the visible-light emissions then traveling through the optically-transparent body [5002] and reaching the second base [5106] of the optically-transparent body [5002] may then be refracted by total internal reflection away from the normalized directions of the central axis [5006] likewise because the refractive index of the optically-transparent body [5002] may be greater than the refractive index of an ambient atmosphere, e.g. air, being present in a cavity [5108] defined by the second base [5106] and the second visible-light-reflective surface [5102]. In those examples [5000] of the combination of the optically-transparent body [5002] and the visible-light reflector [5004], some of the refracted visible-light emissions may be refracted by total internal reflection sufficiently far away from the normalized directions of the central axis [5006] to reduce glare along the central axis [5006]. In additional examples [5000] of the combination of the optically-transparent body [5002] and the visible-light reflector [5004], some of the visible-light emissions traveling through the optically-transparent body [5002] and reaching the second base [5106] of the optically-transparent body [5002] may then reach and be reflected or refracted by the second visible-light-reflective surface [5102] of the visible-light reflector [5004] away from the normalized directions of the central axis [5006]. In those examples [5000] of the combination of the optically-transparent body [5002] and the visible-light reflector [5004], some of the visible-light emissions may be reflected by the second visible-light-reflective surface [5102] or refracted sufficiently far away from the normalized directions of the central axis [5006] to further reduce glare along the central axis [5006].

In other examples [5000], the combination may include the optically-transparent body [5002] together with a visible-light absorber [5004] being substituted for the visible-light reflector [5004]. In those other examples [5000], the visible-light absorber [5004] may include a disk-shaped body [5004] having a visible-light-absorptive coating as forming a second visible-light-absorptive surface [5102]. As examples [5000] of the combination of the optically-transparent body [5002] and the visible-light absorber [5004], the visible-light absorber [5004] may be formed of heat-resistant material. In some examples [5000] of the combination of the optically-transparent body [5002] and the visible-light absorber [5004], the visible-light absorber [5004] may include a disk-shaped body [5004] being formed of a heat-resistant material. As examples [5000] of the combination of the optically-transparent body [5002] and the visible-light absorber [5004], suitable heat-resistant materials may include metals, metal alloys, ceramics, glasses, and plastics having high melting or degradation temperature ratings. In further examples [5000] of the combination of the optically-transparent body [5002] and the visible-light absorber [5004], the visible-light absorber [5004] may include a second visible-light-absorptive surface [5102] as being either attached to or integrally formed together with the body [5004] of heat-resistant material. In an example [5000] of the combination of the optically-transparent body [5002] and the visible-light absorber [5004], the visible-light absorber [5004] may include a second visible-light-absorptive surface [5102] as being a black surface.

In some examples [5000] of the combination of the optically-transparent body [5002] and the visible-light absorber [5004], visible-light emissions (not shown) may enter the first base [5104] and travel through the optically-transparent body [5002] in the same manner as discussed earlier in connection with the optically-transparent bodies [240], [440], [540], [740] of the examples [100], [300] of the lighting system. As examples [5000] of the combination of the optically-transparent body [5002] and the visible-light absorber [5004], some of the visible-light emissions entering into the optically-transparent body [5002] through the first base [5104] may be refracted toward the normalized directions of the central axis [5006] because the refractive index of the optically-transparent body [5002] may be greater than the refractive index of an ambient atmosphere, e.g. air, being adjacent and exterior to the first base [5104]. In further examples [5000] of the combination of the optically-transparent body [5002] and the visible-light absorber [5004], some of the visible-light emissions then traveling through the optically-transparent body [5002] and reaching the second base [5106] of the optically-transparent body [5002] may then be refracted by total internal reflection away from the normalized directions of the central axis [5006] likewise because the refractive index of the optically-transparent body [5002] may be greater than the refractive index of an ambient atmosphere, e.g. air, being present in a cavity [5108] defined by the second base [5106] and the second visible-light-absorptive surface [5102]. In those examples [5000] of the combination of the optically-transparent body [5002] and the visible-light absorber [5004], some of the refracted visible-light emissions may be refracted by total internal reflection sufficiently far away from the normalized directions of the central axis [5006] to reduce glare along the central axis [5006]. In additional examples [5000] of the combination of the optically-transparent body [5002] and the visible-light absorber [5004], some of the visible-light emissions traveling through the optically-transparent body [5002] and reaching the second base [5106] of the optically-transparent body [5002] may then reach and be absorbed by the second visible-light-absorptive surface [5102] of the visible-light absorber [5004]. In those examples [5000] of the combination of the optically-transparent body [5002] and the visible-light absorber [5004], some of the visible-light emissions may sufficiently absorbed by the second visible-light-absorptive surface [5102] to further reduce glare along the central axis [5006].

Figure 64:
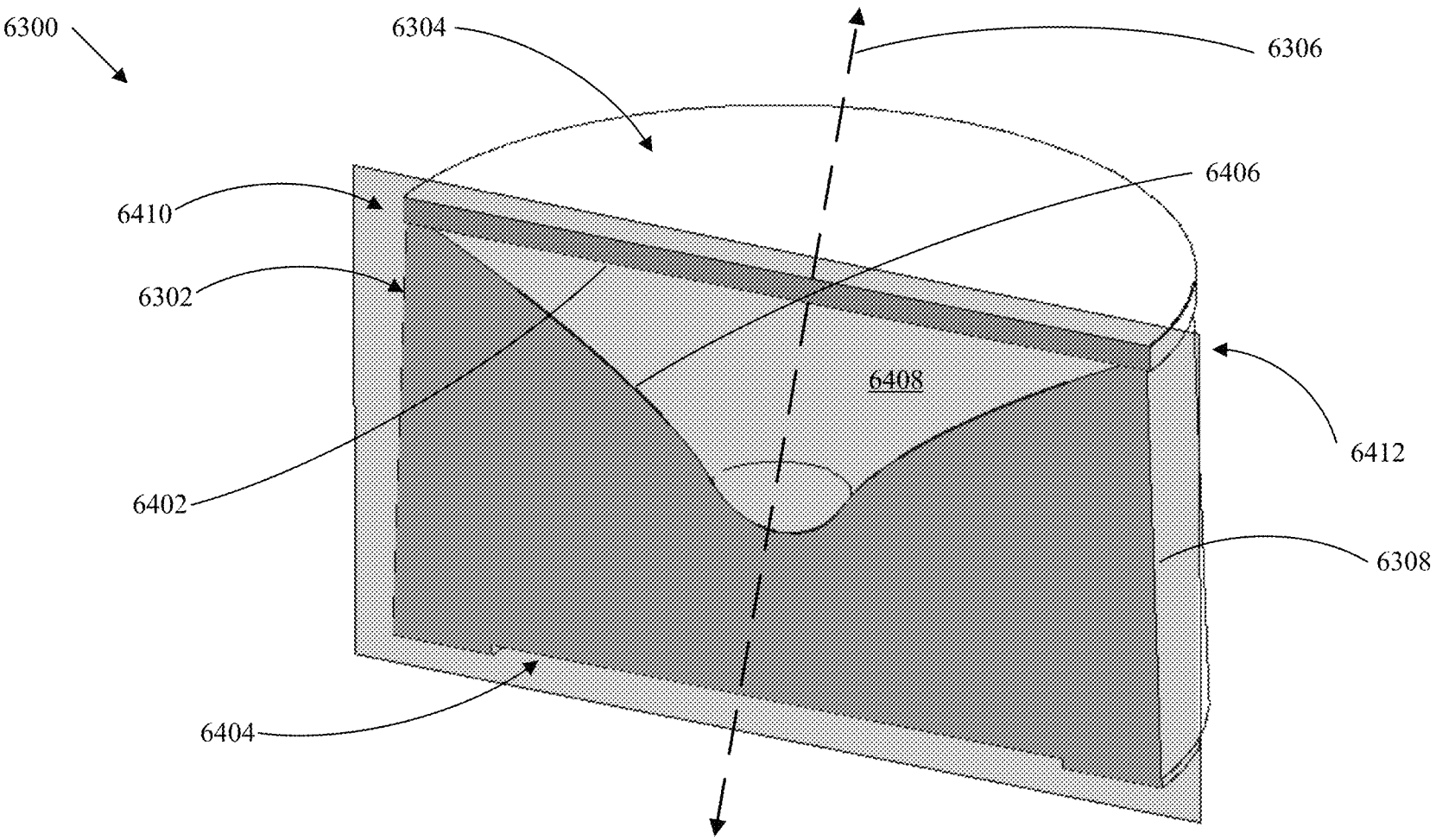
Figure 65:
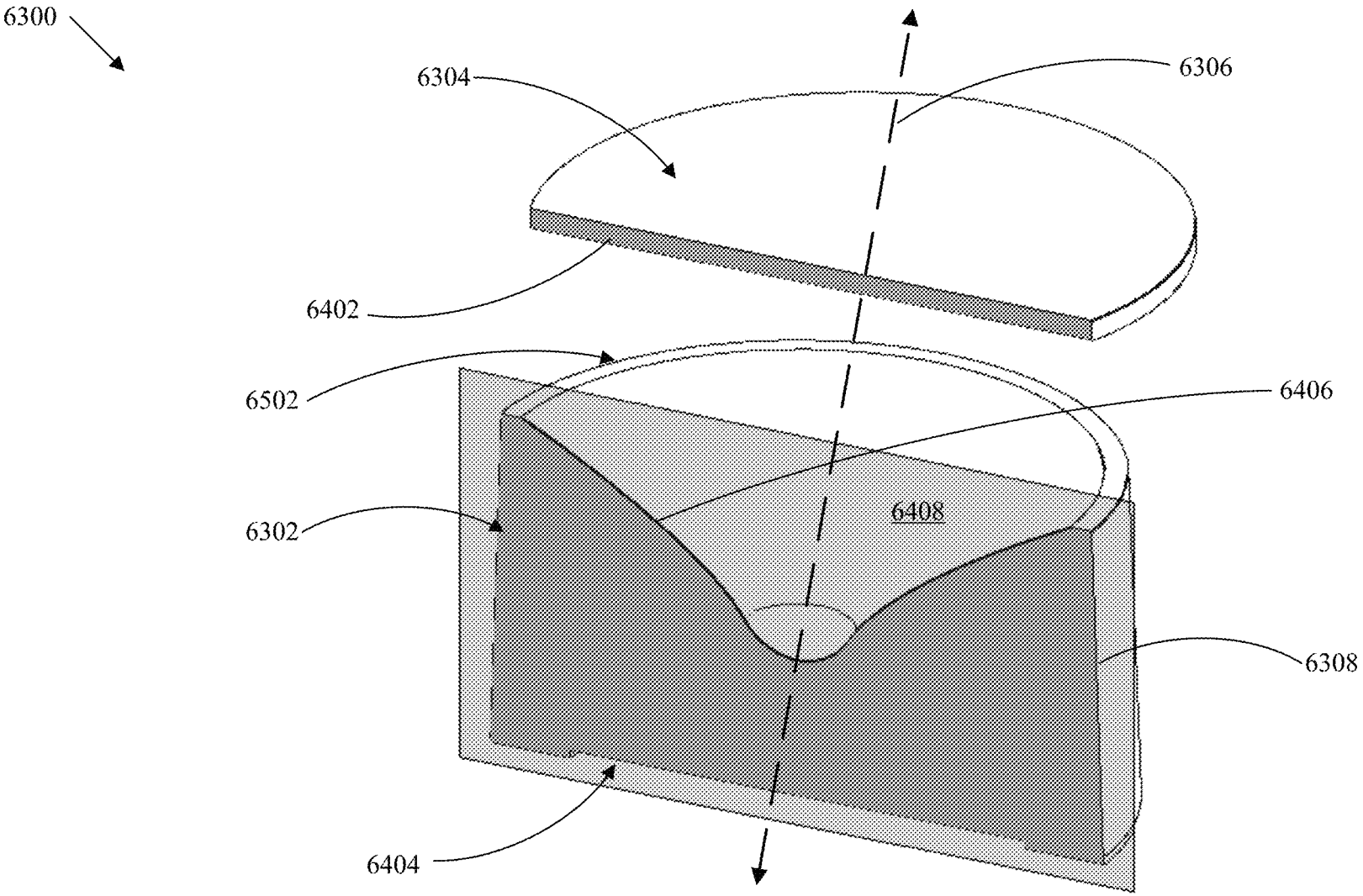
Figure 66:
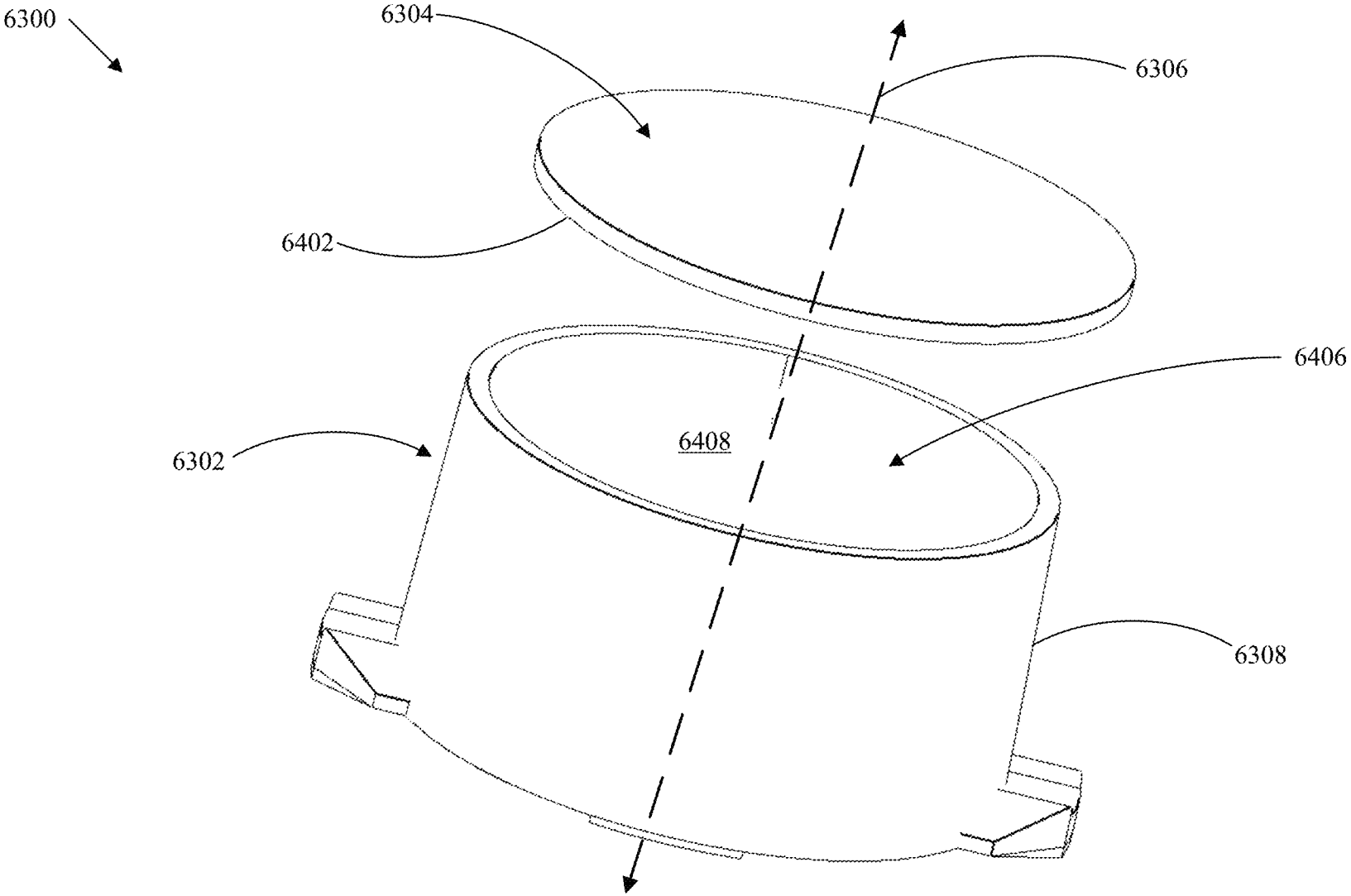
Figure 67:
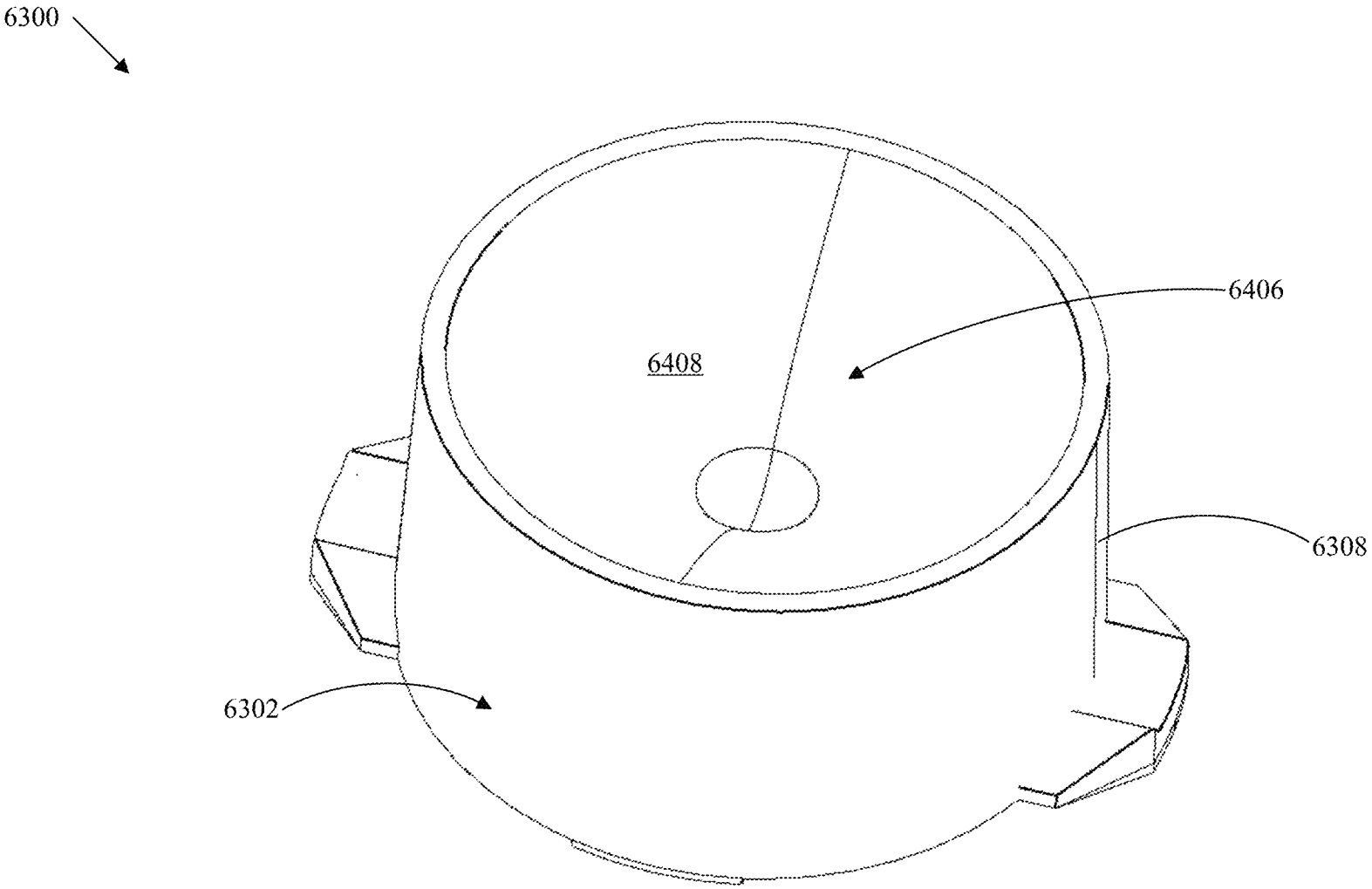
Figure 68:
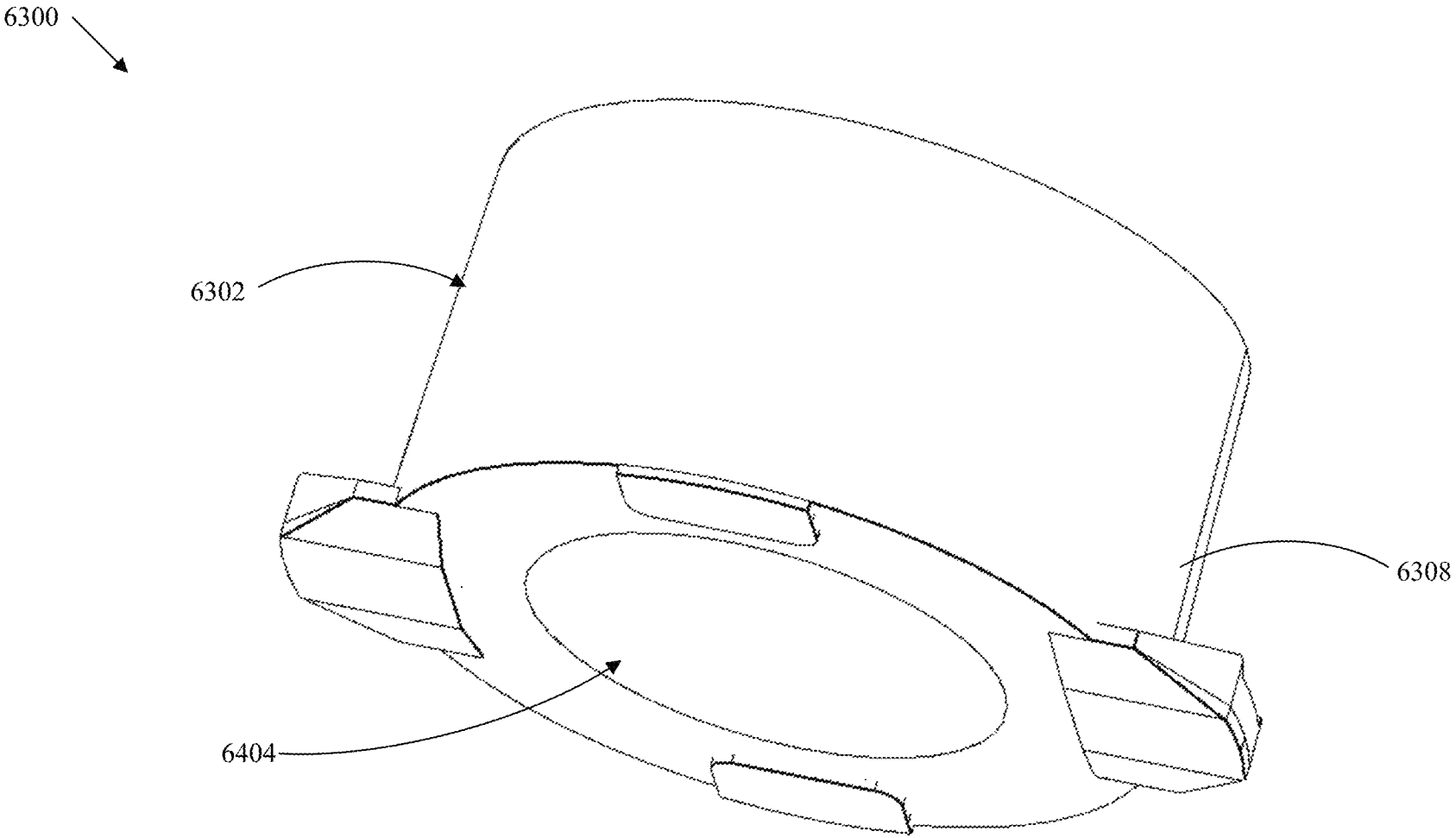
Figure 70:
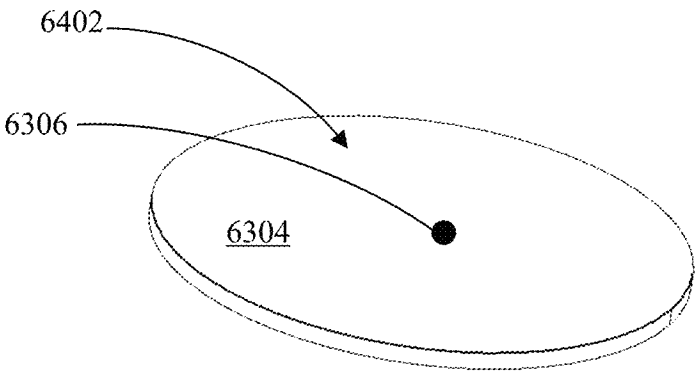
Figure 69:
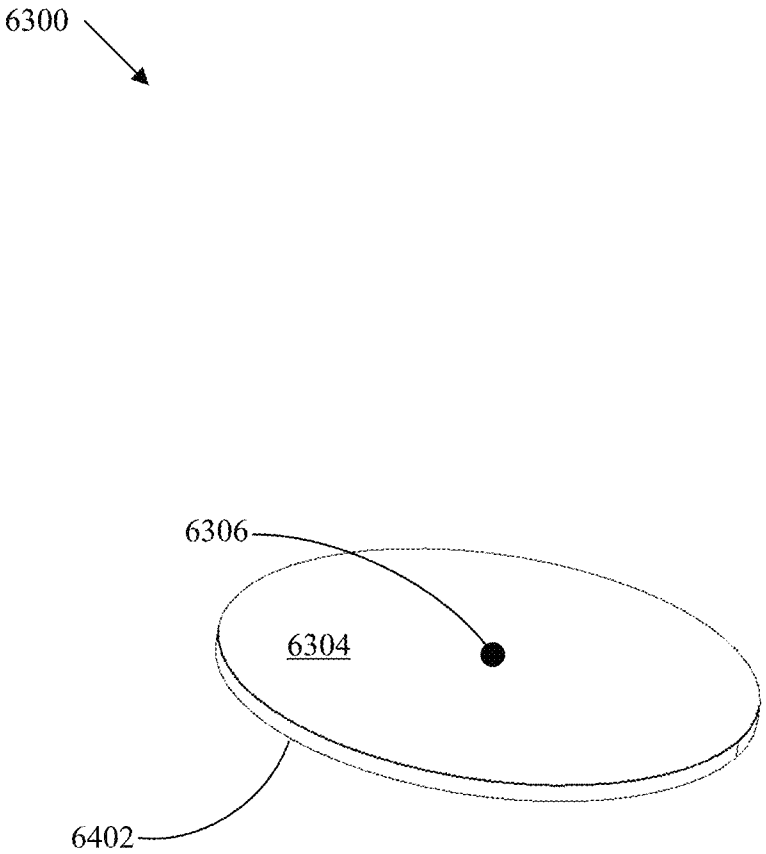

FIGS. 63-70 collectively show an example [6300] of a combination of an optically-transparent body [6302] that may be substituted for the optically-transparent bodies [240], [440], [540], [740] in the examples [100], [300] of the lighting system; and a visible-light reflector [6304] that may be substituted for the funnel reflectors [216], [416] in the examples [100], [300] of the lighting system. FIGS. 64 and 65 are cross-sectional views taken along line 64-64. In the example [6300] of the combination of the optically-transparent body [6302] and the visible-light reflector [6304], the visible-light reflector [6304] has a central axis [6306] and has a second visible-light-reflective surface [6402] being aligned along the central axis [6306]. The example [6300] of the combination of the optically-transparent body [6302] and the visible-light reflector [6304] further includes the optically-transparent body [6302] as being aligned with the second visible-light-reflective surface [6402] along the central axis [6306]. In the example [6300] of the combination of the optically-transparent body [6302] and the visible-light reflector [6304], the optically-transparent body [6302] has a first base [6404] being spaced apart along the central axis [6306] from a second base [6406], and a side surface [6308] extending between the bases [6404], [6406]; and the first base [6404] faces toward a visible-light source (not shown)

in the same manner as discussed earlier in connection with the lighting systems [100], [300]. In some examples [6300] of the combination of the optically-transparent body [6302] and the visible-light reflector [6304], the visible-light reflector [6304] may be disk-shaped as may be seen in FIGS. 69-70. Further, as examples [6300] of the combination of the optically-transparent body [6302] and the visible-light reflector [6304], the visible-light reflector [6304] may include a disk-shaped body [6304] having a visible-light-reflective coating as forming the second visible-light-reflective surface [6402].

As examples [6300] of the combination of the optically-transparent body [6302] and the visible-light reflector [6304], the visible-light reflector [6304] may be formed of heat-resistant material. In some examples [6300] of the combination of the optically-transparent body [6302] and the visible-light reflector [6304], the visible-light reflector [6304] may include a disk-shaped body [6304] being formed of a heat-resistant material. As examples [6300] of the combination of the optically-transparent body [6302] and the visible-light reflector [6304], suitable heat-resistant materials may include metals, metal alloys, ceramics, glasses, and plastics having high melting or degradation temperature ratings. In further examples [6300] of the combination of the optically-transparent body [6302] and the visible-light reflector [6304], the visible-light reflector [6304] may include a second visible-light-reflective surface [6402] as being either attached to or integrally formed together with the body [6304] of heat-resistant material. In examples [6300] of the combination of the optically-transparent body [6302] and the visible-light reflector [6304], the second visible-light-reflective surface [6402] may be formed of a highly-visible-light-reflective material such as, for example, specular silver, or a white coating material. In some examples [6300] of the combination of the optically-transparent body [6302] and the visible-light reflector [6304], the visible-light reflector [6304] may include a disk-shaped body [6304] formed of anodized aluminum having a second visible-light-reflective surface [6402] being formed of silver; an example of such a metal-coated body being commercially-available from Alanod GmbH under the trade name "Miro 4 (tm)".

In some examples [6300] of the combination of the optically-transparent body [6302] and the visible-light reflector [6304], visible-light emissions (not shown) may enter the first base [6404] and travel through the optically-transparent body [6302] in the same manner as discussed earlier in connection with the optically-transparent bodies [240], [440], [540], [740] of the examples [100], [300] of the lighting system. As examples [6300] of the combination of the optically-transparent body [6302] and the visible-light reflector [6304], some of the visible-light emissions entering into the optically-transparent body [6302] through the first base [6404] may be refracted toward the normalized directions of the central axis [6306] because the refractive index of the optically-transparent body [6302] may be greater than the refractive index of an ambient atmosphere, e.g. air, being adjacent and exterior to the first base [6404]. In further examples [6300] of the combination of the optically-transparent body [6302] and the visible-light reflector [6304], some of the visible-light emissions then traveling through the optically-transparent body [6302] and reaching the second base [6406] of the optically-transparent body [6302] may then be refracted by total internal reflection away from the normalized directions of the central axis [6306] likewise because the refractive index of the optically-transparent body [6302] may be greater than the refractive index of an ambient atmosphere, e.g. air, being present in a cavity [6408] defined by the second base [6406] and the second visible-light-reflective surface [6402]. In those examples [6300] of the combination of the optically-transparent body [6302] and the visible-light reflector [6304], some of the refracted visible-light emissions may be refracted by total internal reflection sufficiently far away from the normalized directions of the central axis [6306] to reduce glare along the central axis [6306]. In additional examples [6300] of the combination of the optically-transparent body [6302] and the visible-light reflector [6304], some of the visible-light emissions traveling through the optically-transparent body [6302] and reaching the second base [6406] of the optically-transparent body [6302] may then reach and be reflected or refracted by the second visible-light-reflective surface [6402] of the visible-light reflector [6304] away from the normalized directions of the central axis [6306]. In those examples [6300] of the combination of the optically-transparent body [6302] and the visible-light reflector [6304], some of the visible-light emissions may be reflected by the second visible-light-reflective surface [6402] or refracted sufficiently far away from the normalized directions of the central axis [6306] to further reduce glare along the central axis [6306].

In additional examples [6300] of the combination of the optically-transparent body [6302] and the visible-light reflector [6304], the visible-light reflector [6304] may be placed adjacent to the optically-transparent body [6302] such that the visible-light reflector [6304] is in contact with the perimeter [6502] of the optically-transparent body [6302]. In some of those examples [6300] of the combination of the optically-transparent body [6302] and the visible-light reflector [6304], the visible-light reflector [6304] may be placed adjacent to the optically-transparent body [6302] such that the direct contact between the visible-light reflector [6304] and the optically-transparent body [6302] consists of the perimeter [6502] of the optically-transparent body [6302], being a region [6410], [6412]. Further in those examples [6300] of the combination of the optically-transparent body [6302] and the visible-light reflector [6304], visible-light emissions may generate thermal energy in the visible-light reflector [6304], which accordingly may reach an elevated temperature. In those examples [6300] of the combination of the optically-transparent body [6302] and the visible-light reflector [6304], limiting the direct contact between the visible-light reflector [6304] and the optically-transparent body [6302] to the perimeter [6502] of the optically-transparent body [6302], being the region [6410], [6412], may cause the cavity [6408] to act as a thermal insulator, thereby minimizing thermal conductivity between the visible-light reflector [6304] and the optically-transparent body [6302]. Further in those examples [6300] of the combination of the optically-transparent body [6302] and the visible-light reflector [6304], so minimizing thermal conductivity between the visible-light reflector [6304] and the optically-transparent body [6302] may enhance the operability of the lighting systems [100], [300] by minimizing adverse effects of potential transfer of thermal energy from the visible-light reflector [6304] to the optically-transparent body [6302].

In other examples [6300], the combination may include the optically-transparent body [6302] together with a visible-light absorber [6304] being substituted for the visible-light reflector [6304]. In those other examples [6300], the visible-light absorber [6304] may include a disk-shaped body [6304] having a visible-light-absorptive coating as forming a second visible-light-absorptive surface [6402]. As examples [6300] of the combination of the optically-transparent body [6302] and the visible-light absorber [6304], the visible-light absorber [6304] may be formed of heat-resistant material. In some examples [6300] of the combination of the optically-transparent body [6302] and the visible-light absorber [6304], the visible-light absorber [6304] may include a disk-shaped body [6304] being formed of a heat-resistant material. As examples [6300] of the combination of the optically-transparent body [6302] and the visible-light absorber [6304], suitable heat-resistant materials may include metals, metal alloys, ceramics, glasses, and plastics having high melting or degradation temperature ratings. In further examples [6300] of the combination of the optically-transparent body [6302] and the visible-light absorber [6304], the visible-light absorber [6304] may include a second visible-light-absorptive surface [6402] as being either attached to or integrally formed together with the body [6304] of heat-resistant material. In an example [6300] of the combination of the optically-transparent body [6302] and the visible-light absorber [6304], the visible-light absorber [6304] may include a second visible-light-absorptive surface [6402] as being a black surface.

In some examples [6300] of the combination of the optically-transparent body [6302] and the visible-light absorber [6304], visible-light emissions (not shown) may enter the first base [6404] and travel through the optically-transparent body [6302] in the same manner as discussed earlier in connection with the optically-transparent bodies [240], [440], [540], [740] of the examples [100], [300] of the lighting system. As examples [6300] of the combination of the optically-transparent body [6302] and the visible-light absorber [6304], some of the visible-light emissions entering into the optically-transparent body [6302] through the first base [6404] may be refracted toward the normalized directions of the central axis [6306] because the refractive index of the optically-transparent body [6302] may be greater than the refractive index of an ambient atmosphere, e.g. air, being adjacent and exterior to the first base [6404]. In further examples [6300] of the combination of the optically-transparent body [6302] and the visible-light absorber [6304], some of the visible-light emissions then traveling through the optically-transparent body [6302] and reaching the second base [6406] of the optically-transparent body [6302] may then be refracted by total internal reflection away from the normalized directions of the central axis [6306] likewise because the refractive index of the optically-transparent body [6302] may be greater than the refractive index of an ambient atmosphere, e.g. air, being present in a cavity [6408] defined by the second base [6406] and the second visible-light-absorptive surface [6402]. In those examples [6300] of the combination of the optically-transparent body [6302] and the visible-light absorber [6304], some of the refracted visible-light emissions may be refracted by total internal reflection sufficiently far away from the normalized directions of the central axis [6306] to reduce glare along the central axis [6306]. In additional examples [6300] of the combination of the optically-transparent body [6302] and the visible-light absorber [6304], some of the visible-light emissions traveling through the optically-transparent body [6302] and reaching the second base [6406] of the optically-transparent body [6302] may then reach and be absorbed by the second visible-light-absorptive surface [6402] of the visible-light absorber [6304]. In those examples [6300] of the combination of the optically-transparent body [6302] and the visible-light absorber [6304], some of the visible-light emissions may sufficiently absorbed by the second visible-light-absorptive surface [6402] to further reduce glare along the central axis [6306].

Figure 71:
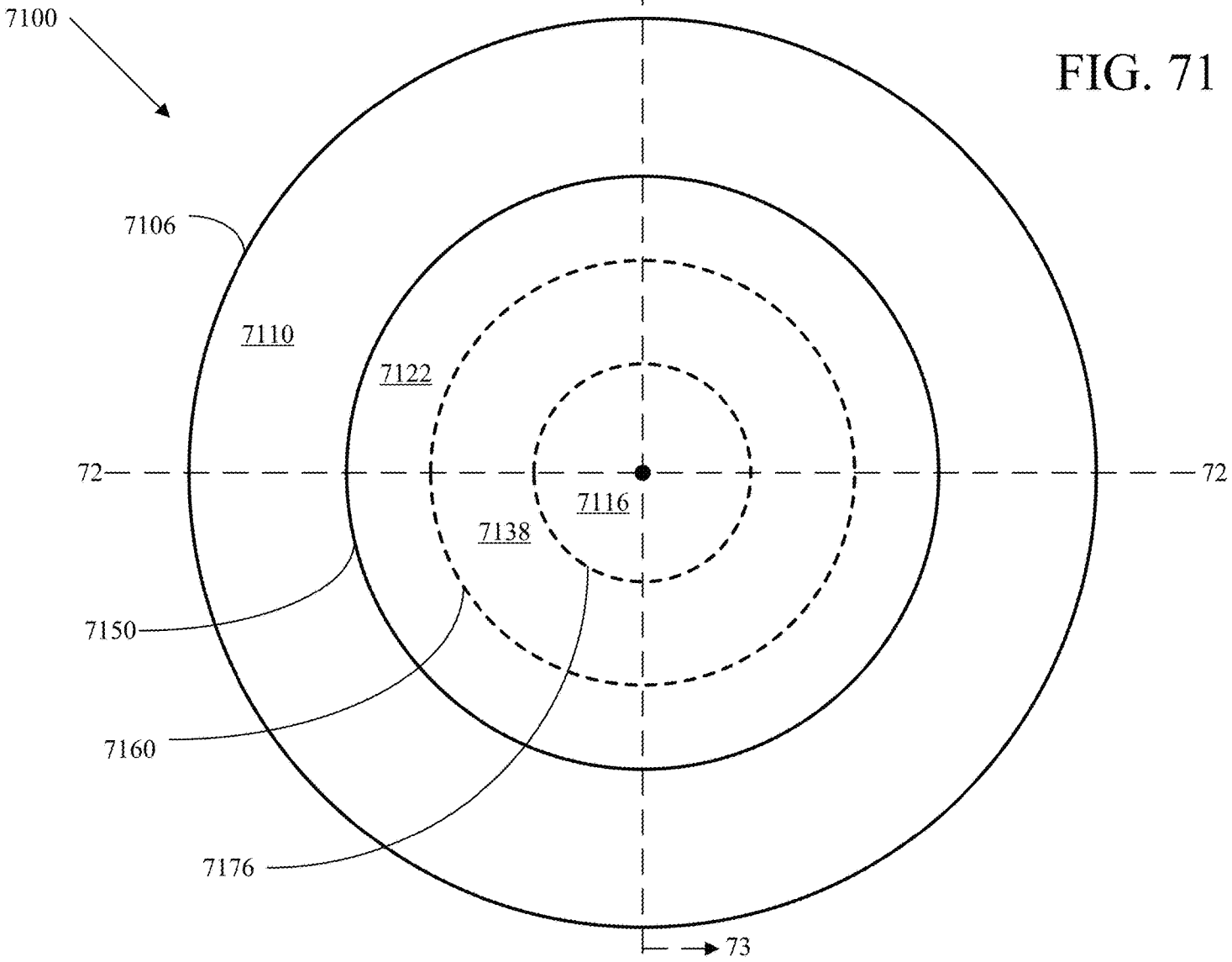
FIG. 71 is a schematic top view showing an example [7100] of a further implementation of a lighting system.
Figure 72:
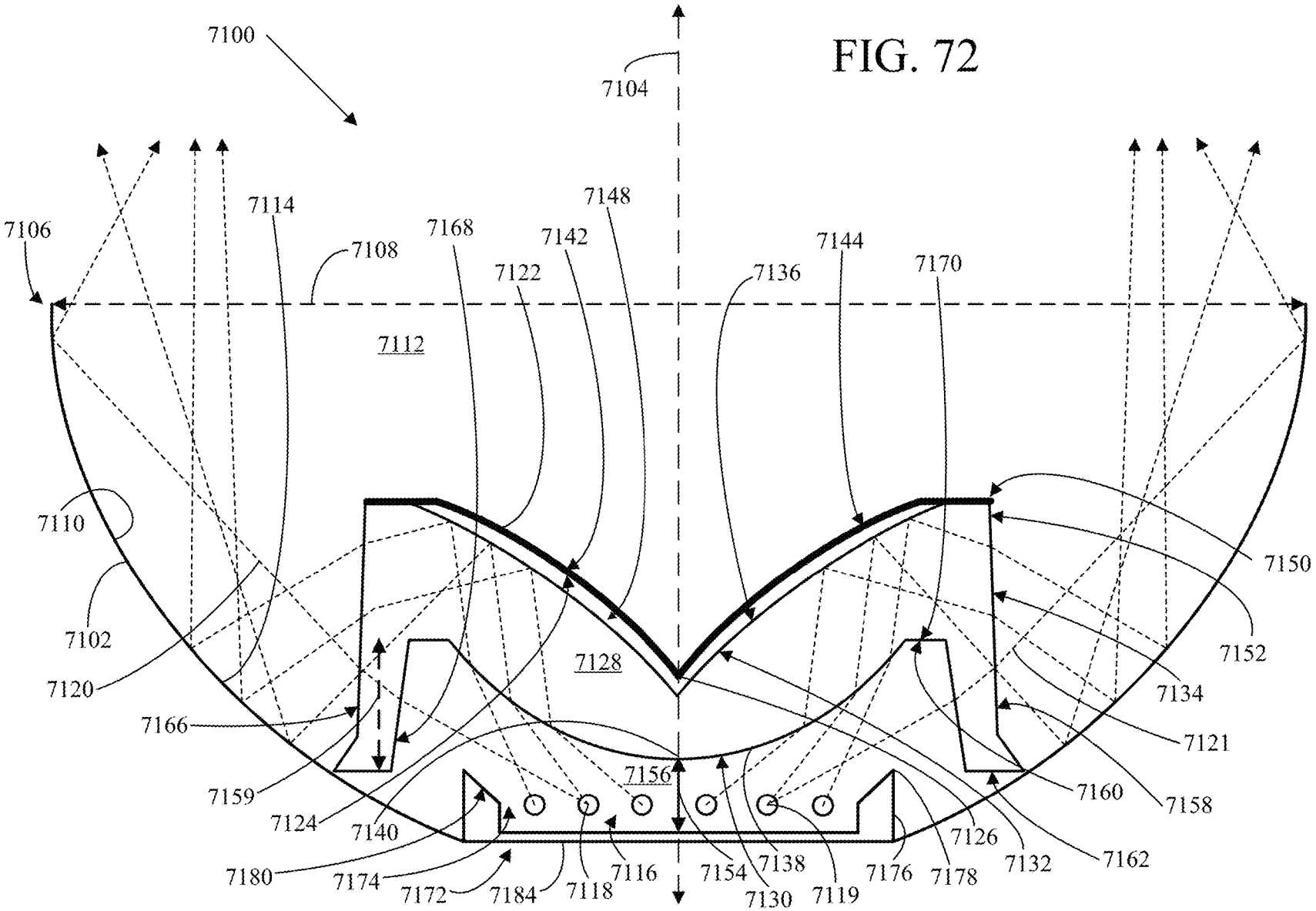
FIG. 72 is a schematic cross-sectional view taken along the line 72-72 of the example [7100] of an implementation of a lighting system.
Figure 73:
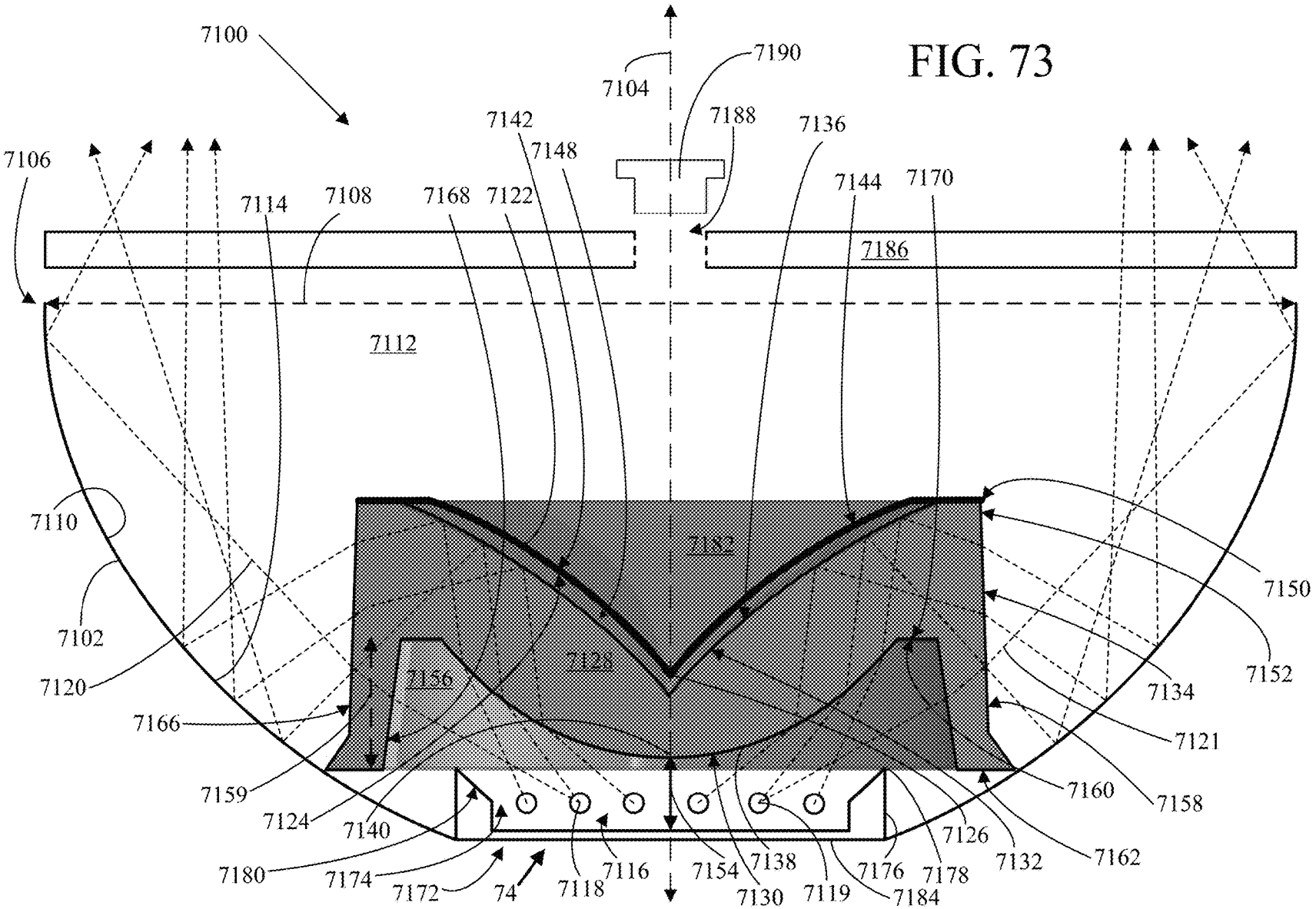
FIG. 73 is another cross-sectional view taken along the line 73-73 including a solid view of an optically-transparent body in the example [7100] of an implementation of a lighting system.
Figure 74:
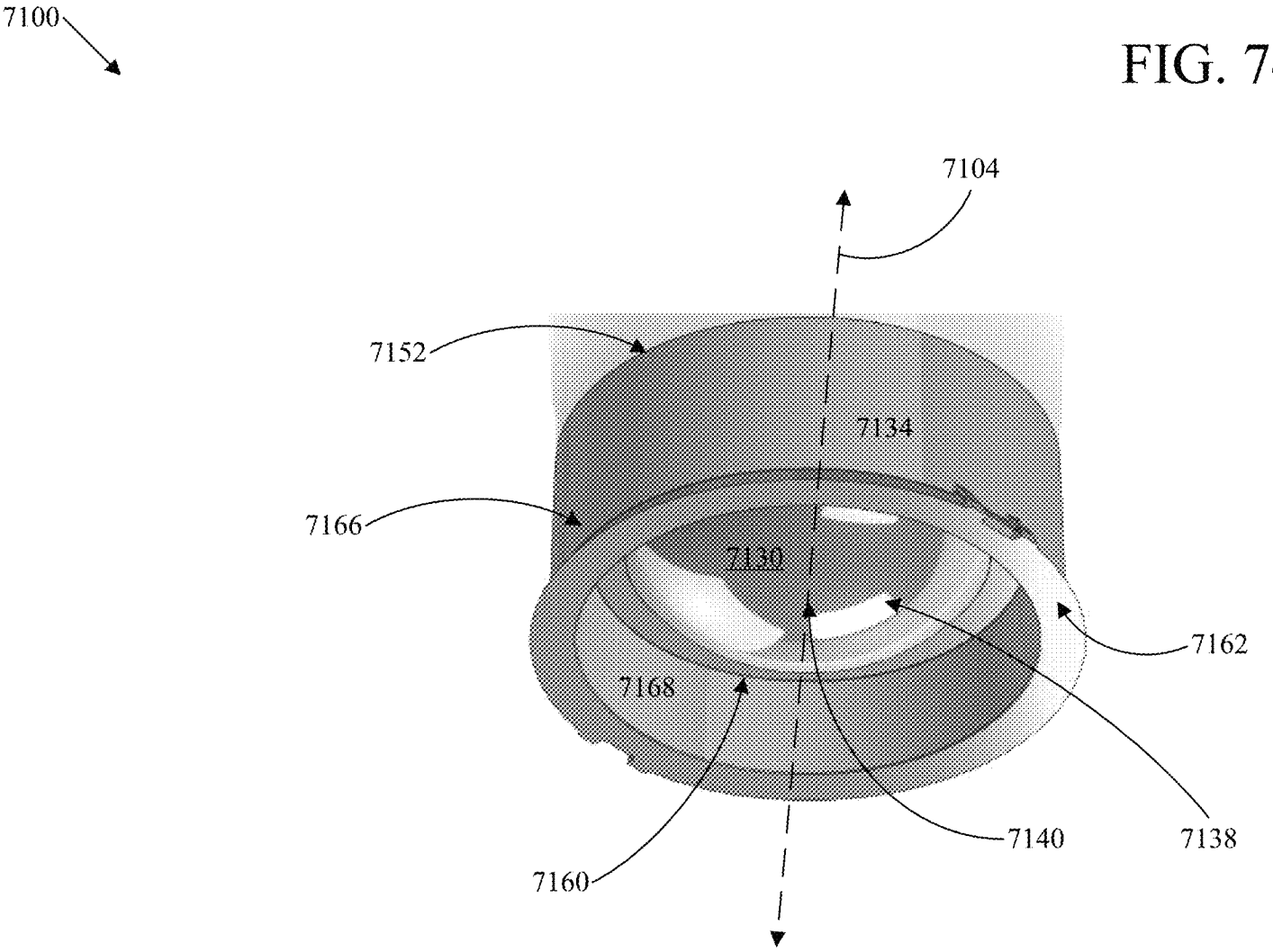
FIG. 74 is a perspective view taken along the line 74 as indicated in FIG. 73, of an optically-transparent body in the example [7100] of an implementation of a lighting system.
Figure 75:
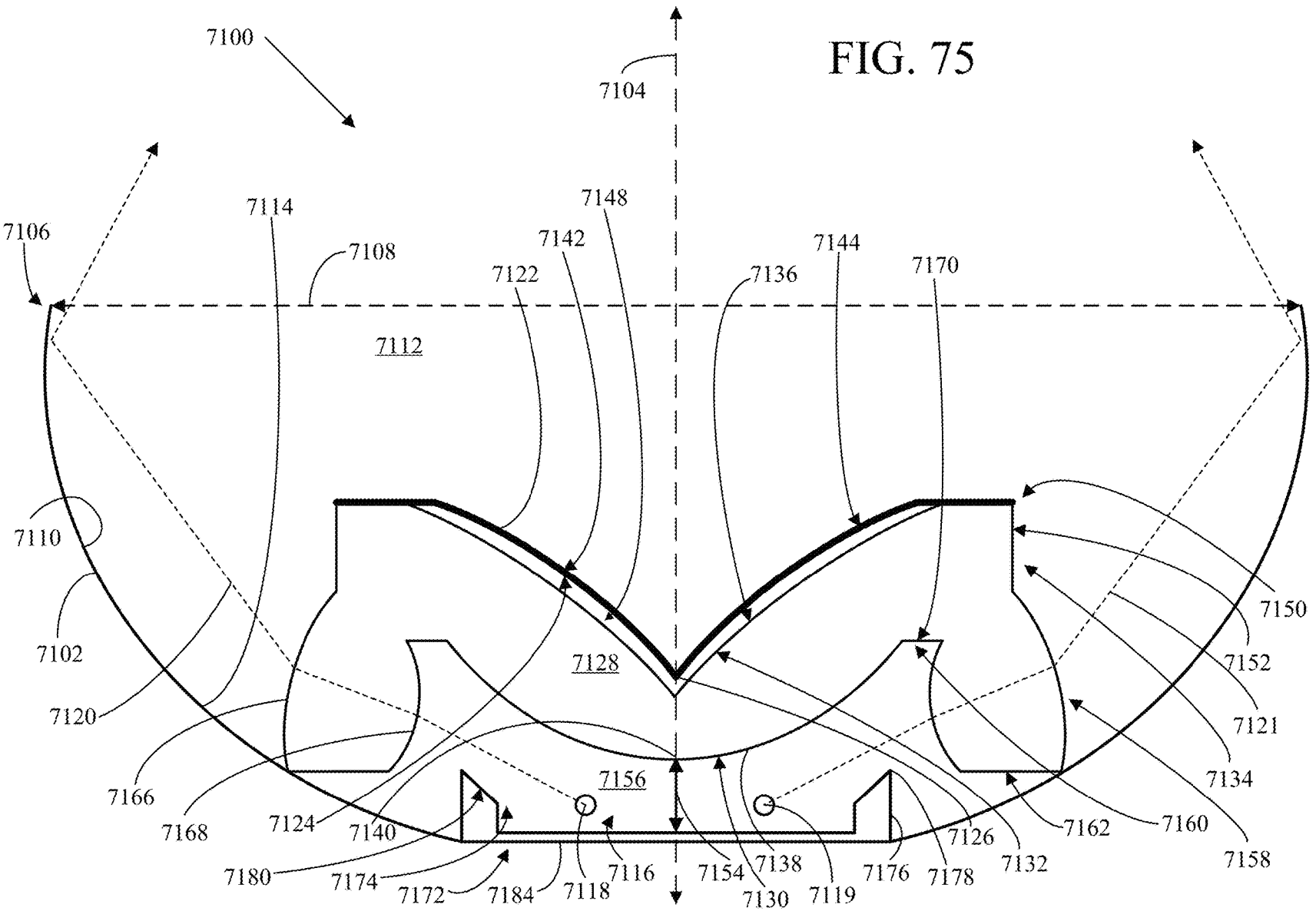
FIG. 75 is a schematic cross-sectional view taken along the line 72-72 of a modified embodiment of the example [7100] of an implementation of a lighting system.

FIG. 71 is a schematic top view showing an example [7100] of a further implementation of a lighting system. FIG. 72 is a schematic cross-sectional view taken along the line 72-72 of the example [7100] of an implementation of a lighting system. FIG. 73 is another cross-sectional view taken along the line 73-73 including a solid view of an optically-transparent body in the example [7100] of an implementation of a lighting system. FIG. 74 is a perspective view taken along the line 74 as indicated in FIG. 73, of an optically-transparent body in the example [7100] of an implementation of a lighting system. FIG. 75 is a schematic cross-sectional view taken along the line 72-72 of a modified embodiment of the example [7100] of an implementation of a lighting system.

It is understood throughout this specification that the further example [7100] of an implementation of the lighting system may be modified as including any of the features or combinations of features that are disclosed in connection with: the examples [100], [300] of implementations of the lighting system; or the examples [500], [700] of alternative optically-transparent bodies; or the additional examples [900], [1200], [1500], [1800], [2000] of alternative bowl reflectors. Accordingly, FIGS. 1-21 and the entireties of the discussions herein of the examples [100], [300], [500], [700], [900], [1200], [1500], [1800], [2000] of implementations of the lighting system are hereby incorporated into the following discussion of the further example [7100] of an implementation of the lighting system. Further, FIGS. 22-49 collectively show an example [2200] of a lighting assembly that includes a bowl reflector, an optically-transparent body, and a funnel reflector, that may be substituted for such elements in the examples [100], [300] of the lighting system. FIGS. 50-62 collectively show an example [5000] of a combination of an optically-transparent body, and a reflector or absorber, that may respectively be substituted for the optically-transparent body and the funnel reflector in the examples [100], [300] of the lighting system. FIGS. 63-70 collectively show an example [6300] of a combination of an optically-transparent body, and a reflector or absorber, that may respectively be substituted for the optically-transparent body and the funnel reflector in the examples [100], [300] of the lighting system. Accordingly, FIGS. 22-70 and the entireties of the subsequent discussions of the examples [2200], [5000] and [6300] are hereby incorporated into the following discussion of the further example [7100] of an implementation of the lighting system.

As collectively shown in FIGS. 71-75, the further example [7100] of an implementation of the lighting system includes a bowl reflector [7102] having a central axis [7104], the bowl reflector [7102] having a rim [7106] defining an emission aperture [7108], the bowl reflector [7102] having a first visible-light-reflective surface [7110] defining a portion of a cavity [7112] in the bowl reflector [7102], a portion of the first visible-light-reflective surface [7110] being a parabolic surface [7114]. The further example [7100] of the lighting system also includes a visible-light source [7116] including a semiconductor light-emitting device [7118], the visible-light source [7116] being located in the cavity [7112], the visible-light source [7116] being configured for generating visible-light emissions [7120] from the semiconductor light-emitting device [7118]. The further example [7100] of the lighting system additionally includes a central reflector [7122] having a second visible-light-reflective surface [7124], the second visible-light-reflective surface [7124] having a convex flared funnel shape and having a first peak [7126], the first peak [7126] facing toward the visible-light source [7116]. In addition, the example [7100] of the lighting system includes an optically-transparent body [7128] having a first base [7130] being spaced apart from a second base [7132] and having a side wall [7134] extending between the first base [7130] and the second base [7132], a surface [7136] of the second base [7132] having a concave flared funnel shape, the concave flared funnel-shaped surface [7136] of the second base [7132] facing toward the convex flared funnel-shaped second visible-light reflective surface [7124] of the central reflector [7122], and the first base [7130] including a central region [7138] having a convex paraboloidal-shaped surface and a second peak [7140], the second peak [7140] facing toward the visible-light source [7116].

In some examples [7100] of the lighting system, the central reflector [7122] may be aligned along the central axis [7104], and a cross-section of the convex flared funnel-shaped second visible-light-reflective surface [7124] of the central reflector [7122], taken along the central axis [7104], may include two concave curved sections [7142], [7144] meeting at the first peak [7126]. Further in those examples [7100] of the lighting system, the cross-section of the convex flared funnel-shaped second visible-light-reflective surface [7124] of the central reflector [7122], taken along the central axis [7104], may include the two concave curved sections [7142], [7144] as being parabolic-curved sections [7142], [7144] meeting at the first peak [7126]. In some examples [7100] of the lighting system, the cross-section of the convex flared funnel-shaped second visible-light-reflective surface [7124] of the central reflector [7122], taken along the central axis [7104], may include each one of the two concave curved sections [7142], [7144] as being a step-curved section, wherein each step-curved section [7142], [7144] may include two curved concave subsections (not shown) meeting at an inflection point between the side wall [7134] and the first peak [7126]. In some examples [7100] of the lighting system, selecting the central reflector [7122] as having the concave step-curved subsections (not shown) may aid in the manufacture of the convex flared funnel-shaped second visible-light-reflective surface [7124] of the central reflector [7122].

In some examples [7100] of the lighting system, the convex flared funnel-shaped second visible-light reflective surface [7124] of the central reflector [7122] may be in contact with the concave flared funnel-shaped surface [7136] of the second base [7132]. In further examples [7100] of the lighting system, the convex flared funnel-shaped second visible-light reflective surface [7124] of the central reflector [7122] may be spaced apart by a gap [7148] away from the concave flared funnel-shaped surface [7136] of the second base [7132] of the optically-transparent body [7128]. In some examples [7100] of the lighting system, the gap [7148] may be an ambient air gap [7148]. In other examples [7100] of the lighting system, the gap [7148] may be filled with a material having a refractive index being higher than a refractive index of ambient air. In further examples [7100] of the lighting system, the gap [7148] may be filled with a material having a refractive index being lower than a refractive index of the optically-transparent body [7128].

In additional examples [7100] of the lighting system, the central reflector [7122] may have a first perimeter [7150] located transversely away from the central axis [7104], and the second base [7132] of the optically-transparent body [7128] may have a second perimeter [7152] located transversely away from the central axis [7104], and the first perimeter [7150] of the central reflector [7122] may be in contact with the second perimeter [7152] of the second base [7132] of the optically-transparent body [7128]. In some of those examples [7100] of the lighting system, the first perimeter [7150] of the central reflector [7122] may be so placed in contact with the second perimeter [7152] of the second base [7132] of the optically-transparent body [7128] in order to mutually support and maintain in position together the central reflector [7122] and the optically-transparent body [7128]. As an example [7100] of the lighting system, the first perimeter [7150] of the central reflector [7122] may be adhesively bonded or otherwise securely attached to the second perimeter [7152] of the second base [7132] of the optically-transparent body [7128]. In other examples [7100] of the lighting system, the central reflector [7122] and the second base [7132] of the optically-transparent body [7128] may be spaced apart by the gap [7148] except for the first perimeter [7150] of the central reflector [7122] as being in contact with the second perimeter [7152] of the second base [7132] of the optically-transparent body [7128].

In some examples [7100] of the lighting system, the convex paraboloidal-shaped surface of the central region [7138] of the first base [7130] may be a spheroidal-shaped surface [7138], or may be a hemispherical-shaped surface [7138].

In other examples [7100] of the lighting system, the optically-transparent body [7128] may be aligned along the central axis [7104], and the second peak [7140] of the central region [7138] of the first base [7130] may be spaced apart by a distance represented by an arrow [7154] along the central axis [7104] away from the visible-light source [7116]. In some examples [7100] of the lighting system, the convex paraboloidal-shaped surface of the central region [7138] of the first base [7130] may disperse reflected visible-light emissions [7120] in many directions which may help avoid over-heating of the visible-light source [7116] that might otherwise be caused by reflection of visible-light emissions [7120] back towards the visible-light source [7116]. In some examples [7100] of the lighting system, the first base [7130] of the optically-transparent body [7128] may be spaced apart by another gap [7156] away from the visible-light source [7116]. In some examples [7100] of the lighting system, the another gap [7156] may be an ambient air gap [7156]. In other examples [7100] of the lighting system, the another gap [7156] may be filled with a material having a refractive index being higher than a refractive index of ambient air. In additional examples [7100] of the lighting system, the another gap [7156] may be filled with a material having a refractive index being lower than a refractive index of the optically-transparent body [7128].

In examples [7100] of the lighting system, the first base [7130] of the optically-transparent body [7128] may include an annular lensed optic region [7158] surrounding the central region [7138], the annular lensed optic region [7158] of the first base [7130] extending, as defined in a direction represented by an arrow [7159] being parallel with the central axis [7104], toward the visible-light source [7116] from a valley [7160] surrounding the central region [7138]. In some of those examples [7100] of the lighting system, the annular lensed optic region [7158] of the first base [7130] may extend, as defined in the direction [7159] being parallel with the central axis [7104], from the valley [7160] surrounding the central region [7138] of the first base [7130] to a third peak [7162] of the first base [7130]. In some of those examples [7100] of the lighting system, the third peak [7162] may be located, as defined in the direction [7159] being parallel with the central axis [7104], at about the distance [7154] of the central region [7138] away from the visible-light source [7116]. In some examples [7100] of the lighting system, the annular lensed optic region [7158] of the first base [7130] may define pathways for some of the visible-light emissions [7120], the annular lensed optic region [7158] including an optical output interface [7166] being spaced apart across the annular lensed optic region [7158] from an optical input interface [7168]. Also in those examples [7100] of the lighting system, the visible-light source [7116] may be positioned for an average angle of incidence at the optical input interface [7168] being selected for causing visible-light emissions [7120] entering the optical input interface [7168] to be refracted in propagation directions toward the bowl reflector [7102] and away from the third peak [7162] of the first base [7130]. Further in those examples [7100] of the lighting system, the optical output interface [7166] may be positioned relative to the propagation directions for another average angle of incidence at the optical output interface [7166] being selected for causing visible-light emissions [7120] exiting the optical output interface [7166] to be refracted in propagation directions toward the bowl reflector [7102] and being further away from the third peak [7162] of the first base [7130]. In other examples [7100] of the lighting system, the optical input interface [7168] may extend between the valley [7160] and the third peak [7162] of the first base [7130], and a distance between the valley [7160] and the central axis [7104] may be smaller than another distance between the third peak [7162] and the central axis [7104].

Referring to FIG. 75, in additional examples [7100] of the lighting system, a cross-section of the annular lensed optic region [7158] of the optically-transparent body [7128] taken along the central axis [7104] may be modified as having a biconvex lens shape. In some of those examples [7100] of the lighting system, the optically-transparent body [7128] may be shaped for directing visible-light emissions [7120], [7121] into a convex-lensed optical input interface [7168] for passage through the annular biconvex-lensed optic region [7158] to then exit from a convex-lensed optical output interface [7166] for propagation toward the bowl reflector [7102]. In some examples [7100] of the lighting system, the annular biconvex-lensed optic region [7158] of the first base [7130] may define focused pathways for some of the visible-light emissions [7120], [7121], the annular biconvex lensed optic region [7158] including the optical output interface [7166] being spaced apart across the annular biconvex lensed optic region [7158] from the optical input interface [7168]. In further examples [7100], the optical input interface [7168] and the optical output interface [7166] each may function as a plano-convex lens, being effective together in focusing the visible-light emissions [7121], [7121] to be reflected by the bowl reflector [7102].

In other examples [7100] of the lighting system, the first base [7130] of the optically-transparent body [7128] may include a lateral region [7170] being located between the annular lensed optic region [7158] and the central region [7138].

In examples [7100], the lighting system may further include a holder [7172] for the semiconductor light-emitting device [7118], and the holder [7172] may include a chamber [7174] for holding the semiconductor light-emitting device [7118], and the chamber [7174] may include a wall [7176] having a fourth peak [7178] facing toward the first base [7130] of the optically-transparent body [7128]. Further in those examples [7100] of the lighting system, the fourth peak [7178] may have an edge [7180] being chamfered for permitting unobstructed propagation of the visible-light emissions [7120] from the visible-light source [7116] to the optically-transparent body [7128]. In some examples [7100] of the lighting system, the fourth peak [7178] may have the edge [7180] as being chamfered at an angle being within a range of between about thirty (30) degrees and about sixty (60) degrees. In further examples [7100] of the lighting system, the fourth peak [7178] may have the edge [7180] as being chamfered, as shown in FIG. 72, at an angle being about forty-five (45) degrees.

In some examples [7100] of the lighting system, the first visible-light-reflective surface [7110] of the bowl reflector [7102] may be a specular light-reflective surface [7110]. In further examples [7100] of the lighting system, the first visible-light-reflective surface [7110] may be a metallic layer on the bowl reflector [7102]. In additional examples [7100] of the lighting system, the first visible-light-reflective surface [7110] of the bowl reflector [7102] may have a minimum visible-light reflection value from any incident angle being at least about ninety percent (90%). In other examples [7100] of the lighting system, the first visible-light-reflective surface [7110] of the bowl reflector [7102] may have a minimum visible-light reflection value from any incident angle being at least about ninety-five percent (95%). In some examples [7100] of the lighting system, the first visible-light-reflective surface [7110] of the bowl reflector [7102] may have a maximum visible-light transmission value from any incident angle being no greater than about ten percent (10%). In further examples [7100] of the lighting system, the first visible-light-reflective surface [7110] of the bowl reflector [7102] may have a maximum visible-light transmission value from any incident angle being no greater than about five percent (5%). In additional examples [7100] of the lighting system, the first visible-light reflective surface [7110] of the bowl reflector [7102] may include a plurality of vertically-faceted sections (not shown) being mutually spaced apart around and joined together around the central axis [7104]. In other examples [7100] of the lighting system, each one of the vertically-faceted sections may have a generally pie-wedge-shaped perimeter. In some examples [7100] of the lighting system, each one of the vertically-faceted sections may form a one of a plurality of facets of the first visible-light-reflective surface [7110], and each one of the facets may have a concave visible-light reflective surface. In further examples [7100] of the lighting system, each one of the vertically-faceted sections may form a one of a plurality of facets of the first visible-light-reflective surface [7110], and each one of the facets may have a convex visible-light reflective surface. In additional examples [7100] of the lighting system, each one of the vertically-faceted sections may form a one of a plurality of facets of the first visible-light-reflective surface [7110], and each one of the facets may have a generally flat visible-light reflective surface.

In some examples [7100] of the lighting system, the second visible-light-reflective surface [7124] of the central reflector [7122] may be a specular surface. In further examples [7100] of the lighting system, the second visible-light-reflective surface [7124] of the central reflector [7122] may be a metallic layer on the central reflector [7122]. In additional examples [7100] of the lighting system, the second visible-light-reflective surface [7124] of the central reflector [7122] may have a minimum visible-light reflection value from any incident angle being at least about ninety percent (90%). In other examples [7100] of the lighting system, the second visible-light-reflective surface [7124] of the central reflector [7122] may have a minimum visible-light reflection value from any incident angle being at least about ninety-five percent (95%). In some examples [7100] of the lighting system, the second visible-light-reflective surface [7124] of the central reflector [7122] may have a maximum visible-light transmission value from any incident angle being no greater than about ten percent (10%). In further examples [7100] of the lighting system, the second visible-light-reflective surface [7124] of the central reflector [7122] may have a maximum visible-light transmission value from any incident angle being no greater than about five percent (5%).

In additional examples [7100] of the lighting system, the optically-transparent body [7128] may be aligned along the central axis [7104], and the first base [7130] may be spaced apart along the central axis [7104] from the second base [7132]. In some examples [7100] of the lighting system, the first base [7130] may include the convex paraboloidal-shaped surface of the central region [7138] having the second peak [7140]. In further examples [7100] of the lighting system, the first base [7130] may further include the annular lensed optic region [7158] surrounding the central region [7138]. In additional examples [7100] of the lighting system, the first base [7130] may also include the lateral region [7160] between the central region [7138] and the annular lensed optic region [7158]. In other examples [7100], the second base [7132] may include the concave flared funnel-shaped surface [7136].

In further examples [7100] of the lighting system, the side wall [7134] of the optically-transparent body [7128] may have a generally-cylindrical shape. In additional examples [7100] of the lighting system, the first and second bases [7130], [7132] of the optically-transparent body [7128] may have circular perimeters located transversely away from the central axis [7104], and the optically-transparent body [7128] may have a generally circular-cylindrical shape. In other examples [7100] of the lighting system, the first and second bases [7130], [7132] of the optically-transparent body [7128] may have circular perimeters located transversely away from the central axis [7104]; and the optically-transparent body [7128] may have a circular-cylindrical shape; and the central reflector [7122] may have a circular perimeter located transversely away from the central axis [7104]; and the rim [7106] of the bowl reflector [7102] may have a circular perimeter. In some examples [7100] of the lighting system, the first and second bases [7130], [7132] of the optically-transparent body [7128] may have elliptical perimeters located transversely away from the central axis [7104]; and the optically-transparent body [7128] may have an elliptical-cylindrical shape; and the central reflector [7122] may have an elliptical perimeter located transversely away from the central axis [7104]; and the rim [7106] of the bowl reflector [7102] may have an elliptical perimeter. In additional examples [7100] of the lighting system, each of the first and second bases [7130], [7132] of the optically-transparent body [7128] may have a multi-faceted perimeter being rectangular, hexagonal, octagonal, or otherwise polygonal; and the optically-transparent body [7128] may have a multi-faceted shape being rectangular-, hexagonal-, octagonal-, or otherwise polygonal-cylindrical; and the central reflector [7122] may have a multi-faceted perimeter being rectangular-, hexagonal-, octagonal-, or otherwise polygonal-shaped; and the rim [7106] of the bowl reflector [7102] may have a multi-faceted perimeter being rectangular, hexagonal, octagonal, or otherwise polygonal. In some examples [7100] of the lighting system, the optically-transparent body [7128] may have a spectrum of transmission values of visible-light emissions [7120] having an average value being at least about ninety percent (90%). In further examples [7100] of the lighting system, the optically-transparent body [7128] may have a spectrum of absorption values of visible-light emissions [7120] having an average value being no greater than about ten percent (10%). In some examples [7100] of the lighting system, the optically-transparent body [7128] may have a refractive index of at least about 1.41.

In some examples [7100], the lighting system may include another surface [7184] defining another portion of the cavity [7112], and the visible-light source [7116] may be located on the another surface [7184] of the example [7100] of the lighting system. In further examples [7100] of the lighting system, the visible-light source [7116] may be aligned along the central axis [7104]. In some examples [7100] of the lighting system, the visible-light source [7116] may include a plurality of semiconductor light-emitting devices [7118], [7119] being configured for respectively generating visible-light emissions [7120], [7121] from the semiconductor light-emitting devices [7118], [7119]. In some of those examples [7100] of the lighting system, the visible-light source [7116] may include the plurality of the semiconductor light-emitting devices [7118], [7119] as being arranged in an array. In other examples [7100] of the lighting system, the plurality of the semiconductor light-emitting devices [7118], [7119] may be collectively configured for generating the visible-light emissions [7120] as having a selectable perceived color. In some examples [7100], the lighting system may include a controller (not shown) for the visible-light source [7116], the controller being configured for causing the visible-light emissions [7120] to be generated, and in examples, as having a selectable perceived color.

In some examples [7100], the lighting system may include a lens [7186] as shown in FIG. 73 defining a further portion of the cavity [7112], the lens [7186] being shaped for covering the emission aperture [7108] of the bowl reflector [7102]. In some of those examples [7100] of the lighting system, the lens [7186] may be a bi-planar lens [7186] having non-refractive anterior and posterior surfaces. Further in some of those examples [7100] of the lighting system, the lens [7186] may have a central orifice [7188] being configured for attachment of accessory lenses to the example [7100] of the lighting system. In other examples [7100], the lighting system may include a removable plug [7190] being configured for closing the central orifice [7188].

In some examples [7100] of the lighting system, the optically-transparent body [7128] and the visible-light source [7116] may be configured for causing some of the visible-light emissions [7120] from the semiconductor light-emitting device [7118] to enter into the optically-transparent body [7128] through the first base [7130] and to then be refracted within the optically-transparent body [7128] toward an alignment along the central axis [7104]. Further in those examples [7100] of the lighting system, the optically-transparent body [7128] and the gap [7148] may be configured for causing some of the visible-light emissions [7120] that may be so refracted within the optically-transparent body [7128] to then be refracted by total internal reflection at the second base [7132] away from the alignment along the central axis [7104]. Additionally in some of those examples [7100] of the lighting system, the central reflector [7122] may be configured for causing some of the visible-light emissions [7120] that may be so refracted toward an alignment along the central axis [7104] within the optically-transparent body [7128] to then be reflected by the convex flared funnel-shaped second visible-light-reflective surface [7124] of the central reflector [7122] after passing through the gap [7148]. In other examples [7100], the lighting system may be configured for causing some of the visible-light emissions [7120] to be refracted within the optically-transparent body [7128] toward an alignment along the central axis [7104] and to then be refracted by the gap [7148] or reflected by the central reflector [7122], and to then be reflected by the bowl reflector [7102]. In some examples [7100] of the lighting system, such refractions and reflections may reduce an angular correlated color temperature deviation of the visible-light emissions [7120]. In some examples [7100] of the lighting system, such refractions and reflections may cause the visible-light emissions to have: a more uniform appearance or a more uniform correlated color temperature; an aesthetically-pleasing appearance without perceived glare; a uniform or stable color point or correlated color temperature; a uniform brightness; a uniform appearance; and/or a long-lasting stable brightness. In other examples [7100] of the lighting system, the visible-light source [7116] may include a phosphor-converted semiconductor light-emitting device [7118] that may emit light with an angular correlated color temperature deviation. In some examples [7100], the lighting system may be configured for causing some of the visible-light emissions [7120] to be refracted within the optically-transparent body [7128] and to be reflected by the central reflector [7122] and by the bowl reflector [7102], thereby reducing an angular correlated color temperature deviation of the visible-light emissions [7120].

The examples [100], [300], [500], [700], [900], [1200], [1500], [1800], [2000], [2200], [5000], [6300], [7100] may provide lighting systems having lower profile structures with reduced glare and offering greater control over propagation directions of visible-light emissions. Accordingly, the examples [100], [300], [500], [700], [900], [1200], [1500], [1800], [2000], [2200], [5000], [6300], [7100] may generally be utilized in end-use applications where light is needed having a partially-collimated distribution, and where a low-profile lighting system structure is needed, and where light is needed as being emitted in partially-controlled directions that may, for example, have a controllable or selectable beam angle or field angle, for reduced glare. The light emissions from these lighting systems [100], [300], [500], [700], [900], [1200], [1500], [1800], [2000], [2200], [5000], [6300], [7100] may further, as examples, be utilized in generating specialty lighting effects being perceived as having a more uniform appearance or a more uniform correlated color temperature in general applications and in specialty applications such as wall wash, corner wash, and floodlight. The visible-light emissions from these lighting systems may, for the foregoing reasons, accordingly be perceived as having, as examples: an aesthetically-pleasing appearance without perceived glare; a uniform or stable color point or correlated color temperature; a uniform brightness; a uniform appearance; and/or a long-lasting stable brightness.

While the present invention has been disclosed in a presently defined context, it will be recognized that the present teachings may be adapted to a variety of contexts consistent with this disclosure and the claims that follow. For example, the lighting systems and processes shown in the figures and discussed above can be adapted in the spirit of the many optional parameters described.

What is claimed is:

1. A lighting system, comprising:

a bowl reflector having a central axis, the bowl reflector having a rim defining an emission aperture, the bowl reflector having a first visible-light-reflective surface defining a portion of a cavity in the bowl reflector, a portion of the first visible-light-reflective surface being a parabolic surface;

a visible-light source including a semiconductor light-emitting device, the visible-light source being located in the cavity, the visible-light source being configured for generating visible-light emissions from the semiconductor light-emitting device;

a central reflector having a second visible-light-reflective surface, the central reflector having a body of a heat-resistant or heat-conductive material for absorbing or dissipating thermal energy generated by the visible-light source at the second visible-light-reflective surface, the second visible-light-reflective surface having a convex flared funnel shape and having a first peak, the first peak facing toward the visible-light source; and an optically-transparent body having a first base being spaced apart from a second base and having a side wall extending between the first base and the second base, a surface of the second base having a concave flared funnel shape, the concave flared funnel-shaped surface of the second base facing toward the convex flared funnel-shaped second visible-light reflective surface of the central reflector.

2. The lighting system of claim 1, wherein the central reflector is aligned along the central axis, and wherein a cross-section of the convex flared funnel-shaped second visible-light-reflective surface of the central reflector, taken along the central axis, includes two concave curved sections meeting at the first peak.

3. The lighting system of claim 2, wherein the cross-section of the convex flared funnel-shaped second visible-light-reflective surface of the central reflector, taken along the central axis, includes the two concave curved sections as being parabolic-curved sections meeting at the first peak.

4. The lighting system of claim 2, wherein the cross-section of the convex flared funnel-shaped second visible-light-reflective surface of the central reflector, taken along the central axis, includes each one of the two concave curved sections as being a step-curved section, wherein each step-curved section includes two curved subsections meeting at an inflection point.

5. The lighting system of claim 1, wherein the convex flared funnel-shaped second visible-light reflective surface of the central reflector is in contact with the concave flared funnel-shaped surface of the second base.

6. The lighting system of claim 1, wherein the convex flared funnel-shaped second visible-light reflective surface of the central reflector is spaced apart by a gap away from the concave flared funnel-shaped surface of the second base of the optically-transparent body.

7. The lighting system of claim 1, wherein the second visible-light-reflective surface of the central reflector is a metallic layer on the central reflector.

8. The lighting system of claim 1, wherein the second visible-light-reflective surface of the central reflector is integrally formed together with the body of the heat-resistant or heat-conductive material.

9. The lighting system of claim 1, wherein the body of the central reflector extends for a distance along the central axis away from the optically-transparent body for carrying the thermal energy away from the second visible-light-reflective surface of the central reflector.

10. The lighting system of claim 9, wherein the body of the central reflector has a cavity aligned with the central axis and opening in a surface facing away from the second visible-light-reflective surface, forming an annular portion of the body.

11. A lighting system, comprising:

a bowl reflector having a central axis, the bowl reflector having a rim defining an emission aperture, the bowl reflector having a first visible-light-reflective surface defining a portion of a cavity in the bowl reflector, a portion of the first visible-light-reflective surface being a parabolic surface;

a visible-light source including a semiconductor light-emitting device, the visible-light source being located in the cavity, the visible-light source being configured for generating visible-light emissions from the semiconductor light-emitting device;

a central light absorber having a second visible-light-reflective surface, the central light absorber having a body of a heat-resistant or heat-conductive material for absorbing or dissipating thermal energy generated by the visible-light source at the second visible-light-reflective surface, the second visible-light-reflective surface having a convex flared funnel shape and having a first peak, the first peak facing toward the visible-light source; and an optically-transparent body having a first base being spaced apart from a second base and having a side wall extending between the first base and the second base, a surface of the second base having a concave flared funnel shape, the concave flared funnel-shaped surface of the second base facing toward the convex flared funnel-shaped second visible-light reflective surface of the central light absorber.

12. The lighting system of claim 11, wherein the central light absorber is aligned along the central axis, and wherein a cross-section of the convex flared funnel-shaped second visible-light-reflective surface of the central light absorber, taken along the central axis, includes two concave curved sections meeting at the first peak.

13. The lighting system of claim 12, wherein the cross-section of the convex flared funnel-shaped second visible-light-reflective surface of the central light absorber, taken along the central axis, includes the two concave curved sections as being parabolic-curved sections meeting at the first peak.

14. The lighting system of claim 12, wherein the cross-section of the convex flared funnel-shaped second visible-light-reflective surface of the central light absorber, taken along the central axis, includes each one of the two concave curved sections as being a step-curved section, wherein each step-curved section includes two curved subsections meeting at an inflection point.

15. The lighting system of claim 11, wherein the convex flared funnel-shaped second visible-light reflective surface of the central light absorber is in contact with the concave flared funnel-shaped surface of the second base.

16. The lighting system of claim 11, wherein the convex flared funnel-shaped second visible-light reflective surface of the central light absorber is spaced apart by a gap away from the concave flared funnel-shaped surface of the second base of the optically-transparent body.

17. The lighting system of claim 11, wherein the second visible-light-reflective surface of the central light absorber is a metallic layer on the central light absorber.

18. The lighting system of claim 11, wherein the second visible-light-reflective surface of the central light absorber is integrally formed together with the body of the heat-resistant or heat-conductive material.

19. The lighting system of claim 11, wherein the body of the central light absorber extends for a distance along the central axis away from the optically-transparent body for carrying the thermal energy away from the second visible-light-reflective surface of the central light absorber.

20. The lighting system of claim 9, wherein the body of the central light absorber has a cavity aligned with the central axis and opening in a surface facing away from the second visible-light-reflective surface, forming an annular portion of the body.

* * * * *